US008132509B2

(12) United States Patent
Sugiyama et al.

(10) Patent No.: US 8,132,509 B2
(45) Date of Patent: Mar. 13, 2012

(54) COLOR MISREGISTER AMOUNT DETECTION METHOD AND APPARATUS FOR PRINTED REPORT

(75) Inventors: Masataka Sugiyama, Ibaraki (JP); Akihiro Inde, Ibaraki (JP); Junichi Tanaka, Ibaraki (JP); Yoshihiko Butsusaka, Chiba (JP); Yusuke Tsumura, Chiba (JP)

(73) Assignee: Komori Corporation, Tokyo (JP)

( * ) Notice: Subject to any disclaimer, the term of this patent is extended or adjusted under 35 U.S.C. 154(b) by 1007 days.

(21) Appl. No.: 12/082,394

(22) Filed: Apr. 10, 2008

(65) Prior Publication Data

US 2008/0250961 A1 Oct. 16, 2008

(30) Foreign Application Priority Data

Apr. 11, 2007 (JP) ..... 2007-104110

(51) Int. Cl.
*B41F 1/34* (2006.01)
*B41F 33/00* (2006.01)
*B41F 33/06* (2006.01)

(52) U.S. Cl. ..... 101/483; 101/481; 101/484; 101/485

(58) Field of Classification Search ..... 101/211, 101/481, 483, 485, 486, 484
See application file for complete search history.

(56) References Cited

U.S. PATENT DOCUMENTS

| | | | | |
|---|---|---|---|---|
| 5,018,213 | A | 5/1991 | Sikes | |
| 5,278,587 | A * | 1/1994 | Strauch et al. | 347/118 |
| 5,287,162 | A * | 2/1994 | de Jong et al. | 399/49 |
| 5,394,223 | A * | 2/1995 | Hart et al. | 399/165 |
| 5,909,235 | A | 6/1999 | Folkins | |
| 6,022,154 | A | 2/2000 | Allen | |
| 2005/0191072 | A1 | 9/2005 | Okano | |

FOREIGN PATENT DOCUMENTS

| | | | |
|---|---|---|---|
| EP | 0 094 027 | A1 | 11/1983 |
| EP | 1 199 168 | A1 | 4/2002 |
| JP | 62-039241 | A | 2/1987 |
| JP | 62-099149 | A | 5/1987 |
| JP | 62-231755 | A | 10/1987 |
| JP | 62-234934 | A | 10/1987 |
| JP | 03-015553 | A | 1/1991 |
| JP | 03-015554 | A | 1/1991 |

* cited by examiner

*Primary Examiner* — Leslie J Evanisko
*Assistant Examiner* — Marissa Ferguson Samreth
(74) *Attorney, Agent, or Firm* — Blakely, Sokoloff, Taylor & Zafman

(57) ABSTRACT

In a printed product color misregister amount detection method, a reference register mark including a first color area portion with a predetermined width and a blank portion in contact with the first color area portion is printed in a reference color on a printed product to be printed by a multi-color printing press. A positional shift detection register mark including a second color area portion with a width smaller than that of the first color area portion of the reference register mark is printed in a color other than the reference color to have as a target position a position where the width of the second color area portion falls within the width of the first color area portion of the reference register mark. Density information representing a density of a color component which is of the same color as that of the positional shift detection register mark within a target range including the first color area portion and the blank portion in contact with the first color area portion of the reference register mark where the positional shift detection register mark has been printed is measured. A positional shift amount between the reference color and the color other than the reference color as a color misregister amount is obtained on the basis of the measured density information.

24 Claims, 141 Drawing Sheets

COLOR MISREGISTER AMOUNT DETECTION METHOD AND APPARATUS FOR PRINTED REPORT

BACKGROUND OF THE INVENTION

The present invention relates to a printed product color misregister amount detection method and apparatus for obtaining a color positional shift amount of a printed product printed by a multi-color printing press as a color misregister amount.

Conventionally, as a method of correcting a color positional shift of a printed product printed by a multi-color printing press, the following color registration methods (1) to (5) are available.

(1) A triangular register mark having an oblique side forming an angle of 45° with respect to a side perpendicular to the sheet convey direction is provided for each color. The misregister amount in the circumferential direction (sheet convey direction) is obtained from the distances among the perpendicular sides of the register marks of the respective colors. The misregister amount in the lateral direction (the direction perpendicular to the circumferential direction) is obtained from the distances among the oblique sides each forming an angle of 45° with respect to the perpendicular side of the corresponding color. The color positional shift amount among the respective colors is then corrected. This method is described in, e.g., Japanese Patent Laid-Open Nos. 62-39241, 62-231755, and 62-234934.

(2) A square register mark having a side parallel to a side perpendicular to the sheet convey direction is provided for each color. The misregister amount in the circumferential direction is obtained from the distances among the perpendicular sides of the register marks of the respective colors, and the misregister amount in the lateral direction is obtained from the distances among the parallel sides. The color positional shift amount among the respective colors is then corrected. This method is described in, e.g., Japanese Patent Laid-Open No. 3-15554.

(3) A circular dot-like register mark is provided for each color. The register marks of the respective colors are captured by a camera at once. The misregister amounts in the circumferential direction and lateral direction are obtained from the distances among the center positions of the register marks of the respective colors. The color positional shift amount among the respective colors is then corrected. This method is described in, e.g., U.S. Pat. No. 5,018,213.

(4) A crisscross register mark is provided for each color employed for the purpose of visual check adjustment. The register marks of the respective colors are captured by a camera at once. The misregister amounts in the circumferential direction and lateral direction are obtained from the distances among the center positions of the register marks of the respective colors. The color positional shift amount among the respective colors is then corrected. This method is described in, e.g., Japanese Patent Laid-Open No. 62-99149.

(5) A plurality of band-like reference-color register marks are printed at constant intervals in the circumferential direction and lateral direction. Band-like register marks of colors other than the reference color are printed to overlap the second and subsequent reference-color register marks of the respective directions. The register marks of the respective colors are captured by a camera at once and binarized. The misregister amount in the circumferential direction is obtained from the lengths of the respective binarized register marks in the circumferential direction and from the distance from the first register mark. The misregister amount in the lateral direction is obtained from the lengths of the respective binarized register marks in the lateral direction and from the distance from the first register mark. The color positional shift amount among the respective colors is then corrected. This method is described in, e.g., Japanese Patent Laid-Open No. 3-15553.

With the conventional color registration apparatus described above, the misregister amount is obtained from: the distances among the perpendicular sides of the register marks of the respective colors and the distances among the oblique sides each forming an angle of 45° with respect to the corresponding perpendicular side according to the method (1); the distances among the respective sides of the register marks of the respective colors according to the method (2); the distances among the center positions of the register marks of the respective colors according to the method (3); the distances among the center positions of the register marks of the respective colors according to the method (4); and the lengths of the respective register marks and the distance from the first register mark according to the method (5). Thus, a detection resolution equal to or more than the allowable misregister (e.g., 0.01 mm) is required. When capturing the images of the register marks by the camera at once, a high-accuracy, high-resolution camera must be used, leading to an expensive apparatus.

In the method (1), the misregister amount is obtained from the distances among the perpendicular sides of the register marks of the respective colors and the distances among the oblique sides each forming an angle of 45° with respect to the corresponding perpendicular side. In the method (2), the misregister amount is obtained from the distances among the respective sides of the register marks of the respective colors. During printing, as the printed portion tends to become thicker than intended, accurate detection cannot be performed. Also, if the misregister amount is to be obtained during conveyance of the printed product, as in the method (1), high-accuracy conveyance is required. An apparatus that satisfies this requirement becomes expensive.

SUMMARY OF THE INVENTION

The present invention has been made to solve the above problems, and has as its object to provide a printed product color misregister amount detection method and apparatus capable of accurately obtaining the color misregister amount of a printed product without using a high-accuracy, high-resolution camera.

It is another object of the present invention to provide a printed product color misregister amount detection method and apparatus which do not require high-accuracy conveyance when obtaining a misregister amount during conveyance of a printed product.

According to an aspect of the present invention, there is provided a printed product color misregister amount detection method comprising the steps of printing, in a reference color on a printed product to be printed by a multi-color printing press, a reference register mark including a first color area portion with a predetermined width and a blank portion in contact with the first color area portion, printing, in a color other than the reference color, a positional shift detection register mark including a second color area portion with a width smaller than that of the first color area portion of the reference register mark to have as a target position a position where the width of the second color area portion falls within the width of the first color area portion of the reference register mark, measuring density information representing a density of a color component which is of the same color as that of the positional shift detection register mark within a target range including the first color area portion and the blank portion in contact with the first color area portion of the reference register mark where the positional shift detection register mark has been printed, and obtaining a positional shift amount between the reference color and the color other than the reference color as a color misregister amount on the basis of the measured density information.

According to another aspect of the present invention, there is provided a printed product color misregister amount detection apparatus comprising density information measuring means for measuring density information representing a density of a color component which is of the same color as that of the positional shift detection register mark within a target range of a printed product where a reference register mark and a positional shift detection register mark have been printed by a multi-color printing press, the reference register mark including a first color area portion with a predetermined width and a blank portion in contact with the first color area portion of the reference register mark and being printed in a reference color, the positional shift detection register mark including a second color area portion with a width smaller than that of the first color area portion and being printed in a color other than the reference color to have as a target position a position where the width of the second color area portion falls within the width of the first color area portion, and the target range including the first color area portion and the blank portion in contact with the first color area portion of the reference register mark, and color misregister amount detection means for obtaining a positional shift amount between the reference color and the color other than the reference color as a color misregister amount on the basis of the measured density information.

BRIEF DESCRIPTION OF THE DRAWINGS

FIGS. 3A to 3F are views to explain detection of an upward positional shift using a reference register mark and positional shift detection register mark, in which FIGS. 3A and 3B show the state of an upward reference register mark and upward positional shift detection register mark and the state of a downward reference register mark and downward positional shift detection register mark, respectively, with no upward positional shift, FIGS. 3C and 3D show the state of an upward reference register mark and upward positional shift detection register mark and the state of a downward reference register mark and downward positional shift detection register mark, respectively, with an upward positional shift of 0.05 mm, and FIGS. 3E and 3F show the state of an upward reference register mark and upward positional shift detection register mark and the state of a downward reference register mark and downward positional shift detection register mark, respectively, with an upward positional shift of 0.1 mm;

FIGS. 4A to 4F are views to explain detection of a downward positional shift using a reference register mark and positional shift detection register mark, in which FIGS. 4A and 4B show the state of an upward reference register mark and upward positional shift detection register mark and the state of a downward reference register mark and downward positional shift detection register mark, respectively, with no downward positional shift, FIGS. 4C and 4D show the state of an upward reference register mark and upward positional shift detection register mark and the state of a downward reference register mark and downward positional shift detection register mark, respectively, with a downward positional shift of 0.05 mm, and FIGS. 4E and 4F show the state of an upward reference register mark and upward positional shift detection register mark and the state of a downward reference register mark and downward positional shift detection register mark, respectively, with a downward positional shift of 0.1 mm;

FIGS. 5A to 5F are views to explain detection of a leftward positional shift using a reference register mark and positional shift detection register mark, in which FIGS. 5A and 5B show the state of a leftward reference register mark and leftward positional shift detection register mark and the state of a rightward reference register mark and rightward positional shift detection register mark, respectively, with no leftward positional shift, FIGS. 5C and 5D show the state of a leftward reference register mark and left positional shift detection register mark and the state of a rightward reference register mark and rightward positional shift detection register mark, respectively, with a leftward positional shift of 0.05 mm, and FIGS. 5E and 5F show the state of a leftward reference register mark and leftward positional shift detection register mark and the state of a rightward reference register mark and rightward positional shift detection register mark, respectively, with a leftward positional shift of 0.1 mm;

FIGS. 6A to 6F are views to explain detection of a rightward positional shift using a reference register mark and positional shift detection register mark, in which FIGS. 6A and 6B show the state of a leftward reference register mark and leftward positional shift detection register mark and the state of a rightward reference register mark and rightward positional shift detection register mark, respectively, with no rightward positional shift, FIGS. 6C and 6D show the state of a leftward reference register mark and left positional shift detection register mark and the state of a rightward reference register mark and rightward positional shift detection register mark, respectively, with a rightward positional shift of 0.05 mm, and FIGS. 6E and 6F show the state of a leftward reference register mark and leftward positional shift detection register mark and the state of a rightward reference register mark and rightward positional shift detection register mark, respectively, with a rightward positional shift of 0.1 mm;

DESCRIPTION OF THE PREFERRED EMBODIMENTS

The embodiments of the present invention will be described in detail with reference to the accompanying drawings. Prior to an explanation on the embodiments of the present invention, the detection principle of a color misregister amount of a printed product utilized in the embodiments will be explained.

[Detection Principle]

In the following embodiments, a printed product is printed in four colors, i.e., black, cyan, magenta, and yellow by a multi-color printing press. In the detection principle to be described hereinafter, a case will be typically explained in which the reference color is black, a color other than the reference color is cyan, and a color positional shift amount between black and cyan is to be obtained as a color misregister amount.

[Printing of Reference Register Mark]

First, note that the flowing direction of the printed product in the multi-color printing press is a circumferential direction, and that a direction perpendicular to the circumferential direction is a lateral direction. A mark including a color area portion (the first color area portion) with a predetermined width and a blank adjacent to the color area portion is printed in black (the reference color) on the printed product as a reference register mark.

The reference register mark includes an upward reference register mark used to detect an upward color positional shift amount, a downward reference register mark used to detect a downward color positional shift amount, a leftward reference register mark used to detect a leftward color positional shift amount, and a rightward reference register mark used to detect a rightward color positional shift amount. The four reference register marks are printed as one set at a predetermined position on the printed product.

Figure 1:
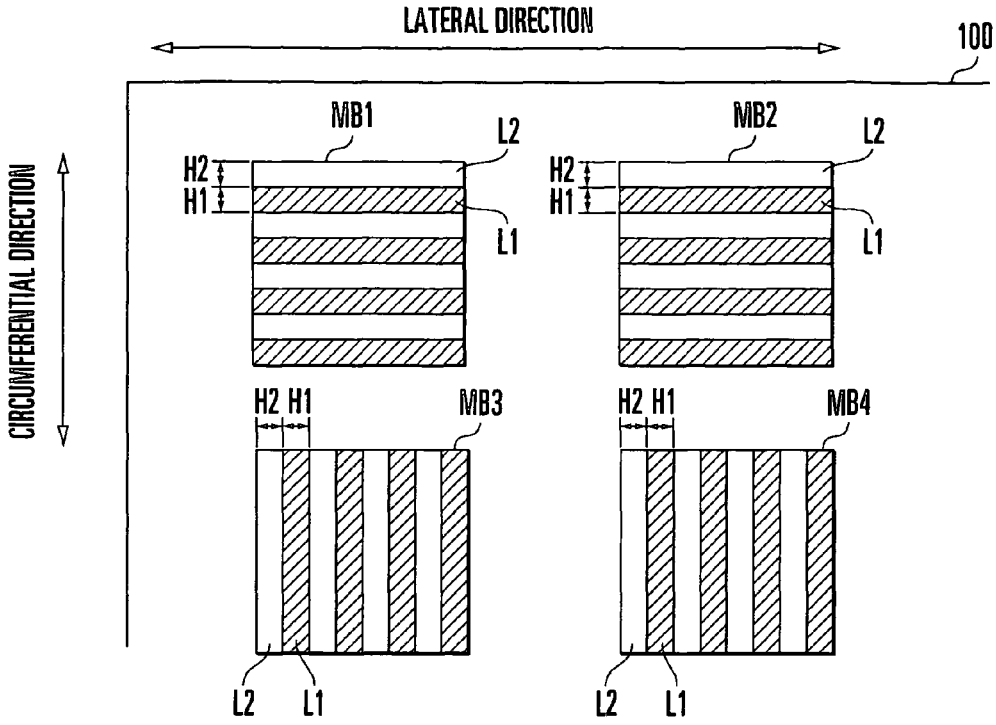
FIG. 1 is a view showing examples of reference register marks employed in an embodiment of the present invention.

FIG. 1 shows examples of the reference register marks, that is, an upward reference register mark MB1, a downward reference register mark MB2, a leftward reference register mark MB3, and a rightward reference register mark MB4.

In each of the upward reference register mark MB1 and downward reference register mark MB2, a black line ((color area portion (with an area ratio of 100%)) L1 extending in the lateral direction of a printed product 100 and having a width H1 and a blank L2 adjacent to the line L1 on the upward side and having a width H2 form one combination. Four combinations each consisting of the line L1 and blank L2 are arranged in the circumferential direction.

In each of the leftward reference register mark MB3 and rightward reference register mark MB4, the black line ((color area portion (with an area ratio of 100%)) L1 having the width H1 and extending in the circumferential direction of the printed product 100, and the blank L2 having the width H2 and adjacent to the left side of the line L1 form one combination. Four combinations each consisting of the line L1 and blank L2 are arranged in the lateral direction.

In this example, the width H1 of the line L1 and the width H2 of the blank L2 of each of the upward reference register mark MB1, downward reference register mark MB2, leftward reference register mark MB3, and rightward reference register mark MB4 are 0.2 mm each. In practice, a larger number of combinations each consisting of the line L1 and blank L2 are provided.

[Printing of Positional Shift Detection Register Mark]

A positional shift detection register mark including a color area portion (the second color area portion) narrower than that of the reference register mark is printed in cyan (the color other than the reference color) to overlap the reference register mark to have as a target position the position where the width of the color area portion of the positional shift detection register mark falls within the width of the color area portion of the reference register mark.

The positional shift detection register mark includes an upward positional shift detection register mark used to detect an upward color positional shift amount, a downward positional shift detection register mark used to detect a downward color positional shift amount, a leftward positional shift detection register mark used to detect a leftward color positional shift amount, and a rightward positional shift detection register mark used to detect a rightward color positional shift amount. The four positional shift detection register marks are printed as one set.

Figure 2:
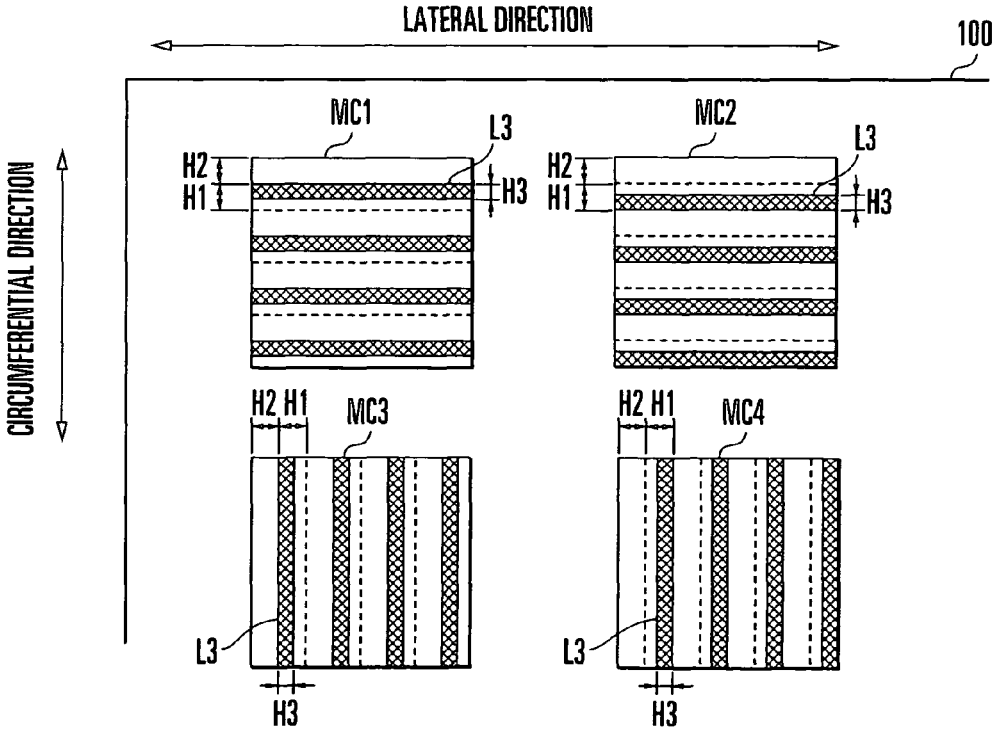
FIG. 2 is a view showing examples of positional shift detection register marks employed in the embodiment of the present invention.

FIG. 2 shows examples of the positional shift detection register marks, that is, an upward positional shift detection register mark MC1, a downward positional shift detection register mark MC2, a leftward positional shift detection register mark MC3, and a rightward positional shift detection register mark MC4.

In each of the upward positional shift detection register mark MC1 and downward positional shift detection register mark MC2, four cyan lines ((color area portions (each with an area ratio of 100%)) L3 each having a width H3 and extending in the lateral direction of the printed product 100 are arranged in the circumferential direction at predetermined intervals. In this example, the width H3 of the line L3 of each of the upward positional shift detection register mark MC1 and downward positional shift detection register mark MC2 is ½ the width H1 of the line L1 of each of the upward reference register mark MB1 and downward reference register mark MB2 (H3=0.1 mm).

The upward positional shift detection register mark MC1 is printed to overlap the upward reference register mark MB1 to have as a target position the position where the upward edge of the line L3 of the detection register mark MC1 overlaps the upward edge of the line L1 of the upward reference register mark MB1. The downward positional shift detection register mark MC2 is printed to overlap the downward reference register mark MB2 to have as a target position the position where the downward edge of the line L3 of the detection register mark MC2 overlaps the downward edge of the line L1 of the downward reference register mark MB2.

The line L1 of each of the upward reference register mark MB1 and downward reference register mark MB2 has the same length as that of the line L3 of each of the upward positional shift detection register mark MC1 and downward positional shift detection register mark MC2. Hence, at the target position, the upward edge of the line L3 of the upward positional shift detection register mark MC1 entirely overlaps the upward edge of the line L1 of the upward reference register mark MB1, and the downward edge of the line L3 of the downward positional shift detection register mark MC2 entirely overlaps the downward edge of the line L1 of the downward reference register mark MB2.

In each of the leftward positional shift detection register mark MC3 and rightward positional shift detection register mark MC4, the four cyan lines ((color area portions (each with an area ratio of 100%)) L3 each having the width H3 and extending in the lateral direction of the printed product 100 are arranged in the lateral direction at predetermined intervals. In this example, the width H3 of the line L3 of each of the leftward positional shift detection register mark MC3 and rightward positional shift detection register mark MC4 is ½ the width H1 of the line L1 of each of the leftward reference register mark MB3 and rightward reference register mark MB4 (H3=0.1 mm).

The leftward positional shift detection register mark MC3 is printed to overlap the leftward reference register mark MB3 to have as a target position the position where the leftward edge of the line L3 of the detection register mark MC3 overlaps the leftward edge of the line L1 of the leftward reference register mark MB3. The rightward positional shift detection register mark MC4 is printed to overlap the rightward reference register mark MB4 to have as a target position the position where the rightward edge of the line L3 of the detection register mark MC4 overlaps the rightward edge of the line L1 of the rightward reference register mark MB4.

The line L1 of each of the leftward reference register mark MB3 and rightward reference register mark MB4 has the same length as that of the line L3 of each of the leftward positional shift detection register mark MC3 and rightward positional shift detection register mark MC4. Hence, at the target position, the leftward edge of the line L3 of the leftward positional shift detection register mark MC3 entirely overlaps the leftward edge of the line L1 of the leftward reference register mark MB3, and the rightward edge of the line L3 of the rightward positional shift detection register mark MC4 entirely overlaps the rightward edge of the line L1 of the rightward reference register mark MB4.

[Detection of Positional Shift in Circumferential Direction]

[No Positional Shift in Circumferential Direction]

Figure 3A:
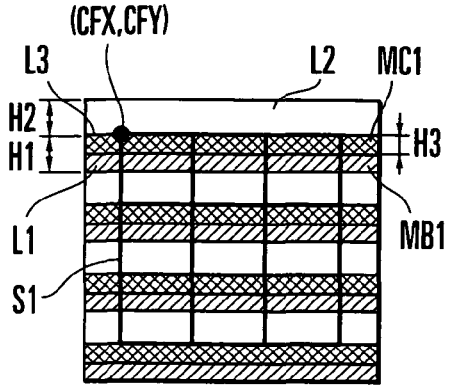
Figure 3B:
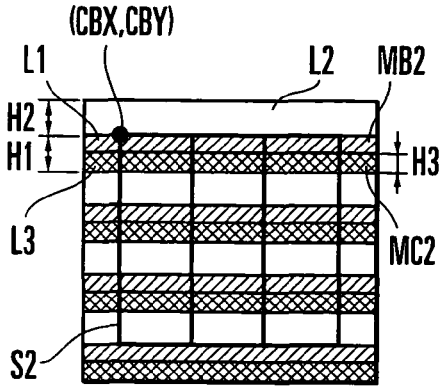

When there is no positional shift in the circumferential direction, as shown in FIG. 3A, the upward positional shift detection register mark MC1 is printed to overlap the upward reference register mark MB1 such that the upward edge of its line L3 overlaps the upward edge of the line L1 of the upward reference register mark MB1, that is, such that the line L3 covers the upper portion of the line L1. As shown in FIG. 3B, the downward positional shift detection register mark MC2 is printed to overlap the downward reference register mark MB2 such that the downward edge of its line L3 overlaps the downward edge of the line L1 of the downward reference register mark MB2, that is, such that the line L3 covers the lower portion of the line L1.

The upward reference register mark MB1 on which the upward positional shift detection register mark MC1 is printed to overlap is captured by a CCD color camera such that the target range covers a predetermined range S1 including the line L1 and blank L2 of the upward reference register mark MB1. Similarly, the downward reference register mark MB2 on which the downward positional shift detection register mark MC2 is printed to overlap is captured by the CCD color camera such that the target range covers a predetermined range S2 including the line L1 and blank L2 of the downward reference register mark MB2.

In this example, as shown in FIGS. 3A and 3B, a square region including three combinations each consisting of the line L1 and blank L2 is defined as each of the ranges S1 and S2, and each of the ranges S1 and S2 is captured by the nine pixels of the CCD color camera. In practice, the pixel size of the CCD color camera is about 1 mm×1 mm. In this example, the pixel size is 0.4 mm×0.4 mm for descriptive convenience.

Three, R, G, and B image signals are obtained by the CCD color camera. More specifically, an image signal of red (R image signal) as the complementary color of cyan, an image signal of green (G image signal) as the complementary color of magenta, and an image signal of blue (B image signal) as the complementary color of yellow are obtained. In this example, as the color of the positional shift detection register mark is cyan and a color misregister amount between black and cyan is to be obtained, an image in red as the complementary color of cyan is determined as the target, and the sum of the pixel values of the red image within the target ranges S1 and S2 is measured as density information representing the density of the cyan component.

In this case, the area ratio of the cyan component of the upward reference register mark MB1, on which the upward positional shift detection register mark MC1 is printed, within the target range S1 is 50%. A sum GF of the pixel values of a red image within the target range S1 obtained by the CCD color camera satisfies GF=50 where the maximal value is 100. Similarly, the area ratio of the cyan component of the downward reference register mark MB2, on which the downward positional shift detection register mark MC2 is printed, within the target range S2 is also 50%. A sum GB of the pixel values of the red image within the target range S2 obtained by the CCD color camera satisfies GB=50 where the maximal value is 100.

[Upward Shift of 0.05 mm]

Figure 3C:
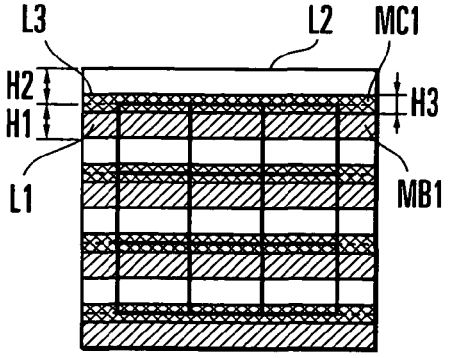

When cyan shifts upward by 0.05 mm, as shown in FIG. 3C, the line L3 of the upward positional shift detection register mark MC1 extends from the line L1 of the upward reference register mark MB1 by 0.05 mm. More specifically, the line L3 of the upward positional shift detection register mark MC1 moves upward, and the width H3 of the line L3 extends from the upward edge of the line L1 of the upward reference register mark MB1 by 0.05 mm. Thus, the area ratio of the cyan component of the target range S1 becomes 62.5%, and the sum GF of the pixel values of the red image within the target range S1 satisfies GF=62.5.

Figure 3D:
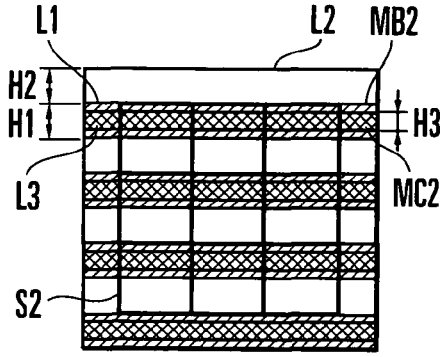

At this time, as shown in FIG. 3D, the line L3 of the downward positional shift detection register mark MC2 moves upward within the width H1 of the line L1 of the downward reference register mark MB2. As the width H3 of the line L3 falls within the width H1 in any direction, the area ratio of the cyan component of the target range S2 stays 50%. Accordingly, the sum GB of the pixel values of the red image within the target range S2 satisfies GB=50 and does not change.

[Upward Shift of 0.1 mm]

Figure 3E:
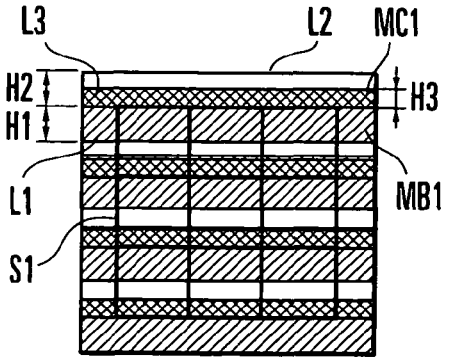

When cyan shifts upward by 0.1 mm, as shown in FIG. 3E, the line L3 of the upward positional shift detection register mark MC1 extends from the line L1 of the upward reference register mark MB1 by 0.1 mm. More specifically, the line L3 of the upward positional shift detection register mark MC1 moves upward, and the width H3 of the line L3 entirely extends from the upward edge of the line L1 of the upward reference register mark MB1. Thus, the area ratio of the cyan component of the target range S1 becomes 75%, and the sum GF of the pixel values of the red image within the target range S1 satisfies GF=75.

Figure 3F:
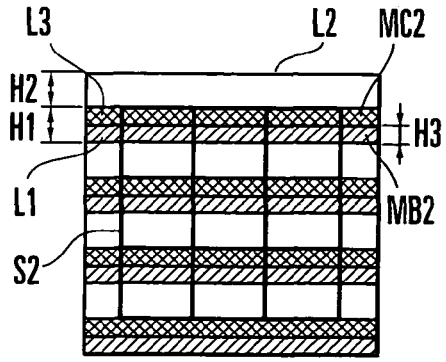

At this time, as shown in FIG. 3F, the line L3 of the downward positional shift detection register mark MC2 moves within the width H1 of the line L1 of the downward reference register mark MB2. As the width H3 of the line L3 falls within the width H1 in any direction, the area ratio of the cyan component of the target range S2 stays 50%. Accordingly, the sum GB of the pixel values of the red image within the target range S2 satisfies GB=50 and does not change.

When cyan shifts upward in this manner, the sum GF of the pixel values of the red image of the upward reference register mark MB1, on which the upward positional shift detection register mark MC1 is printed, within the target range S1 changes within the range of "50" to "75". Accordingly, the upward color misregister amount between black and cyan can be obtained from the change in the sum GF of the pixel values of the red image within the target range S1.

In the following embodiments, "50" obtained when no positional shift occurs is subtracted from the sum GF of the pixel values of the red image within the target range S1, and the upward color misregister amount between black and cyan is obtained from the change in the range of "0" to "25" that remains.

In the following embodiments, to obtain the value of GF when no positional shift occurs, assume that a black circumferential direction reference register mark MB12 (see FIG. 7) is printed on the printed product 100 independently of the upward reference register mark MB1 and downward reference register mark MB2, and that the value of the GF is obtained from the circumferential direction reference register mark MB12.

In this example, the apparatus which inspects the printing quality of the printed product by using the CCD color camera has a detection accuracy of 2%. If the detection accuracy of the area ratio of the cyan component within the target range S1 is 2%, the measurement accuracy of the upward color misregister amount is 0.1/(25/2)=0.008 mm. In this manner, an upward fine shift amount can be detected from the sum GF of the pixel values of the red image within the target range S1 regardless of the pixel size.

[Downward Shift of 0.05 mm]

Figure 4A:
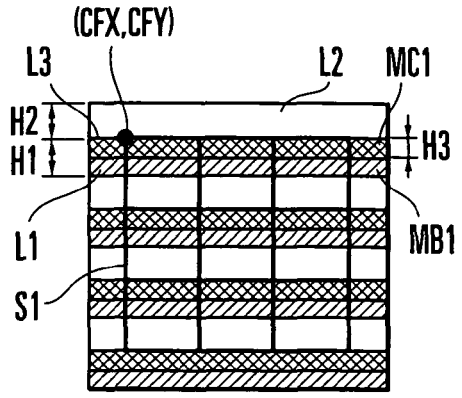
Figure 4B:
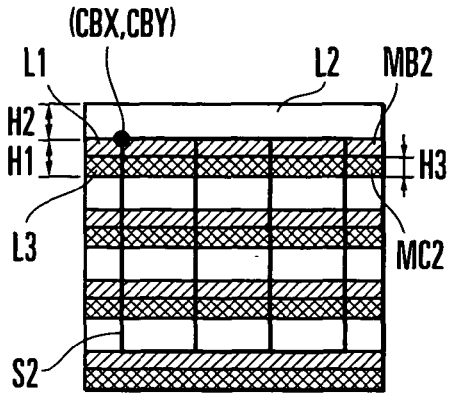
Figure 4C:
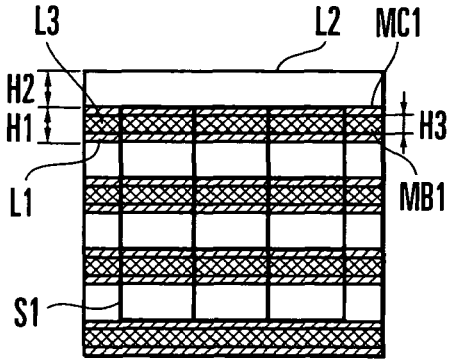
Figure 4D:
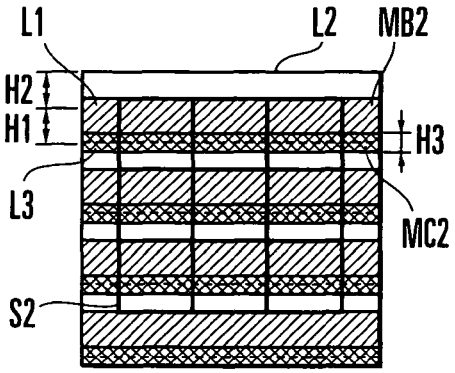

When cyan shifts downward by 0.05 mm, as shown in FIG. 4D, the line L3 of the downward positional shift detection register mark MC2 extends from the line L1 of the downward reference register mark MB2 by 0.05 mm. More specifically, the line L3 of the downward positional shift detection register mark MC2 moves downward, and the width H3 of the line L3 extends from the downward edge of the line L1 of the downward reference register mark MB2 by 0.05 mm. Thus, the area ratio of the cyan component of the target range S2 becomes 62.5%, and the sum GB of the pixel values of the red image within the target range S2 satisfies GB=62.5.

At this time, as shown in FIG. 4C, the line L3 of the upward positional shift detection register mark MC1 moves downward within the width H1 of the line L1 of the upward reference register mark MB1. As the width H3 of the line L3 falls within the width H1 in any direction, the area ratio of the cyan component of the target range S1 stays 50%. Accordingly, the sum GF of the pixel values of the red image within the target range S1 satisfies GF=50 and does not change.

[Downward Shift of 0.1 mm]

Figure 4E:
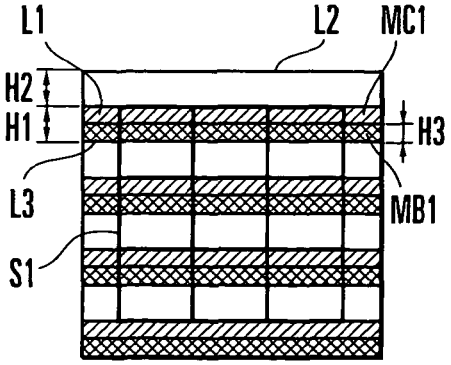
Figure 4F:
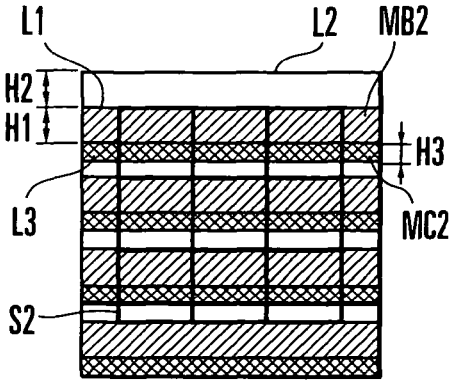

When cyan shifts downward by 0.1 mm, as shown in FIG. 4F, the line L3 of the downward positional shift detection register mark MC2 extends from the line L1 of the downward reference register mark MB2 by 0.1 mm. More specifically, the line L3 of the downward positional shift detection register mark MC2 moves downward, and the width H3 of the line L3 entirely extends from the downward edge of the line L1 of the downward reference register mark MB2. Thus, the area ratio of the cyan component of the target range S2 becomes 75%, and the sum GB of the pixel values of the red image within the target range S2 satisfies GB=75.

At this time, as shown in FIG. 4E, the line L3 of the upward positional shift detection register mark MC1 moves within the width H1 of the line L1 of the upward reference register mark MB1. As the width H3 of the line L3 falls within the width H1 in any direction, the area ratio of the cyan component of the target range S1 stays 50%. Accordingly, the sum GF of the pixel values of the red image within the target range S1 satisfies GF=50 and does not change.

When cyan shifts downward in this manner, the sum GB of the pixel values of the red image of the downward reference register mark MB2, on which the downward positional shift detection register mark MC2 is printed, within the target range S2 changes within the range of "50" to "75". Accordingly, the downward color misregister amount between black and cyan can be obtained from the change in the sum GB of the pixel values of the red image within the target range S2.

In the following embodiments, "50" obtained when no positional shift occurs is subtracted from the sum GB of the pixel values of the red image within the target range S2, and the downward color misregister amount between black and cyan is obtained from the change in the range of "0" to "25" that remains.

In the following embodiments, to obtain the value of GB when no positional shift occurs, assume that the black circumferential direction reference register mark MB12 (see FIG. 7) is printed on the printed product 100 independently of the upward reference register mark MB1 and downward reference register mark MB2, and that the value of the GB is obtained from the circumferential direction reference register mark MB12.

In this example, the apparatus which inspects the printing quality of the printed product by using the CCD color camera has a detection accuracy of 2%. If the detection accuracy of the area ratio of the cyan component within the target range S2 is 2%, the measurement accuracy of the downward color misregister amount is 0.1/(25/2)=0.008 mm. In this manner, a downward fine shift amount can be detected from the sum GB of the pixel values of the red image within the target range S2 regardless of the pixel size.

[Detection of Positional Shift in Lateral Direction]

[No Positional Shift in Lateral Direction]

Figure 5A:
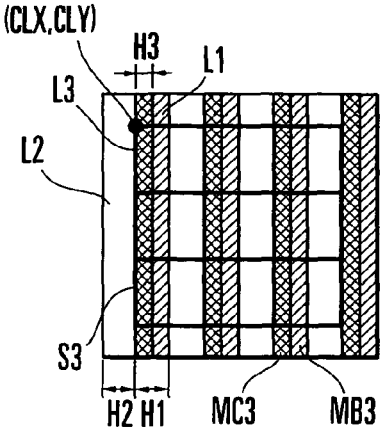
Figure 5B:
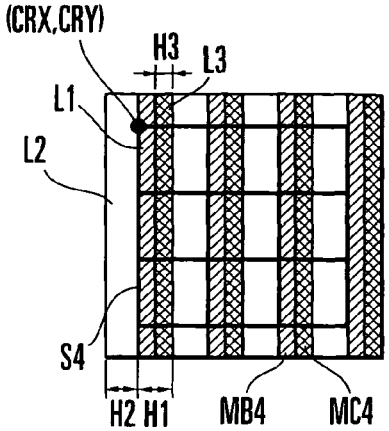

When there is no positional shift in the lateral direction, as shown in FIG. 5A, the leftward positional shift detection register mark MC3 is printed to overlap the leftward reference register mark MB3 such that the leftward edge of its line L3 overlaps the leftward edge of the line L1 of the leftward reference register mark MB3, that is, such that the line L3 contacts the left portion of the line L1. As shown in FIG. 5B, the rightward positional shift detection register mark MC4 is printed to overlap the rightward reference register mark MB4 such that the rightward edge of its line L3 overlaps the rightward edge of the line L1 of the rightward reference register mark MB4, that is, such that the line L3 contacts the right portion of the line L1.

The leftward reference register mark MB3 on which the leftward positional shift detection register mark MC3 is printed to overlap is captured by the CCD color camera such that the target range covers a predetermined range S3 including the line L1 and blank L2 of the leftward reference register mark MB3. Similarly, the rightward reference register mark MB4 on which the rightward positional shift detection register mark MC4 is printed to overlap is captured by the CCD color camera such that the target range covers a predetermined range S4 including the line L1 and blank L2 of the rightward reference register mark MB4.

In this example, as shown in FIGS. 5A and 5B, a square region including three combinations each consisting of the line L1 and blank L2 is defined as each of the ranges S3 and S4, and each of the ranges S3 and S4 is captured by the nine pixels of the CCD color camera. In practice, the pixel size of the CCD color camera is about 1 mm×1 mm. In this example, the pixel size is 0.4 mm×0.4 mm for descriptive convenience.

In this case, the area ratio of the cyan component of the leftward reference register mark MB3, on which the leftward positional shift detection register mark MC3 is printed, within the target range S3 is 50%. A sum GL of the pixel values of the red image within the target range S3 obtained by the CCD color camera satisfies GL=50 where the maximal value is 100. Similarly, the area ratio of the cyan component of the rightward reference register mark MB4, on which the rightward positional shift detection register mark MC4 is printed, within the target range S4 is also 50%. A sum GR of the pixel values of the red image within the target range S4 obtained by the CCD color camera satisfies GR=50 where the maximal value is 100.

[Leftward Shift of 0.05 mm]

Figure 5C:
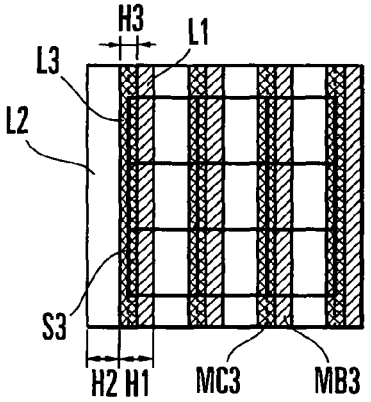

When cyan shifts leftward by 0.05 mm, as shown in FIG. 5C, the line L3 of the leftward positional shift detection register mark MC3 extends from the line L1 of the leftward reference register mark MB3 by 0.05 mm. More specifically, the line L3 of the leftward positional shift detection register mark MC3 moves leftward, and the width H3 of the line L3 extends from the leftward edge of the line L1 of the leftward reference register mark MB3 by 0.05 mm. Thus, the area ratio of the cyan component of the target range S3 becomes 62.5%, and the sum GL of the pixel values of the red image within the target range S3 satisfies GL=62.5.

Figure 5D:
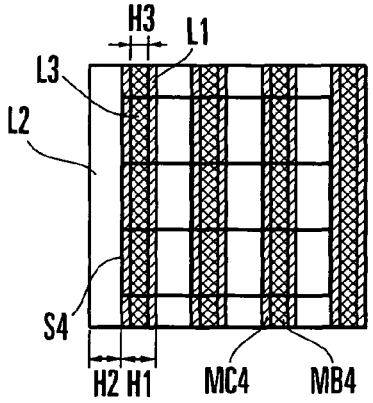

At this time, as shown in FIG. 5D, the line L3 of the rightward positional shift detection register mark MC4 moves leftward within the width H1 of the line L1 of the rightward reference register mark MB4. As the width H3 of the line L3 falls within the width H1 in any direction, the area ratio of the cyan component of the target range S4 stays 50%. Accordingly, the sum GR of the pixel values of the red image within the target range S4 satisfies GR=50 and does not change.

[Leftward Shift of 0.1 mm]

Figure 5E:
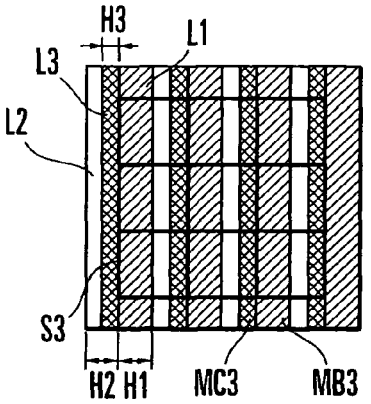

When cyan shifts leftward by 0.1 mm, as shown in FIG. 5E, the line L3 of the leftward positional shift detection register mark MC3 extends from the line L1 of the leftward reference register mark MB3 by 0.1 mm. More specifically, the line L3 of the leftward positional shift detection register mark MC3 moves leftward, and the width H3 of the line L3 entirely extends from the leftward edge of the line L1 of the leftward reference register mark MB3. Thus, the area ratio of the cyan component of the target range S3 becomes 75%, and the sum GL of the pixel values of the red image within the target range S3 satisfies GL=75.

Figure 5F:
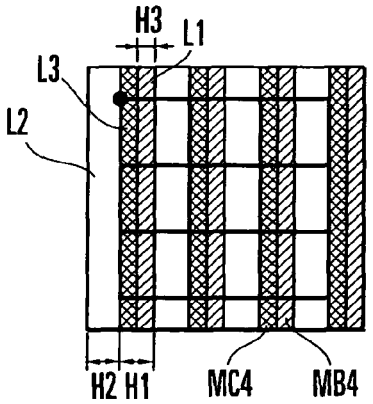

At this time, as shown in FIG. 5F, the line L3 of the rightward positional shift detection register mark MC4 moves within the width H1 of the line L1 of the rightward reference register mark MB4. As the width H3 of the line L3 falls within the width H1 in any direction, the area ratio of the cyan component of the target range S4 stays 50%. Accordingly, the sum GR of the pixel values of the red image within the target range S4 satisfies GR=50 and does not change.

When cyan shifts leftward in this manner, the sum GL of the pixel values of the red image of the leftward reference register mark MB3, on which the leftward positional shift detection register mark MC3 is printed, within the target range S3 changes within the range of "50" to "75". Accordingly, the leftward color misregister amount between black and cyan can be obtained from the change in the sum GL of the pixel values of the red image within the target range S3.

In the following embodiments, "50" obtained when no positional shift occurs is subtracted from the sum GL of the pixel values of the red image within the target range S3, and the leftward color misregister amount between black and cyan is obtained from the change in the range of "0" to "25" that remains.

In the following embodiments, to obtain the value of GL when no positional shift occurs, assume that a black lateral direction reference register mark MB34 (see FIG. 7) is printed on the printed product 100 independently of the leftward reference register mark MB3 and rightward reference register mark MB4, and that the value of the GL is obtained from the lateral direction reference register mark MB34.

In this example, the apparatus which inspects the printing quality of the printed product by using the CCD color camera has a detection accuracy of 2%. If the detection accuracy of the area ratio of the cyan component within the target range S3 is 2%, the measurement accuracy of the leftward color misregister amount is 0.1/(25/2)=0.008 mm. In this manner, a leftward fine shift amount can be detected from the sum GL of the pixel values of the red image within the target range S3 regardless of the pixel size.

[Rightward Shift of 0.05 mm]

Figure 6A:
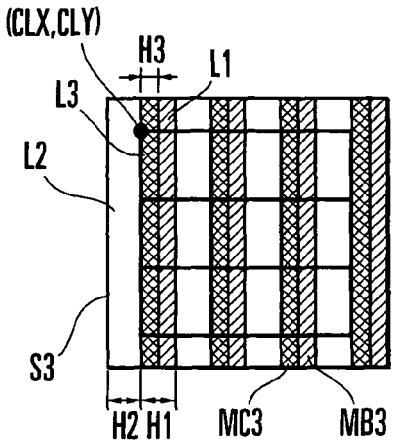
Figure 6B:
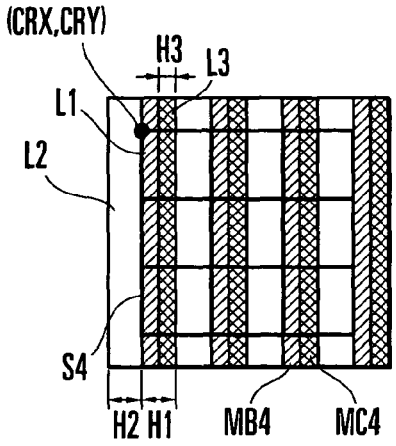
Figure 6C:
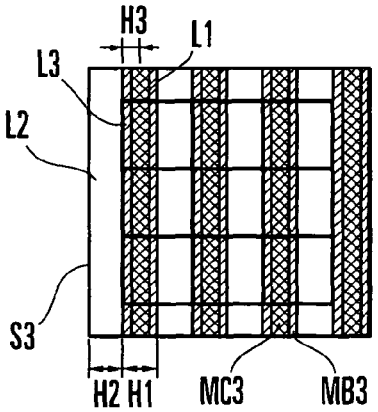
Figure 6D:
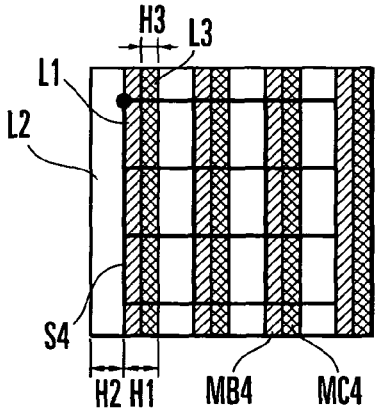

When cyan shifts rightward by 0.05 mm, as shown in FIG. 6D, the line L3 of the rightward positional shift detection register mark MC4 extends from the line L1 of the rightward reference register mark MB4 by 0.05 mm. More specifically, the line L3 of the rightward positional shift detection register mark MC4 moves rightward, and the width H3 of the line L3 extends from the rightward edge of the line L1 of the rightward reference register mark MB4 by 0.05 mm. Thus, the area ratio of the cyan component of the target range S4 becomes 62.5%, and the sum GR of the pixel values of the red image within the target range S4 satisfies GR=62.5.

At this time, as shown in FIG. 6C, the line L3 of the leftward positional shift detection register mark MC3 moves rightward within the width H1 of the line L1 of the leftward reference register mark MB3. As the width H3 of the line L3 falls within the width H1 in any direction, the area ratio of the cyan component of the target range S3 stays 50%. Accordingly, the sum GL of the pixel values of the red image within the target range S3 satisfies GL=50 and does not change.

[Rightward Shift of 0.1 mm]

Figure 6E:
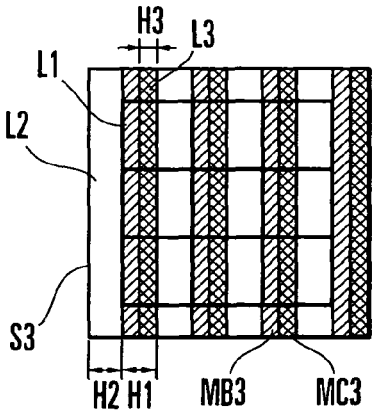
Figure 6F:
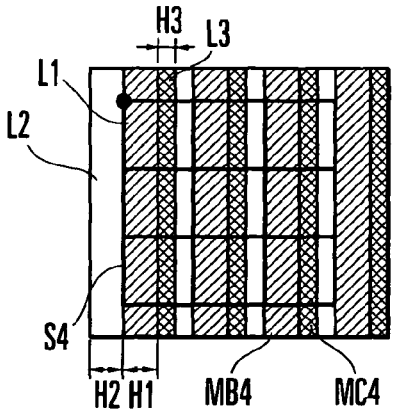

When cyan shifts rightward by 0.1 mm, as shown in FIG. 6F, the line L3 of the rightward positional shift detection register mark MC4 extends from the line L1 of the rightward reference register mark MB4 by 0.1 mm. More specifically, the line L3 of the rightward positional shift detection register mark MC4 moves rightward, and the width H3 of the line L3 entirely extends from the rightward edge of the line L1 of the rightward reference register mark MB4. Thus, the area ratio of the cyan component of the target range S4 becomes 75%, and the sum GR of the pixel values of the red image within the target range S4 satisfies GR=75.

At this time, as shown in FIG. 6E, the line L3 of the leftward positional shift detection register mark MC3 moves within the width H1 of the line L1 of the leftward reference register mark MB3. As the width H3 of the line L3 falls within the width H1 in any direction, the area ratio of the cyan component of the target range S3 stays 50%. Accordingly, the sum GL of the pixel values of the red image within the target range S3 satisfies GL=50 and does not change.

When cyan shifts rightward in this manner, the sum GR of the pixel values of the red image of the rightward reference register mark MB4, on which the rightward positional shift detection register mark MC4 is printed, within the target range S4 changes within the range of "50" to "75". Accordingly, the rightward color misregister amount between black and cyan can be obtained from the change in the sum GR of the pixel values of the red image within the target range S4.

In the following embodiments, "50" obtained when no positional shift occurs is subtracted from the sum GR of the pixel values of the red image within the target range S4, and the rightward color misregister amount between black and cyan is obtained from the change in the range of "0" to "25" that remains.

In the following embodiments, to obtain the value of GR when no positional shift occurs, assume that the black lateral direction reference register mark MB34 (see FIG. 7) is printed on the printed product 100 independently of the leftward reference register mark MB3 and rightward reference register mark MB4, and that the value of the GR is obtained from the lateral direction reference register mark MB34.

In this example, the apparatus which inspects the printing quality of the printed product by using the CCD color camera has a detection accuracy of 2%. If the detection accuracy of the area ratio of the cyan component within the target range S4 is 2%, the measurement accuracy of the rightward color misregister amount is 0.1/(25/2)=0.008 mm. In this manner, a rightward fine shift amount can be detected from the sum GR of the pixel values of the red image within the target range S4 regardless of the pixel size.

In the example described above, the line L1 of the upward reference register mark MB1 has the same length as that of the line L3 of the upward positional shift detection mark MC1. The line L3 of the upward positional shift detection register mark MC1 may be shorter or longer than the line L1 of the upward reference register mark MB1. The upward reference register mark MB1 and upward positional shift detection register mark MC1 may be printed to be shifted from each other in the lateral direction while their lines L1 and L3 have the same length. The color area portion of the width H3 of the upward positional shift detection register mark MC1 need not form a line (straight line) but may be changed to form, e.g., a circle. The relationships between the downward reference register mark MB2 and downward positional shift detection register mark MC2, between the leftward reference register mark MB3 and leftward positional shift detection register mark MC3, and between the rightward reference register mark MB4 and rightward positional shift detection register mark MC4 can vary in the same manner as the relationship between the upward reference register mark MB1 and upward positional shift register mark MC1.

In the above example, the upward positional shift detection register mark MC1 is printed to have as the target position the upward edge of the line L1 of the upward reference register mark MB1, such that the upward edge of the line L3 of the upward positional shift detection register mark MC1 overlaps the upward edge of the line L1. However, the target position need not be the position where the edges overlap. For example, a position where the circumferential direction positional shift detection register mark MC1 extends from the upward reference register mark MB1 by 0.05 mm may be determined as the target position. If the position where the edges overlap is determined as the target position, an upward positional shift between black and cyan can be measured more accurately and within a wider range by starting measurement at the upward edge of the line L1 of the upward reference register mark MB1. The same applies to the relationships between the downward reference register mark MB2 and downward positional shift detection register mark MC2, between the leftward reference register mark MB3 and leftward positional shift detection register mark MC3, and between the rightward reference register mark MB4 and rightward positional shift detection register mark MC4 as well.

In the above example, the width H1 of the line L1 and the width H2 of the blank L2 are 0.2 mm, and the width H3 of the line L3 is 0.1 mm. However, the present invention is not limited to these values. Theoretically, if the thicknesses and intervals of lines on a register mark (the reference register mark or positional shift detection register mark) are set in accordance with the target detection accuracy, detection with accuracy up to the printing limit is possible. With a register mark for detecting a fine positional shift, however, a large positional shift cannot be detected, and line reproduction accuracy on the plate also influences detection. Therefore, depending on the target accuracy, a set consisting of a plurality of register marks is necessary. The apparatus which inspects the printing quality of the printed product using the CCD color camera has detection accuracy of 2%. If the repetition accuracy of measurement accuracy is 2%, the thickness of a line segment within a register mark takes values as shown in Table 1 depending on the target accuracy.

TABLE 1

Relationship between Measurement Range and Line Segment Thickness of Register Mark

| Measurement Range (mm) | Accuracy (mm) | Reference-color Line Thickness (mm) | Target-color Line Thickness (mm) | Line Pitch (mm) |
|---|---|---|---|---|
| 0.004-0.050 | 0.004 | 0.10 | 0.050 | 0.2 |
| 0.01-0.125 | 0.01 | 0.25 | 0.125 | 0.5 |
| 0.03-0.375 | 0.03 | 0.75 | 0.375 | 1.5 |

TABLE 1-continued

Relationship between Measurement Range and Line Segment Thickness of Register Mark

| Measurement Range (mm) | Accuracy (mm) | Reference-color Line Thickness (mm) | Target-color Line Thickness (mm) | Line Pitch (mm) |
|---|---|---|---|---|
| 0.04-0.500 | 0.04 | 1.00 | 0.500 | 2.0 |
| 0.05-0.625 | 0.05 | 1.25 | 0.625 | 2.5 |
| 0.10-1.25 | 0.10 | 2.5 | 1.25 | 5.0 |

The above example has described that the color misregister amount between black and cyan is obtained. The color misregister amount between black and magenta and that between black and yellow can be obtained in the same manner. As the CCD color camera deals with the three, R, G, and B image signals, basically, use of a combination of data corresponding to a given color and its complementary color (cyan for R image signal data, magenta for G image signal data, and yellow for B image signal data) is appropriate. If a variety of special color inks are to be used, the data of the channel with the widest range may be used, and R, G, and B data may be processed (addition, subtraction, or the like) in accordance with the respective color characteristics.

In the above example, the color misregister amount between black and cyan is obtained from the sum of the pixel values G (GF, GB, GL, and GR) of the red image within the target range S (S1, S2, S3, or S4) by using the CCD color camera. Alternatively, the color misregister amount between black and cyan may be obtained from the cyan density value D (DF, DB, DL, or DR) within the target range S (S1, S2, S3, or S4) by using a spectrometer or densitometer. In this case, the color misregister amount between black and magenta and that between black and yellow can be obtained in the same manner. In the following first embodiment, the color misregister amount between black and each other color is obtained from the sum of the pixel values of each of the R, G, and B images within the target range S by using the CCD color camera. In the following second embodiment, the color misregister amount between black and each other color is obtained from the density value of each of cyan (C), magenta (M), and yellow (Y) within the target range S by using a spectrometer.

The conventional plate registration apparatus measures a specific register mark rather in a pinpoint manner. In contrast to this, the characteristic feature of the method of the present invention resides in that it can read a register mark at an arbitrary position by using the data of a camera that captures the entire area of the image. Data can thus be acquired not by periodic sampling but from all of the printed products in a steady state. By analyzing the tendency of the printed results of several sheets including a defective sheet, whether or not the defective sheet is merely accidental can be determined by a statistic process, so that registration adjustment can be performed appropriately.

With the conventional register marks, the problem of color separation is solved because the register marks of the respective colors do not overlap. With the conventional methods, as the register marks of the respective colors are separate from each other, it is not easy to identify visually which color is shifted in which direction. In contrast to this, according to the method of the present invention, the relationship between the reading result using the sensor and the actual motions of the register marks can be visually checked easily. This facilitates direct discrimination from the printed pattern.

When the color misregister amount of the printed product is obtained by the method of the present invention, the respective colors can be automatically controlled in accordance with the misregistration. This can considerably reduce the amount of waste paper caused by misregistration during printing by a multi-color printing press.

In ordinary operation, registration adjustment control requires know-how. By automatizing the registration adjustment control which is difficult to perform, human errors can be decreased regardless of the skill and experience of the printing operator. Thus, operation including final printing of the printed product can be automatized and standardized.

With the method of the present invention, if an inspection apparatus is used for determination of misregistration, it can grasp an error caused by a registration error. This can lead to automatic classification of defective phenomena. If an image in the optimal state is stored as the master image, data on the master image can be compared with data on initial printing obtained after plate change, and a correction amount can be fed back to a plate registration remote control where necessary. This shortens the time required for registration for initial printing.

Theoretically, the present invention can also be applied to a case in which a printing sample extracted periodically is captured by an area camera. The present invention can be applied not only to a sheet-fed offset printing press and web offset rotary printing press, but also to all printing presses that employ the method of mounting plates for respective colors in printing units of the respective colors.

[First Embodiment]

Figure 8:
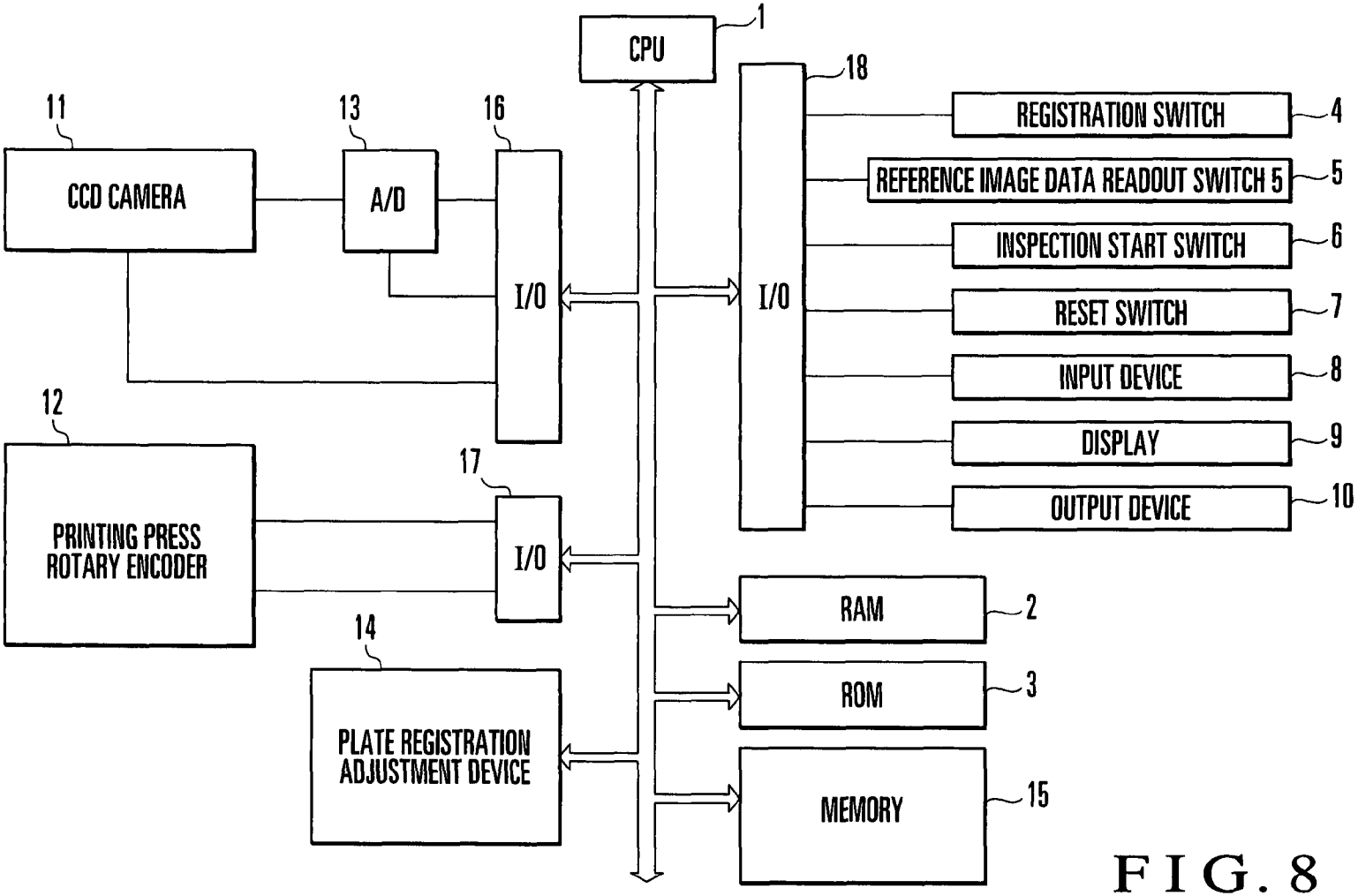
FIG. 8 is a block diagram showing a printed product color misregister amount detection apparatus according to the first embodiment of present invention.

FIG. 8 is a block diagram showing a printed product color misregister amount detection apparatus according to the first embodiment which utilizes the detection principle described above.

This printed product color misregister amount detection apparatus comprises a CPU 1, RAM 2, ROM 3, registration switch 4, reference image data loading switch 5, inspection start switch 6, reset switch 7, input device 8, display 9, output device 10, CCD camera 11, printing press rotary encoder 12, A/D converter 13, plate registration adjustment device 14, memory 15, and input/output interfaces (I/Os) 16 to 18. An example of the output device 10 includes an FD drive, a printer, or the like. Note that the CCD camera 11 includes its controller.

This printed product color misregister amount detection apparatus obtains the color misregister amount between black and each one of red (R), green (G), and blue (B) from the sum of the pixel values of the corresponding one of the R, G, and B images within the target range S described regarding above the detection principle by using the CCD camera 11.

Figure 9:
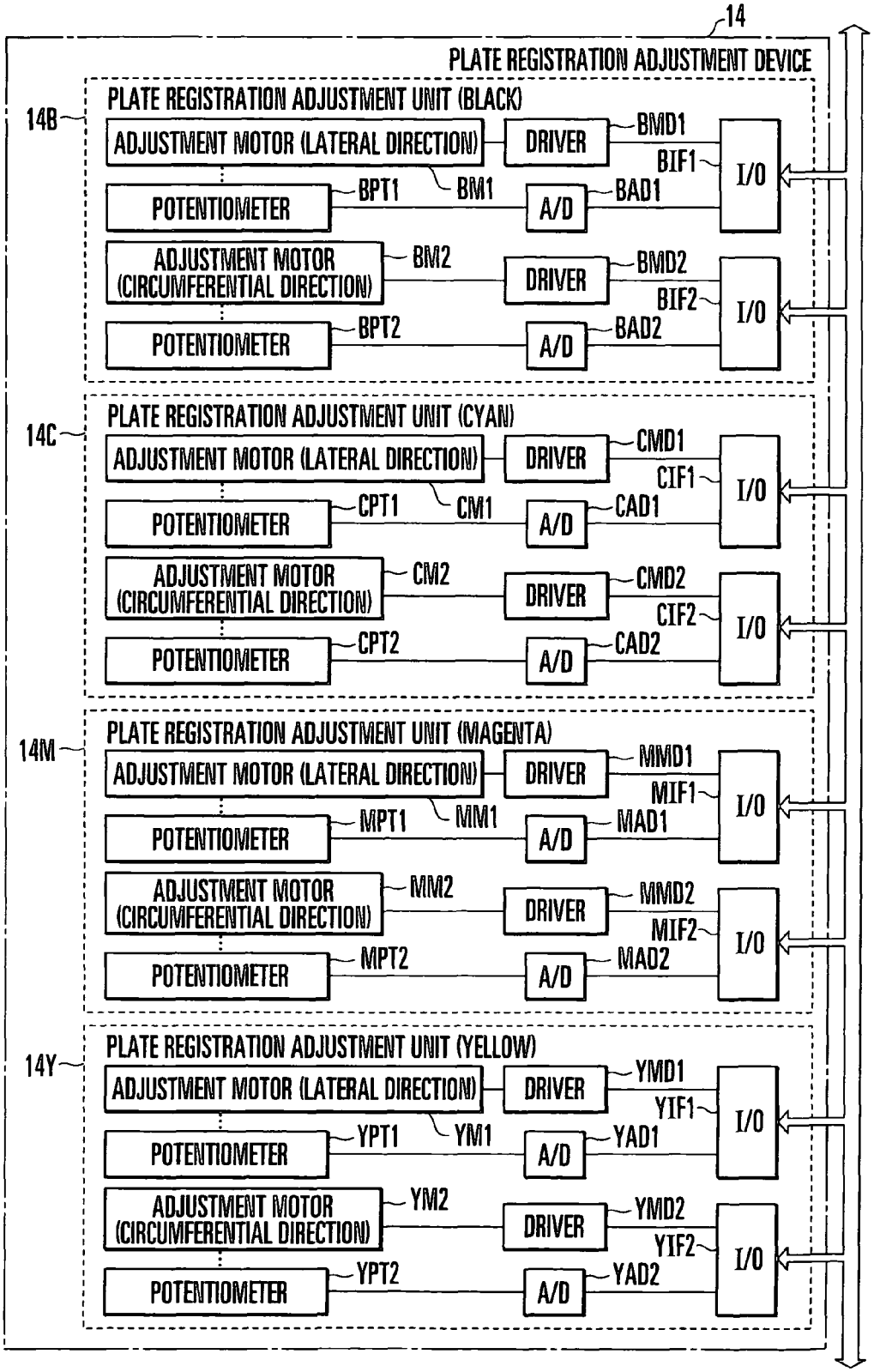
FIG. 9 is a block diagram showing the configuration of a plate registration adjustment device in FIG. 8.

FIG. 9 shows the configuration of the plate registration adjustment device 14. The plate registration adjustment device 14 comprises a plate registration adjustment unit 14B for a black printing unit, a plate registration adjustment unit 14C for a cyan printing unit, a plate registration adjustment unit 14M for a magenta printing unit, and a plate registration adjustment unit 14Y for a yellow printing unit.

The plate registration adjustment unit 14B for the black printing unit comprises a lateral direction registration adjustment motor BM1 for the black printing unit, a circumferential direction registration adjustment motor BM2 for the black printing unit, a lateral direction registration adjustment motor driver BMD1 for the black printing unit, a circumferential direction registration adjustment motor driver BMD2 for the black printing unit, a lateral direction registration adjustment motor potentiometer BPT1 for the black printing unit, a circumferential direction registration adjustment motor potentiometer BPT2 for the black printing unit, A/D converters BAD1 and BAD2, and input/output interfaces BIF1 and BIF2.

The plate registration adjustment unit 14C for the cyan printing unit comprises a lateral direction registration adjustment motor CM1 for the cyan printing unit, a circumferential direction registration adjustment motor CM2 for the cyan printing unit, a lateral direction registration adjustment motor driver CMD1 for the cyan printing unit, a circumferential direction registration adjustment motor driver CMD2 for the cyan printing unit, a lateral direction registration adjustment motor potentiometer CPT1 for the cyan printing unit, a circumferential direction registration adjustment motor potentiometer CPT2 for the cyan printing unit, A/D converters CAD1 and CAD2, and input/output interfaces CIF1 and CIF2.

The plate registration adjustment unit 14M for the magenta printing unit comprises a lateral direction registration adjustment motor MM1 for the magenta printing unit, a circumferential direction registration adjustment motor MM2 for the magenta printing unit, a lateral direction registration adjustment motor driver MMD1 for the magenta printing unit, a circumferential direction registration adjustment motor driver MMD2 for the magenta printing unit, a lateral direction registration adjustment motor potentiometer MPT1 for the magenta printing unit, a circumferential direction registration adjustment motor potentiometer MPT2 for the magenta printing unit, A/D converters MAD1 and MAD2, and input/output interfaces MIF1 and MIF2.

The plate registration adjustment unit 14Y for the yellow printing unit comprises a lateral direction registration adjustment motor YM1 for the yellow printing unit, a circumferential direction registration adjustment motor YM2 for the yellow printing unit, a lateral direction registration adjustment motor driver YMD1 for the yellow printing unit, a circumferential direction registration adjustment motor driver YMD2 for the yellow printing unit, a lateral direction registration adjustment motor potentiometer YPT1 for the yellow printing unit, a circumferential direction registration adjustment motor potentiometer YPT2 for the yellow printing unit, A/D converters YAD1 and YAD2, and input/output interfaces YIF1 and YIF2.

Figure 10:
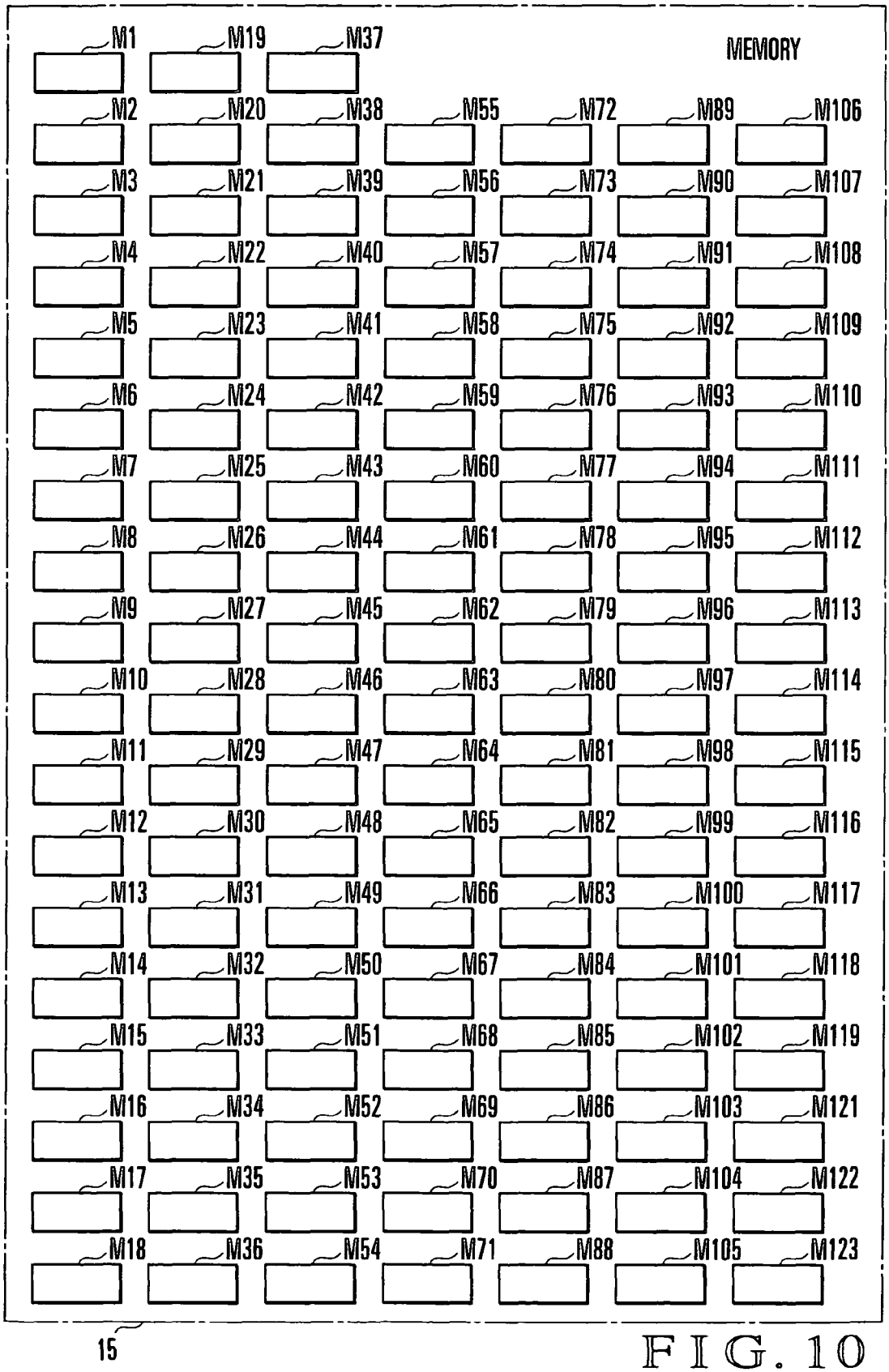
FIG. 10 is a block diagram showing the configuration of a memory in FIG. 8.

FIG. 10 shows the configuration of the memory 15. The memory 15 comprises memories M1 to M123. The memory M1 stores a count M. The memory M2 stores a count N. The memory M3 stores inspection target image data for R image data. The memory M4 stores inspection target image data for G image data. The memory M5 stores inspection target image data for B image data. The memory M6 stores a pixel count X of each of R, G, and B pixels of the CCD camera. The memory M7 stores a detected line count Y of one printed product sheet. The memory M8 stores the R value of a black lateral direction reference register mark. The memory M9 stores the G value of the black lateral direction reference register mark. The memory M10 stores the B value of the black lateral direction reference register mark. The memory M11 stores the position (BLX, BLY) of the black lateral direction reference register mark. The memory M12 stores the length (LW2) of a lateral direction register mark within a detection range in the lateral direction. The memory M13 stores the length (LH2) of the lateral direction register mark within the detection range in the circumferential direction. The memory M14 stores the R value of a black circumferential direction reference register mark. The memory M15 stores the G value of the black circumferential direction reference register mark. The memory M16 stores the B value of the black circumferential direction reference register mark. The memory M17 stores the position (BCX, BCY) of the black circumferential direction reference register mark. The memory M18 stores the length (LW1) of a circumferential direction register mark within the detection range in the lateral direction. The memory M19 stores the length (LH1) of the circumferential direction register mark within the detection range in the circumferential direction. The memory M20 stores the R value of a cyan leftward register mark. The memory M21 stores the position (CLX, CLY) of the cyan leftward register mark. The memory M22 stores the R value of a cyan rightward register mark. The memory M23 stores the position (CRX, CRY) of the cyan rightward register mark. The memory M24 stores the R value of a cyan upward register mark. The memory M25 stores the position (CFX, CFY) of the cyan upward register mark. The memory M26 stores the R value of a cyan downward register mark. The memory M27 stores the position (CBX, CBY) of the cyan downward register mark. The memory M28 stores the G value of a magenta leftward register mark. The memory M29 stores the position (MLX, MLY) of the magenta leftward register mark. The memory M30 stores the G value of a magenta rightward register mark. The memory M31 stores the position (MRX, MRY) of the magenta rightward register mark. The memory M32 stores the G value of a magenta upward register mark. The memory M33 stores the position (MFX, MFY) of the magenta upward register mark. The memory M34 stores the G value of a magenta downward register mark. The memory M35 stores the position (MBX, MBY) of the magenta downward register mark. The memory M36 stores the B value of a yellow leftward register mark. The memory M37 stores the position (YLX, YLY) of the yellow leftward register mark. The memory M38 stores the B value of a yellow rightward register mark. The memory M39 stores the position (YRX, YRY) of the yellow rightward register mark. The memory M40 stores the B value of a yellow upward register mark. The memory M41 stores the position (YFX, YFY) of the yellow upward register mark. The memory M42 stores the B value of a yellow downward register mark. The memory M43 stores the position (YBX, YBY) of the yellow downward register mark. The memory M44 stores a difference in the R value of the cyan leftward register mark. The memory M45 stores the tolerance of the R value of a cyan lateral direction register mark. The memory M46 stores a conversion table for converting the difference in the R value of the cyan lateral direction register mark into the lateral direction misregister amount of the cyan printing unit. The memory M47 stores the leftward misregister amount of the cyan printing unit. The memory M48 stores a difference in the R value of the cyan rightward register mark. The memory M49 stores the rightward misregister amount of the cyan printing unit. The memory M50 stores a difference in the R value of the cyan upward register mark. The memory M51 stores the tolerance of the R value of a cyan circumferential direction register mark. The memory M52 stores a conversion table for converting the difference in the R value of the cyan circumferential direction register mark into the circumferential direction misregister amount of the cyan printing unit. The memory M53 stores the upward misregister amount of the cyan printing unit. The memory M54 stores a difference in the R value of the cyan downward register mark. The memory M55 stores the downward misregister amount of the cyan printing unit. The memory M56 stores a difference in the G value of the magenta leftward register mark. The memory M57 stores the tolerance of the G value of a magenta lateral direction register mark. The memory M58 stores a conversion table for converting the difference in the G value of the magenta lateral direction register mark into the lateral direction misregister amount of the magenta printing unit. The memory M59 stores the leftward misregister amount of the magenta printing unit. The memory M60 stores a difference in the G value of the magenta rightward register mark. The memory M61 stores the rightward misregister amount of the magenta printing unit. The memory M62 stores a difference in the G value of the magenta upward register mark. The memory M63 stores the tolerance of the G value of the magenta circumferential direction register mark. The memory M64 stores a conversion table for converting the difference in the G value of the magenta circumferential direction register mark into the circumferential direction misregister amount of the magenta printing unit. The memory M65 stores the upward misregister amount of the magenta printing unit. The memory M66 stores a difference in the G value of the magenta downward register mark. The memory M67 stores the downward misregister amount of the magenta printing unit. The memory M68 stores a difference in the B value of the yellow leftward register mark. The memory M69 stores the tolerance of the B value of a yellow lateral direction register mark. The memory M70 stores a conversion table for converting the difference in the B value of the yellow lateral direction register mark into the lateral direction misregister amount of the yellow printing unit. The memory M71 stores the leftward misregister amount of the yellow printing unit. The memory M72 stores a difference in the B value of the yellow rightward register mark. The memory M73 stores the rightward misregister amount of the yellow printing unit. The memory M74 stores a difference in the B value of the yellow upward register mark. The memory M75 stores the tolerance of the B value of a yellow circumferential direction register mark. The memory M76 stores a conversion table for converting the difference in the B value of the yellow circumferential direction register mark into the circumferential direction misregister amount of the yellow printing unit. The memory M77 stores the upward misregister amount of the yellow printing unit. The memory M78 stores a difference in the B value of the yellow downward register mark. The memory M79 stores the downward misregister amount of the yellow printing unit. The memory M80 stores an output from an A/D converter connected to the potentiometer of the lateral direction registration adjustment motor of the cyan printing unit. The memory M81 stores the current position of the lateral direction registration adjustment motor of the cyan printing unit. The memory M82 stores the target position of the lateral direction registration adjustment motor of the cyan printing unit. The memory M83 stores the target output from the A/D converter connected to the potentiometer of the lateral direction registration adjustment motor of the cyan printing unit. The memory M84 stores an output from an A/D converter connected to the potentiometer of the circumferential direction registration adjustment motor of the cyan printing unit. The memory M85 stores the current position of the circumferential direction registration adjustment motor of the cyan printing unit. The memory M86 stores the target position of the circumferential direction registration adjustment motor of the cyan printing unit. The memory M87 stores the target output from the A/D converter connected to the potentiometer of the circumferential direction registration adjustment motor of the cyan printing unit. The memory M88 stores an output from an A/D converter connected to the potentiometer of the lateral direction registration adjustment motor of the magenta printing unit. The memory M89 stores the current position of the lateral direction registration adjustment motor of the magenta printing unit. The memory M90 stores the target position of the lateral direction registration adjustment motor of the magenta printing unit. The memory M91 stores the target output from the A/D converter connected to the potentiometer of the lateral direction registration adjustment motor of the magenta printing unit. The memory M92 stores an output from an A/D converter connected to the potentiometer of the circumferential direction registration adjustment motor of the magenta printing unit. The memory M93 stores the current position of the circumferential direction registration adjustment motor of the magenta printing unit. The memory M94 stores the target position of the circumferential direction registration adjustment motor of the magenta printing unit. The memory M95 stores the target output from the A/D converter connected to the potentiometer of the circumferential direction registration adjustment motor of the magenta printing unit. The memory M96 stores an output from an A/D converter connected to the potentiometer of the lateral direction registration adjustment motor of the yellow printing unit. The memory M97 stores the current position of the lateral direction registration adjustment motor of the yellow printing unit. The memory M98 stores the target position of the lateral direction registration adjustment motor of the yellow printing unit. The memory M99 stores the target output from the A/D converter connected to the potentiometer of the lateral direction registration adjustment motor of the yellow printing unit. The memory M100 stores an output from an A/D converter connected to the potentiometer of the circumferential direction registration adjustment motor of the yellow printing unit. The memory M101 stores the current position of the circumferential direction registration adjustment motor of the yellow printing unit. The memory M102 stores the target position of the circumferential direction registration adjustment motor of the yellow printing unit. The memory M103 stores the target output from the A/D converter connected to the potentiometer of the circumferential direction registration adjustment motor of the yellow printing unit. The memory M104 stores reference image data for R image data. The memory M105 stores reference image data for G image data. The memory M106 stores reference image data for B image data. The memory M107 stores registration abnormality. The memory M108 stores the NG pixel count for the R image data. The memory M109 stores the NG pixel count for the G image data. The memory M110 stores the NG pixel count for the B image data. The memory M111 stores an R image data difference. The memory M112 stores the absolute value of the R image data difference. The memory M113 stores an R image data tolerance. The memory M114 stores a G image data difference. The memory M115 stores the absolute value of the G image data difference. The memory M116 stores a G image data tolerance. The memory M117 stores a B image data difference. The memory M118 stores the absolute value of the B image data difference. The memory M119 stores a B image data tolerance. The memory M120 stores an NG determination value for the R image data. The memory M121 stores an NG determination value for the G image data. The memory M122 stores an NG determination value for the B image data. The memory M123 stores an NG color. The functions of the respective memories in the memory 15 will be described later. In this printed product color misregister amount detection apparatus, the CCD camera 11 corresponds to the CCD color camera described regarding the detection principle described above, and captures each line of the pattern printed on the printed product 100 in the circumferential direction in synchronism with the flow of the printed product 100.

The CPU 1 obtains various types of input information supplied through the I/O interfaces 16 to 18 and operates in accordance with the program stored in the ROM 3, while accessing the RAM 2 and memory 15, to obtain the circumferential and lateral direction color misregister amounts between the reference color and each color other than the reference color, and adjusts the registration position of the plate in the printing unit of each color through the plate registration adjustment device 14. The printing press rotary encoder 12 generates a zero pulse signal each time a plate cylinder (not shown) rotates by one revolution, and a clock pulse signal each time the plate cylinder rotates through a predetermined rotation amount during one revolution.

According to this embodiment, the respective pixel counts X of red (R), green (G), and blue (B) (the same value for R, G, and B in this case) of the CCD camera 11 are set in the memory M6 via the input device 8, and the detected line count Y of one printed product sheet is set in the memory M7 via the input device 8.

The mark position (BCX, BCY) of a black circumferential direction reference register mark MB12 (see FIG. 7) is set in the memory M17, and the mark position (BLX, BLY) of a black lateral direction reference register mark MB34 is set in the memory M11.

The mark position (CFX, CFY) of a cyan upward positional shift detection register mark MC1 (see FIG. 3A) is set in the memory M25, and the mark position (CBX, CBY) of a cyan downward positional shift detection register mark MC2 (see FIG. 3B) is set in the memory M27.

The mark position (CLX, CLY) of a cyan leftward positional shift detection register mark MC3 (see FIG. 5A) is set in the memory M21, and the mark position (CRX, CRY) of a cyan rightward positional shift detection register mark MC4 (FIG. 5B) is set in the memory M23.

In the same manner as with cyan, the mark position (MFX, MFY) of a magenta upward positional shift detection register mark is set in the memory M33. The mark position (MBX, MBY) of a magenta downward positional shift detection register mark is set in the memory M35. The mark position (MLX, MLY) of a magenta leftward positional shift detection register mark is set in the memory M29. The mark position (MRX, MRY) of a magenta rightward positional shift detection register mark is set in the memory M31. The mark position (YFX, YFY) of a yellow upward positional shift detection register mark is set in the memory M41. The mark position (YBX, YBY) of a yellow downward positional shift detection register mark is set in the memory M43. The mark position (YLX, YLY) of a yellow leftward positional shift detection register mark is set in the memory M37. The mark position (YRX, YRY) of a yellow rightward positional shift detection register mark is set in the memory M39.

In the following description, the upward, downward, leftward, and rightward positional shift detection register marks will be called upward, downward, leftward, and rightward register marks, respectively.

Figure 7:
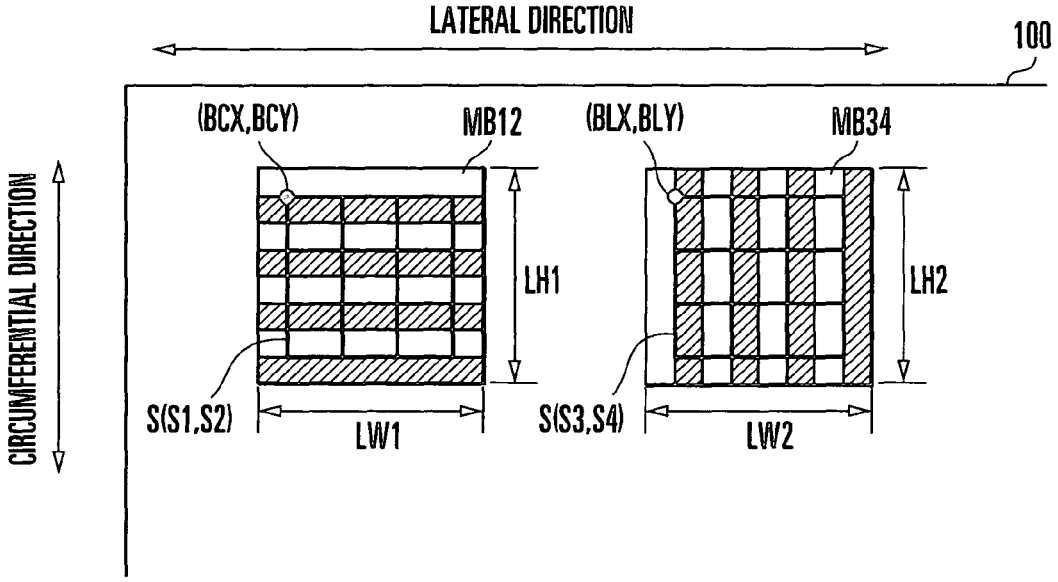
FIG. 7 is a view showing an example of a circumferential direction reference register mark and an example of a lateral direction reference register mark employed in the embodiment of the present invention.

In this embodiment, the target range S (S1 or S2) determined for the upward reference register mark MB1, downward reference register mark MB2, or circumferential direction reference register mark MB12 is defined as the detection range of the circumferential direction register mark (see FIG. 7). A length LW1 of the detection range in the lateral direction is set in the memory M18, and a length LH1 of the detection range in the circumferential direction is set in the memory M19. The target range S (S3 or S4) determined for the leftward reference register mark MB3, rightward reference register mark MB4, or lateral direction reference register mark MB34 is defined as the detection range of the lateral direction register mark (see FIG. 7). A length LW2 of the detection range in the lateral direction is set in the memory M12, and a length LH2 of the detection range in the circumferential direction is set in the memory M13. The lengths LW1, LW2, LH1, and LH2 are set as values corresponding to the counts N and M to be described later.

[Registration]

[Loading of Inspection Target Image]

In this color misregister amount detection apparatus, when the registration switch 4 is turned on during printing (YES in step S101, FIG. 11A), the CPU 1 reads an output from the printing press rotary encoder 12 (step S104). When the printing press rotary encoder 12 generates a zero pulse signal (YES in step S105), the CPU 1 sends a detection start instruction to the CCD camera 11 (step S106). The CPU 1 then sets the count M of the memory M1 to one (step S107) and reads the output from the printing press rotary encoder 12 (step S108). When the printing press rotary encoder 12 generates a clock pulse signal (YES in step S109), the CPU 1 sends an output instruction to the CCD camera 11 (step S110). The CPU 1 then sets the count N of the memory M2 to one (step S111 in FIG. 11B).

Upon reception of the output instruction from the CPU 1, the CCD camera 11 sends image data (R image data) on the first one pixel of the R image of the captured printed product (reference printed product) to the A/D converter 13. The CPU 1 receives the A/D-converted R image data from the CCD camera 11 (YES in step S112) and stores it in the memory M104 at an address position (N, M) (step S113). The CPU 1 then increments the count N by one (step S114), reads out the respective pixel counts X of R, G, and B of the CCD camera 11 set in the memory M6 (step S115), and outputs an output instruction to the CCD camera 11 in response to NO in step S116 (step S117). The process then returns to step S112. The CPU 1 repeats this operation until the count N exceeds X in step S116. Thus, the R image data (image pixel) on the respective pixels of the first one line of the printed product captured by the CCD camera 11 is stored in the memory M104.

When the count N exceeds X (YES in step S116), the CPU 1 restores the count N to one (step S118), receives the A/D-converted G image data from the CCD camera 11 in the same manner as in the case of the R image (YES in step S119), and stores the G image data at the address position (N, M) of the memory M105 (step S120). The CPU 1 then increments the count N by one (step S121), reads the pixel count X of each of the R, G, and B pixels of the CCD camera 11 (step S122), and sends an output instruction to the CCD camera 11 in response to NO of step S123 (step S124). Then, the process returns to step S119. The CPU 1 repeats this operation until the count N exceeds X in step S123. Thus, the G image data (pixel value) of each pixel of the first one line on the printed product captured by the CCD camera 11 is stored in the memory M105.

When the count N exceeds X (YES in step S123), the CPU 1 restores the count N to one (step S125 in FIG. 11C), receives the A/D-converted B image data from the CCD camera 11 in the same manner as in the case of the G image (YES in step S126), and stores the B image data at the address position (N, M) of the memory M106 (step S127). The CPU 1 then increments the count N by one (step S128), reads the pixel count X of each of the R, G, and B pixels of the CCD camera 11 (step S129), and sends an output instruction to the CCD camera 11 in response to NO of step S130 (step S131). Then, the process returns to step S126. The CPU 1 repeats this operation until the count N exceeds X in step S130. Thus, the B image data (pixel value) of each pixel of the first one line on the printed product captured by the CCD camera 11 is stored in the memory M106.

When the count N exceeds X (YES in step S130), the CPU 1 increments the count M by one (step S132), and reads out the detected line count Y of one printed product sheet set in the memory M7 (step S133). The process returns to step S108 (FIG. 11A) in response to NO in step S134. The CPU 1 repeats this operation until the count M exceeds Y (YES in step S134).

Figure 28A:
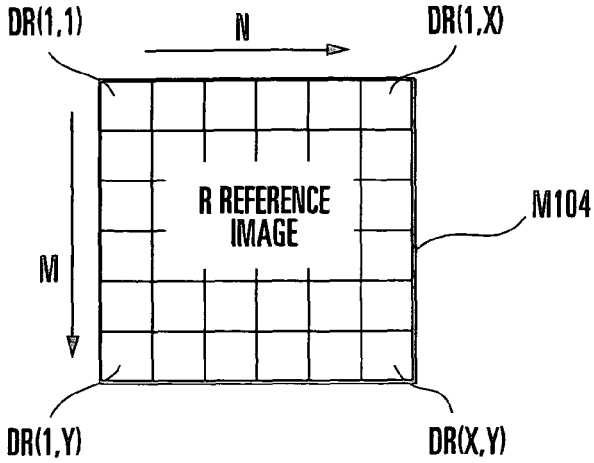
FIGS. 28A to 28C are views showing how R, G, and B reference image data are stored.
Figure 28B:
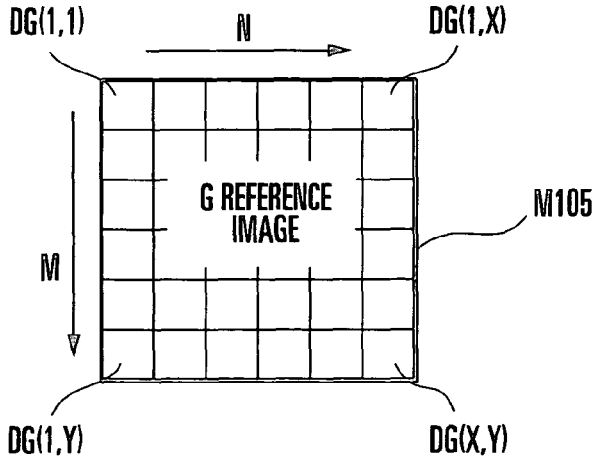
Figure 28C:
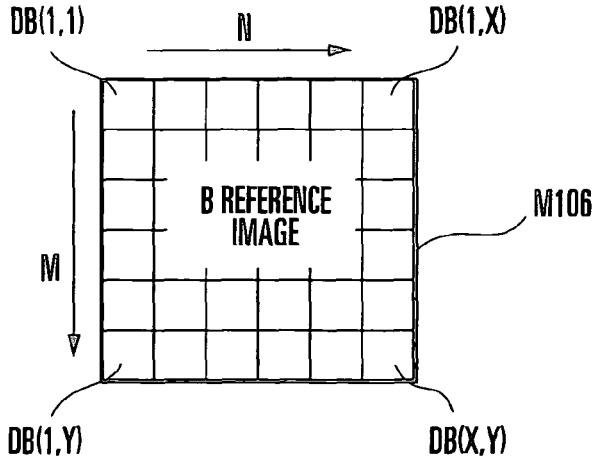

Thus, as shown in FIGS. 28A to 28C, reference image data DR (1, 1) to DR (X, Y) on the R image of the reference printed product are stored in the memory M104 as the R reference image. Reference image data DG (1, 1) to DG (X, Y) on the G image of the reference printed product are stored in the memory M105 as the G reference image. Reference image data DB (1, 1) to DB (X, Y) on the B image of the reference printed product are stored in the memory M106 as the B reference image.

[Calculation of Misregister Amount]

[Acquisition of Density Information on Each Color of Black Lateral Direction Reference Register Mark within Target Range]

The CPU 1 sets zero in the memories M8, M9, and M10 (step S135 in FIG. 12A) and resets the count M to zero (step S136) and the count N to zero (step S137). The CPU 1 reads out the value of the memory M8 (step S138), the mark position (BLX, BLY) of the black lateral direction reference register mark MB34 from the memory M11 (step S139), and the image data at the address position (BLX+N, BLY+M) of the memory M3 (step S140), adds the image data at the address position (BLX+N, BLY+M) read out from the memory M3 to the value of the memory M8 read out in step S138, and overwrites the sum in the memory M8 as a value R of the black lateral direction reference register mark (step S141).

The CPU 1 reads out the value of the memory M9 (step S142) and the image data at the address position (BLX+N, BLY+M) of the memory M4 (step S143), adds the image data at the address position (BLX+N, BLY+M) read out from the memory M4 to the value of the memory M9 read out in step S142, and overwrites the sum as a value G of the black lateral direction reference register mark in the memory M9 (step S144).

The CPU 1 reads out the value of the memory M10 (step S145) and the image data at the address position (BLX+N, BLY+M) of the memory M5 (step S146), adds the image data at the address position (BLX+N, BLY+M) read out from the memory M5 to the value of the memory M10 read out in step S142, and overwrites the sum as a value B of the black lateral direction reference register mark in the memory M10 (step S147).

The CPU 1 then increments the count N by one (step S148), and reads out the length LW2 of the lateral direction register mark within the lateral detection range from the memory M12 (step S149). The CPU 1 repeats the processes of steps S138 to S150 until the count N exceeds LW2 in step S150. When the count N exceeds LW2 (YES in step S150), the CPU 1 increments the count M by one (step S151) and reads the length LH2 of the lateral direction register mark within the circumferential detection range from the memory M13 (step S152). The CPU 1 repeats the processes of steps S137 to S153 until the count M exceeds LH2 in step S153.

Hence, the pixel values of the R, G, and B inspection target images of the black lateral direction reference register mark MB34 within the target range S are added separately for each color. The sum of the pixel values of the R inspection target image is stored in the memory M8 as the density information on the cyan component within the target range S. The sum of the pixel values of the G inspection target image is stored in the memory M9 as the density information on the magenta component within the target range S. The sum of the pixel values of the B inspection target image is stored in the memory M10 as the density information on the yellow component within the target range S.

[Acquisition of Density Information on Each Color of Black Circumferential Direction Reference Register Mark within Target Range]

The CPU 1 sets zero in the memories M14, M15, and M16 (step S154 in FIG. 12B) and resets the count M to zero (step S155) and the count N to zero (step S156). The CPU 1 reads out the value of the memory M14 (step S157), the mark position (BCX, BCY) of the black circumferential direction reference register mark MB12 from the memory M17 (step S158), and the image data at the address position (BCX+N, BCY+M) of the memory M3 (step S159), adds the image data at the address position (BCX+N, BCY+M) read out from the memory M3 to the value of the memory M14 read out in step S157, and overwrites the sum in the memory M14 as a value R of the black circumferential direction reference register mark (step S160).

The CPU 1 reads out the value of the memory M15 (step S161) and the image data at the address position (BCX+N, BCY+M) of the memory M4 (step S162), adds the image data at the address position (BCX+N, BCY+M) read out from the memory M4 to the value of the memory M15 read out in step S161, and overwrites the sum as a value G of the black circumferential direction reference register mark in the memory M15 (step S163).

The CPU 1 reads out the value of the memory M16 (step S164) and the image data at the address position (BCX+N, BCY+M) of the memory M5 (step S165), adds the image data at the address position (BCX+N, BCY+M) read out from the memory M5 to the value of the memory M16 read out in step S164, and overwrites the sum as a value B of the black circumferential direction reference register mark in the memory M16 (step S166).

The CPU 1 then increments the count N by one (step S167), and reads out the length LW1 of the circumferential direction register mark within the lateral detection range from the memory M18 (step S168). The CPU 1 repeats the processes of steps S157 to S169 until the count N exceeds LW1 in step S169. When the count N exceeds LW1 (YES in step S169), the CPU 1 increments the count M by one (step S170) and reads the length LH1 of the circumferential direction register mark within the circumferential detection range from the memory M19 (step S171). The CPU 1 repeats the processes of steps S156 to S172 until the count M exceeds LH1 in step S172.

Hence, the pixel values of the R, G, and B inspection target images of the black circumferential direction reference register mark MB12 within the target range S are added separately for each color. The sum of the pixel values of the R inspection target image is stored in the memory M14 as the density information on the cyan component within the target range S. The sum of the pixel values of the G inspection target image is stored in the memory M15 as the density information on the magenta component within the target range S. The sum of the pixel values of the B inspection target image is stored in the memory M16 as the density information on the yellow component within the target range S.

[Acquisition of Density Information on Cyan Component of Leftward Reference Register Mark+Cyan Leftward Register Mark within Target Range]

The CPU 1 sets zero in the memory M20 (step S173 in FIG. 12C) and resets the count M to zero (step S174) and the count N to zero (step S175). The CPU 1 reads out the value of the memory M20 (step S176), the position (CLX, CLY) of the cyan leftward register mark from the memory M21 (step S177), and the image data at the address position (CLX+N, CLY+M) of the memory M3 (step S178), adds the image data at the address position (CLX+N, CLY+M) read out from the memory M3 to the value of the memory M20 read out in step S176, and overwrites the sum in the memory M20 as a value R of the cyan leftward register mark (step S179).

The CPU 1 then increments the count N by one (step S180), and reads out the length LW2 of the lateral direction register mark within the lateral detection range from the memory M12 (step S181). The CPU 1 repeats the processes of steps S176 to S182 until the count N exceeds LW2 in step S182. When the count N exceeds LW2 (YES in step S182), the CPU 1 increments the count M by one (step S183) and reads the length LH2 of the lateral direction register mark within the circumferential detection range from the memory M13 (step S184). The CPU 1 repeats the processes of steps S175 to S185 until the count M exceeds LH2 in step S185.

Hence, the pixel values of the R inspection target image of the leftward reference register mark MB3, on which the cyan leftward register mark MC3 is printed to overlap, within the target range S are added. The sum of the pixel values of the R inspection target image is stored in the memory M20 as the density information on the cyan component within the target range S.

[Acquisition of Density Information on Cyan Component of Rightward Reference Register Mark+Cyan Rightward Register Mark within Target Range]

The CPU 1 sets zero in the memory M22 (step S186 in FIG. 12D) and resets the count M to zero (step S187) and the count N to zero (step S188). The CPU 1 reads out the value of the memory M22 (step S189), the position (CRX, CRY) of the cyan rightward register mark from the memory M23 (step S190), and the image data at the address position (CRX+N, CRY+M) of the memory M3 (step S191), adds the image data at the address position (CRX+N, CRY+M) read out from the memory M3 to the value of the memory M22 read out in step S189, and overwrites the sum in the memory M22 as a value R of the cyan rightward register mark (step S192).

The CPU 1 then increments the count N by one (step S193), and reads out the length LW2 of the lateral direction register mark within the lateral detection range from the memory M12 (step S194). The CPU 1 repeats the processes of steps S189 to S195 until the count N exceeds LW2 in step S195. When the count N exceeds LW2 (YES in step S195), the CPU 1 increments the count M by one (step S196) and reads the length LH2 of the lateral direction register mark within the circumferential detection range from the memory M13 (step S197). The CPU 1 repeats the processes of steps S188 to S198 until the count M exceeds LH2 in step S198.

Hence, the pixel values of the R inspection target image of the rightward reference register mark MB4, on which the cyan rightward register mark MC4 is printed to overlap, within the target range S are added. The sum of the pixel values of the R inspection target image is stored in the memory M22 as the density information on the cyan component within the target range S.

[Acquisition of Density Information on Cyan Component of Upward Reference Register Mark+Cyan Upward Register Mark within Target Range]

The CPU 1 sets zero in the memory M24 (step S199 in FIG. 12E) and resets the count M to zero (step S200) and the count N to zero (step S201). The CPU 1 reads out the value of the memory M24 (step S202), the position (CFX, CFY) of the cyan upward register mark from the memory M25 (step S203), and the image data at the address position (CFX+N, CFY+M) of the memory M3 (step S204), adds the image data at the address position (CFX+N, CFY+M) read out from the memory M3 to the value of the memory M24 read out in step S202, and overwrites the sum in the memory M24 as a value R of the cyan upward register mark (step S205).

The CPU 1 then increments the count N by one (step S206), and reads out the length LW1 of the circumferential direction register mark within the lateral detection range from the memory M18 (step S207). The CPU 1 repeats the processes of steps S202 to S208 until the count N exceeds LW1 in step S208. When the count N exceeds LW1 (YES in step S208), the CPU 1 increments the count M by one (step S209) and reads the length LH1 of the circumferential direction register mark within the circumferential detection range from the memory M19 (step S210). The CPU 1 repeats the processes of steps S201 to S211 until the count M exceeds LH1 in step S211.

Hence, the pixel values of the R inspection target image of the upward reference register mark MB1, on which the cyan upward register mark MC1 is printed to overlap, within the target range S are added. The sum of the pixel values of the R inspection target image is stored in the memory M24 as the density information on the cyan component within the target range S.

[Acquisition of Density Information on Cyan Component of Downward Reference Register Mark+Cyan Downward Register Mark within Target Range]

The CPU 1 sets zero in the memory M26 (step S212 in FIG. 12F) and resets the count M to zero (step S213) and the count N to zero (step S214). The CPU 1 reads out the value of the memory M26 (step S215), the position (CBX, CBY) of the cyan downward register mark from the memory M27 (step S216), and the image data at the address position (CBX+N, CBY+M) of the memory M3 (step S217), adds the image data at the address position (CBX+N, CBY+M) read out from the memory M3 to the value of the memory M26 read out in step S215, and overwrites the sum in the memory M26 as a value R of the cyan downward register mark (step S218).

The CPU 1 then increments the count N by one (step S219), and reads out the length LW1 of the circumferential direction register mark within the lateral detection range from the memory M18 (step S220). The CPU 1 repeats the processes of steps S215 to S221 until the count N exceeds LW1 in step S221. When the count N exceeds LW1 (YES in step S221), the CPU 1 increments the count M by one (step S222) and reads the length LH1 of the circumferential direction register mark within the circumferential detection range from the memory M19 (step S223). The CPU 1 repeats the processes of steps S214 to S224 until the count M exceeds LH1 in step S224.

Hence, the pixel values of the R inspection target image of the downward reference register mark MB2, on which the cyan downward register mark MC2 is printed to overlap, within the target range S are added. The sum of the pixel values of the R inspection target image is stored in the memory M26 as the density information on the cyan component within the target range S.

[Acquisition of Density Information on Magenta Component of Leftward Reference Register Mark+Magenta Leftward Register Mark within Target Range]

Figure 12A:
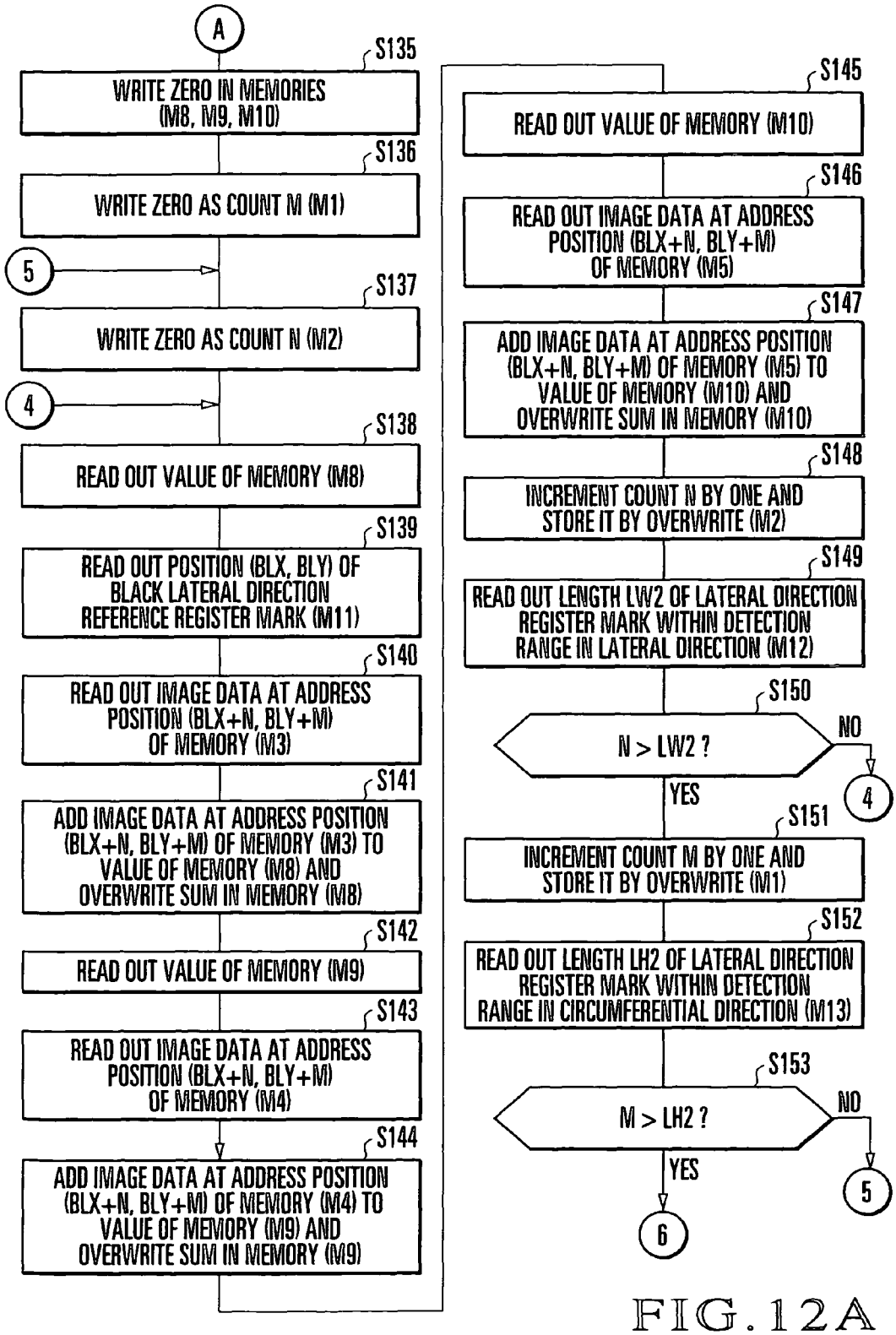
FIGS. 12A to 12N are flowcharts showing the processes, subsequent to the processes shown in FIGS. 11A to 11C, of acquiring density information on each color within a target range.
Figure 12B:
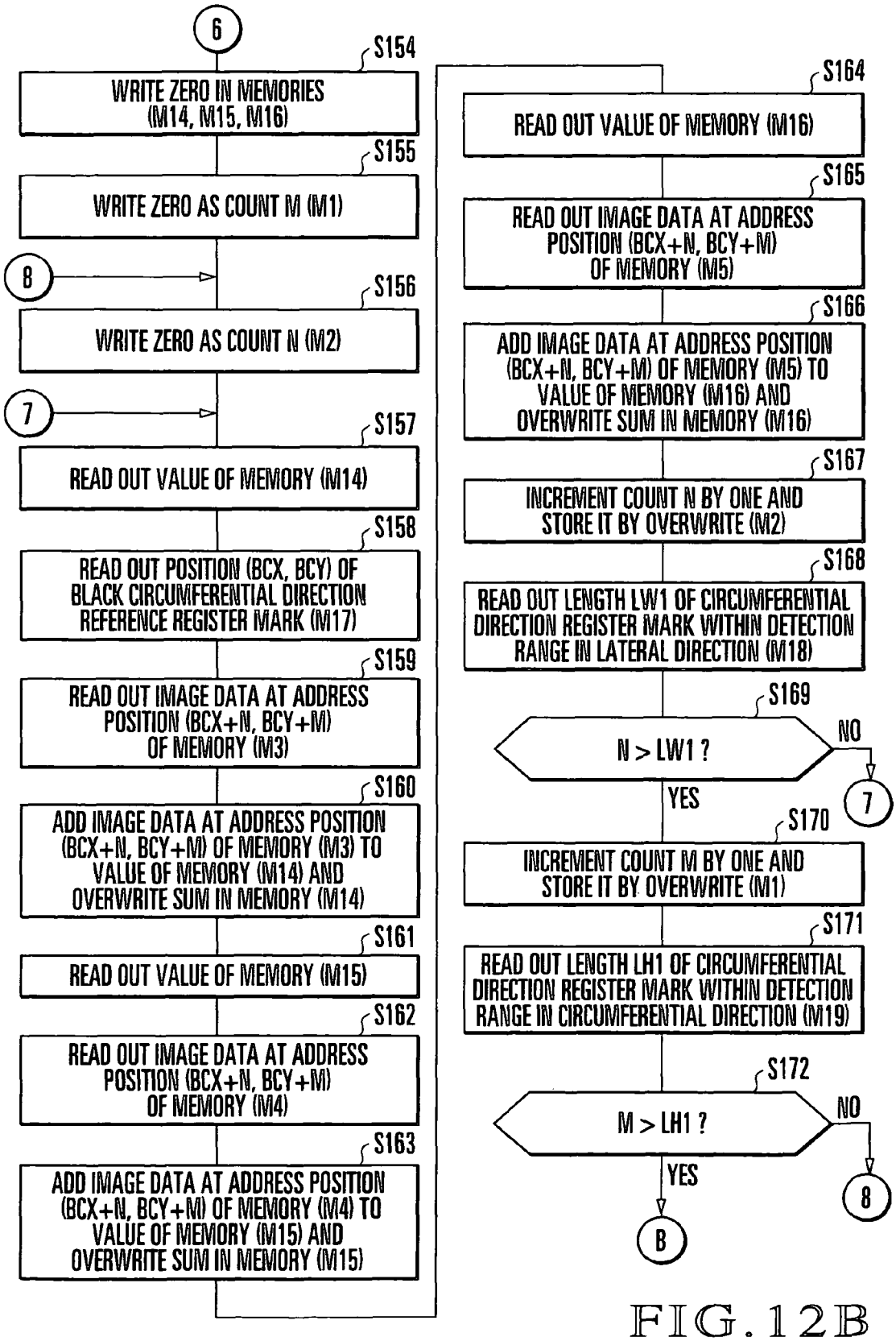
Figure 12C:
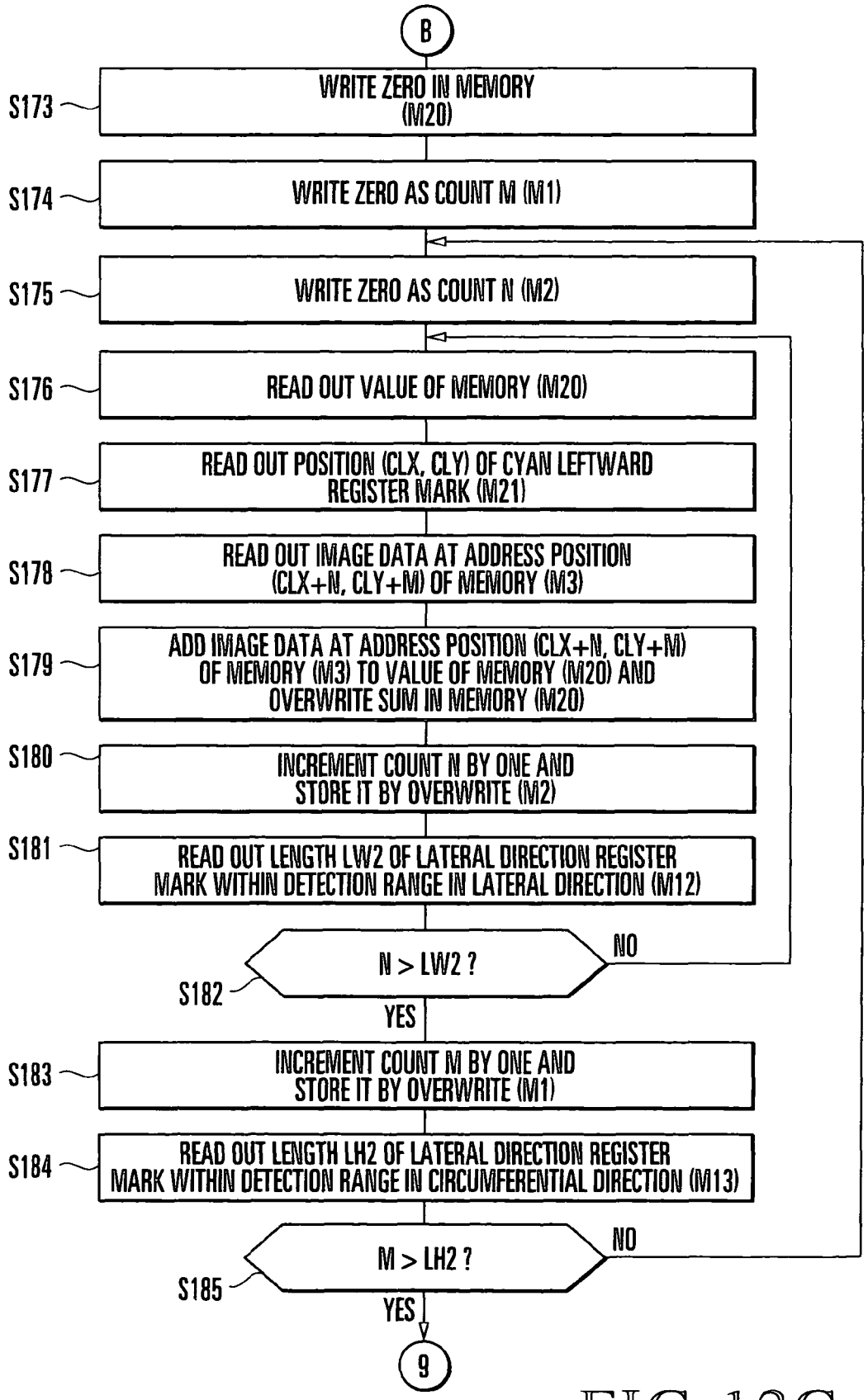

The CPU 1 then performs the processes of steps S225 to S237 (FIG. 12G) corresponding to steps S173 to S185 shown in FIG. 12C, adds the pixel values of the G inspection target image of the leftward reference register mark MB3, on which a magenta leftward register mark (not shown) is printed to overlap, within the target range S, and stores the sum of the pixel values of the G inspection target image in the memory M28 as the density information on the magenta component within the target range S.

[Acquisition of Density Information on Magenta Component of Rightward Reference Register Mark+Magenta Rightward Register Mark within Target Range]

Figure 12D:
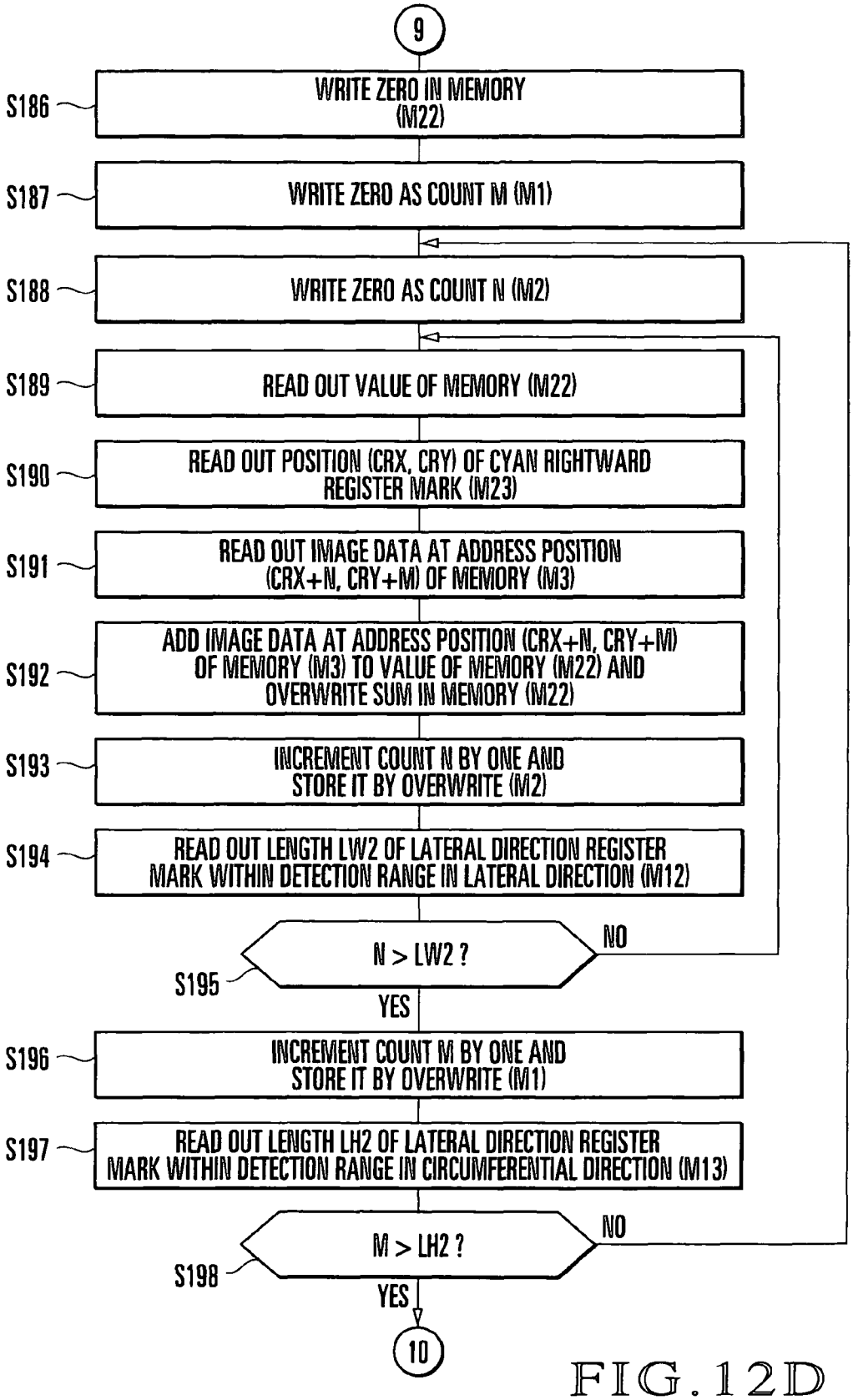

The CPU 1 performs the processes of steps S238 to S250 (FIG. 12H) corresponding to steps S186 to S198 shown in FIG. 12D, adds the pixel values of the G inspection target image of the rightward reference register mark MB4, on which a magenta rightward register mark (not shown) is printed to overlap, within the target range S, and stores the sum of the pixel values of the G inspection target image in the memory M30 as the density information on the magenta component within the target range S.

[Acquisition of Density Information on Magenta Component of Upward Reference Register Mark+Magenta Upward Register Mark within Target Range]

Figure 12E:
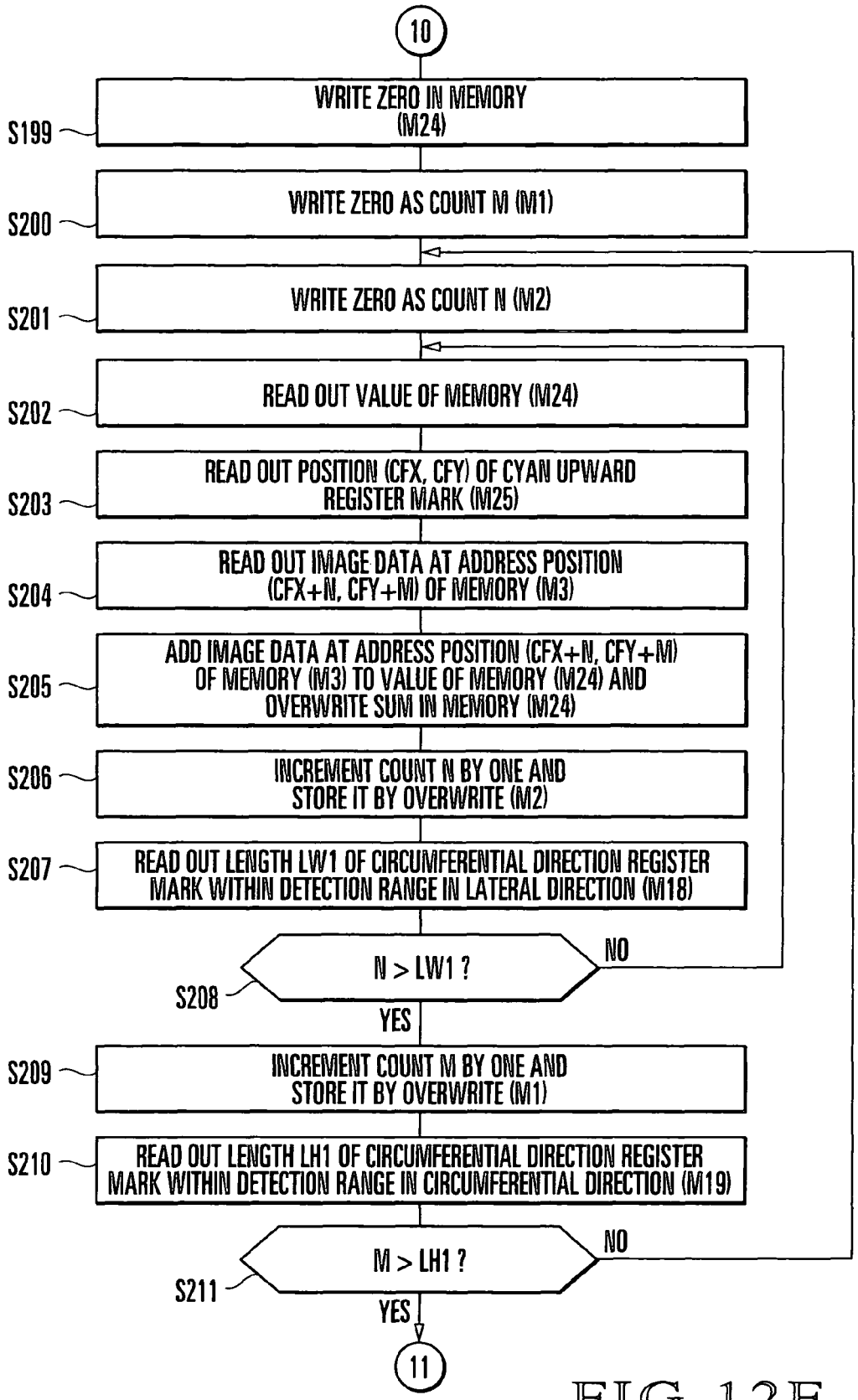

The CPU 1 performs the processes of steps S251 to S263 (FIG. 12I) corresponding to steps S199 to S211 shown in FIG. 12E, adds the pixel values of the G inspection target image of the upward reference register mark MB1, on which a magenta upward register mark (not shown) is printed to overlap, within the target range S, and stores the sum of the pixel values of the G inspection target image in the memory M32 as the density information on the magenta component within the target range S.

[Acquisition of Density Information on Magenta Component of Downward Reference Register Mark+Magenta Downward Register Mark within Target Range]

Figure 12F:
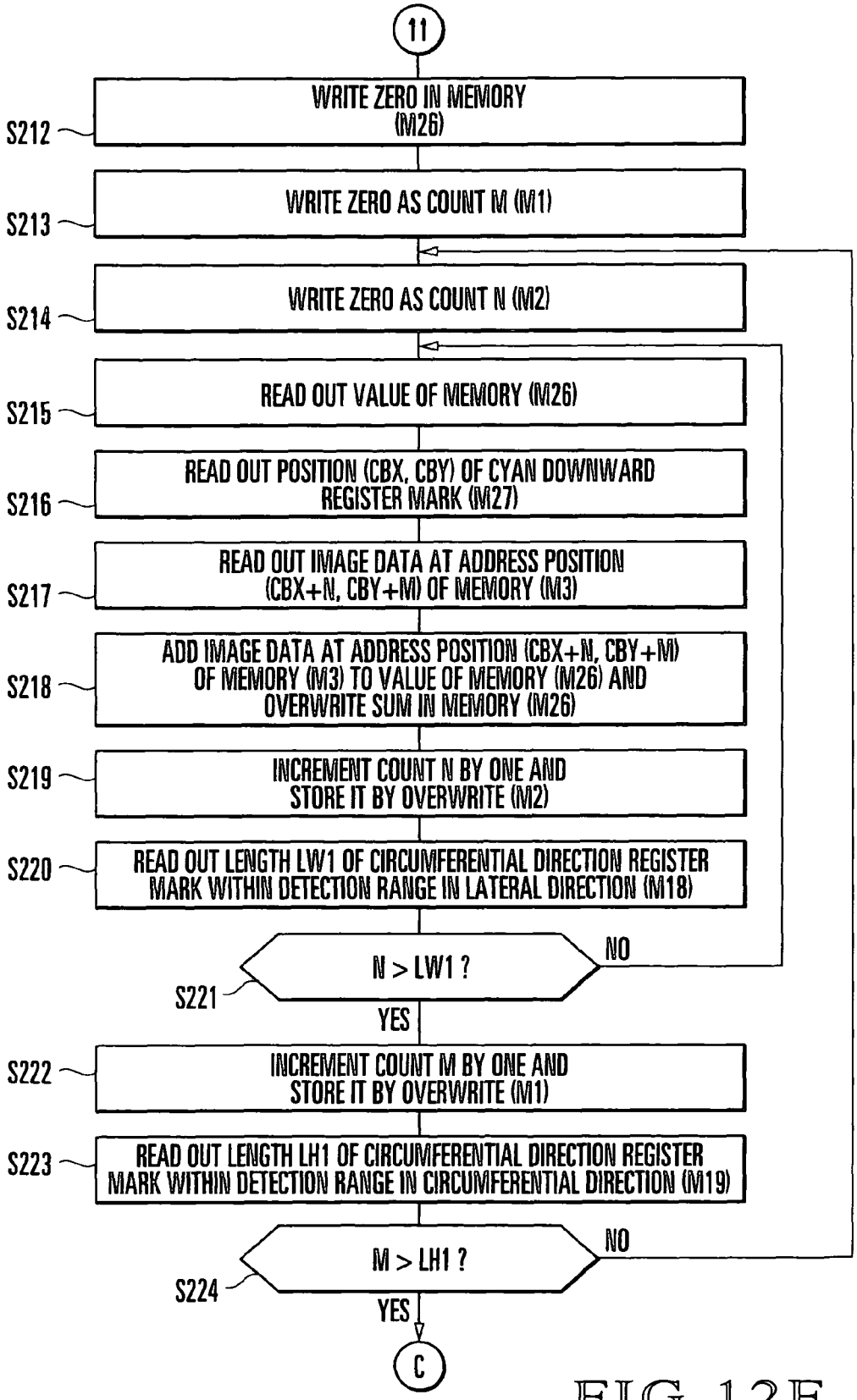
Figure 12G:
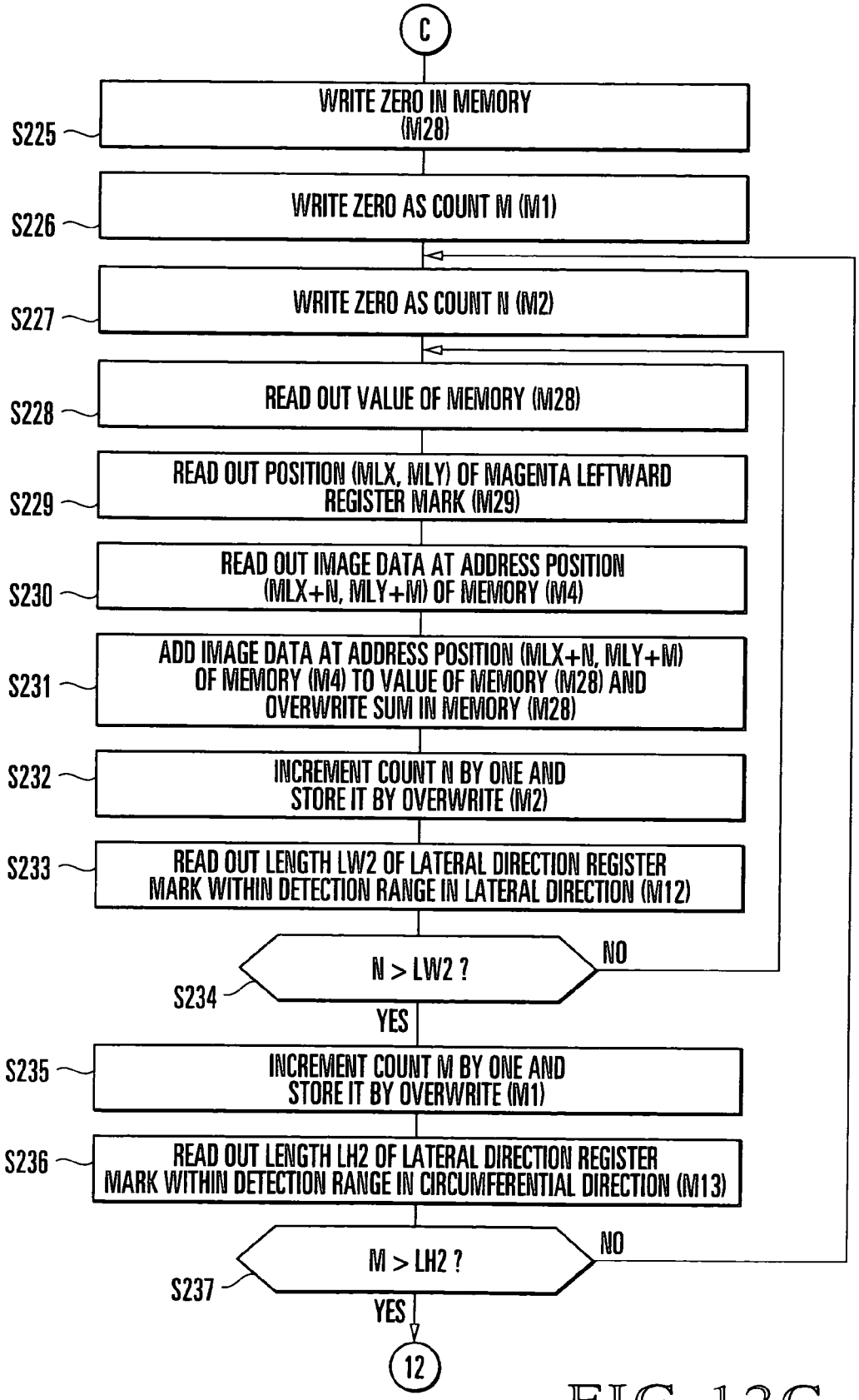
Figure 12H:
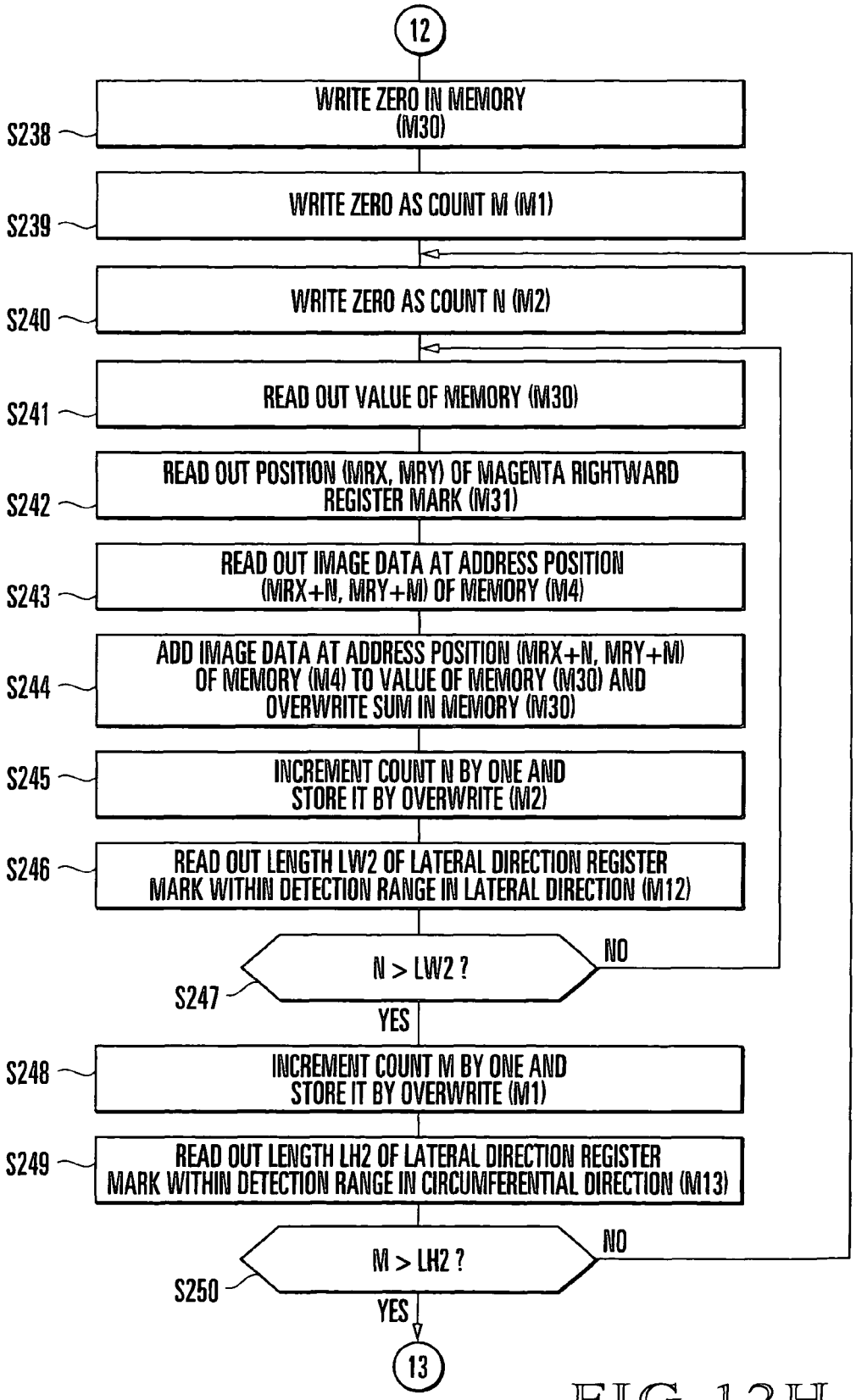
Figure 12I:
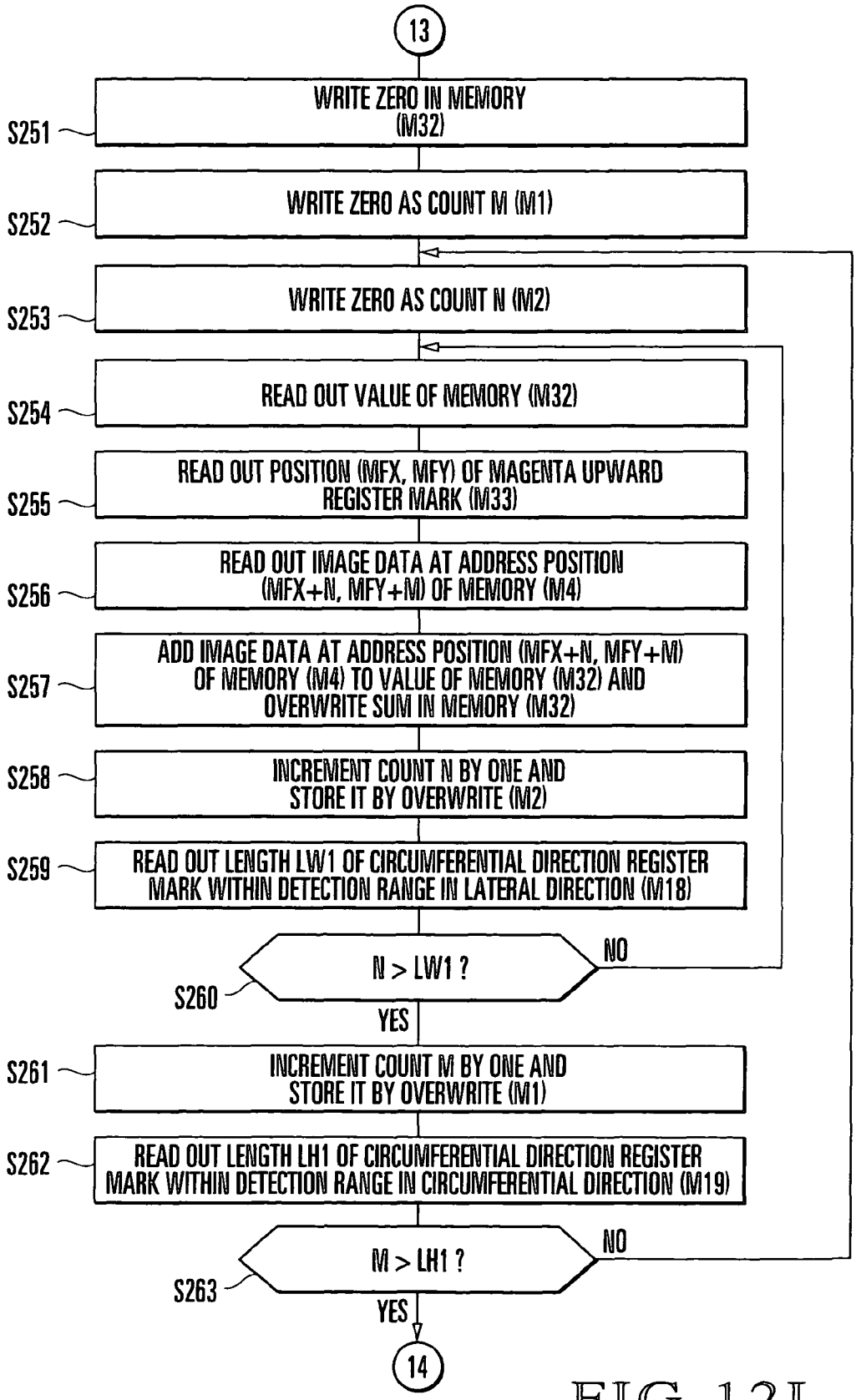
Figure 12J:
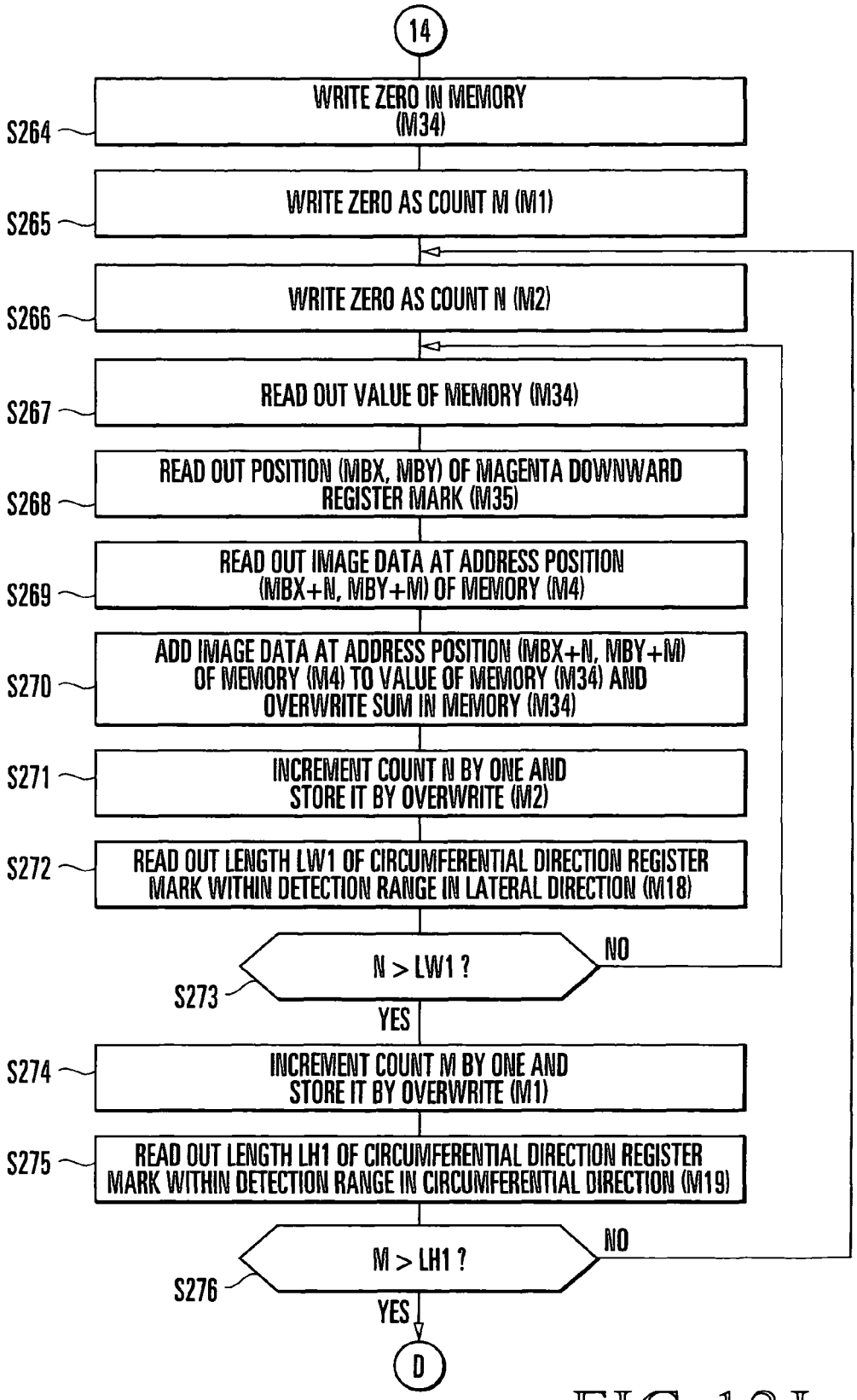

The CPU 1 performs the processes of steps S264 to S276 (FIG. 12J) corresponding to steps S212 to S224 shown in FIG. 12F, adds the pixel values of the G inspection target image of the downward reference register mark MB2, on which a magenta downward register mark (not shown) is printed to overlap, within the target range S, and stores the sum of the pixel values of the G inspection target image in the memory M34 as the density information on the magenta component within the target range S.

[Acquisition of Density Information on Yellow Component of Leftward Reference Register Mark+Yellow Leftward Register Mark within Target Range]

Figure 12K:
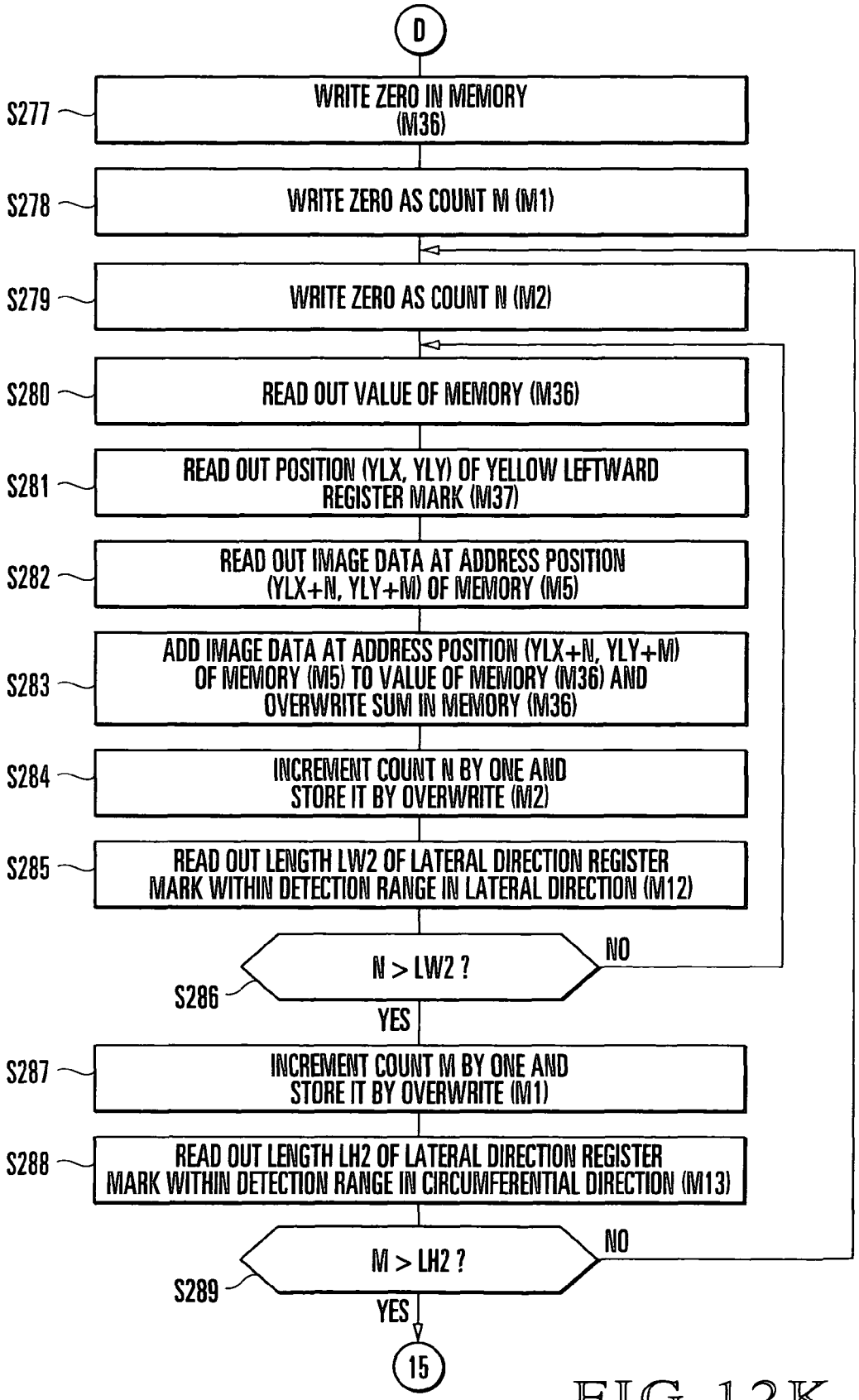

The CPU 1 performs the processes of steps S277 to S289 (FIG. 12K) corresponding to steps S173 to S185 shown in FIG. 12C, adds the pixel values of the B inspection target image of the leftward reference register mark MB3, on which a yellow leftward register mark (not shown) is printed to overlap, within the target range S, and stores the sum of the pixel values of the B inspection target image in the memory M36 as the density information on the yellow component within the target range S.

[Acquisition of Density Information on Yellow Component of Rightward Reference Register Mark+Yellow Rightward Register Mark within Target Range]

Figure 12L:
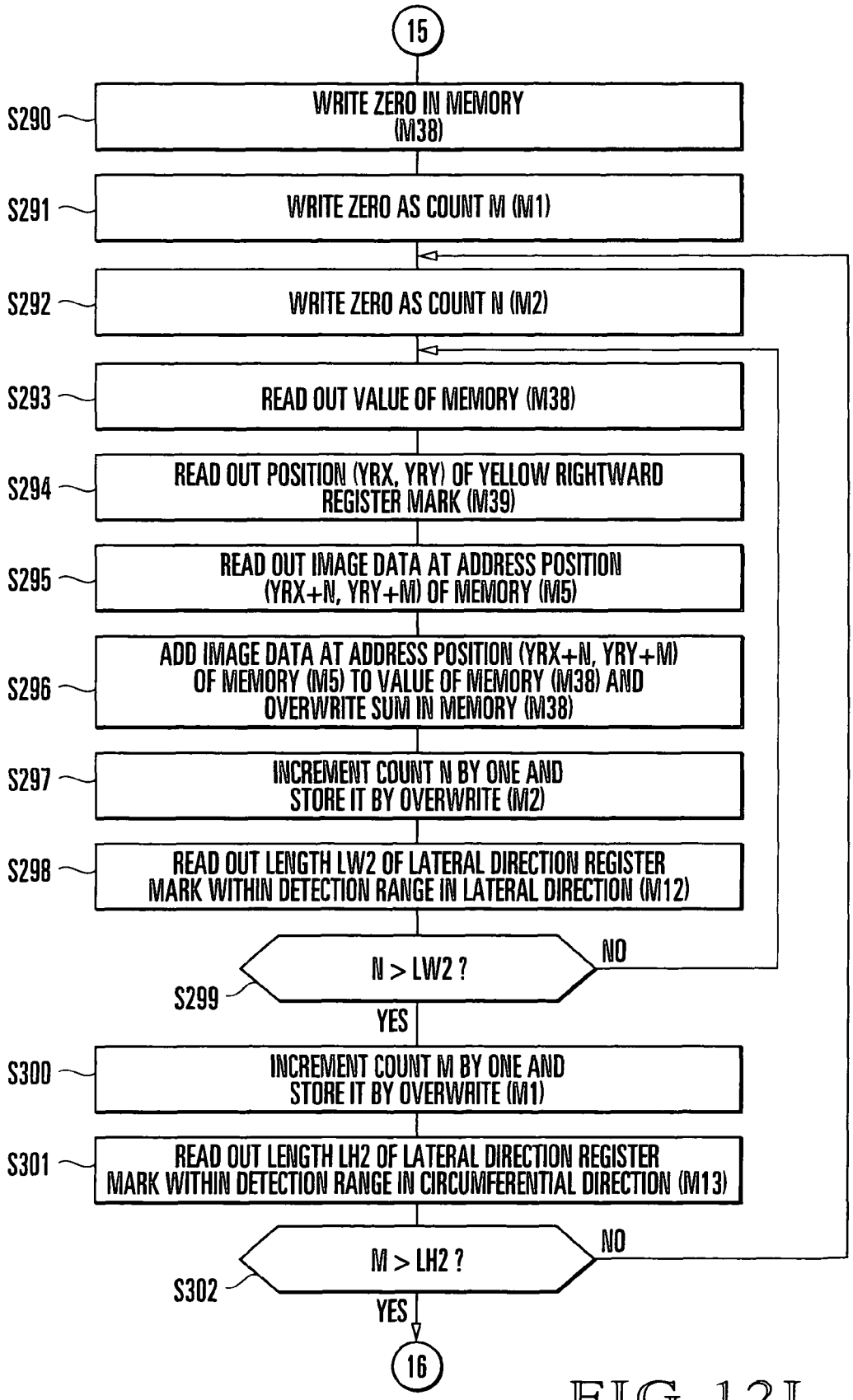

The CPU 1 performs the processes of steps S290 to S302 (FIG. 12L) corresponding to steps S186 to S198 shown in FIG. 12D, adds the pixel values of the B inspection target image of the rightward reference register mark MB4, on which a yellow rightward register mark (not shown) is printed to overlap, within the target range S, and stores the sum of the pixel values of the B inspection target image in the memory M38 as the density information on the yellow component within the target range S.

[Acquisition of Density Information on Yellow Component of Upward Reference Register Mark+Yellow Upward Register Mark within Target Range]

Figure 12M:
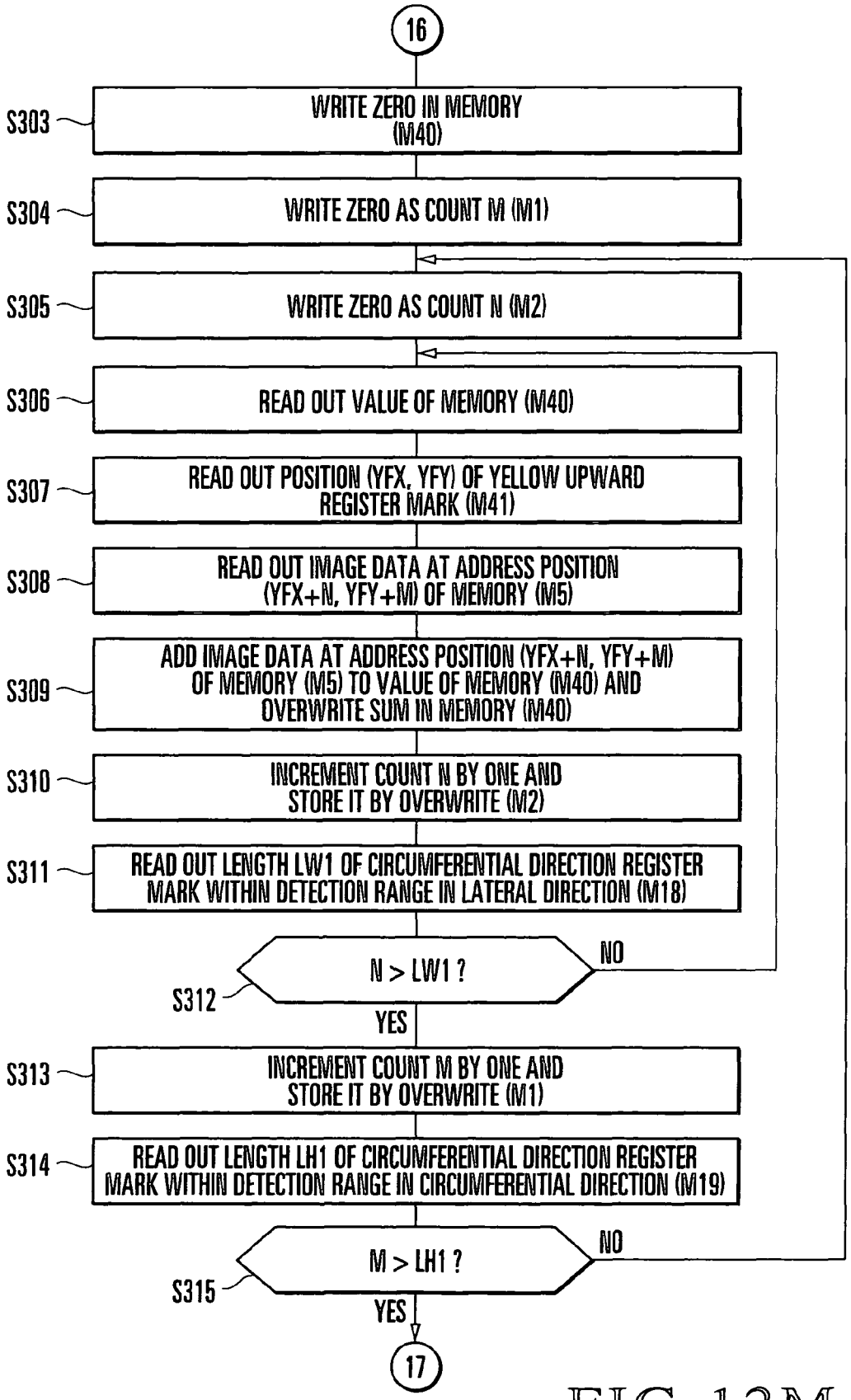

The CPU 1 performs the processes of steps S303 to S315 (FIG. 12M) corresponding to steps S199 to S211 shown in FIG. 12E, adds the pixel values of the B inspection target image of the upward reference register mark MB1, on which a yellow upward register mark (not shown) is printed to overlap, within the target range S, and stores the sum of the pixel values of the B inspection target image in the memory M40 as the density information on the yellow component within the target range S.

[Acquisition of Density Information on Yellow Component of Downward Reference Register Mark+Yellow Downward Register Mark within Target Range]

The CPU 1 performs the processes of steps S316 to S328 (FIG. 12N) corresponding to steps S212 to S224 shown in FIG. 12F, adds the pixel values of the B inspection target image of the downward reference register mark MB2, on which a yellow downward register mark (not shown) is printed to overlap, within the target range S, and stores the sum of the pixel values of the B inspection target image in the memory M42 as the density information on the yellow component within the target range S.

[Calculation of Misregister Amount]

[Calculation of Misregister Amount of Cyan in Lateral Direction]

The CPU 1 reads out the sum (the R value of the cyan leftward register mark) of the pixel values of the R inspection target image of the leftward reference register mark MB3, on which the cyan leftward register mark MC3 is printed to overlap, within the target range S from the memory M20 (step S329 in FIG. 13A) and the sum (the R value of the black lateral direction reference register mark) of the pixel values of the R inspection target image of the black lateral direction reference register mark MB34 within the target range S from the memory M8 (step S330), subtracts the value read out from the memory M8 from the value read out from the memory M20 to obtain the difference in R value of the cyan leftward register mark, and stores the difference in R value in the memory M44 (step S331).

The CPU 1 reads out a tolerance from the memory M45 (step S332) and compares it with the difference in R value of the cyan leftward register mark obtained in step S331 (step S333). If the difference in R value of the cyan leftward register mark exceeds the tolerance (YES in step S333), the CPU 1 reads out from the memory M46 the conversion table of the difference in R value of the cyan lateral direction register mark into the lateral direction misregister amount of the cyan printing unit (step S334), obtains a lateral direction misregister amount corresponding to the given difference in R value of the cyan leftward register mark from the readout table, and stores the obtained lateral direction misregister amount in the memory M47 as the leftward misregister amount of the cyan printing unit (step S335).

The CPU 1 reads out the sum (the R value of the cyan rightward register mark) of the pixel values of the R inspection target image of the rightward reference register mark MB4, on which the cyan rightward register mark MC4 is printed to overlap, within the target range S from the memory M22 (step S336) and the sum (the R value of the black lateral direction reference register mark) of the pixel values of the R inspection target image of the black lateral direction reference register mark MB34 within the target range S from the memory M8 (step S337), subtracts the value read out from the memory M8 from the value read out from the memory M22 to obtain the difference in R value of the cyan rightward register mark, and stores the difference in R value in the memory M48 (step S338).

The CPU 1 reads out the tolerance from the memory M45 (step S339) and compares it with the difference in R value of the cyan rightward register mark obtained in step S338 (step S340). If the difference in R value of the cyan rightward register mark exceeds the tolerance (YES in step S340), the CPU 1 reads out from the memory M46 the conversion table of the difference in R value of the cyan lateral direction register mark into the lateral direction misregister amount of the cyan printing unit (step S341), obtains a lateral direction misregister amount corresponding to the given difference in R value of the cyan rightward register mark from the readout table, and stores the obtained lateral direction misregister amount in the memory M49 as the rightward misregister amount of the cyan printing unit (step S342).

[Calculation of Misregister Amount of Cyan in Circumferential Direction]

The CPU 1 reads out the sum (the R value of the cyan upward register mark) of the pixel values of the R inspection target image of the upward reference register mark MB1, on which the cyan upward register mark MC1 is printed to overlap, within the target range S from the memory M24 (step S343 in FIG. 13B) and the sum (the R value of the black circumferential direction reference register mark) of the pixel values of the R inspection target image of the black circumferential direction reference register mark MB12 within the target range S from the memory M14 (step S344), subtracts the value read out from the memory M14 from the value read out from the memory M24 to obtain the difference in R value of the cyan upward register mark, and stores the difference in R value in the memory M50 (step S345).

The CPU 1 reads out a tolerance from the memory M51 (step S346) and compares it with the difference in R value of the cyan upward register mark obtained in step S345 (step S347). If the difference in R value of the cyan upward register mark exceeds the tolerance (YES in step S347), the CPU 1 reads out from the memory M52 the conversion table of the difference in R value of the cyan circumferential direction register mark into the circumferential direction misregister amount of the cyan printing unit (step S348), obtains a circumferential direction misregister amount corresponding to the given difference in R value of the cyan upward register mark from the readout table, and stores the obtained circumferential direction misregister amount in the memory M53 as the upward misregister amount of the cyan printing unit (step S349).

The CPU 1 reads out the sum (the R value of the cyan downward register mark) of the pixel values of the R inspection target image of the downward reference register mark MB2, on which the cyan downward register mark MC2 is printed to overlap, within the target range S from the memory M26 (step S350) and the sum (the R value of the black circumferential direction reference register mark) of the pixel values of the R inspection target image of the black circumferential direction reference register mark MB12 within the target range S from the memory M14 (step S351), subtracts the value read out from the memory M14 from the value read out from the memory M26 to obtain the difference in R value of the cyan downward register mark, and stores the difference in R value in the memory M54 (step S352).

The CPU 1 reads out the tolerance from the memory M51 (step S353) and compares it with the difference in R value of the cyan downward register mark obtained in step S352 (step S354). If the difference in R value of the cyan downward register mark exceeds the tolerance (YES in step S354), the CPU 1 reads out from the memory M52 the conversion table of the difference in R value of the cyan circumferential direction register mark into the circumferential direction misregister amount of the cyan printing unit (step S355), obtains a circumferential direction misregister amount corresponding to the given difference in R value of the cyan downward register mark from the readout table, and stores the obtained circumferential direction misregister amount in the memory M55 as the downward misregister amount of the cyan printing unit (step S356).

[Calculation of Magenta Lateral Direction Misregister Amount]

Figure 13A:
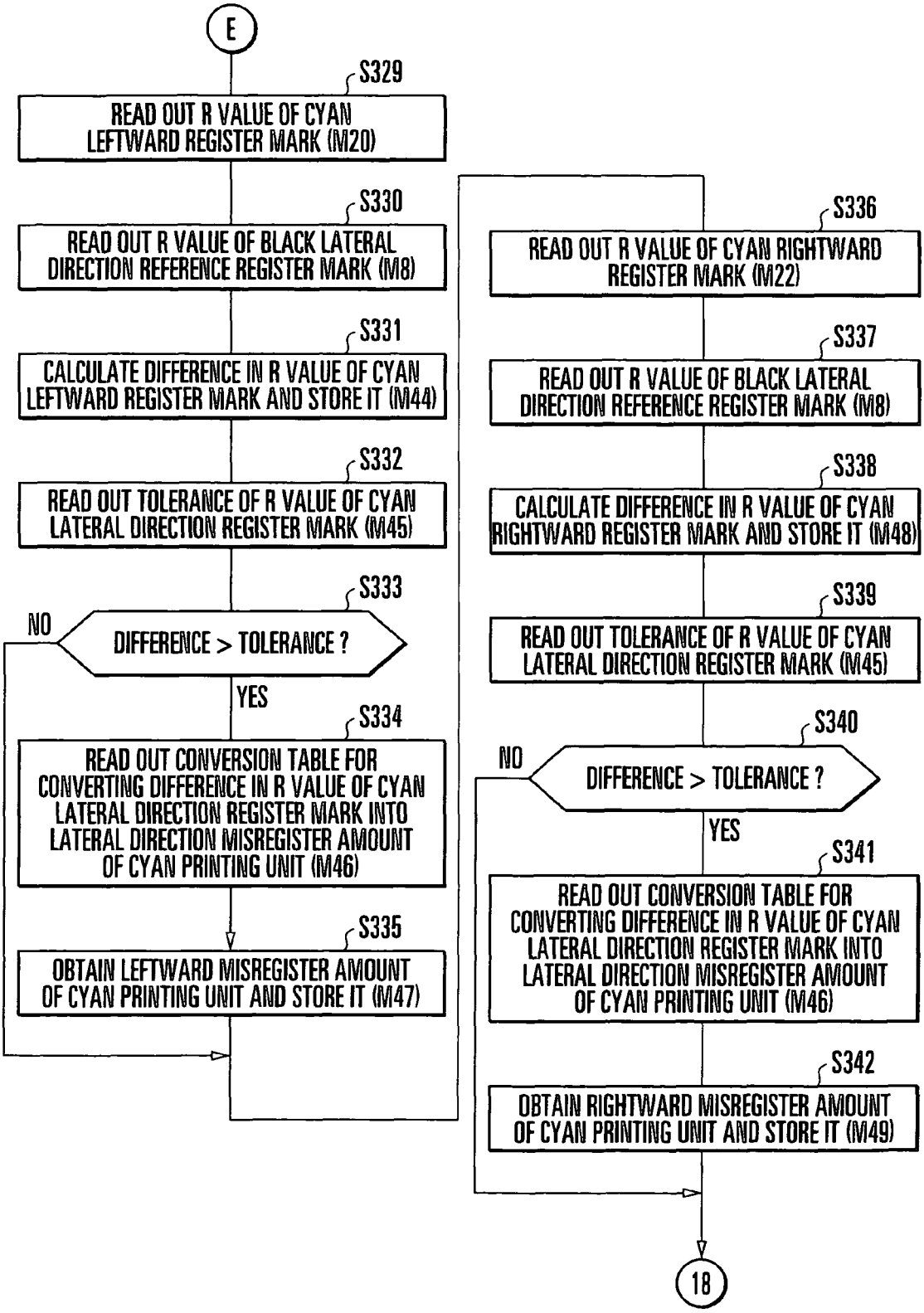
FIGS. 13A to 13F are flowcharts showing the processes, subsequent to the processes shown in FIGS. 12A to 12N, of calculating a misregister amount.

The CPU 1 performs the processes of steps S357 to S370 (FIG. 13C) corresponding to steps S329 to S342 shown in FIG. 13A. The CPU 1 thus obtains a leftward misregister amount corresponding to the difference in G value of the magenta leftward register mark and stores it in the memory M59, and obtains a rightward misregister amount corresponding to the difference in G value of the magenta rightward register mark and stores it in the memory M61.

[Calculation of Magenta Circumferential Direction Misregister Amount]

Figure 13B:
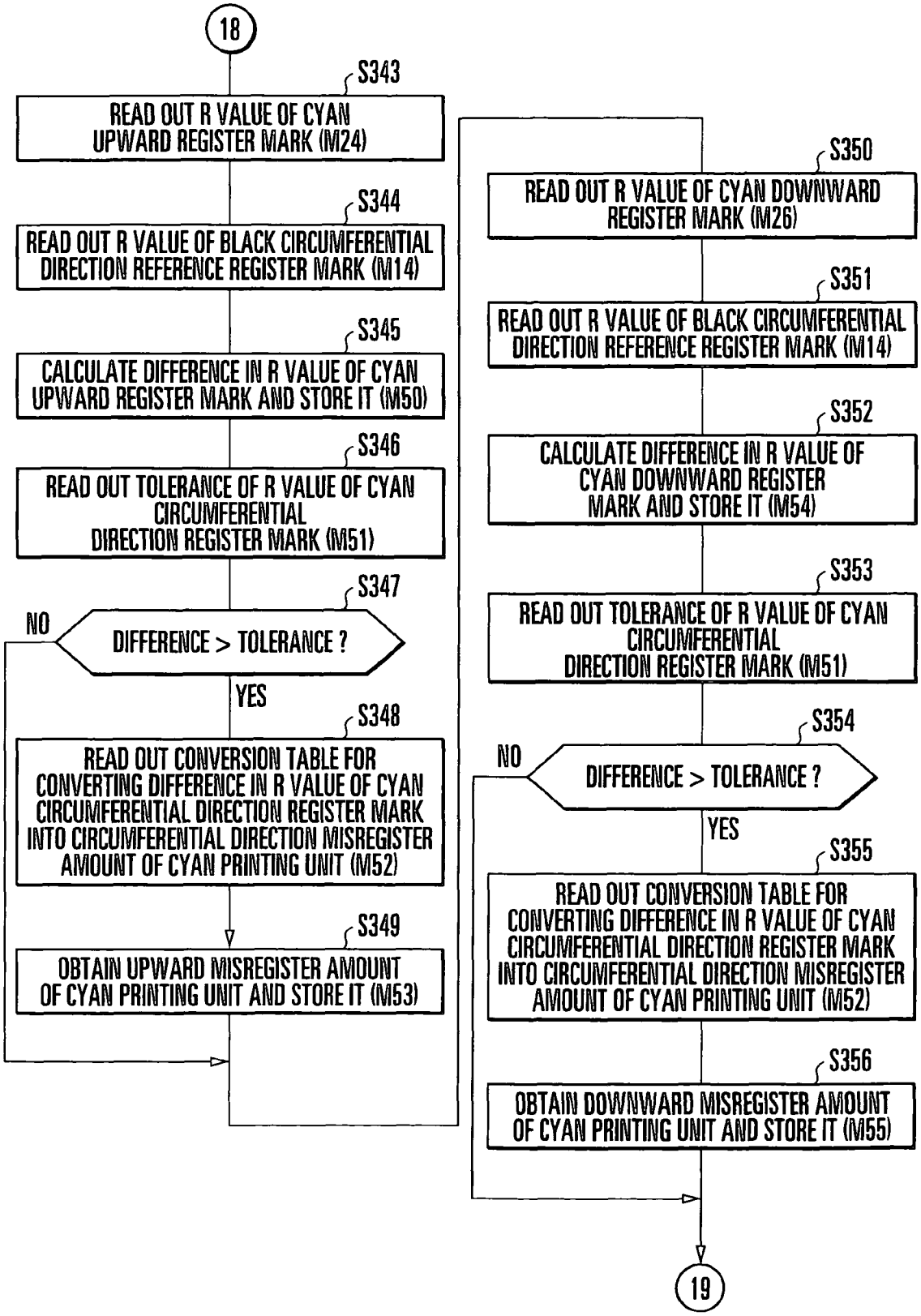
Figure 13C:
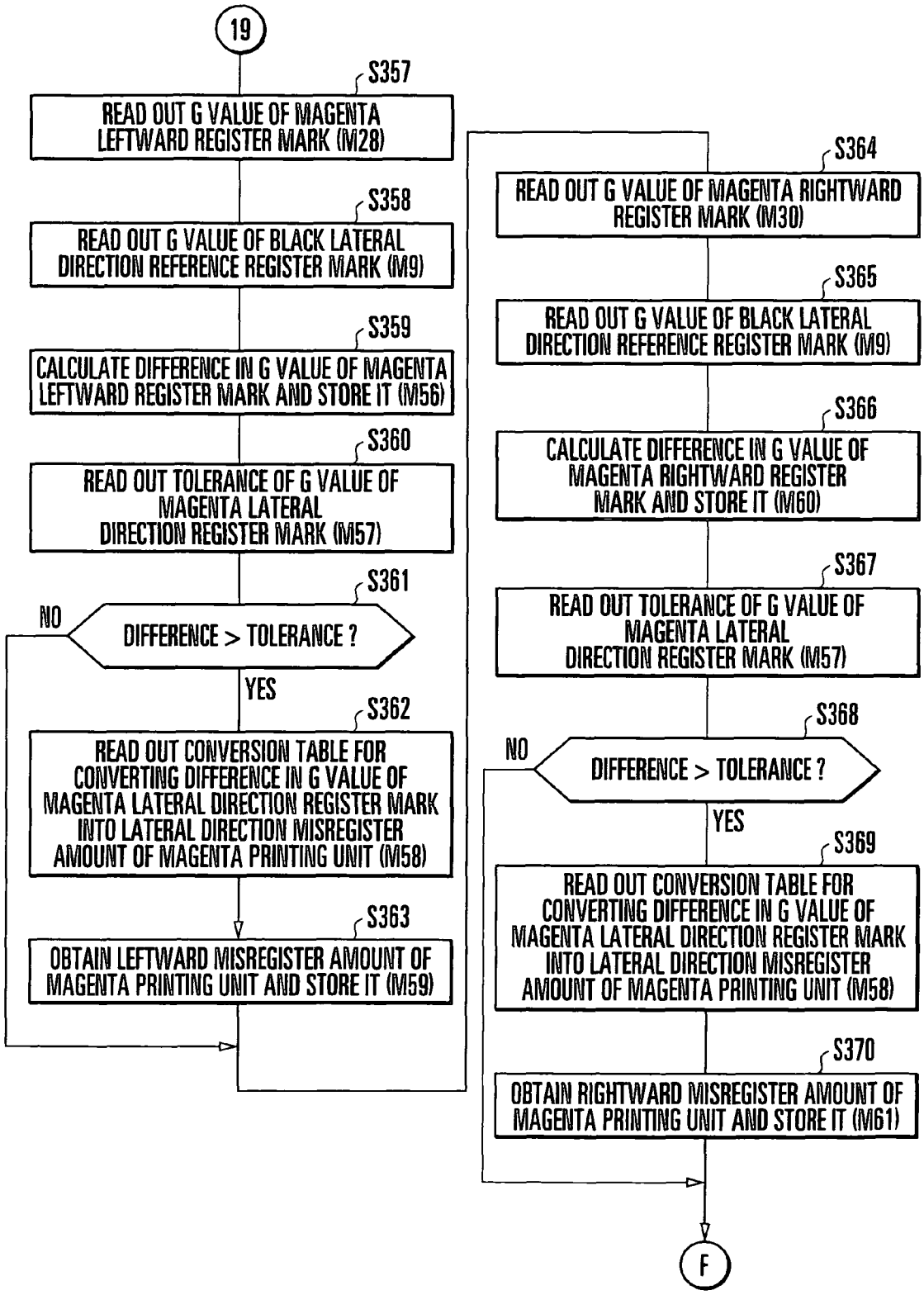
Figure 13D:
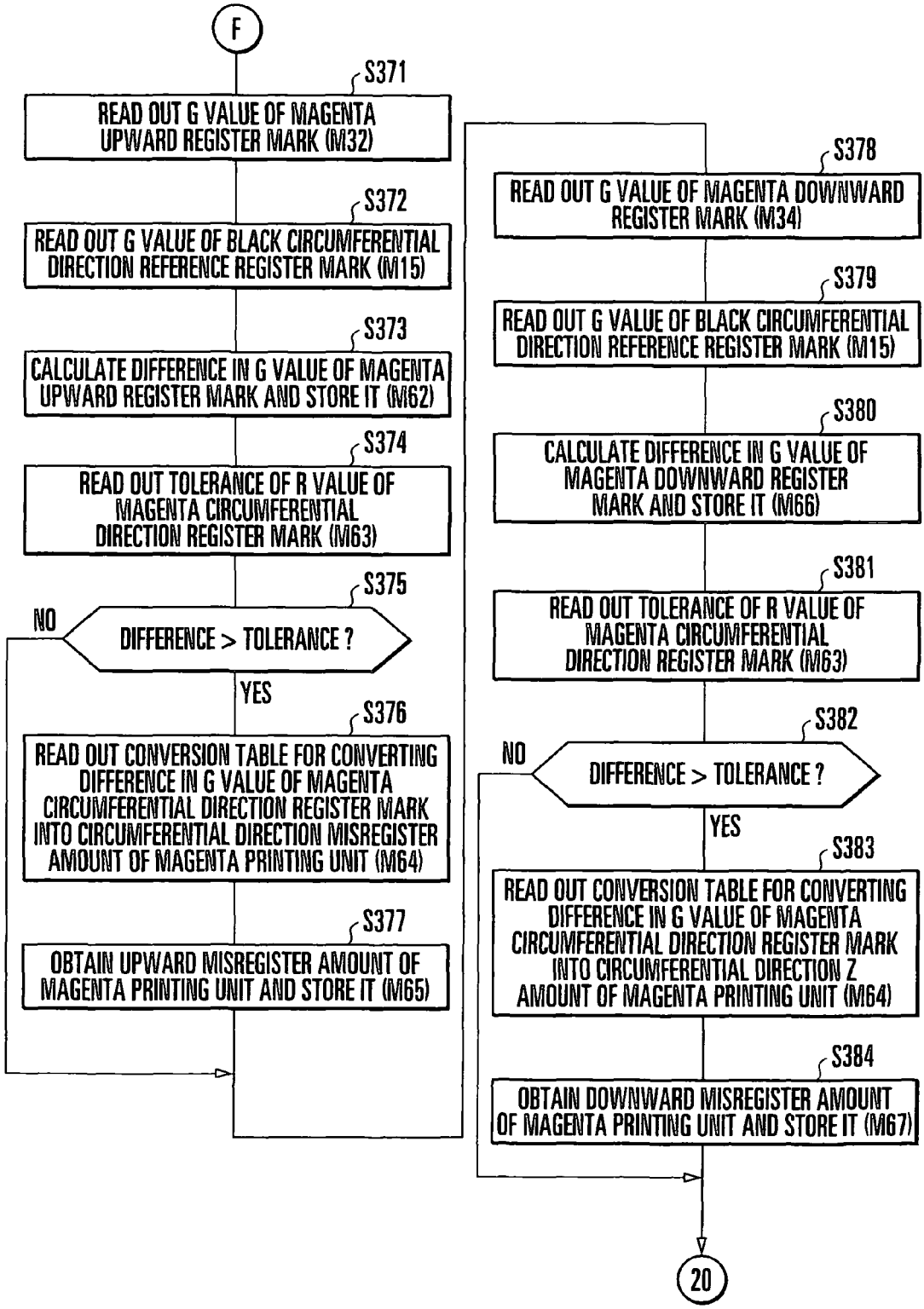

The CPU 1 performs the processes of steps S371 to S384 (FIG. 13D) corresponding to steps S343 to S356 shown in FIG. 13B. The CPU 1 thus obtains an upward misregister amount corresponding to the difference in G value of the magenta upward register mark and stores it in the memory M65, and obtains a downward misregister amount corresponding to the difference in G value of the magenta downward register mark and stores it in the memory M67.

[Calculation of Yellow Lateral Direction Misregister Amount]

Figure 13E:
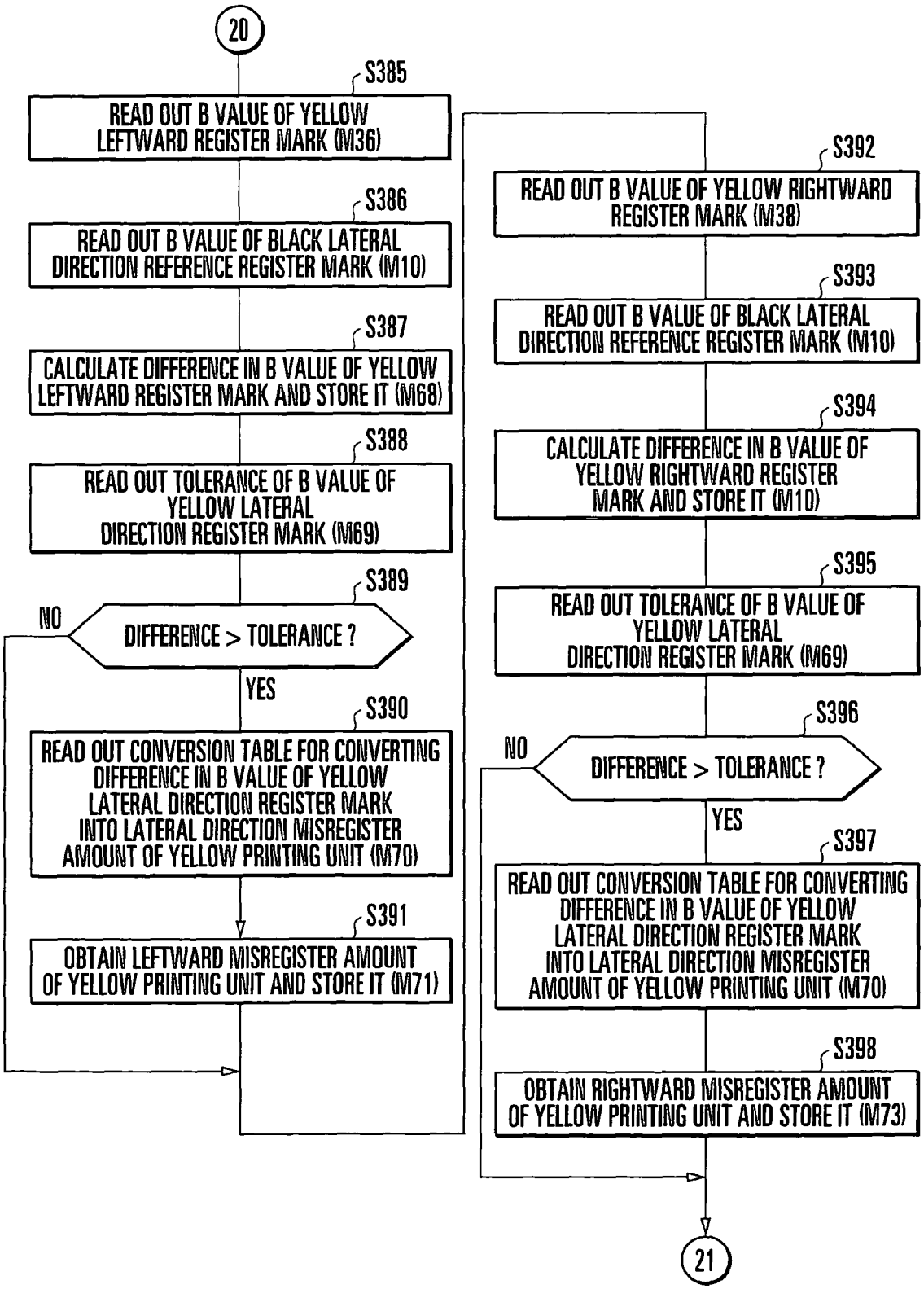

The CPU 1 performs the processes of steps S385 to S398 (FIG. 13E) corresponding to steps S329 to S342 shown in FIG. 13A. The CPU 1 thus obtains a leftward misregister amount corresponding to the difference in B value of the yellow leftward register mark and stores it in the memory M71, and obtains a rightward misregister amount corresponding to the difference in B value of the yellow rightward register mark and stores it in the memory M73.

[Calculation of Yellow Circumferential Direction Misregister Amount]

Figure 13F:
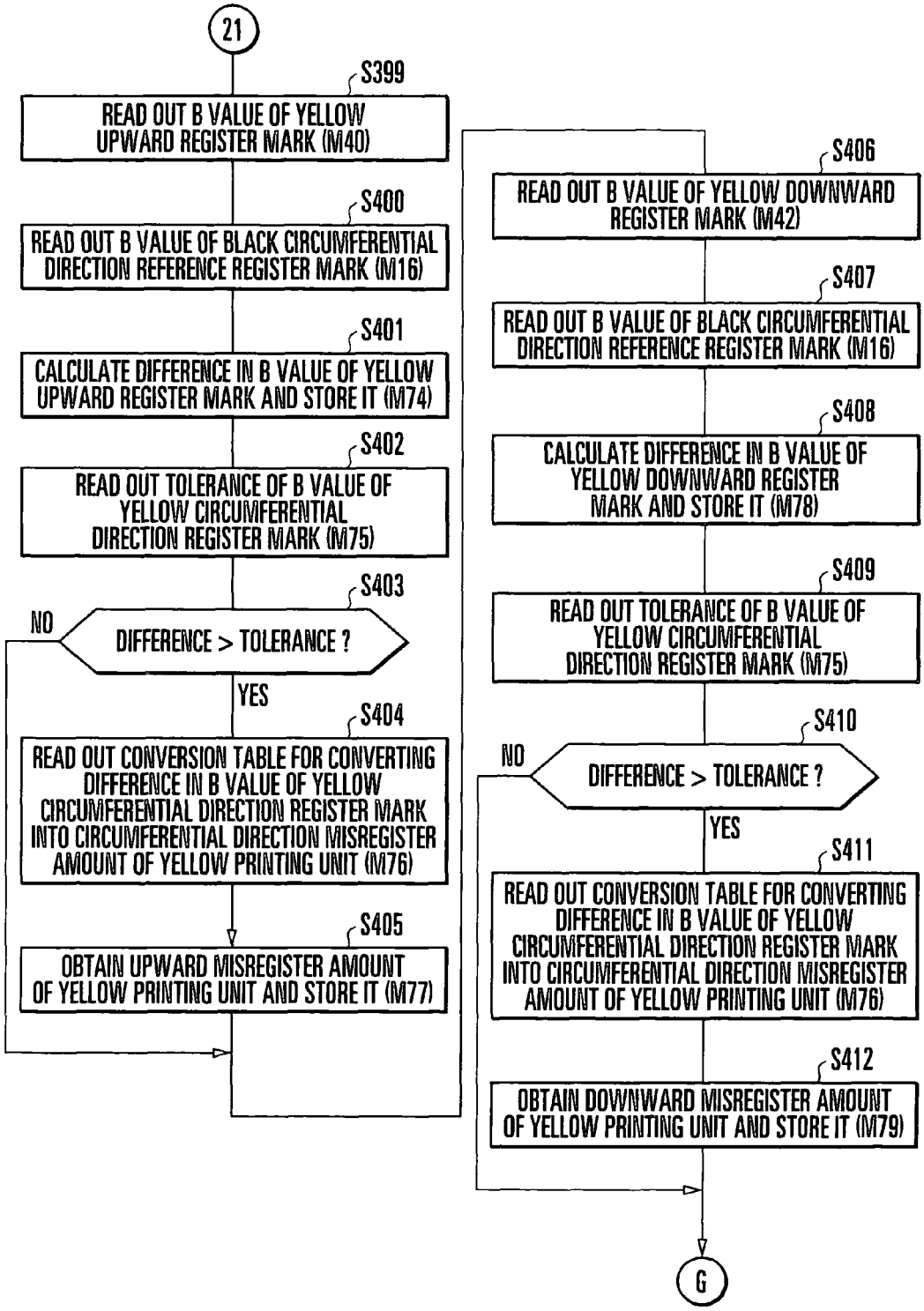

The CPU 1 performs the processes of steps S399 to S412 (FIG. 13F) corresponding to steps S343 to S356 shown in FIG. 13B. The CPU 1 thus obtains an upward misregister amount corresponding to the difference in B value of the yellow upward register mark and stores it in the memory M77, and obtains a downward misregister amount corresponding to the difference in B value of the yellow downward register mark and stores it in the memory M79.

[Adjustment of Registration Position]

On the basis of the misregister amount obtained in the above manner, the CPU 1 adjusts the registration position of the plate in the lateral direction and circumferential direction in each of the cyan, magenta, and yellow printing units. The adjustment of the registration position is performed in the following manner.

Figure 14A:
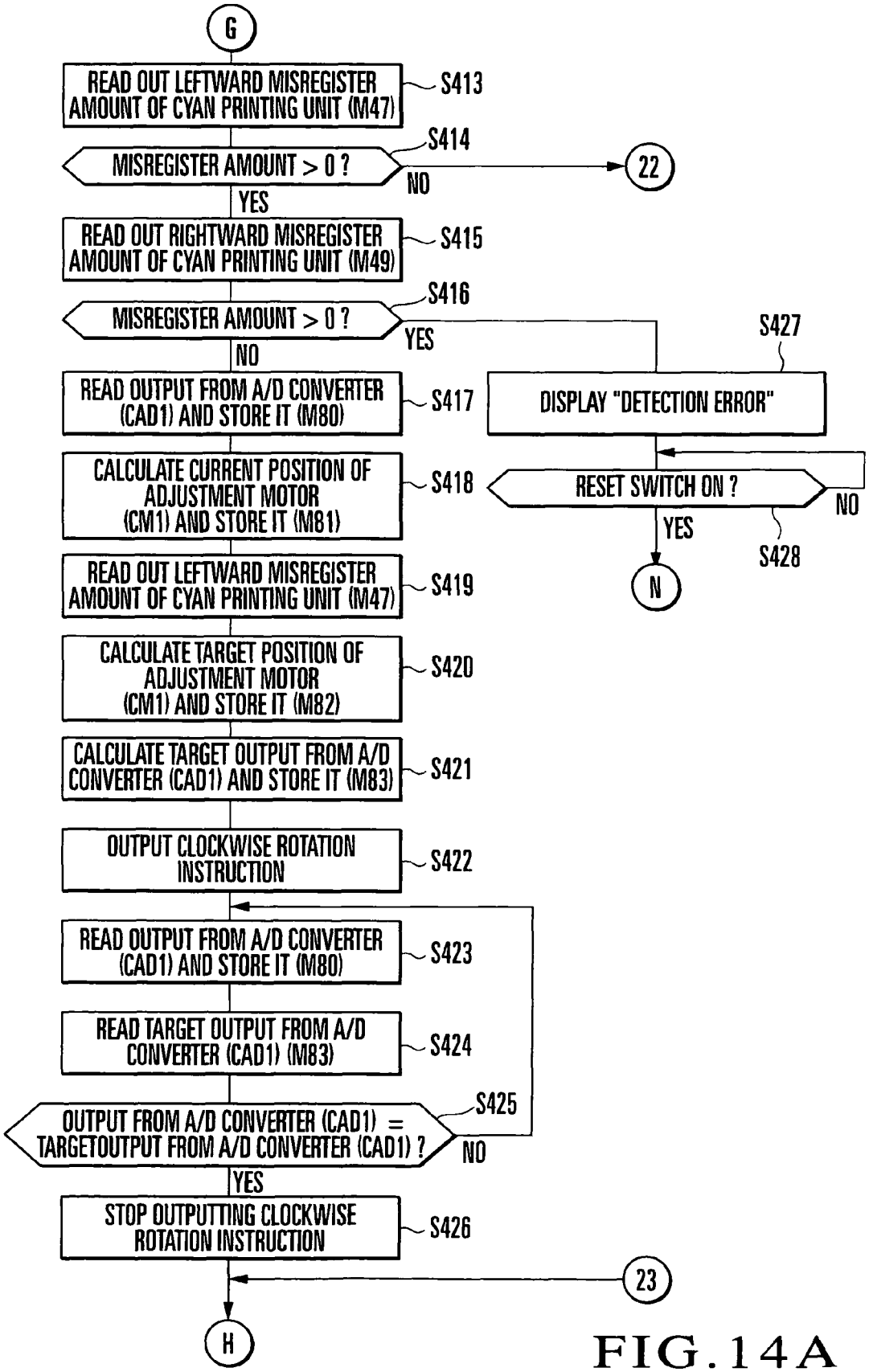
FIGS. 14A to 14L are flowcharts showing the processes, subsequent to the processes shown in FIGS. 13A to 13F, of adjusting a registration position.

First, the CPU 1 reads out the leftward misregister amount of the cyan printing unit from the memory M47 (step S413 in FIG. 14A). If the leftward misregister amount of the cyan printing unit is larger than zero (YES in step S414), the CPU 1 reads out the rightward misregister amount of the cyan printing unit from the memory M49 (step S415).

Figure 11A:
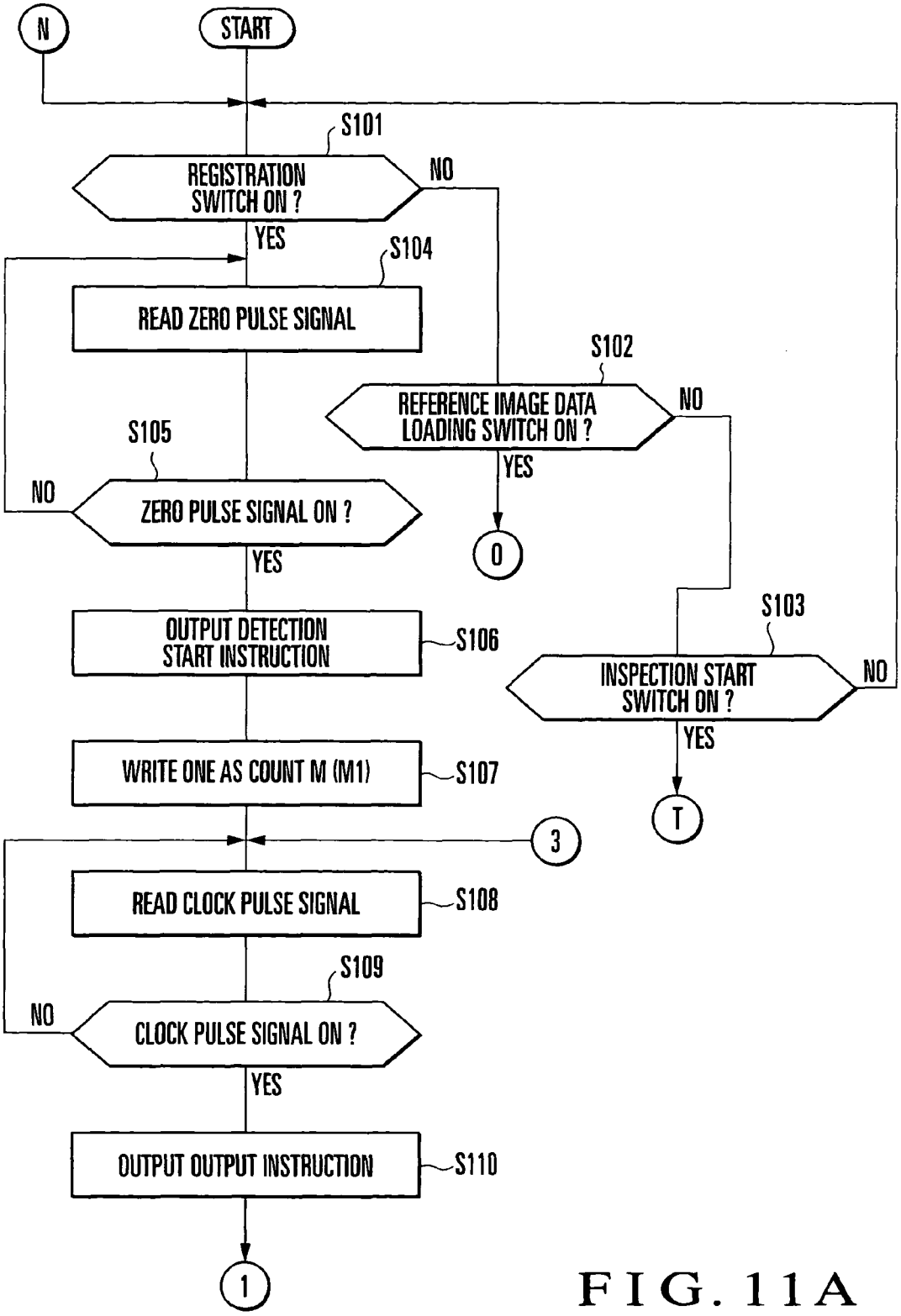
FIGS. 11A to 11C are flowcharts showing the processes of loading an inspection target image for the purpose of registration in the first embodiment.
Figure 11B:
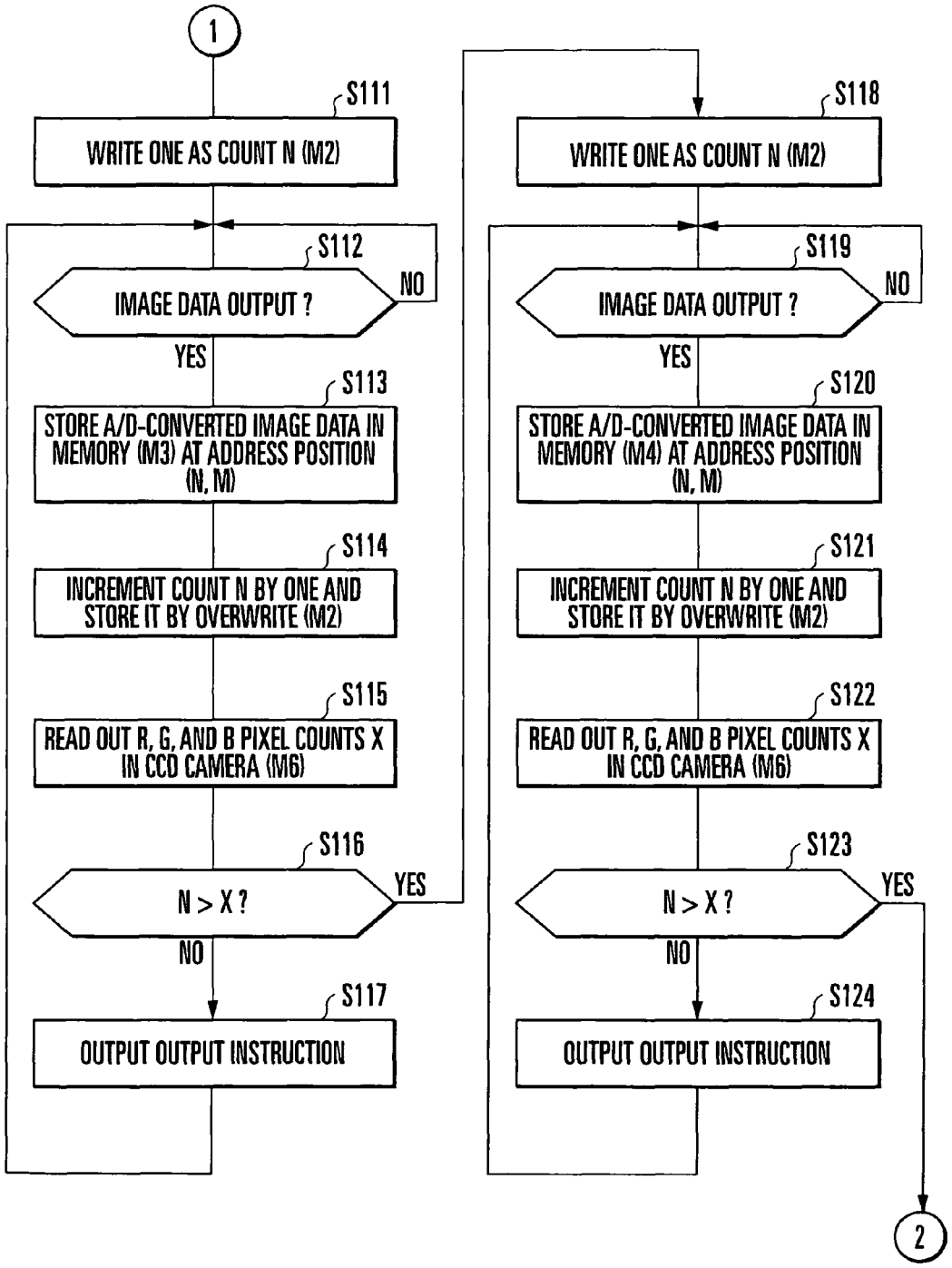
Figure 11C:
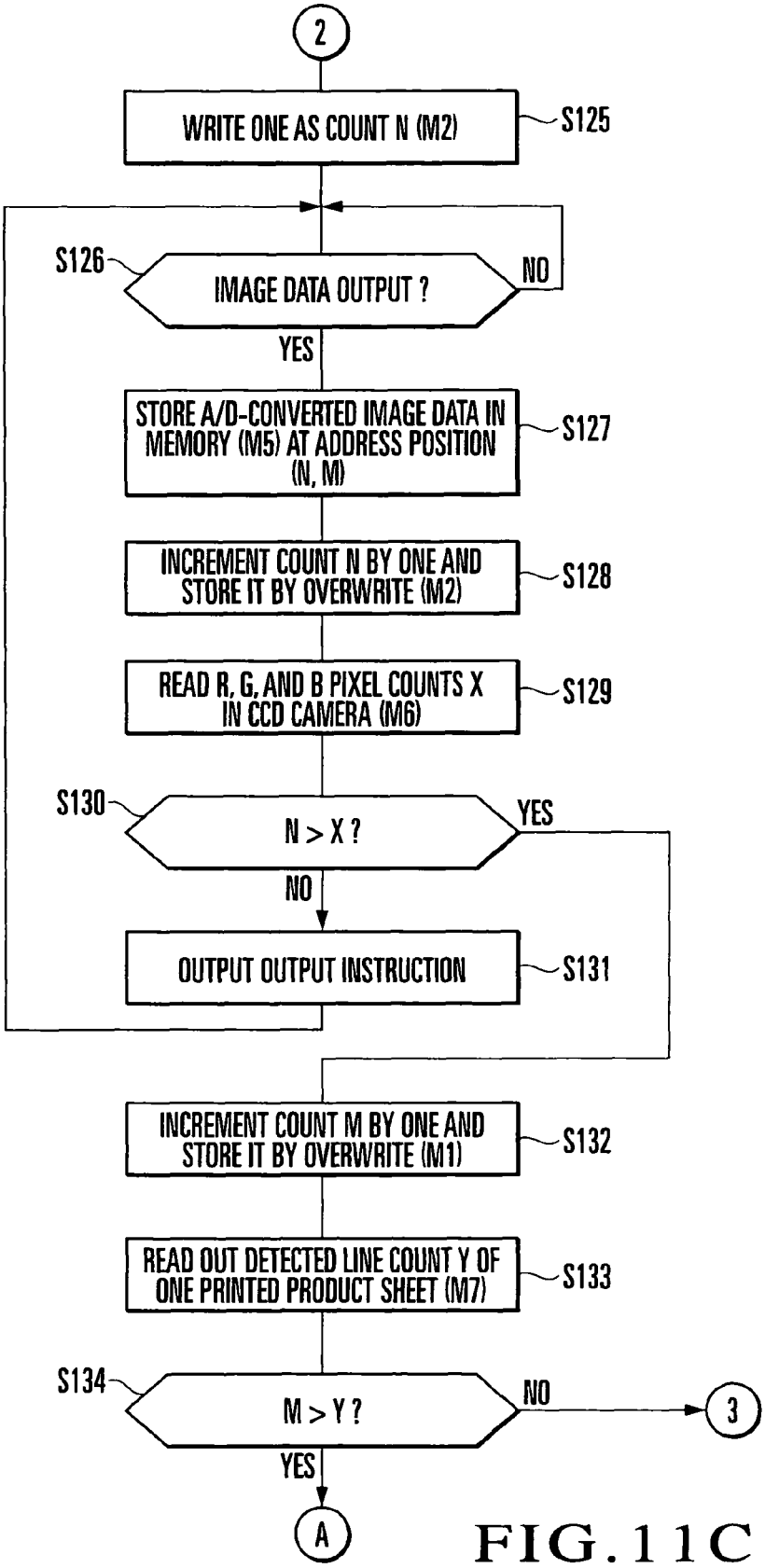

If the rightward misregister amount of the cyan printing unit is larger than zero (YES in step S416), "Detection Error" is displayed on the display 9 (step S427), and the process is interrupted. In this case, when the reset switch 7 is turned on (YES in step S428), the process returns to step S101 (FIG. 11A).

[Adjustment of Leftward Registration Position of Cyan Printing Unit]

If the rightward misregister amount of the cyan printing unit is not larger than zero (NO in step S416), that is, of the lateral direction misregister amounts of the cyan printing unit, if only the leftward misregister amount is larger than zero, the CPU 1 reads the output from the A/D converter CAD1 in the plate registration adjustment unit 14C of the cyan printing unit (step S417), and obtains the current position of the lateral direction registration adjustment motor CM1 for the cyan printing unit from the read output (step S418). The CPU 1 then reads out the leftward misregister amount of the cyan printing unit from the memory M47 (step S419), and adds the leftward misregister amount of the cyan printing unit to the current position of the lateral direction registration adjustment motor CM1 for the cyan printing unit to obtain the target position of the lateral direction registration adjustment motor CM1 for the cyan printing unit (step S420).

The CPU 1 calculates the target output of the A/D converter CAD1 from the target position of the lateral direction registration adjustment motor CM1 for the cyan printing unit (step S421), sends a clockwise rotation instruction to the lateral direction registration adjustment motor driver CMD1 for the cyan printing unit (step S422), and reads the output value of the A/D converter CAD1 connected to the lateral direction registration adjustment motor potentiometer CPT1 for the cyan printing unit (step S423). The CPU 1 also reads the target output from the A/D converter CAD1 (step S424). When the output value of the A/D converter CAD1 connected to the lateral direction registration adjustment motor potentiometer CPT1 for the cyan printing unit becomes equal to the target output from the A/D converter CAD1 (YES in step S425), the CPU 1 stops outputting the clockwise rotation instruction to the lateral direction registration adjustment motor driver CMD1 for the cyan printing unit (step S426). Thus, the leftward registration position of the cyan printing unit is adjusted, and its misregister amount falls within the tolerance range.

[Adjustment of Rightward Registration Position of Cyan Printing Unit]

Figure 14B:
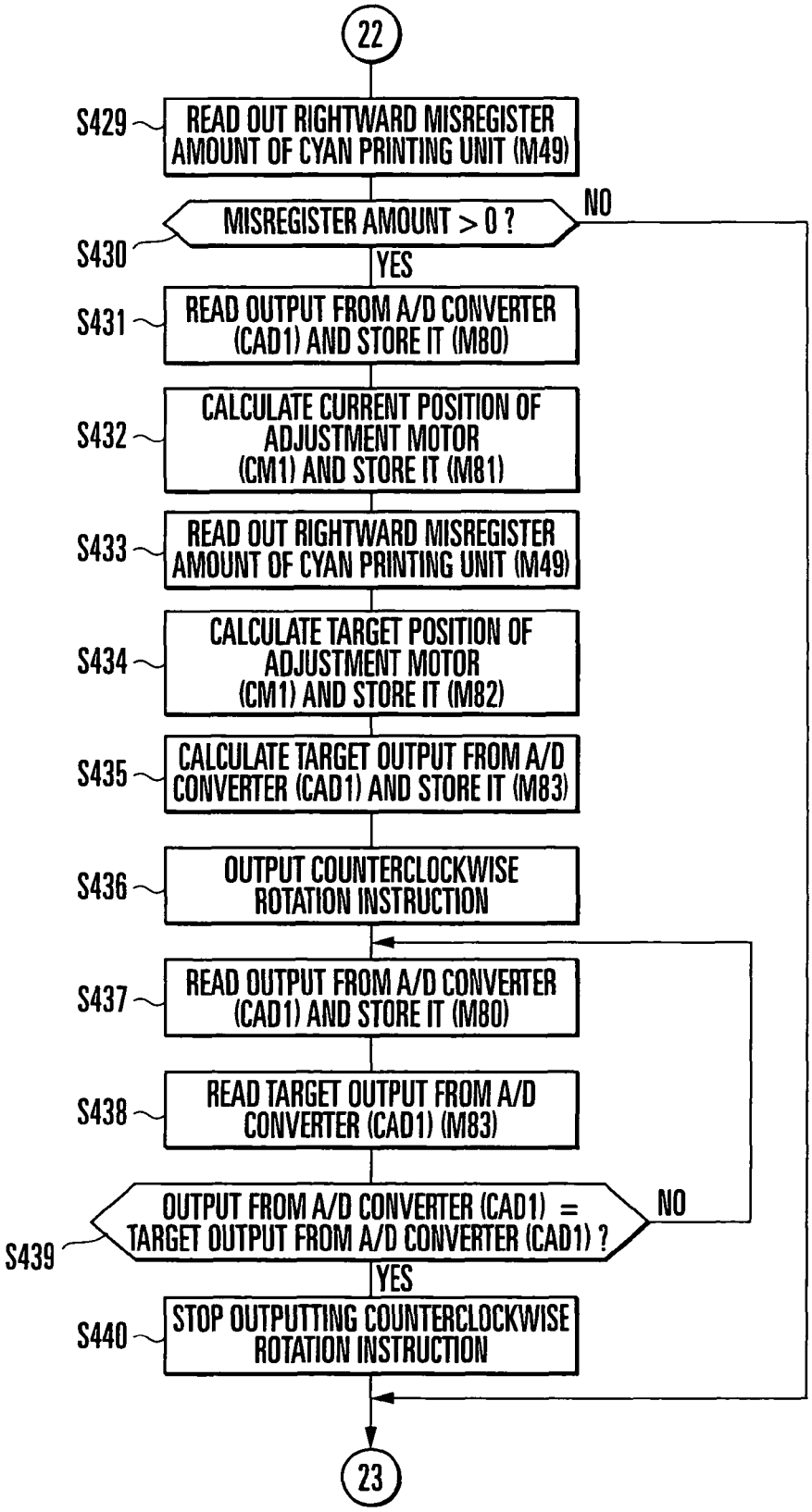

If the leftward misregister amount of the cyan printing unit is not larger than zero (No in step S414), the CPU 1 reads out the rightward misregister amount of the cyan printing unit from the memory M49 (step S429 in FIG. 14B). If the rightward misregister amount of the cyan printing unit is larger than zero (YES in step S430), that is, of the lateral direction misregister amounts of the cyan printing unit, if only the rightward misregister amount is larger than zero, the CPU 1 reads the output from the A/D converter CAD1 in the plate registration adjustment unit 14C of the cyan printing unit (step S431), and obtains the current position of the lateral direction registration adjustment motor CM1 for the cyan printing unit from the read output (step S432). The CPU 1 then reads out the rightward misregister amount of the cyan printing unit from the memory M49 (step S433), and subtracts the rightward misregister amount of the cyan printing unit from the current position of the lateral direction registration adjustment motor CM1 for the cyan printing unit to obtain the target position of the lateral direction registration adjustment motor CM1 for the cyan printing unit (step S434).

The CPU 1 calculates the target output of the A/D converter CAD1 from the target position of the lateral direction registration adjustment motor CM1 for the cyan printing unit (step S435), sends a counterclockwise rotation instruction to the lateral direction registration adjustment motor driver CMD1 for the cyan printing unit (step S436), and reads the output value of the A/D converter CAD1 connected to the lateral direction registration adjustment motor potentiometer CPT1 for the cyan printing unit (step S437). The CPU 1 also reads the target output from the A/D converter CAD1 (step S438). When the output value of the A/D converter CAD1 connected to the lateral direction registration adjustment motor potentiometer CPT1 for the cyan printing unit becomes equal to the target output from the A/D converter CAD1 (YES in step S439), the CPU 1 stops outputting the counterclockwise rotation instruction to the lateral direction registration adjustment motor driver CMD1 for the cyan printing unit (step S440). Thus, the rightward registration position of the cyan printing unit is adjusted, and its misregister amount falls within the tolerance range.

Figure 14C:
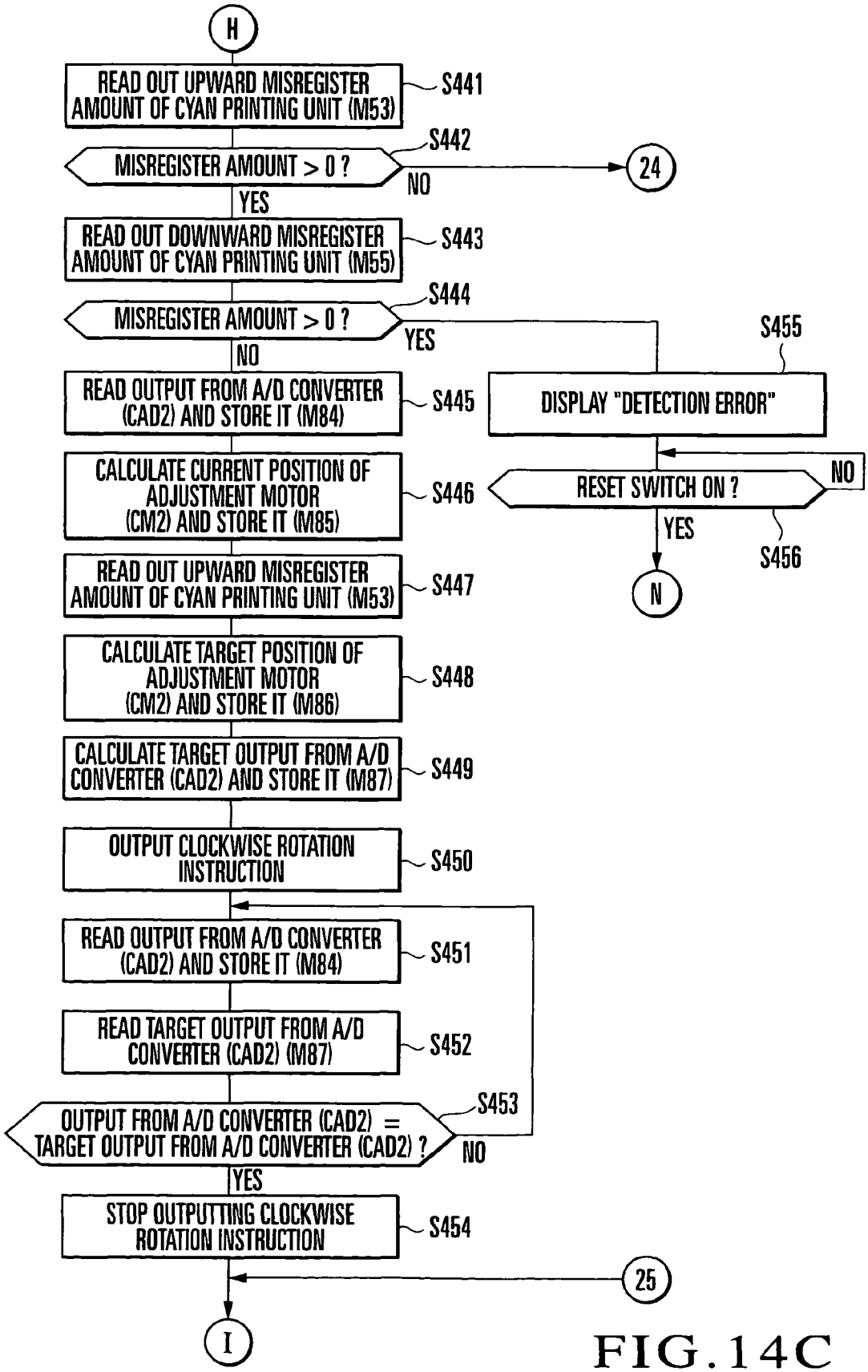

Next, the CPU 1 reads out the upward misregister amount of the cyan printing unit from the memory M53 (step S441 in FIG. 14C). If the upward misregister amount of the cyan printing unit is larger than zero (YES in step S442), the CPU 1 reads out the downward misregister amount of the cyan printing unit from the memory M55 (step S443).

If the downward misregister amount of the cyan printing unit is larger than zero (YES in step S444), "Detection Error" is displayed on the display 9 (step S455), and the process is interrupted. In this case, when the reset switch 7 is turned on (YES in step S456), the process returns to step S101 (FIG. 11A).

[Adjustment of Upward Registration Position of Cyan Printing Unit]

If the downward misregister amount of the cyan printing unit is not larger than zero (NO in step S444), that is, of the circumferential direction misregister amounts of the cyan printing unit, if only the upward misregister amount is larger than zero, the CPU 1 reads the output from the A/D converter CAD2 in the plate registration adjustment unit 14C of the cyan printing unit (step S445), and obtains the current position of the circumferential direction registration adjustment motor CM2 for the cyan printing unit from the read output (step S446). The CPU 1 then reads out the upward misregister amount of the cyan printing unit from the memory M53 (step S447), and adds the upward misregister amount of the cyan printing unit to the current position of the circumferential direction registration adjustment motor CM2 for the cyan printing unit to obtain the target position of the circumferential direction registration adjustment motor CM2 for the cyan printing unit (step S448).

The CPU 1 calculates the target output of the A/D converter CAD2 from the target position of the circumferential direction registration adjustment motor CM2 for the cyan printing unit (step S449), sends a clockwise rotation instruction to the circumferential direction registration adjustment motor driver CMD2 for the cyan printing unit (step S450), and reads the output value of the A/D converter CAD2 connected to the circumferential direction registration adjustment motor potentiometer CPT2 for the cyan printing unit (step S451). The CPU 1 also reads the target output from the A/D converter CAD2 (step S452). When the output value of the A/D converter CAD2 connected to the circumferential direction registration adjustment motor potentiometer CPT2 for the cyan printing unit becomes equal to the target output from the A/D converter CAD2 (YES in step S453), the CPU 1 stops outputting the clockwise rotation instruction to the circumferential direction registration adjustment motor driver CMD2 for the cyan printing unit (step S454). Thus, the upward registration position of the cyan printing unit is adjusted, and its misregister amount falls within the tolerance range.

[Adjustment of Downward Registration Position of Cyan Printing Unit]

Figure 14D:
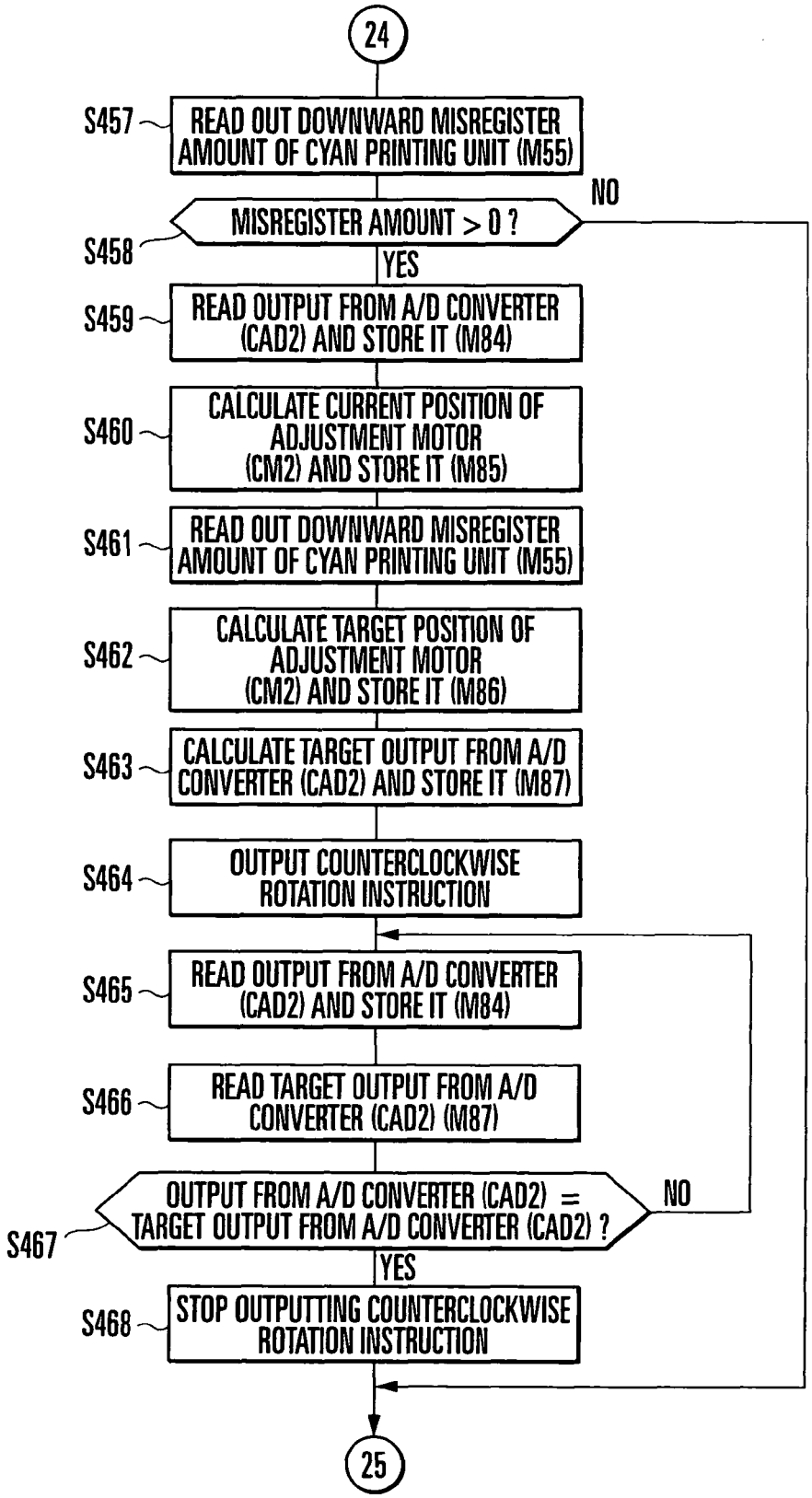

If the upward misregister amount of the cyan printing unit is not larger than zero (No in step S442), the CPU 1 reads out the downward misregister amount of the cyan printing unit from the memory M55 (step S457 in FIG. 14D). If the downward misregister amount of the cyan printing unit is larger than zero (YES in step S458), that is, of the circumferential direction misregister amounts of the cyan printing unit, if only the downward misregister amount is larger than zero, the CPU 1 reads the output from the A/D converter CAD2 in the plate registration adjustment unit 14C of the cyan printing unit (step S459), and obtains the current position of the circumferential direction registration adjustment motor CM2 for the cyan printing unit from the read output (step S460). The CPU 1 then reads out the downward misregister amount of the cyan printing unit from the memory M55 (step S461), and subtracts the downward misregister amount of the cyan printing unit from the current position of the circumferential direction registration adjustment motor CM2 for the cyan printing unit to obtain the target position of the circumferential direction registration adjustment motor CM2 for the cyan printing unit (step S462).

The CPU 1 calculates the target output of the A/D converter CAD2 from the target position of the circumferential direction registration adjustment motor CM2 for the cyan printing unit (step S463), sends a counterclockwise rotation instruction to the circumferential direction registration adjustment motor driver CMD2 for the cyan printing unit (step S464), and reads the output value of the A/D converter CAD2 connected to the circumferential direction registration adjustment motor potentiometer CPT2 for the cyan printing unit (step S465). The CPU 1 also reads the target output from the A/D converter CAD2 (step S466). When the output value of the A/D converter CAD2 connected to the circumferential direction registration adjustment motor potentiometer CPT2 for the cyan printing unit becomes equal to the target output from the A/D converter CAD2 (YES in step S467), the CPU 1 stops outputting the counterclockwise rotation instruction to the circumferential direction registration adjustment motor driver CMD2 for the cyan printing unit (step S468). Thus, the downward registration position of the cyan printing unit is adjusted, and its misregister amount falls within the tolerance range.

[Adjustment of Registration Position of Magenta Printing Unit]

Figure 14E:
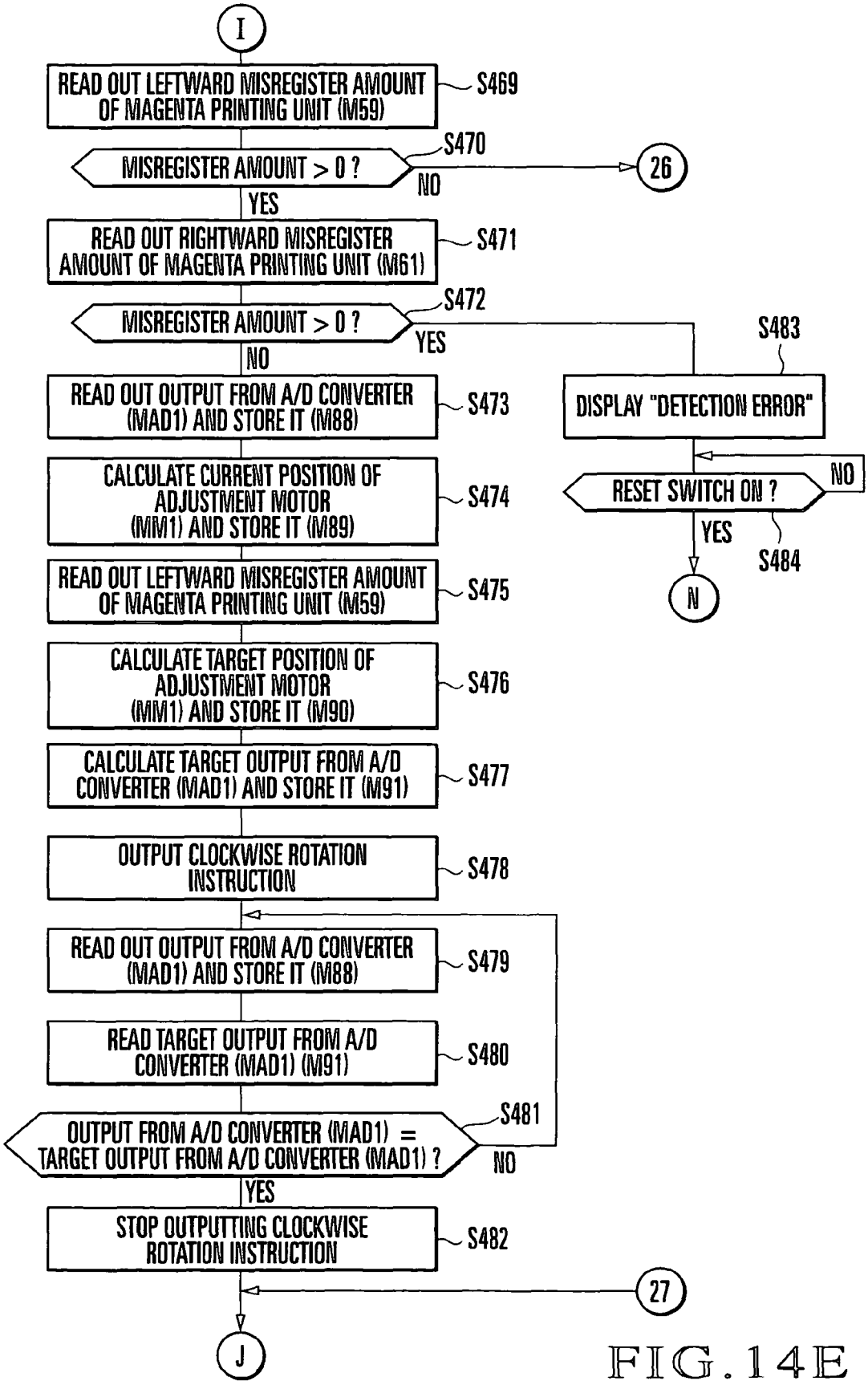
Figure 14F:
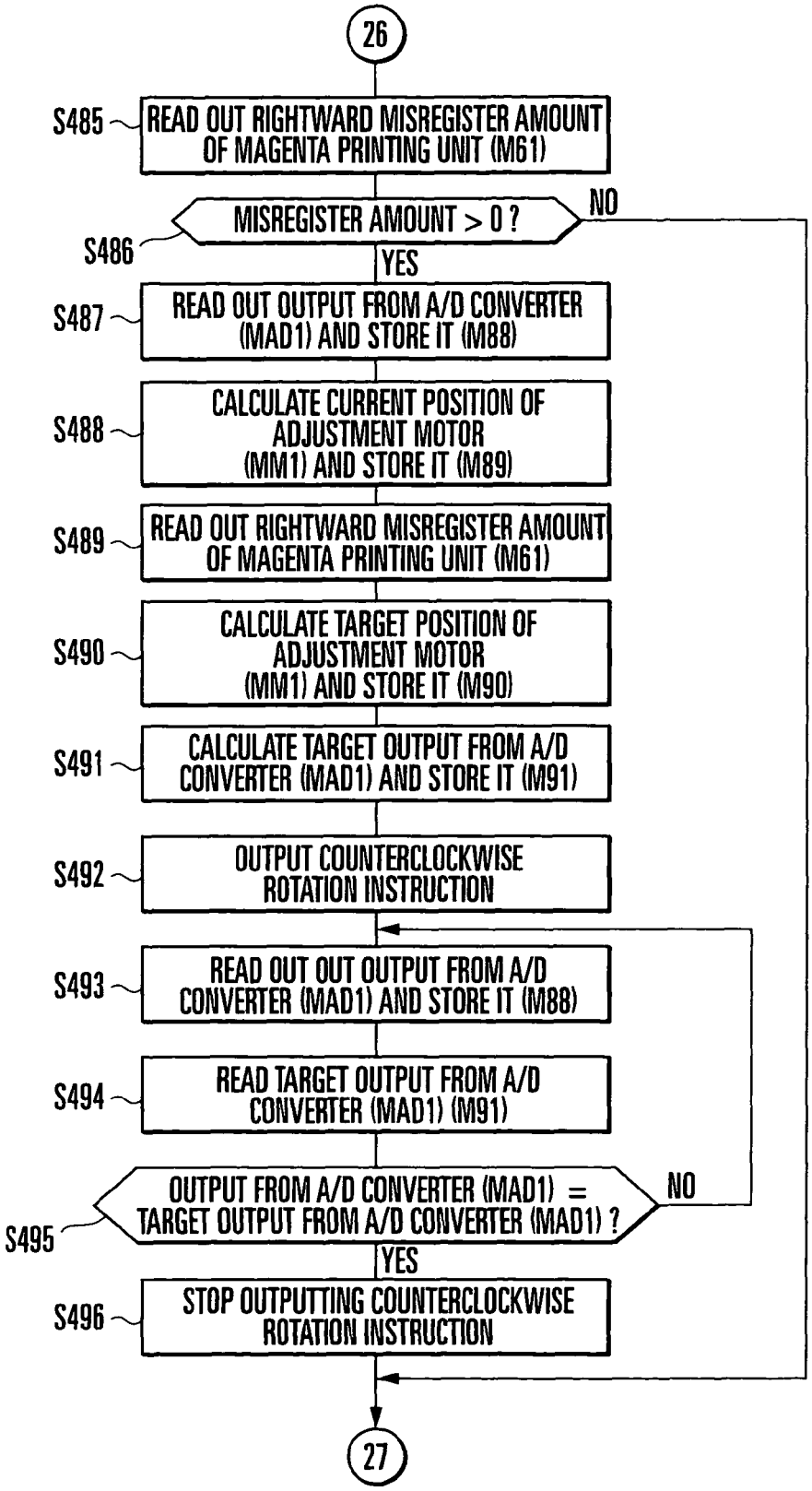
Figure 14G:
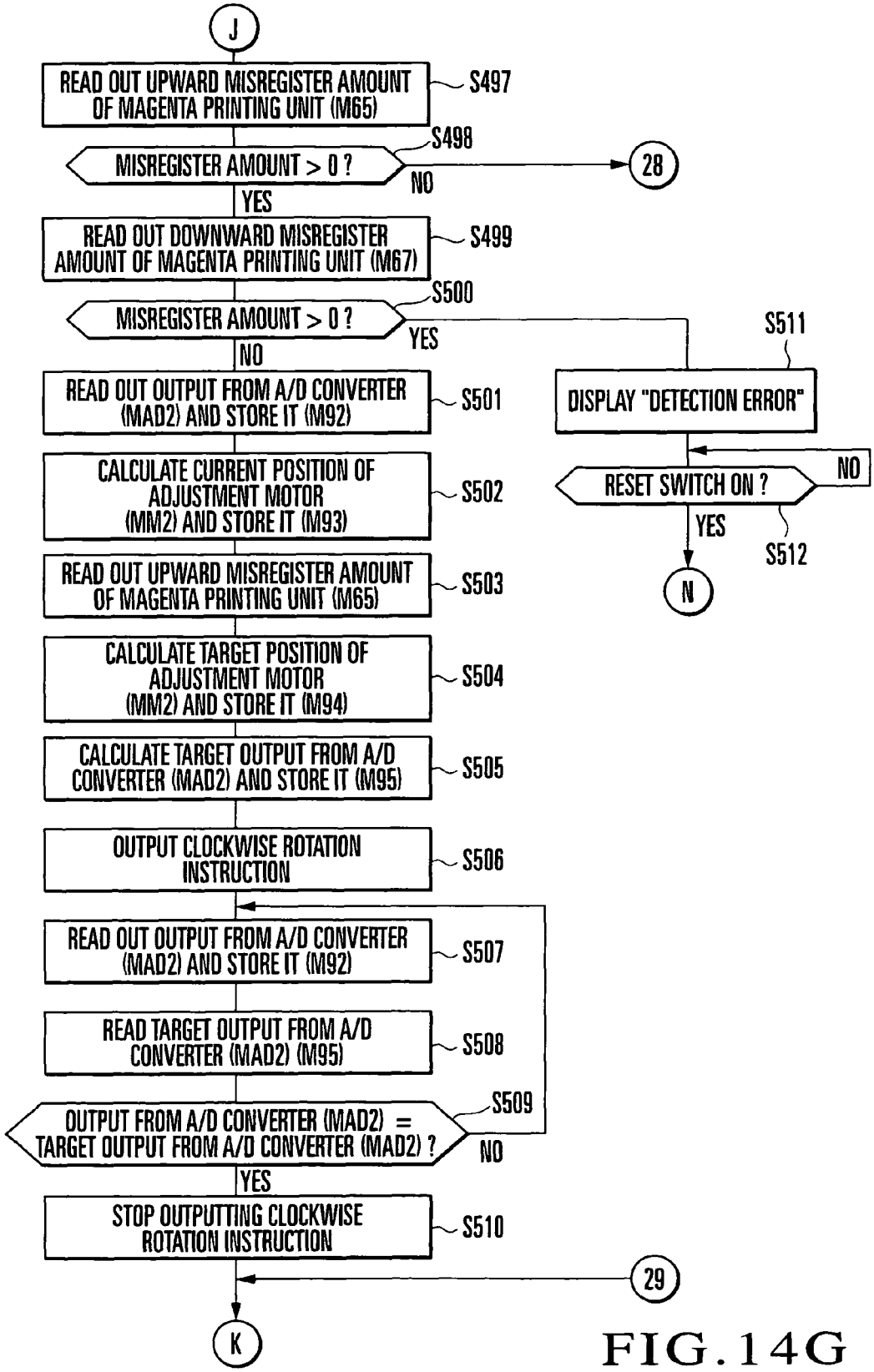
Figure 14H:
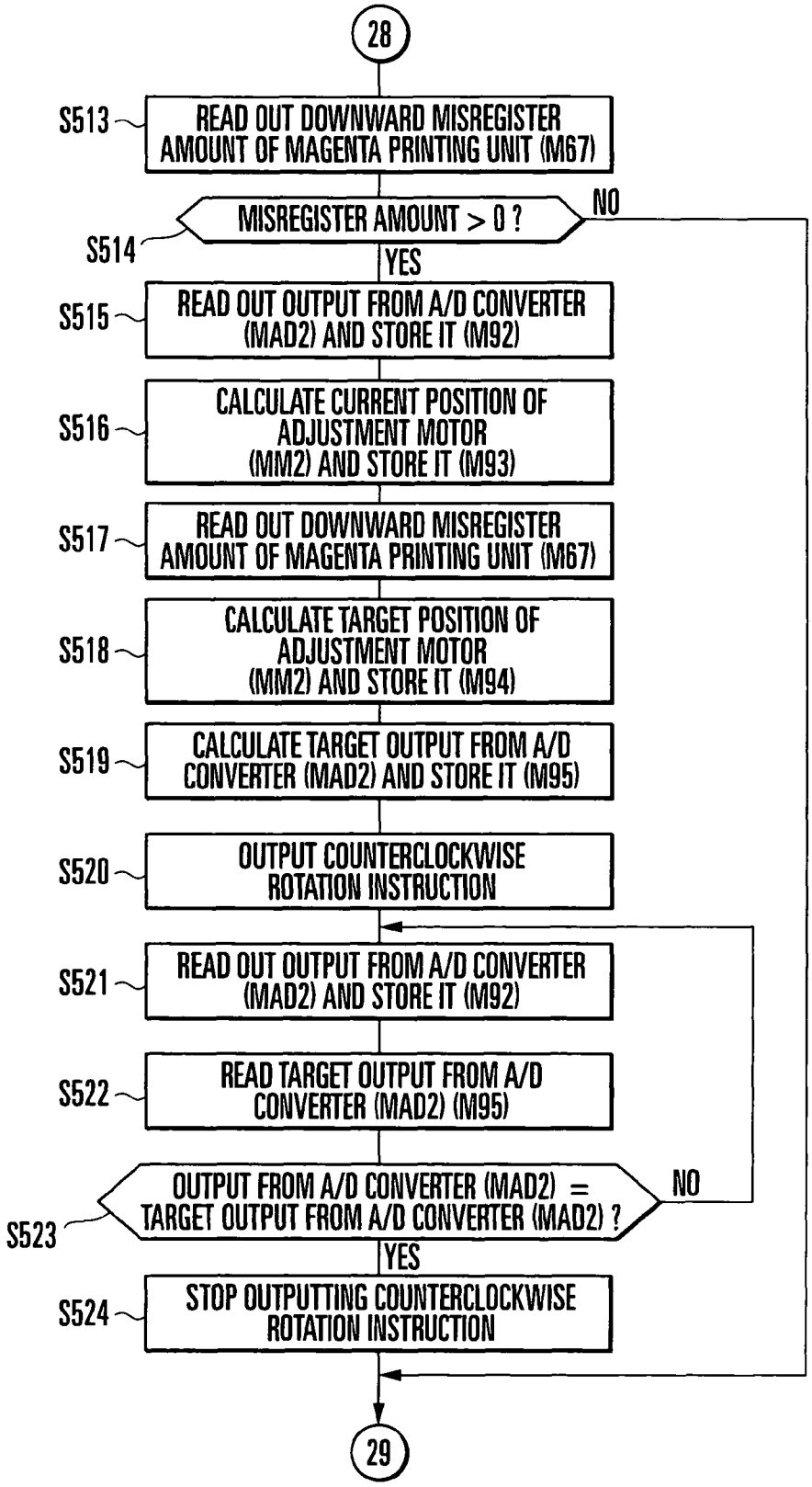

The CPU 1 performs the processes of steps S469 to S482 (FIG. 14E) corresponding to steps S413 to S426 shown in FIG. 14A to adjust the leftward misregister amount of the magenta printing unit, and the processes of steps S485 to S496 (FIG. 14F) corresponding to steps S429 to S440 shown in FIG. 14B to adjust the rightward misregister amount of the magenta printing unit. The CPU 1 also performs the processes of steps S497 to S510 (FIG. 14G) corresponding to steps S441 to S454 shown in FIG. 14C to adjust the upward misregister amount of the magenta printing unit, and the processes of steps S513 to S524 (FIG. 14H) corresponding to steps S457 to S468 shown in FIG. 14D to adjust the downward misregister amount of the magenta printing unit.

[Adjustment of Registration Position of Yellow Printing Unit]

Figure 14I:
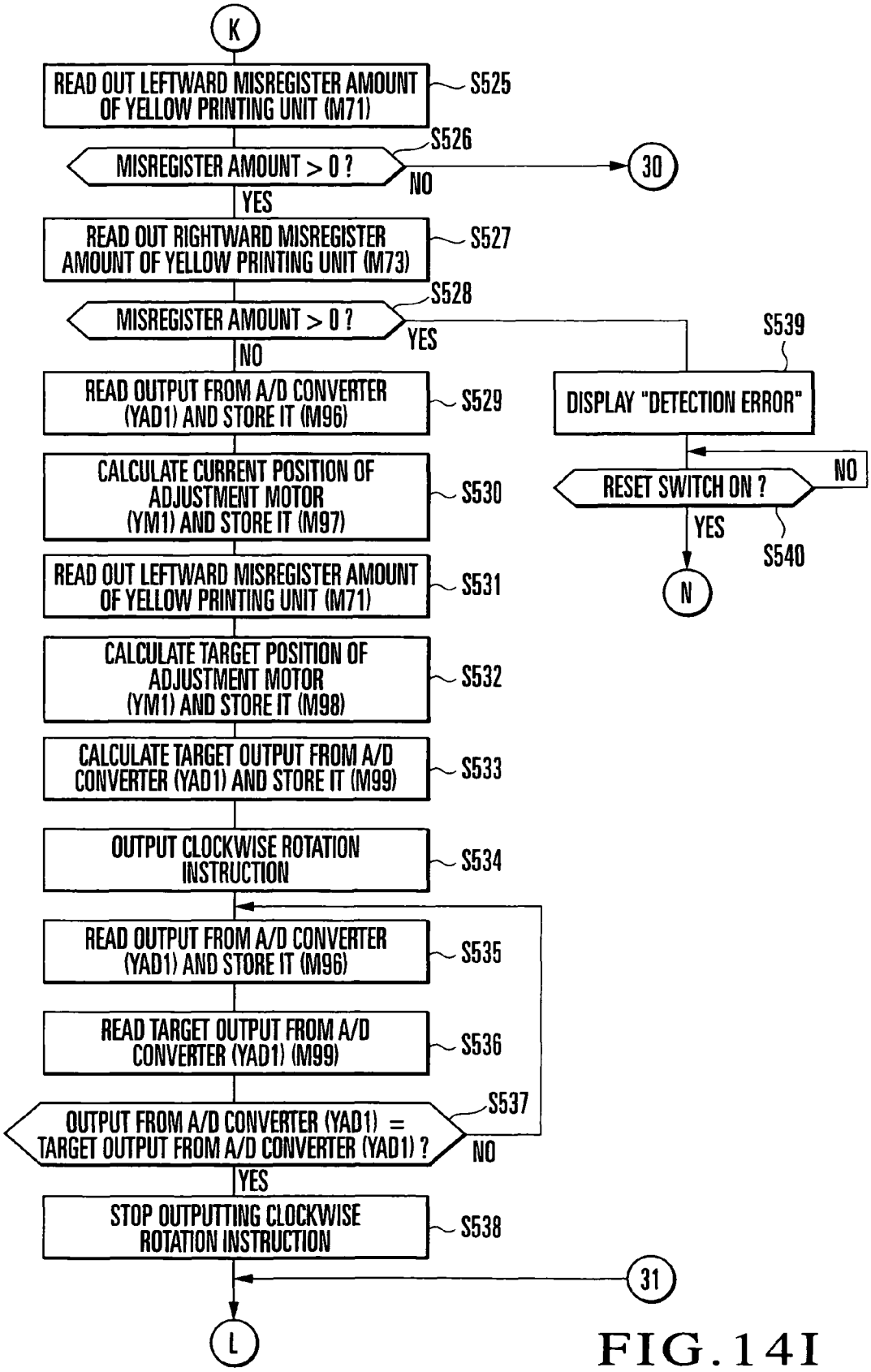
Figure 14J:
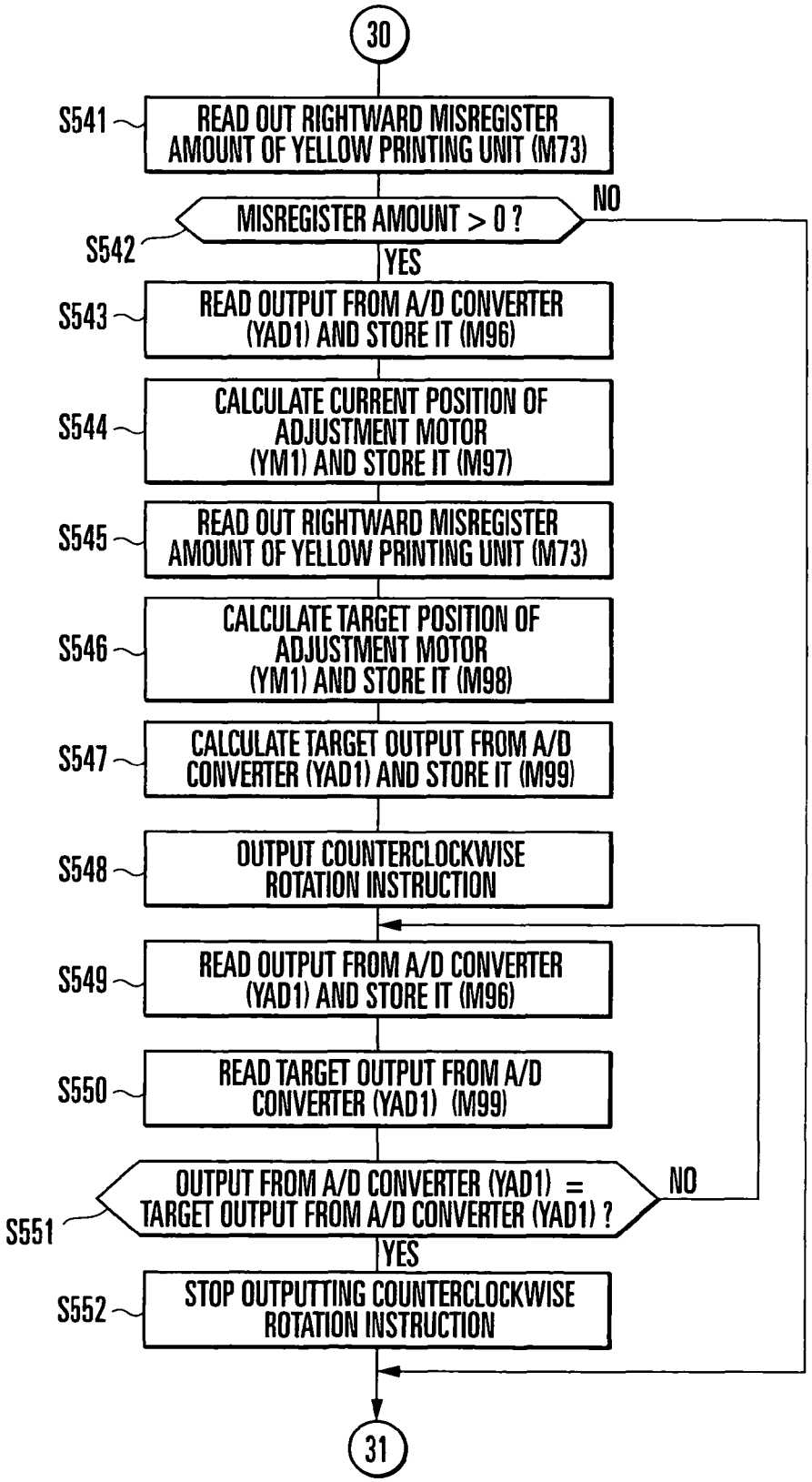
Figure 14K:
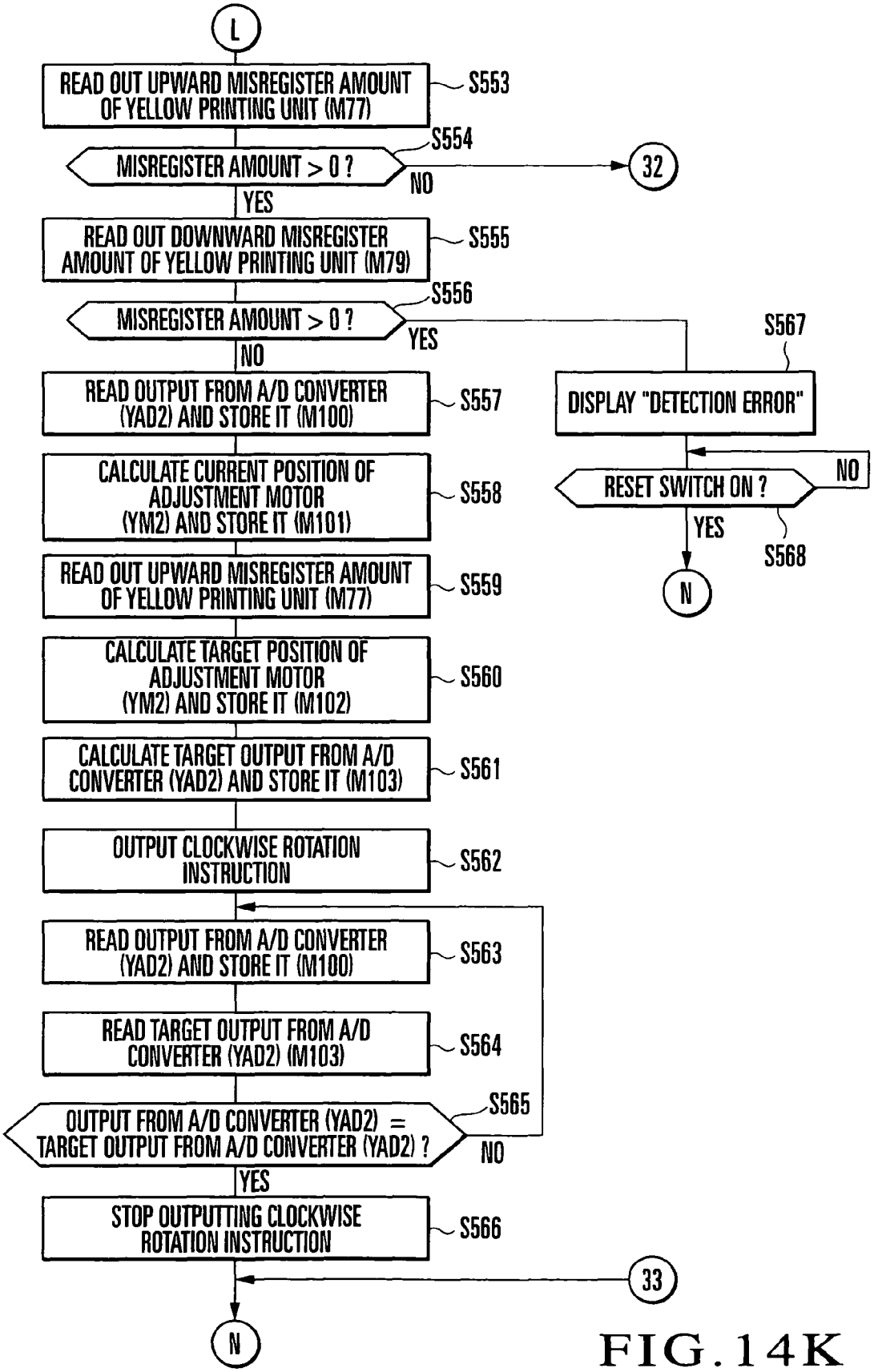
Figure 14L:
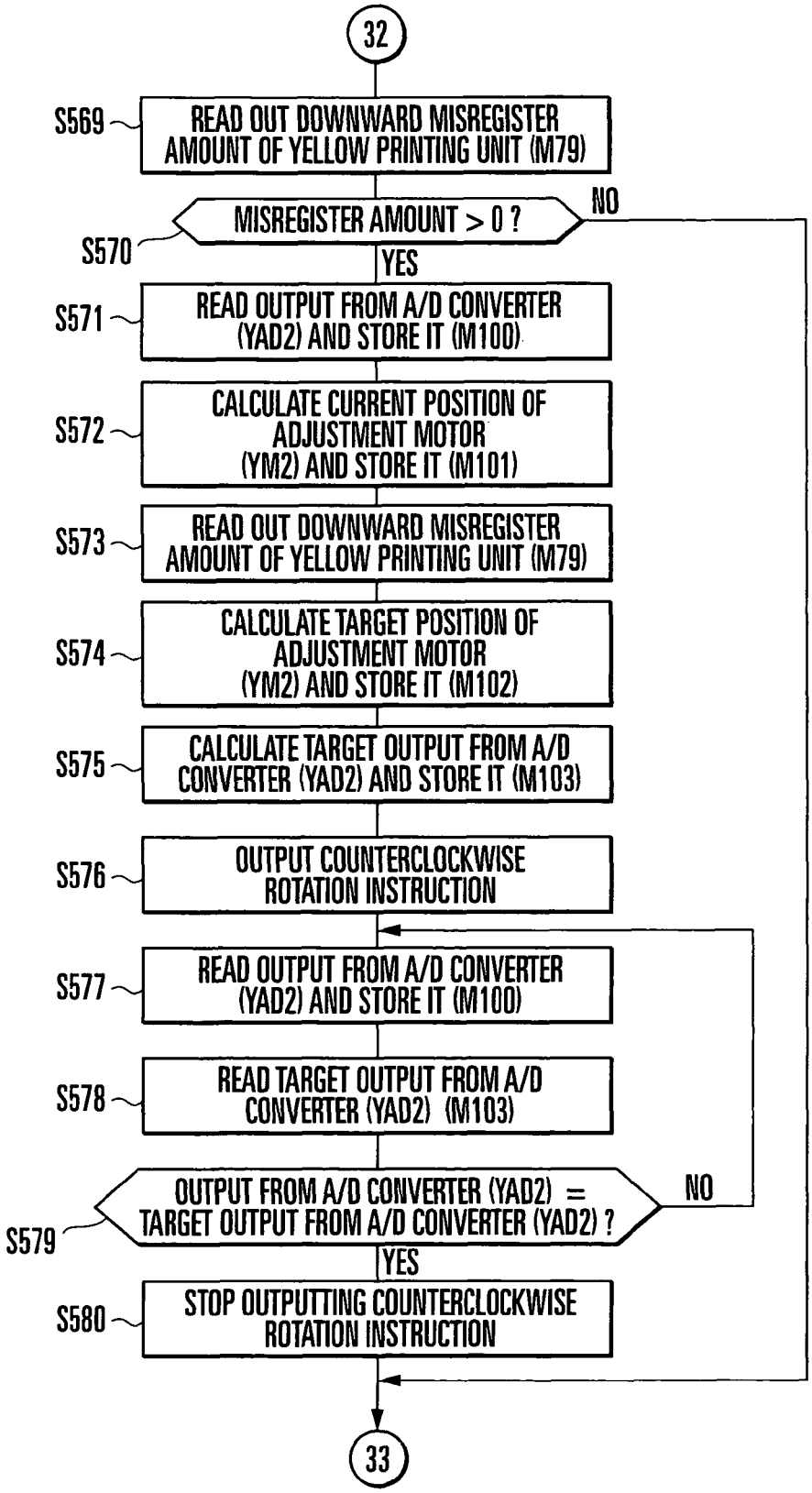

The CPU 1 performs the processes of steps S525 to S538 (FIG. 14I) corresponding to steps S413 to S426 shown in FIG. 14A to adjust the leftward misregister amount of the yellow printing unit, and the processes of steps S541 to S552 (FIG. 14J) corresponding to steps S457 to S468 shown in FIG. 14D to adjust the rightward misregister amount of the yellow printing unit. The CPU 1 also performs the processes of steps S553 to S566 (FIG. 14K) corresponding to steps S441 to S454 shown in FIG. 14C to adjust the upward misregister amount of the yellow printing unit, and the processes of steps S569 to S580 (FIG. 14L) corresponding to steps S457 to S468 shown in FIG. 14D to adjust the downward misregister amount of the yellow printing unit.

[Loading of Reference Image]

Figure 15A:
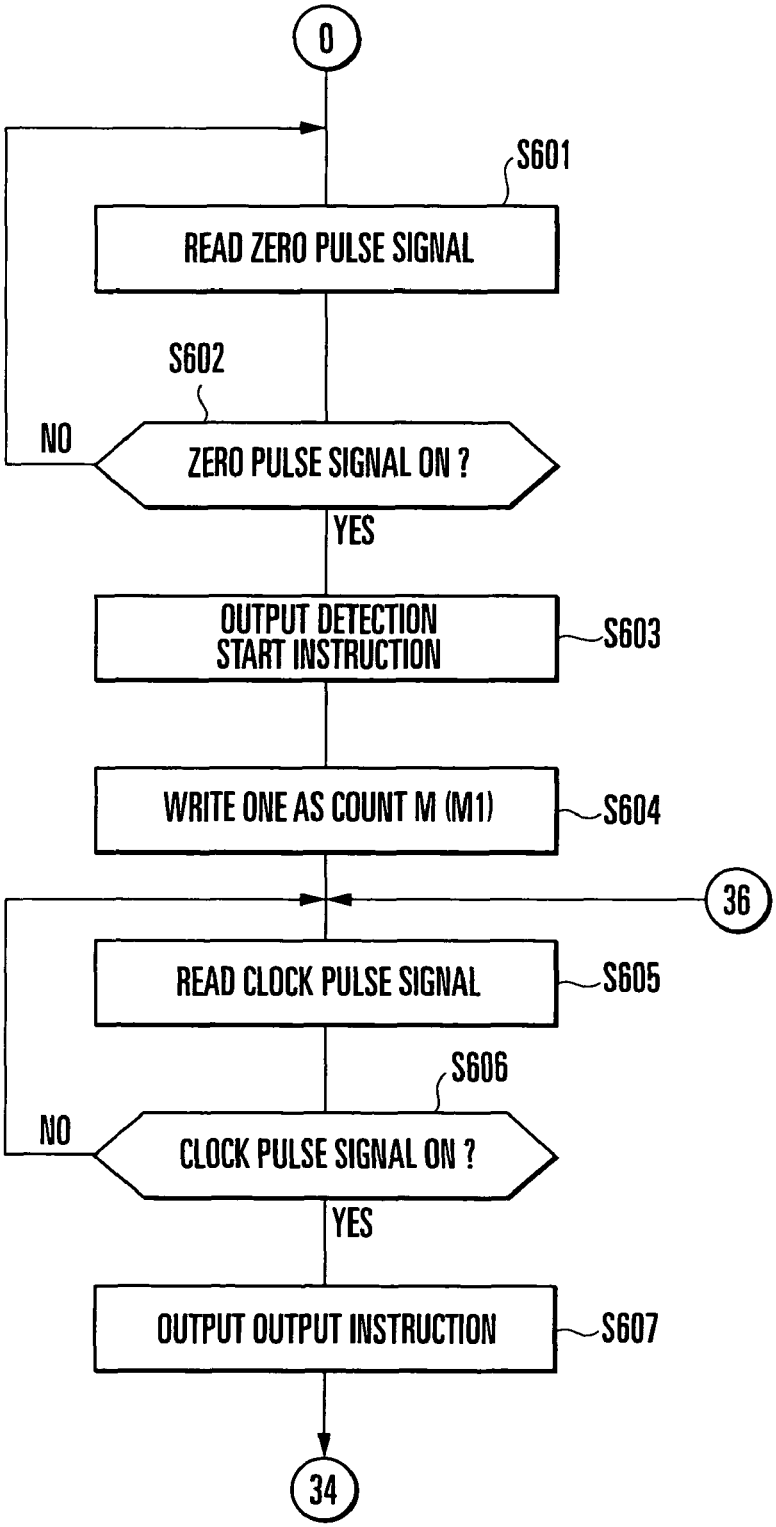
FIGS. 15A to 15C are flowcharts showing the processes of loading a reference image.
Figure 15B:
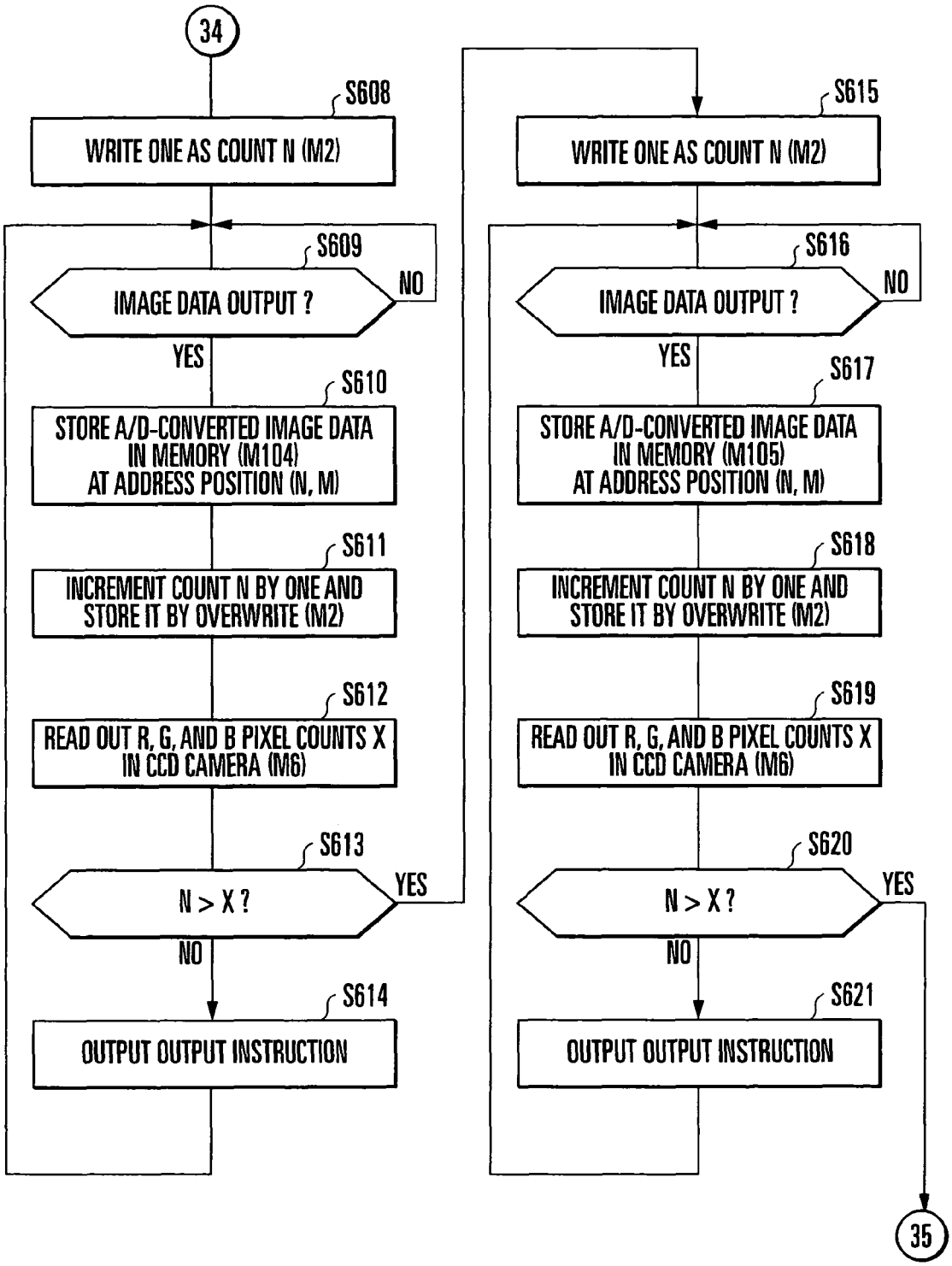
Figure 15C:
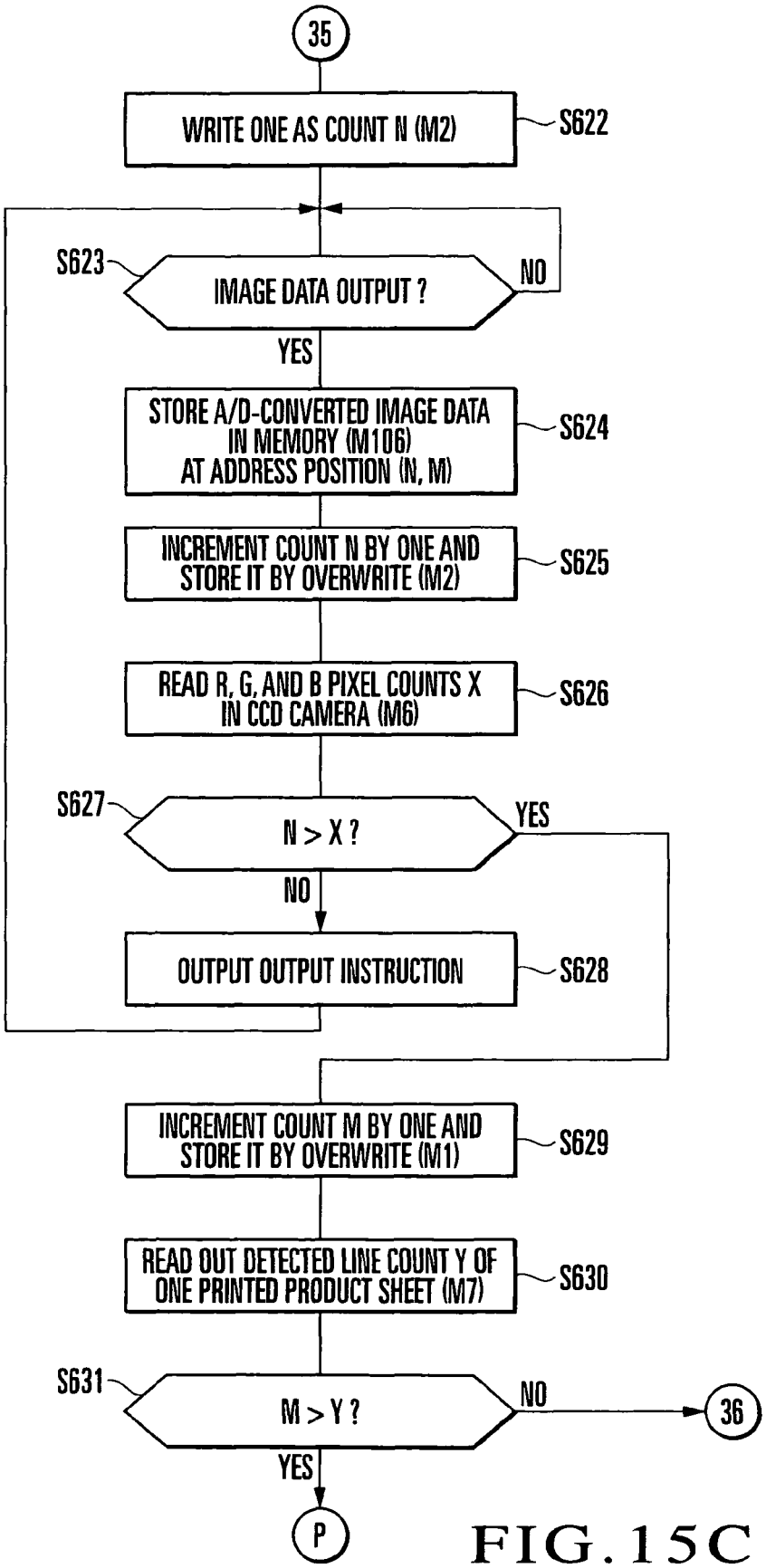

In this color misregister amount detection apparatus, when the registration is ended, the operator turns on the reference image data loading switch 5 (YES in step S102, FIG. 11A). Then, the CPU 1 performs the processes of steps S601 to S631 (FIGS. 15A to 15C) corresponding to steps S104 to S134 shown in FIGS. 11A to 11C, determines the given printed product as the inspection target printed product, and stores the image data on the R image, the image data on the G image, and the image data on the B image of the inspection target printed product as the R, G, and B inspection target images in the memories M3, M4, and M5, respectively.

[Acquisition of Density Information on Each Color of Black Lateral Direction Reference Register Mark within Target Range]

Figure 16A:
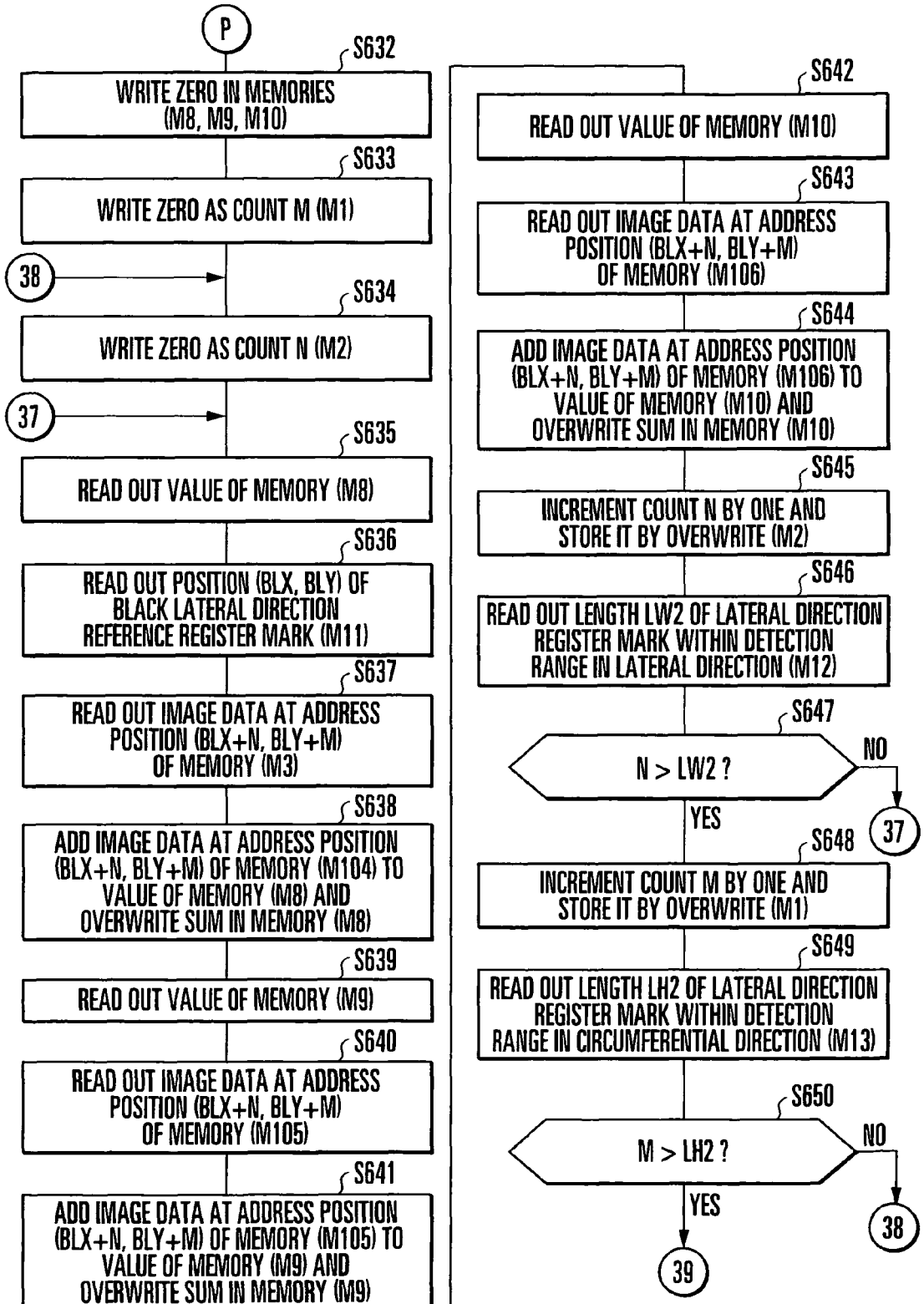
FIGS. 16A to 16N are flowcharts showing the processes, subsequent to the processes shown in FIGS. 15A to 15C, of acquiring density information on each color within the target range.

The CPU 1 sets zero in the memories M8, M9, and M10 (step S632 in FIG. 16A) and resets the count M to zero (step S633) and the count N to zero (step S634). The CPU 1 reads out the value of the memory M8 (step S635), the mark position (BLX, BLY) of the black lateral direction reference register mark MB34 from the memory M11 (step S636), and the image data at the address position (BLX+N, BLY+M) of the memory M104 (step S637), adds the image data at the address position (BLX+N, BLY+M) read out from the memory M104 to the value of the memory M8 read out in step S635, and overwrites the sum in the memory M8 as the value R of the black lateral direction reference register mark (step S638).

The CPU 1 reads out the value of the memory M9 (step S639) and the image data at the address position (BLX+N, BLY+M) of the memory M105 (step S640), adds the image data at the address position (BLX+N, BLY+M) read out from the memory M105 to the value of the memory M9 read out in step S639, and overwrites the sum as the value G of the black lateral direction reference register mark in the memory M9 (step S641).

The CPU 1 reads out the value of the memory M10 (step S642) and the image data at the address position (BLX+N, BLY+M) of the memory M106 (step S643), adds the image data at the address position (BLX+N, BLY+M) read out from the memory M106 to the value of the memory M10 read out in step S642, and overwrites the sum as the value B of the black lateral direction reference register mark in the memory M10 (step S644).

The CPU 1 then increments the count N by one (step S645), and reads out the length LW2 of the lateral direction register mark within the lateral detection range from the memory M12 (step S646). The CPU 1 repeats the processes of steps S635 to S647 until the count N exceeds LW2 in step S647. When the count N exceeds LW2 (YES in step S647), the CPU 1 increments the count M by one (step S648) and reads the length LH2 of the lateral direction register mark within the circumferential detection range from the memory M13 (step S649). The CPU 1 repeats the processes of steps S634 to S650 until the count M exceeds LH2 in step S650.

Hence, the pixel values of the R, G, and B reference images of the black lateral direction reference register mark MB34 within the target range S are added separately for each color. The sum of the pixel values of the R reference image is stored in the memory M8 as the density information on the cyan component within the target range S. The sum of the pixel values of the G reference image is stored in the memory M9 as the density information on the magenta component within the target range S. The sum of the pixel values of the B reference image is stored in the memory M10 as the density information on the yellow component within the target range S.

[Acquisition of Density Information on Each Color of Black Circumferential Direction Reference Register Mark within Target Range]

Figure 16B:
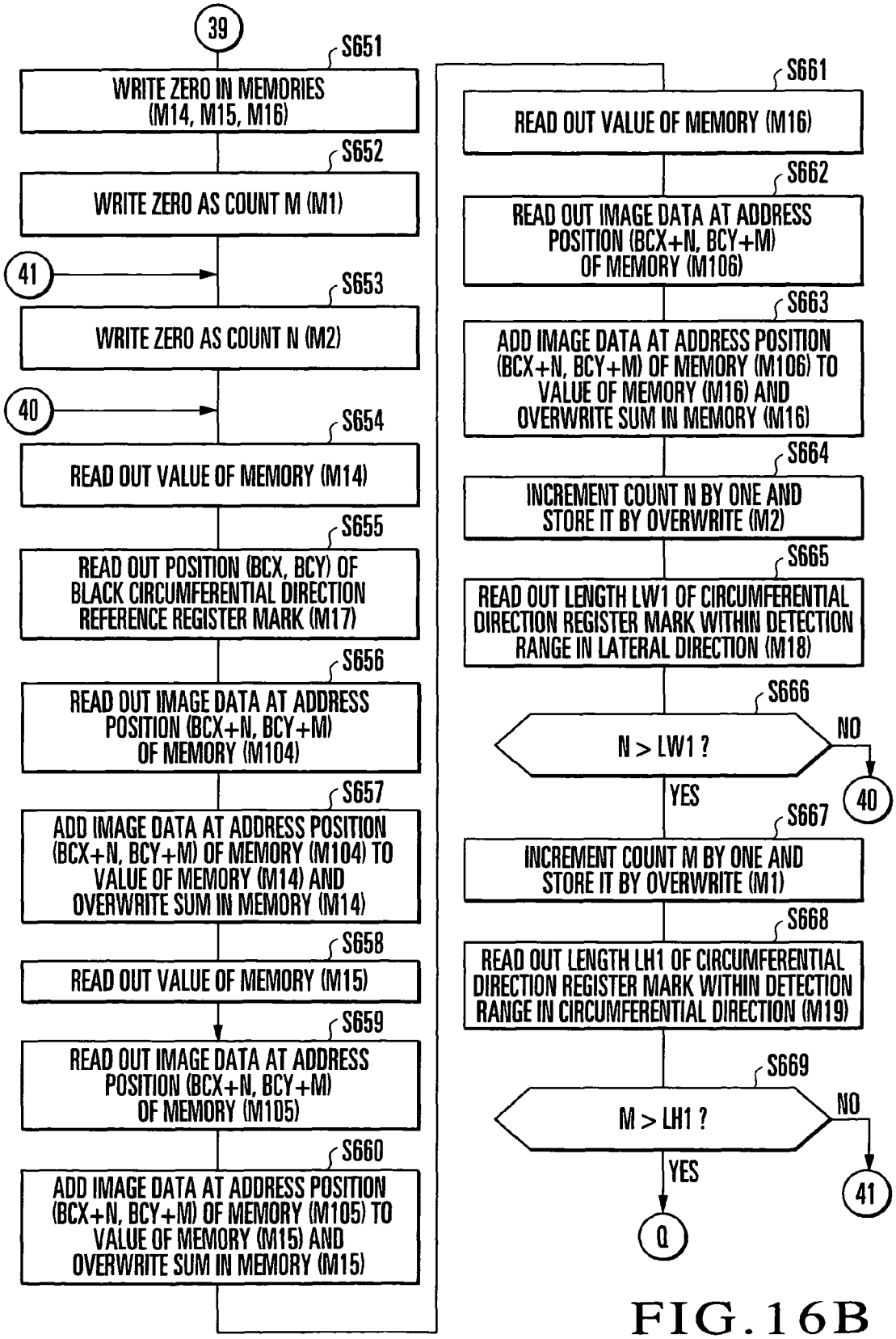

The CPU 1 sets zero in the memories M14, M15, and M16 (step S651 in FIG. 16B) and resets the count M to zero (step S652) and the count N to zero (step S653). The CPU 1 reads out the value of the memory M14 (step S654), the mark position (BCX, BCY) of the black circumferential direction reference register mark MB12 from the memory M17 (step S655), and the image data at the address position (BCX+N, BCY+M) of the memory M104 (step S656), adds the image data at the address position (BCX+N, BCY+M) read out from the memory M104 to the value of the memory M14 read out in step S654, and overwrites the sum in the memory M14 as the value R of the black circumferential direction reference register mark (step S657).

The CPU 1 reads out the value of the memory M15 (step S658) and the image data at the address position (BCX+N, BCY+M) of the memory M105 (step S659), adds the image data at the address position (BCX+N, BCY+M) read out from the memory M105 to the value of the memory M15 read out in step S658, and overwrites the sum as the value G of the black circumferential direction reference register mark in the memory M15 (step S660).

The CPU 1 reads out the value of the memory M16 (step S661) and the image data at the address position (BCX+N, BCY+M) of the memory M106 (step S662), adds the image data at the address position (BCX+N, BCY+M) read out from the memory M106 to the value of the memory M16 read out in step S661, and overwrites the sum as the value B of the black circumferential direction reference register mark in the memory M16 (step S663).

The CPU 1 then increments the count N by one (step S664), and reads out the length LW1 of the circumferential direction register mark within the lateral detection range from the memory M18 (step S665). The CPU 1 repeats the processes of steps S654 to S666 until the count N exceeds LW1 in step S666. When the count N exceeds LW1 (YES in step S666), the CPU 1 increments the count M by one (step S667) and reads the length LH1 of the circumferential direction register mark within the circumferential detection range from the memory M19 (step S668). The CPU 1 repeats the processes of steps S653 to S669 until the count M exceeds LH1 in step S669.

Hence, the pixel values of the R, G, and B reference images of the black circumferential direction reference register mark MB12 within the target range S are added separately for each color. The sum of the pixel values of the R reference image is stored in the memory M14 as the density information on the cyan component within the target range S. The sum of the pixel values of the G reference image is stored in the memory M15 as the density information on the magenta component within the target range S. The sum of the pixel values of the B reference image is stored in the memory M16 as the density information on the yellow component within the target range S.

[Acquisition of Density Information on Cyan Component of Leftward Reference Register Mark+Cyan Leftward Register Mark within Target Range]

The CPU 1 sets zero in the memory M20 (step S670 in FIG. 16C) and resets the count M to zero (step S671) and the count N to zero (step S672). The CPU 1 reads out the value of the memory M20 (step S673), the position (CLX, CLY) of the cyan leftward register mark from the memory M21 (step S674), and the image data at the address position (CLX+N, CLY+M) of the memory M104 (step S675), adds the image data at the address position (CLX+N, CLY+M) read out from the memory M104 to the value of the memory M20 read out in step S673, and overwrites the sum in the memory M20 as the value R of the cyan leftward register mark (step S676).

The CPU 1 then increments the count N by one (step S677), and reads out the length LW2 of the lateral direction register mark within the lateral detection range from the memory M12 (step S678). The CPU 1 repeats the processes of steps S673 to S679 until the count N exceeds LW2 in step S679. When the count N exceeds LW2 (YES in step S679), the CPU 1 increments the count M by one (step S680) and reads the length LH2 of the lateral direction register mark within the circumferential detection range from the memory M13 (step S681). The CPU 1 repeats the processes of steps S672 to S682 until the count M exceeds LH2 in step S682.

Hence, the pixel values of the R reference image of the leftward reference register mark MB3, on which the cyan leftward register mark MC3 is printed to overlap, within the target range S are added. The sum of the pixel values of the R reference image is stored in the memory M20 as the density information on the cyan component within the target range S.

[Acquisition of Density Information on Cyan Component of Rightward Reference Register Mark+Cyan Rightward Register Mark within Target Range]

The CPU 1 sets zero in the memory M22 (step S683 in FIG. 16D) and resets the count M to zero (step S684) and the count N to zero (step S685). The CPU 1 reads out the value of the memory M22 (step S686), the position (CRX, CRY) of the cyan rightward register mark from the memory M23 (step S687), and the image data at the address position (CRX+N, CRY+M) of the memory M104 (step S688), adds the image data at the address position (CRX+N, CRY+M) read out from the memory M104 to the value of the memory M22 read out in step S686, and overwrites the sum in the memory M22 as the value R of the cyan rightward register mark (step S689).

The CPU 1 then increments the count N by one (step S690), and reads out the length LW2 of the lateral direction register mark within the lateral detection range from the memory M12 (step S691). The CPU 1 repeats the processes of steps S686 to S692 until the count N exceeds LW2 in step S692. When the count N exceeds LW2 (YES in step S692), the CPU 1 increments the count M by one (step S693) and reads the length LH2 of the lateral direction register mark within the circumferential detection range from the memory M13 (step S694). The CPU 1 repeats the processes of steps S685 to S695 until the count M exceeds LH2 in step S695.

Hence, the pixel values of the R reference image of the rightward reference register mark MB4, on which the cyan rightward register mark MC4 is printed to overlap, within the target range S are added. The sum of the pixel values of the R reference image is stored in the memory M22 as the density information on the cyan component within the target range S.

[Acquisition of Density Information on Cyan Component of Upward Reference Register Mark+Cyan Upward Register Mark within Target Range]

The CPU 1 sets zero in the memory M24 (step S696 in FIG. 16E) and resets the count M to zero (step S697) and the count N to zero (step S698). The CPU 1 reads out the value of the memory M24 (step S699), the position (CFX, CFY) of the cyan upward register mark from the memory M25 (step S700), and the image data at the address position (CFX+N, CFY+M) of the memory M104 (step S701), adds the image data at the address position (CFX+N, CFY+M) read out from the memory M104 to the value of the memory M24 read out in step S699, and overwrites the sum in the memory M24 as the value R of the cyan upward register mark (step S702).

The CPU 1 then increments the count N by one (step S703), and reads out the length LW1 of the circumferential direction register mark within the lateral detection range from the memory M18 (step S704). The CPU 1 repeats the processes of steps S699 to S705 until the count N exceeds LW1 in step S705. When the count N exceeds LW1 (YES in step S705), the CPU 1 increments the count M by one (step S706) and reads the length LH1 of the circumferential direction register mark within the circumferential detection range from the memory M19 (step S707). The CPU 1 repeats the processes of steps S698 to S708 until the count M exceeds LH1 in step S708.

Hence, the pixel values of the R reference image of the upward reference register mark MB1, on which the cyan upward register mark MC1 is printed to overlap, within the target range S are added. The sum of the pixel values of the R reference image is stored in the memory M24 as the density information on the cyan component within the target range S.

[Acquisition of Density Information on Cyan Component of Downward Reference Register Mark+Cyan Downward Register Mark within Target Range]

The CPU 1 sets zero in the memory M26 (step S709 in FIG. 16F) and resets the count M to zero (step S710) and the count N to zero (step S711). The CPU 1 reads out the value of the memory M26 (step S712), the position (CBX, CBY) of the cyan downward register mark from the memory M27 (step S713), and the image data at the address position (CBX+N, CBY+M) of the memory M104 (step S714), adds the image data at the address position (CBX+N, CBY+M) read out from the memory M104 to the value of the memory M26 read out in step S712, and overwrites the sum in the memory M26 as the value R of the cyan downward register mark (step S715).

The CPU 1 then increments the count N by one (step S716), and reads out the length LW1 of the circumferential direction register mark within the lateral detection range from the memory M18 (step S717). The CPU 1 repeats the processes of steps S712 to S718 until the count N exceeds LW1 in step S718. When the count N exceeds LW1 (YES in step S718), the CPU 1 increments the count M by one (step S719) and reads the length LH1 of the circumferential direction register mark within the circumferential detection range from the memory M19 (step S720). The CPU 1 repeats the processes of steps S711 to S721 until the count M exceeds LH1 in step S721.

Hence, the pixel values of the R reference image of the downward reference register mark MB2, on which the cyan downward register mark MC2 is printed to overlap, within the target range S are added. The sum of the pixel values of the R reference image is stored in the memory M26 as the density information on the cyan component within the target range S.

[Acquisition of Density Information on Magenta Component of Leftward Reference Register Mark+Magenta Leftward Register Mark within Target Range]

Figure 16C:
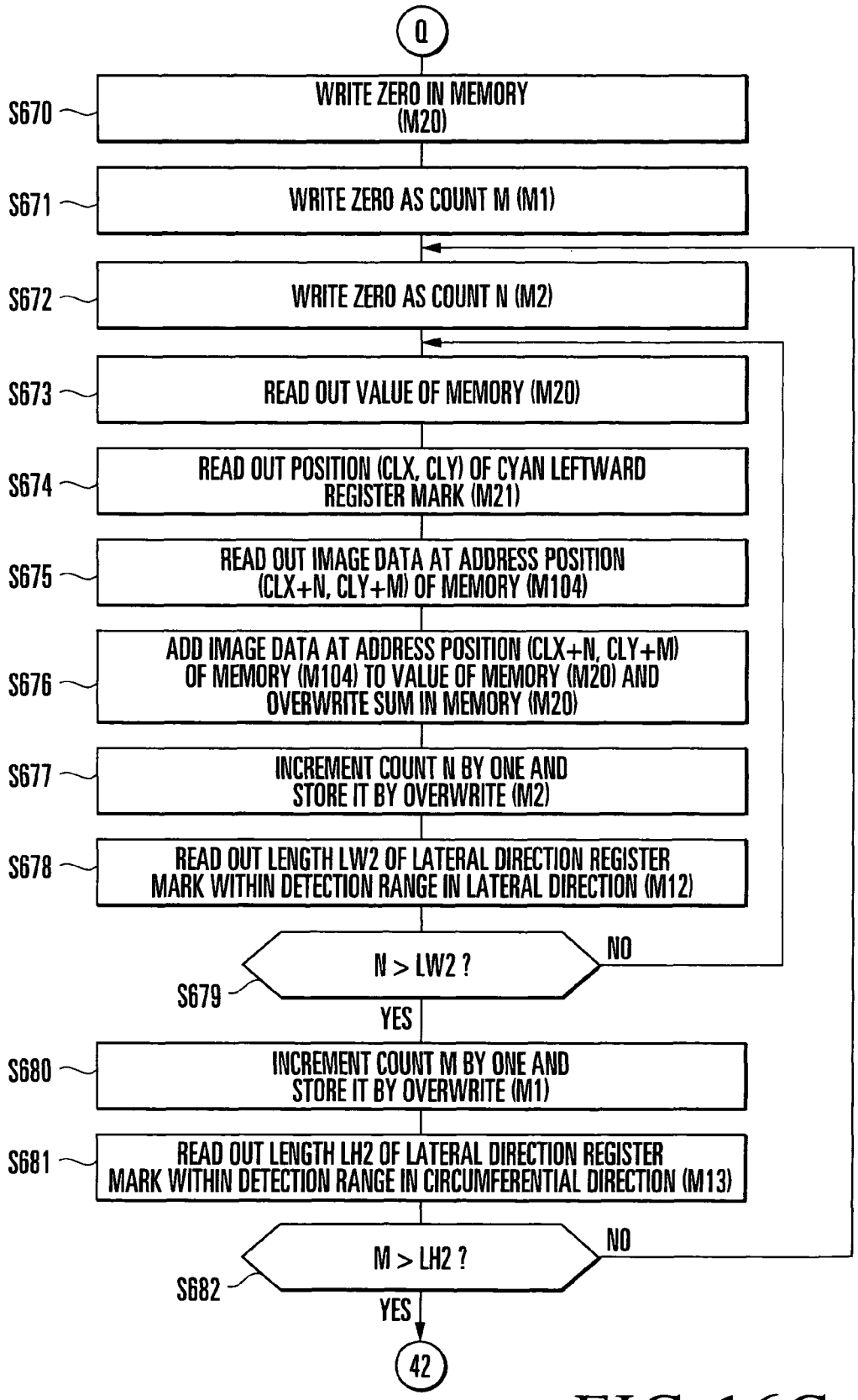

The CPU 1 then performs the processes of steps S722 to S734 (FIG. 16G) corresponding to steps S670 to S682 shown in FIG. 16C, adds the pixel values of the G reference image of the leftward reference register mark MB3, on which a magenta leftward register mark (not shown) is printed to overlap, within the target range S, and stores the sum of the pixel values of the G reference image in the memory M28 as the density information on the magenta component within the target range S.

[Acquisition of Density Information on Magenta Component of Rightward Reference Register Mark+Magenta Rightward Register Mark within Target Range]

Figure 16D:
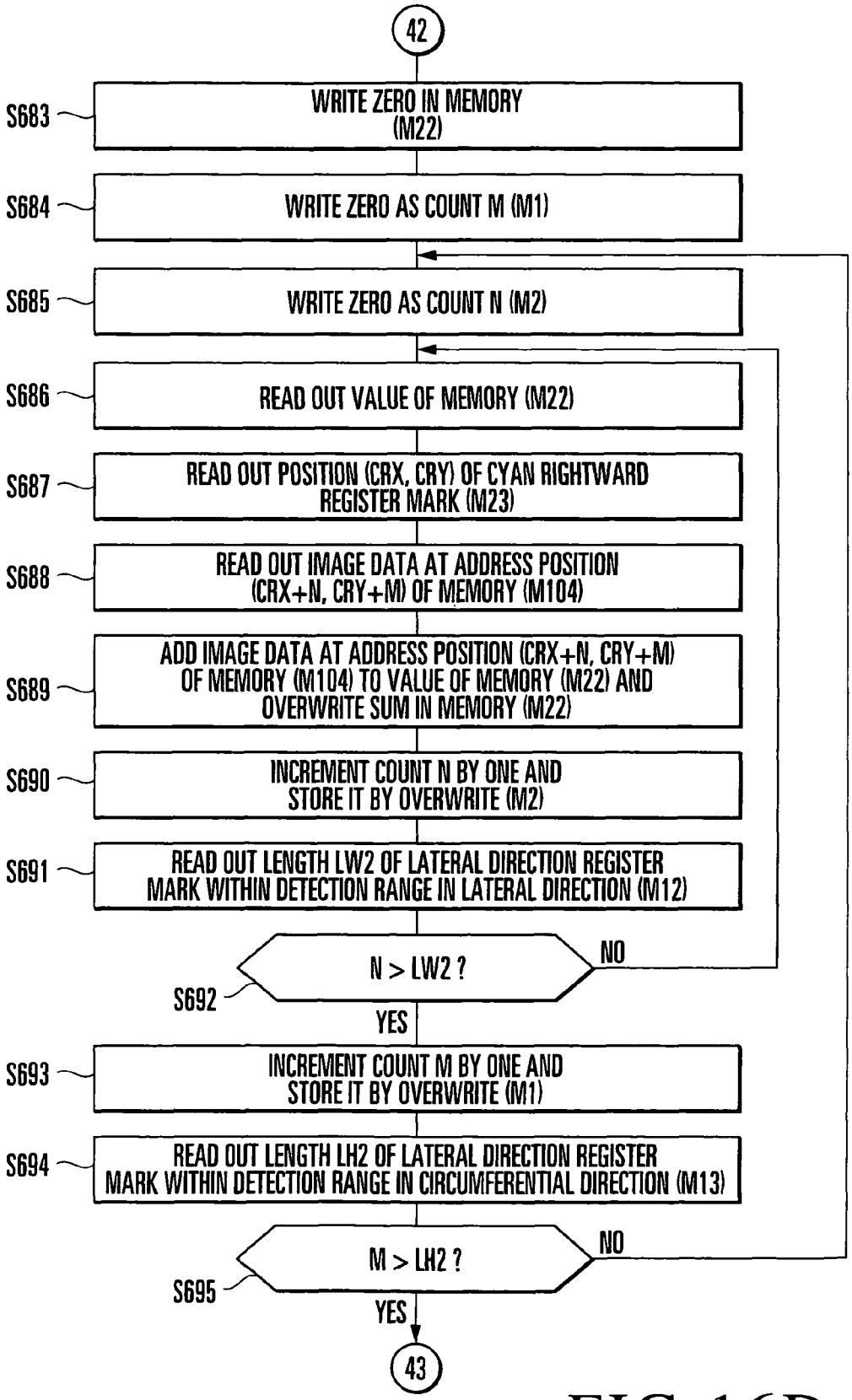

The CPU 1 then performs the processes of steps S735 to S747 (FIG. 16H) corresponding to steps S683 to S695 shown in FIG. 16D, adds the pixel values of the G reference image of the rightward reference register mark MB4, on which a magenta rightward register mark (not shown) is printed to overlap, within the target range S, and stores the sum of the pixel values of the G reference image in the memory M30 as the density information on the magenta component within the target range S.

[Acquisition of Density Information on Magenta Component of Upward Reference Register Mark+Magenta Upward Register Mark within Target Range]

Figure 16E:
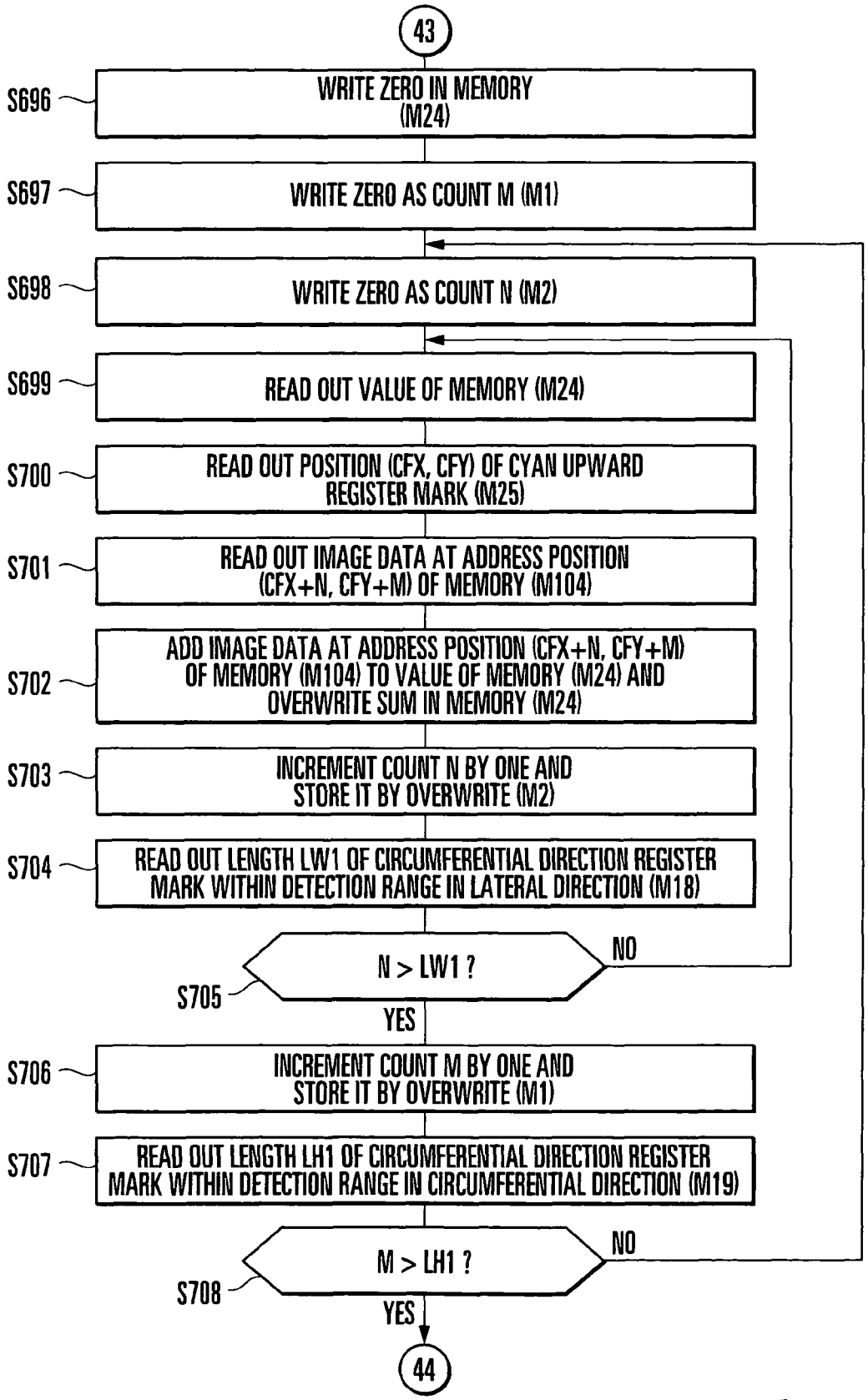

The CPU 1 then performs the processes of steps S748 to S760 (FIG. 16I) corresponding to steps S696 to S708 shown in FIG. 16E, adds the pixel values of the G reference image of the upward reference register mark MB1, on which a magenta upward register mark (not shown) is printed to overlap, within the target range S, and stores the sum of the pixel values of the G reference image in the memory M32 as the density information on the magenta component within the target range S.

[Acquisition of Density Information on Magenta Component of Downward Reference Register Mark+Magenta Downward Register Mark within Target Range]

Figure 16F:
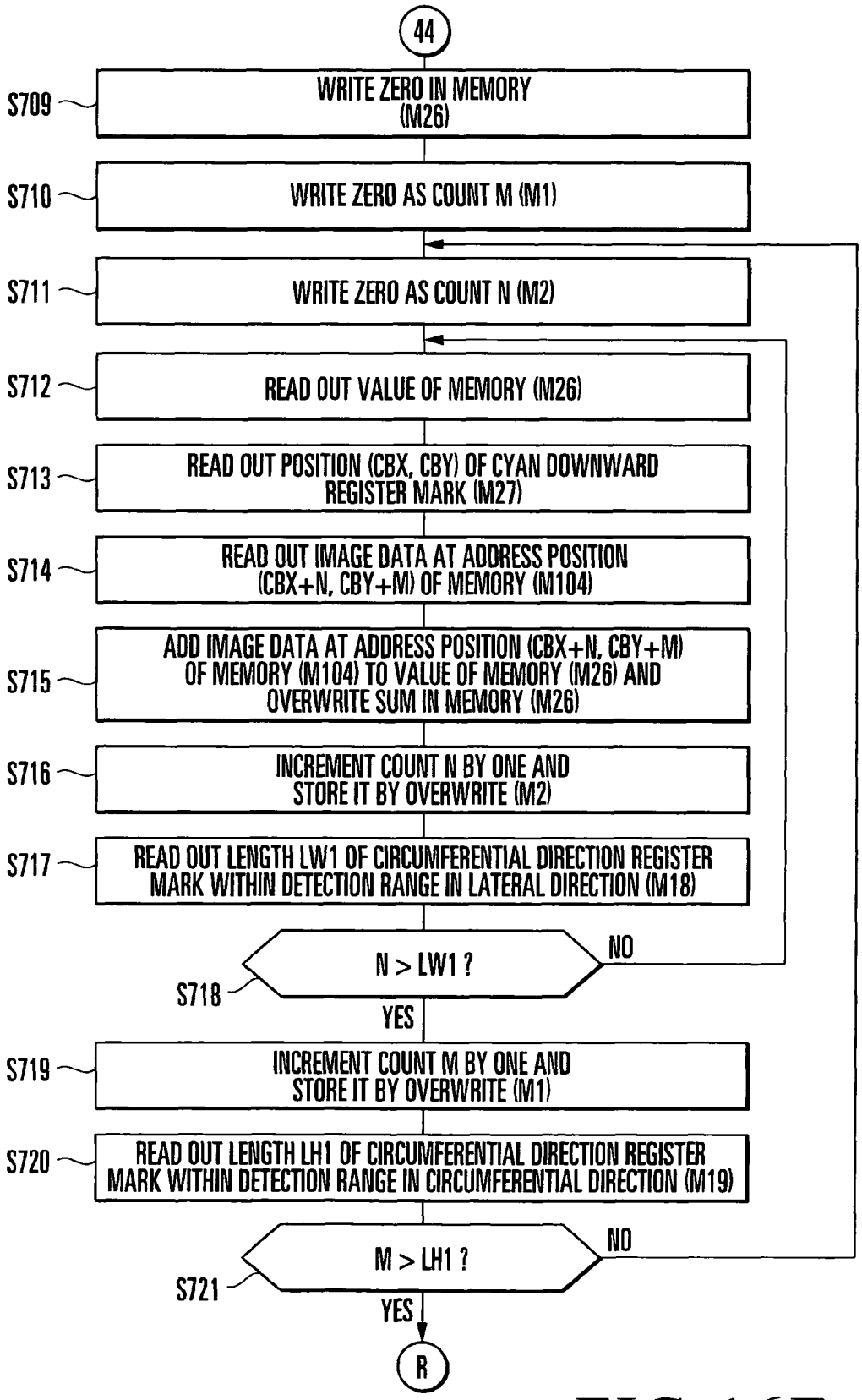
Figure 16G:
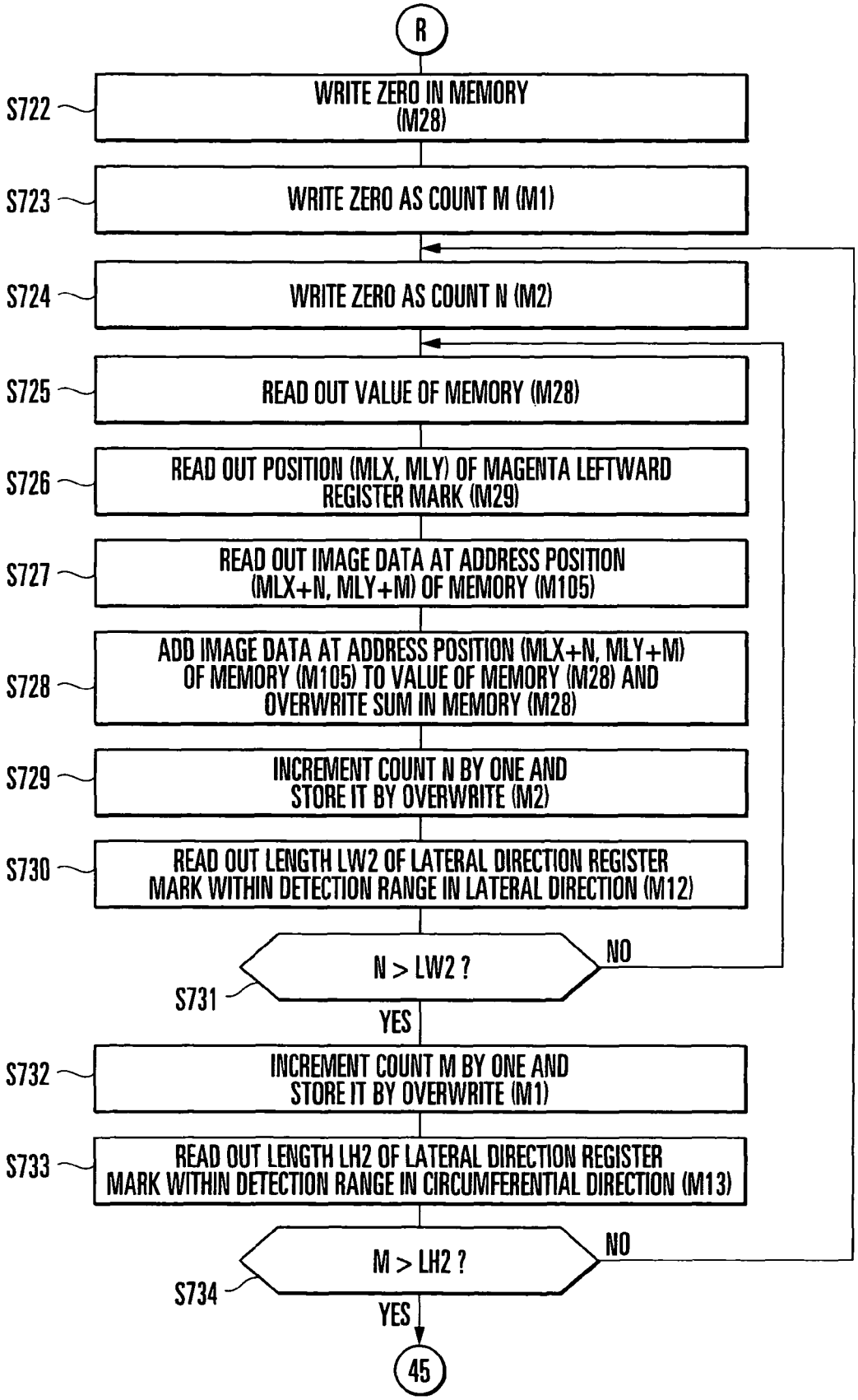
Figure 16H:
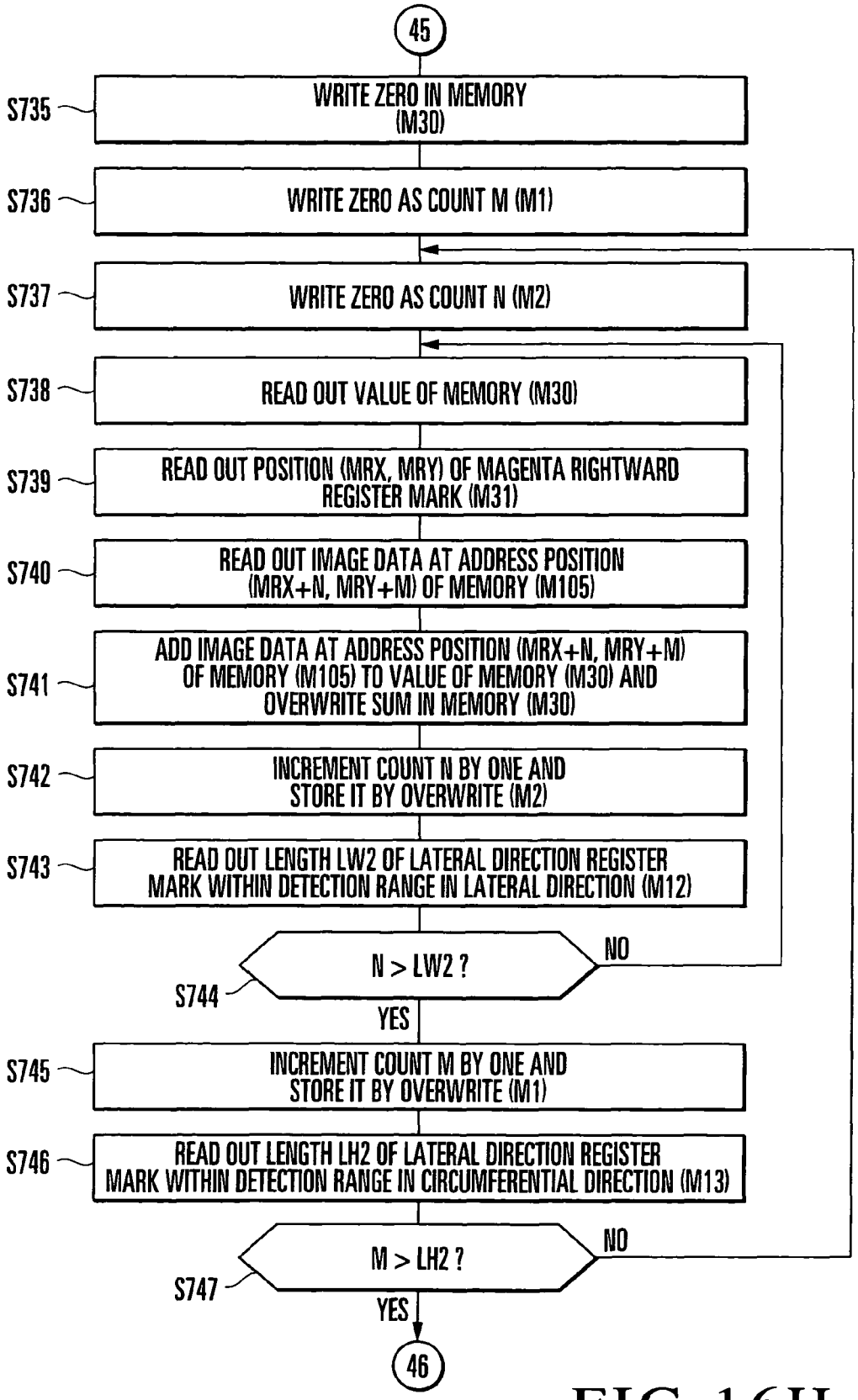
Figure 16I:
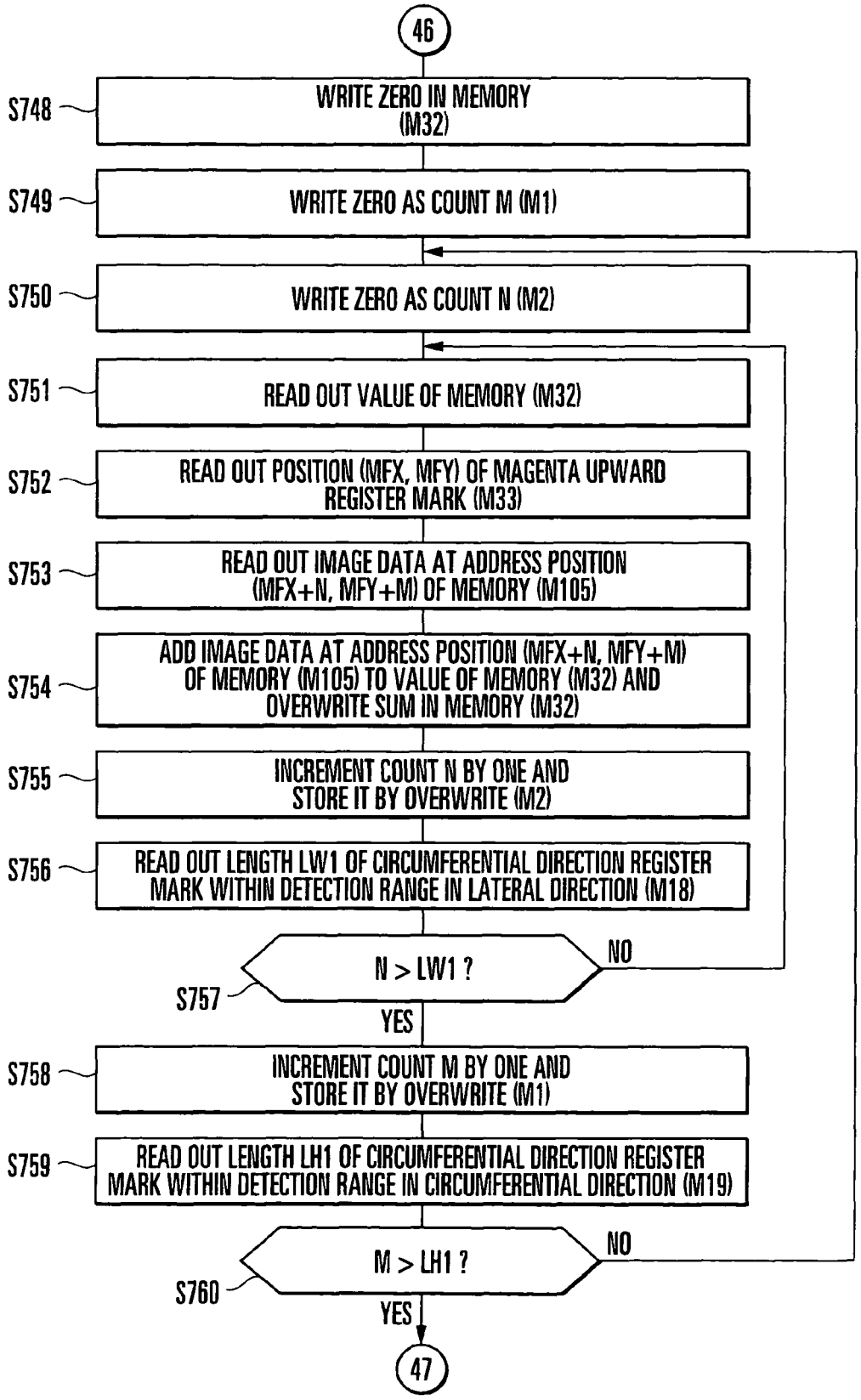
Figure 16J:
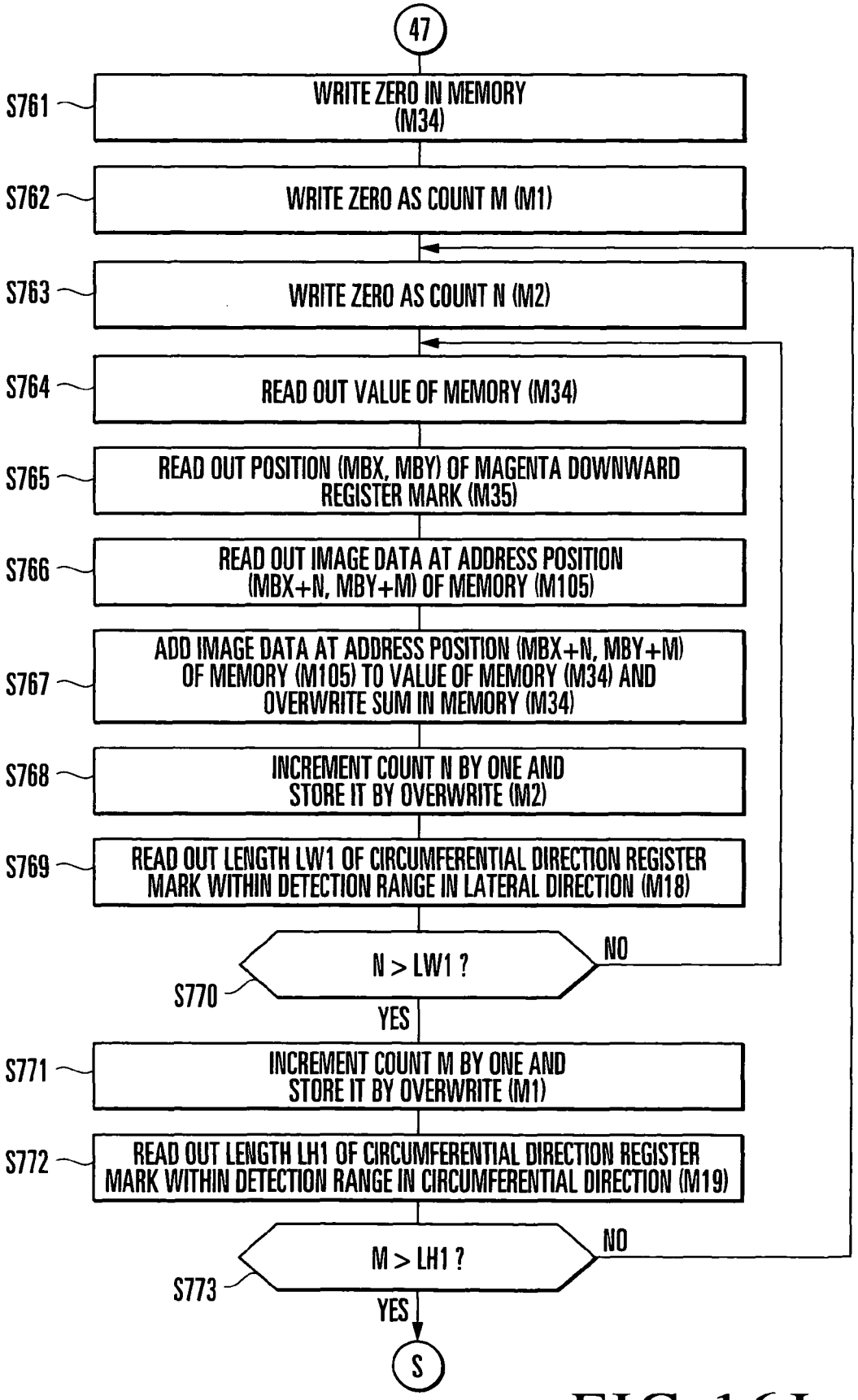

The CPU 1 then performs the processes of steps S761 to S773 (FIG. 16J) corresponding to steps S709 to S721 shown in FIG. 16F, adds the pixel values of the G reference image of the downward reference register mark MB2, on which a magenta downward register mark (not shown) is printed to overlap, within the target range S, and stores the sum of the pixel values of the G reference image in the memory M34 as the density information on the magenta component within the target range S.

[Acquisition of Density Information on Yellow Component of Leftward Reference Register Mark+Yellow Leftward Register Mark within Target Range]

Figure 16K:
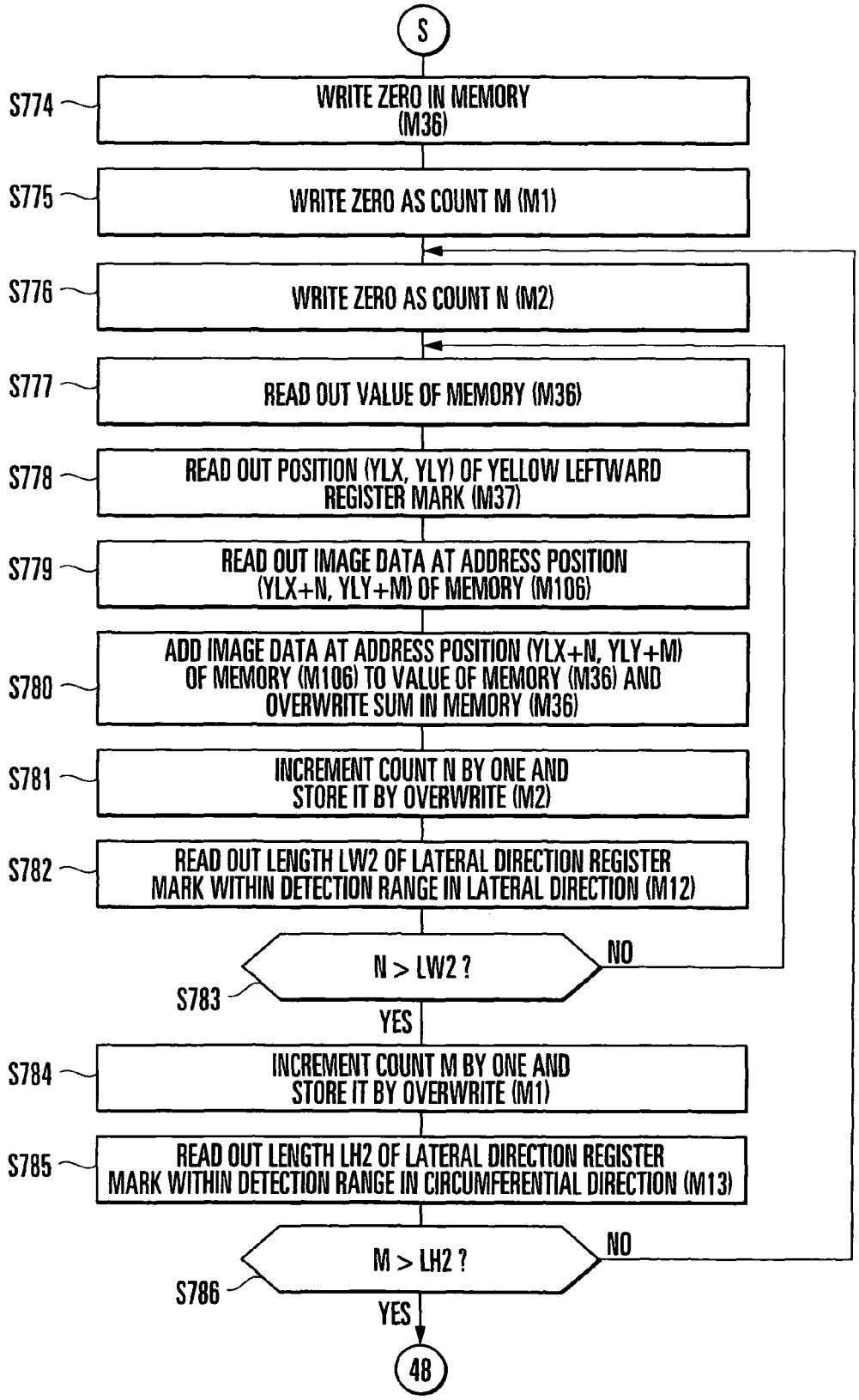

The CPU 1 then performs the processes of steps S774 to S786 (FIG. 16K) corresponding to steps S670 to S682 shown in FIG. 16C, adds the pixel values of the B reference image of the leftward reference register mark MB3, on which a yellow leftward register mark (not shown) is printed to overlap, within the target range S, and stores the sum of the pixel values of the B reference image in the memory M36 as the density information on the yellow component within the target range S.

[Acquisition of Density Information on Yellow Component of Rightward Reference Register Mark+Yellow Rightward Register Mark within Target Range]

Figure 16L:
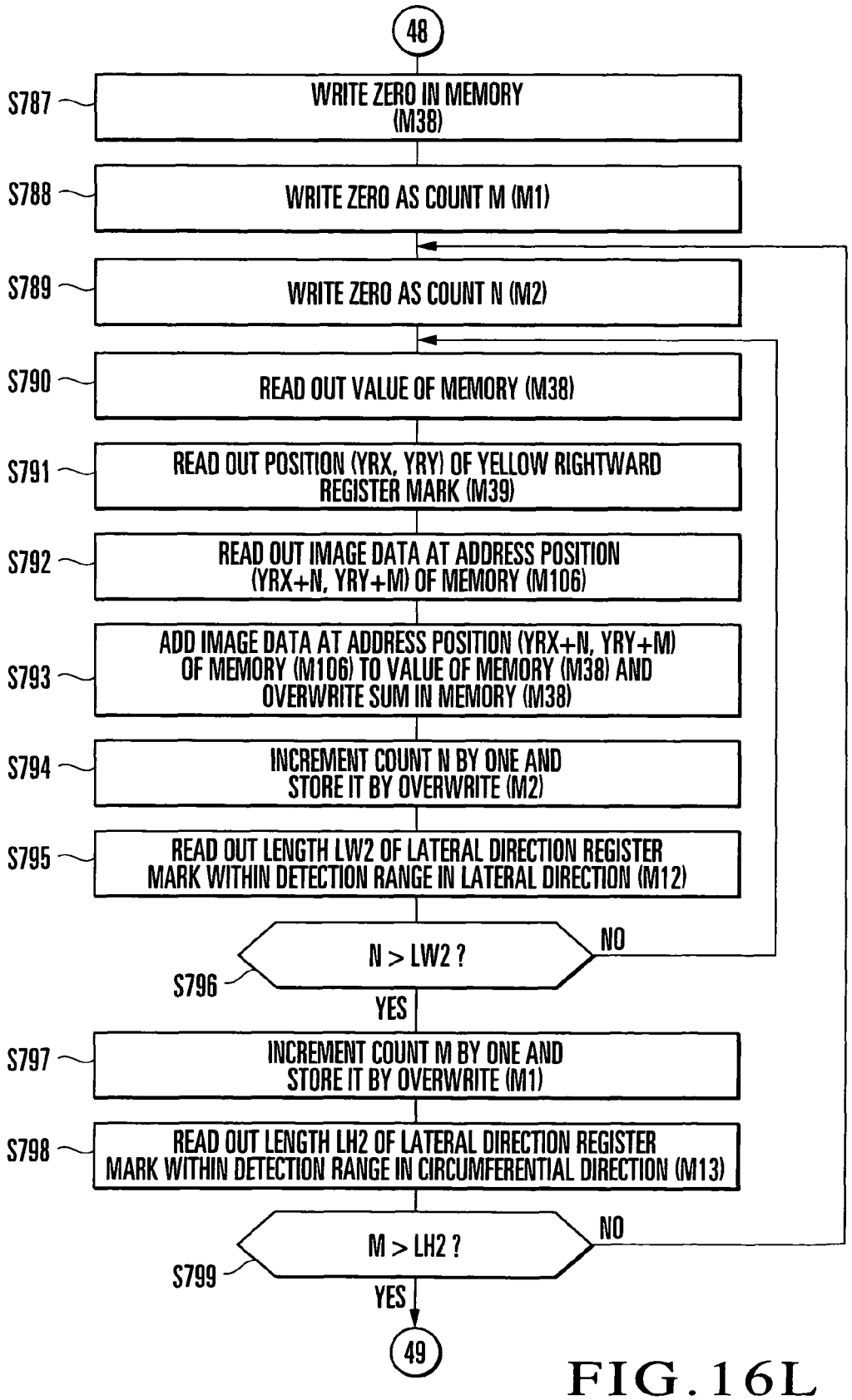

The CPU 1 then performs the processes of steps S787 to S799 (FIG. 16L) corresponding to steps S683 to S695 shown in FIG. 16D, adds the pixel values of the B reference image of the rightward reference register mark MB4, on which a yellow rightward register mark (not shown) is printed to overlap, within the target range S, and stores the sum of the pixel values of the B reference image in the memory M38 as the density information on the yellow component within the target range S.

[Acquisition of Density Information on Yellow Component of Upward Reference Register Mark+Yellow Upward Register Mark within Target Range]

Figure 16M:
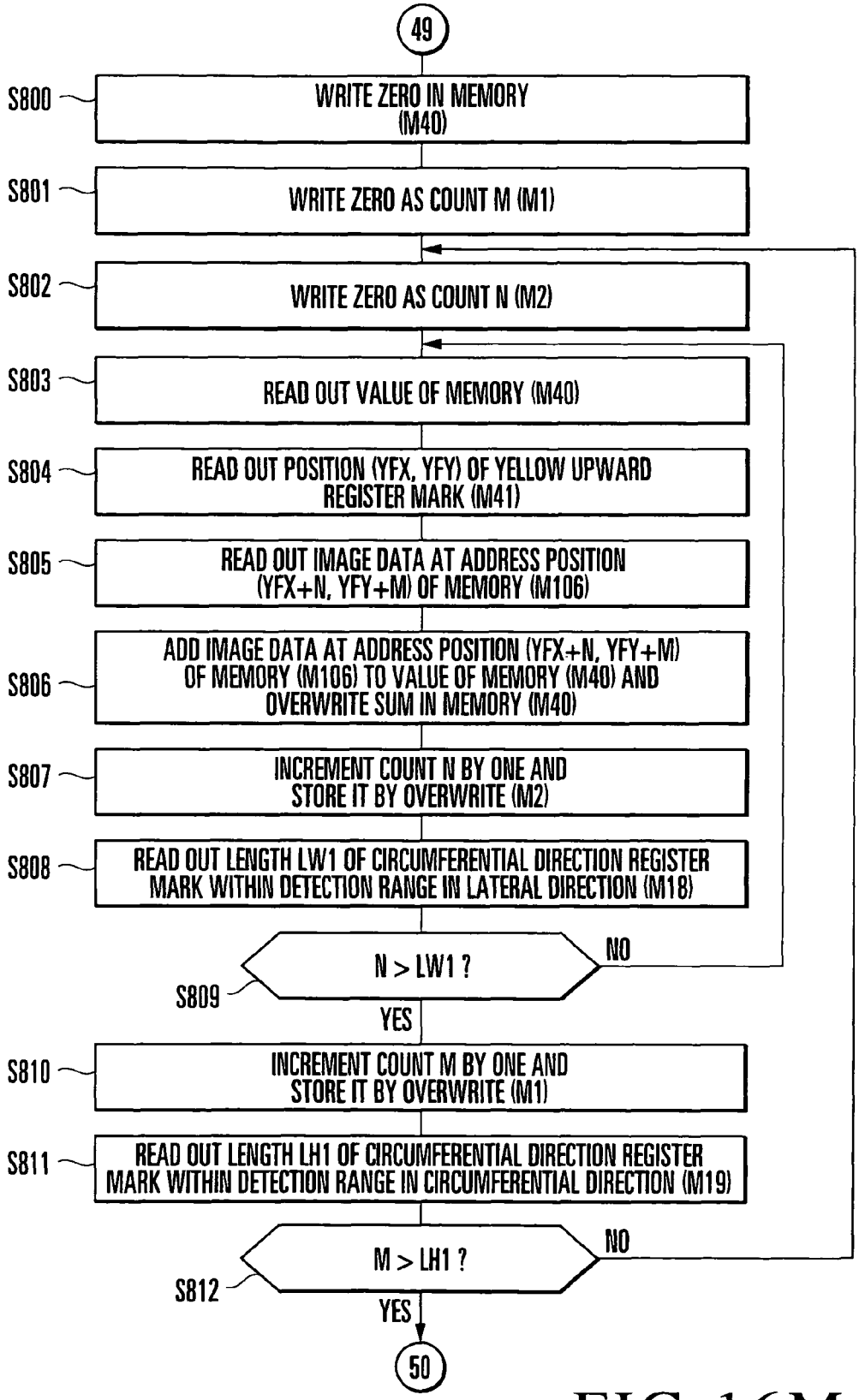

The CPU 1 then performs the processes of steps S800 to S812 (FIG. 16M) corresponding to steps S696 to S708 shown in FIG. 16E, adds the pixel values of the B reference image of the upward reference register mark MB1, on which a yellow upward register mark (not shown) is printed to overlap, within the target range S, and stores the sum of the pixel values of the B reference image in the memory M40 as the density information on the yellow component within the target range S.

[Acquisition of Density Information on Yellow Component of Downward Reference Register Mark+Yellow Downward Register Mark within Target Range]

Figure 16N:
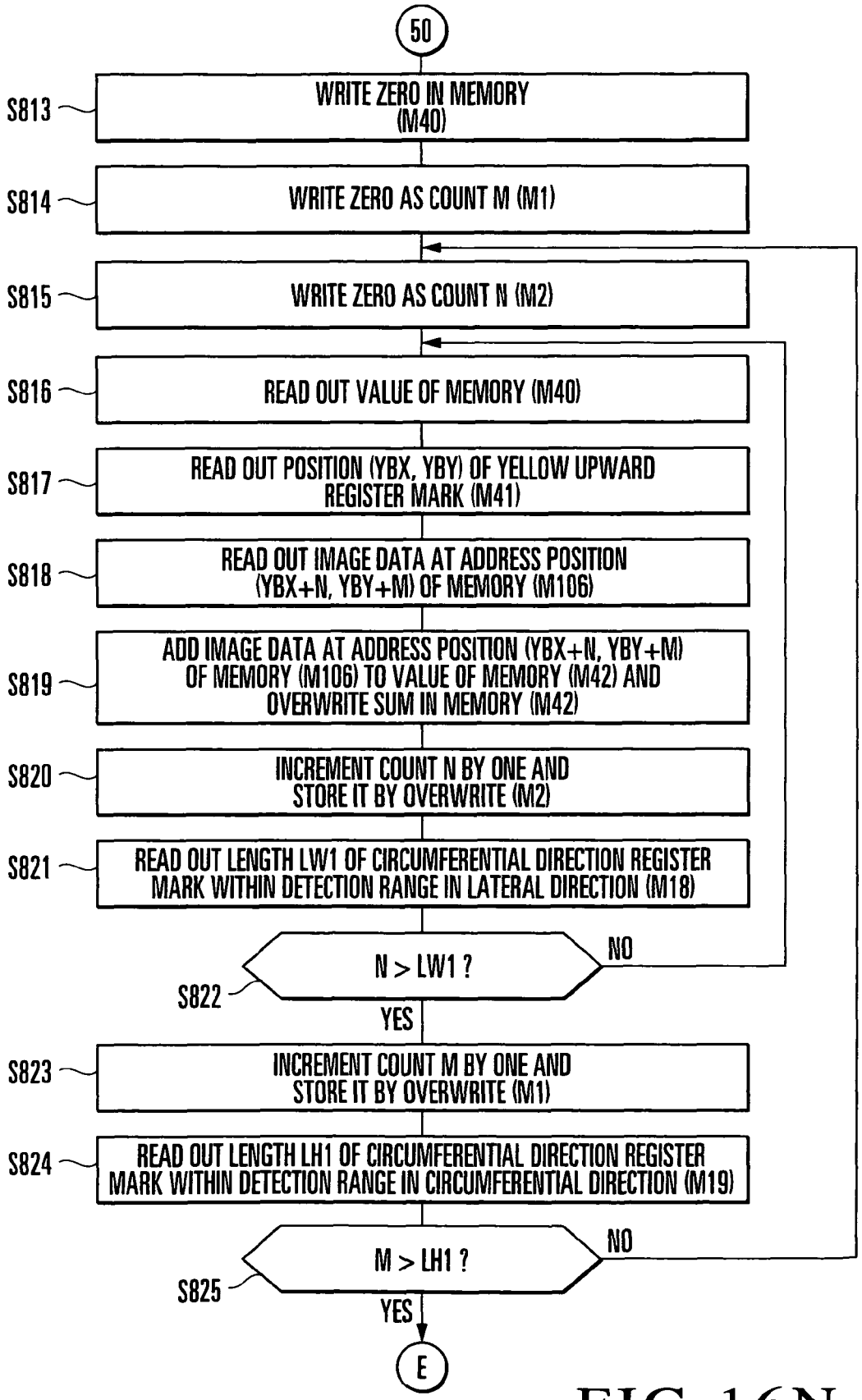

The CPU 1 then performs the processes of steps S813 to S825 (FIG. 16N) corresponding to steps S709 to S721 shown in FIG. 16F, adds the pixel values of the B reference image of the downward reference register mark MB2, on which a yellow downward register mark (not shown) is printed to overlap, within the target range S, and stores the sum of the pixel values of the B reference image in the memory M42 as the density information on the yellow component within the target range S. The process advances to the processes of step S329 and the subsequent steps shown in FIG. 13A to calculate the misregister amounts and adjust the registration positions in the same manner as in the case of the registration described above.

[Inspection]

[Loading of Inspection Target Image]

Figure 17A:
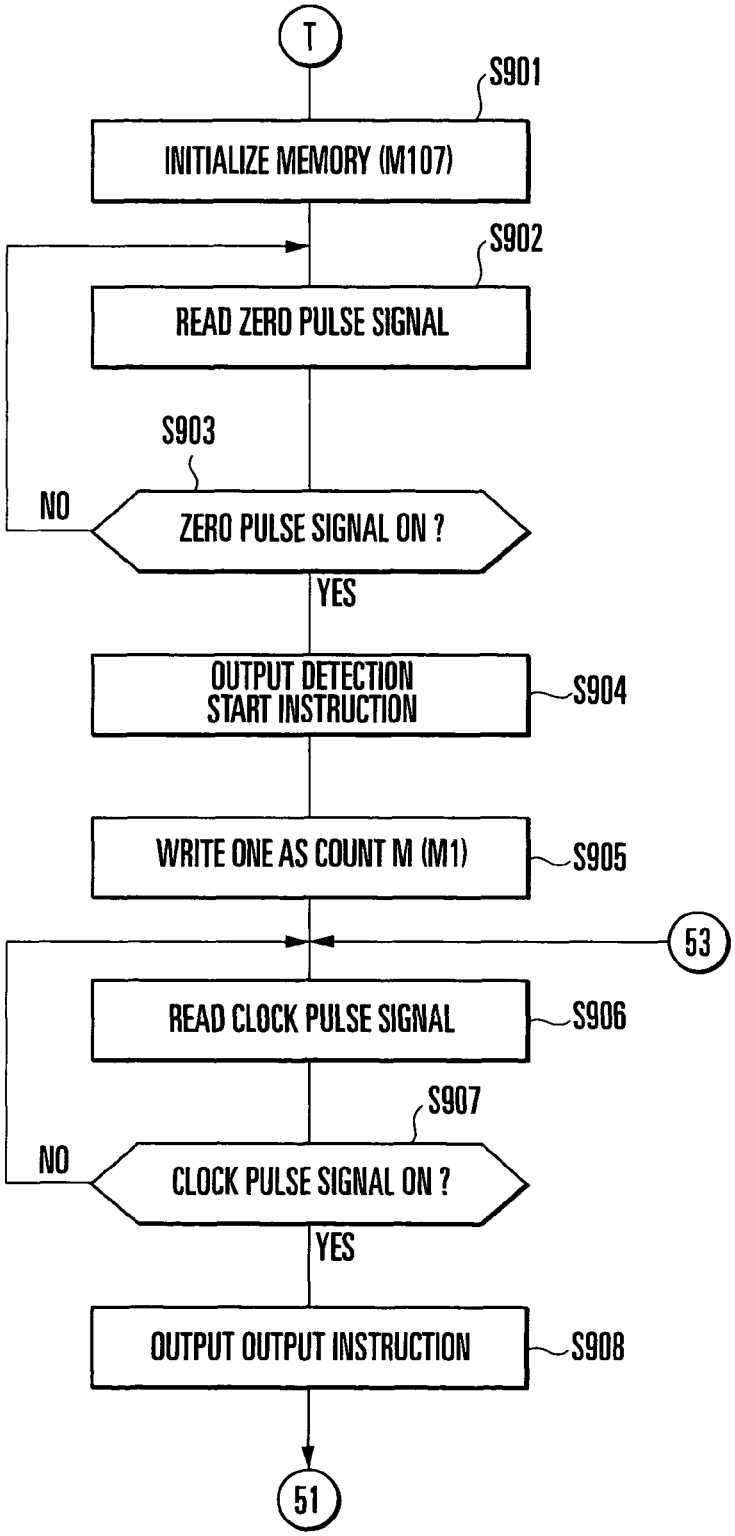
FIGS. 17A to 17C are flowcharts showing the processes of loading the inspection target image for the purpose of inspection.
Figure 17B:
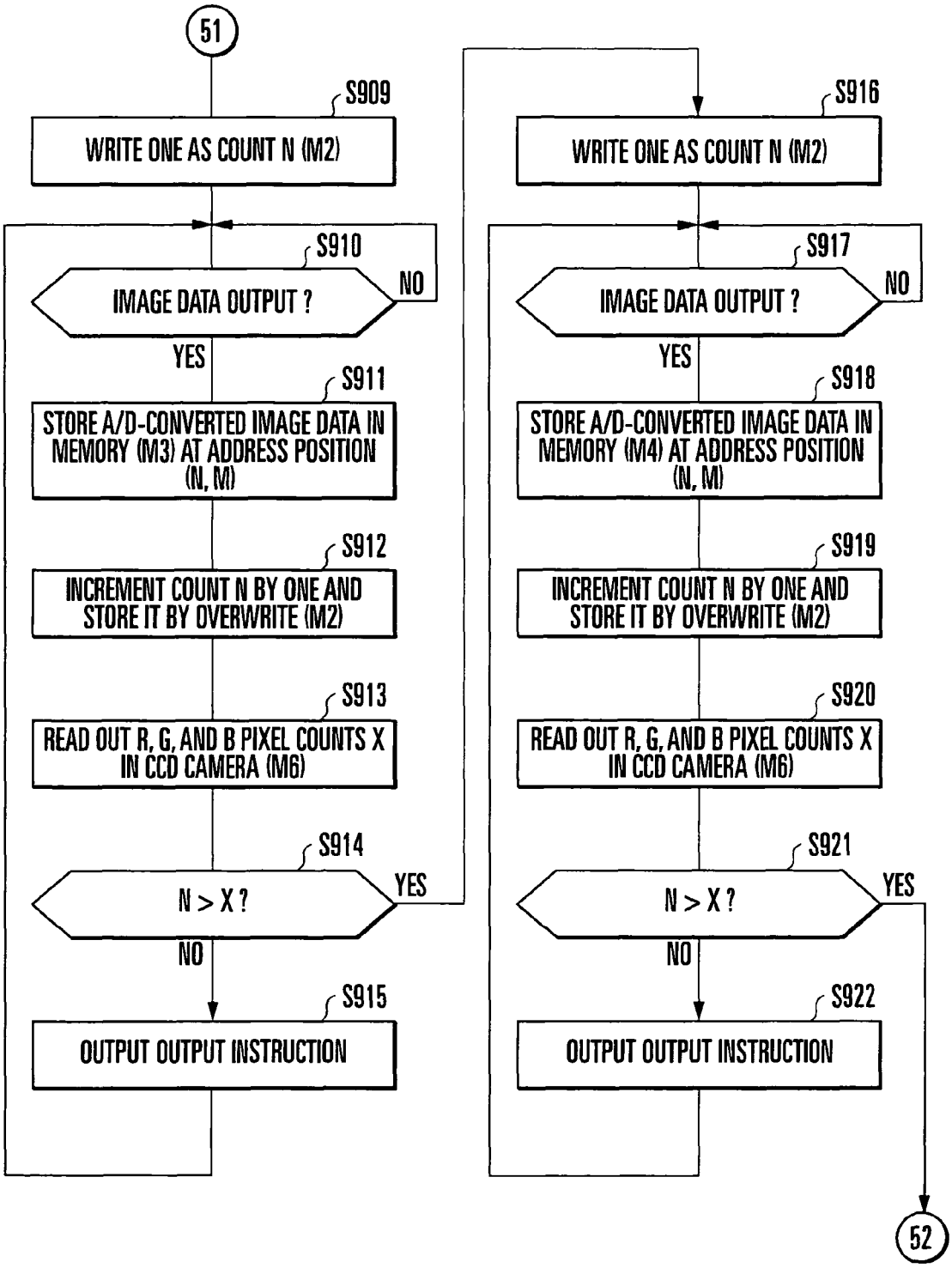
Figure 17C:
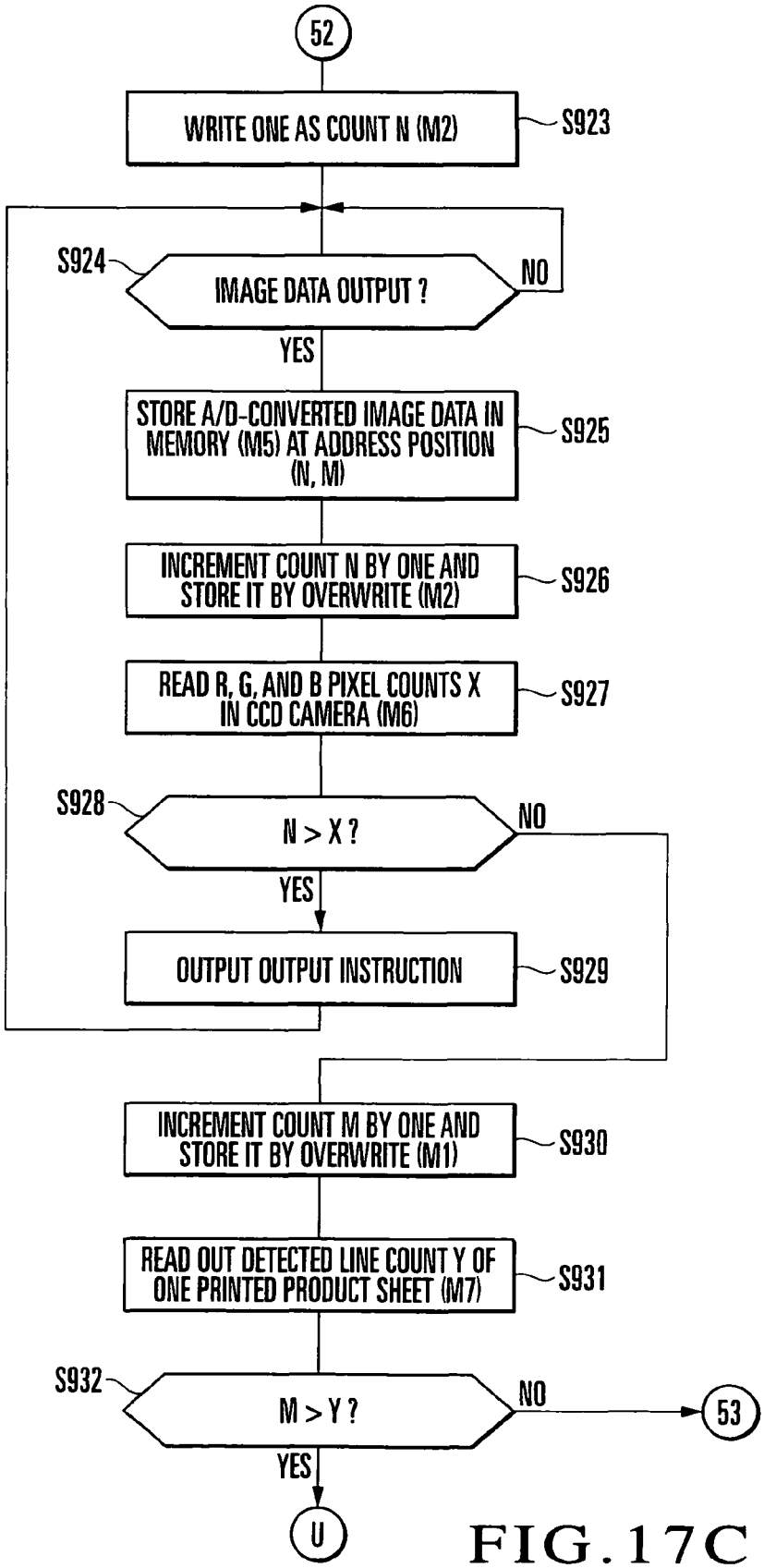

In this color misregister amount detection apparatus, when the inspection start switch 6 is turned on during printing (YES in step S103, FIG. 11A), the CPU 1 initializes the registration abnormality storing memory M107 (step S901 in FIG. 17A). Then, the CPU 1 performs the processes of steps S902 to S932 (FIGS. 17A to 17C) corresponding to steps S104 to S134 shown in FIGS. 11A to 11C, determines the given printed product as the inspection target printed product, and stores the image data on the R image, the image data on the G image, and the image data on the B image of the inspection target printed product as the R, G, and B inspection target images in the memories M3, M4, and M5, respectively.

[Calculation of Misregister Amount]

Figure 12N:
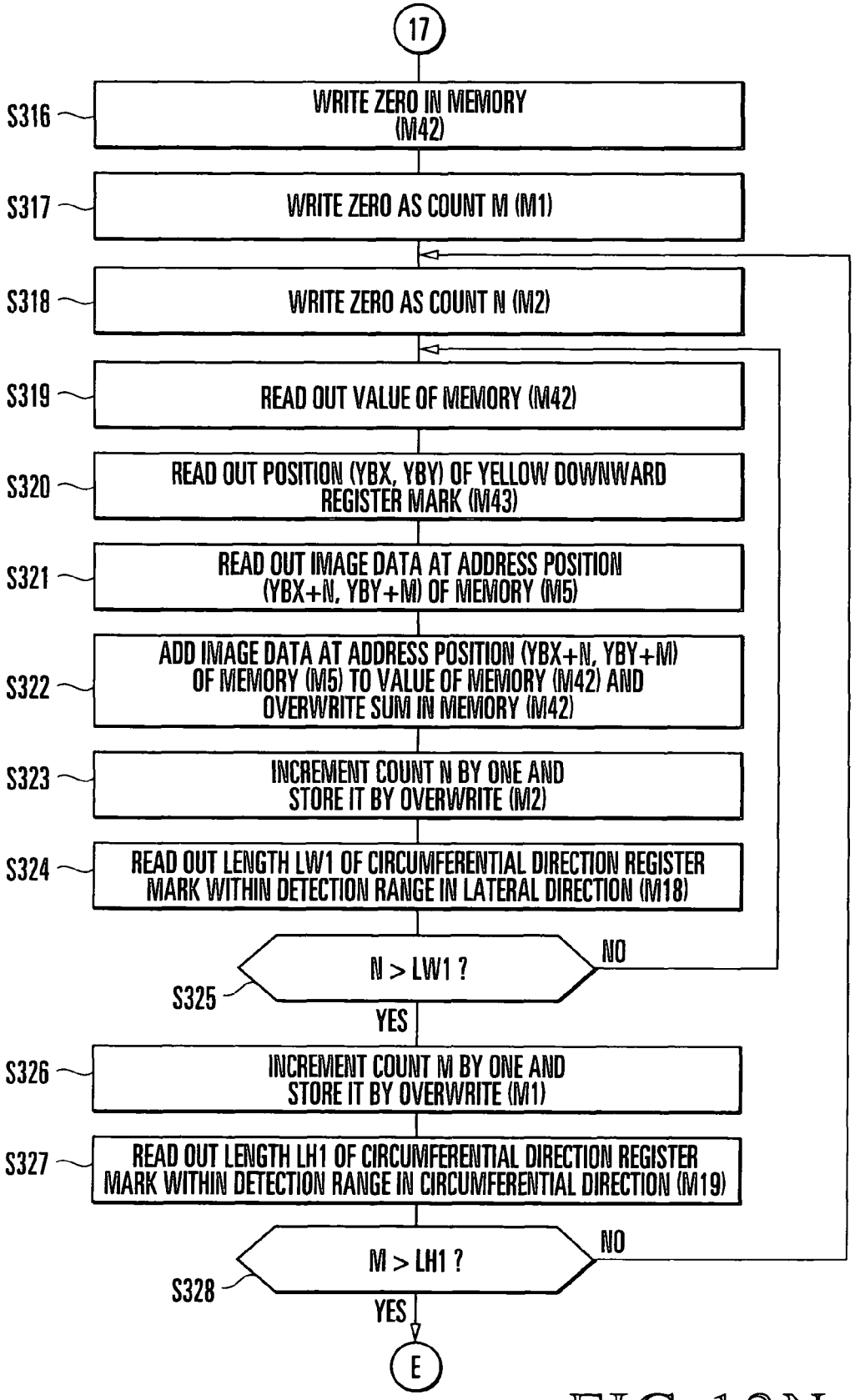
Figure 18A:
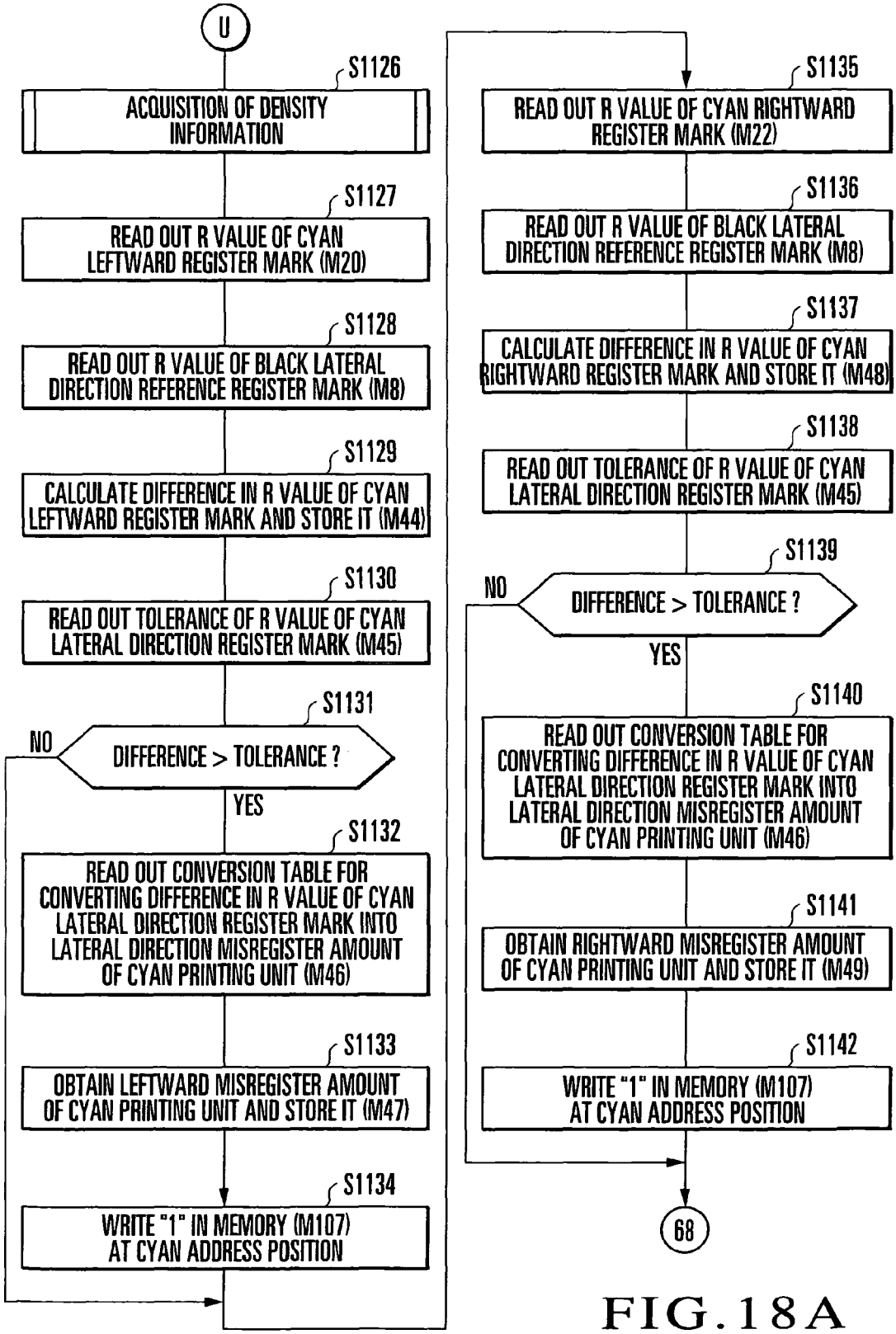
FIGS. 18A to 18F are flowcharts showing the processes, subsequent to the processes shown in FIGS. 17A to 17C, of acquiring density information on each color within the target range and calculating a misregister amount.
Figure 18B:
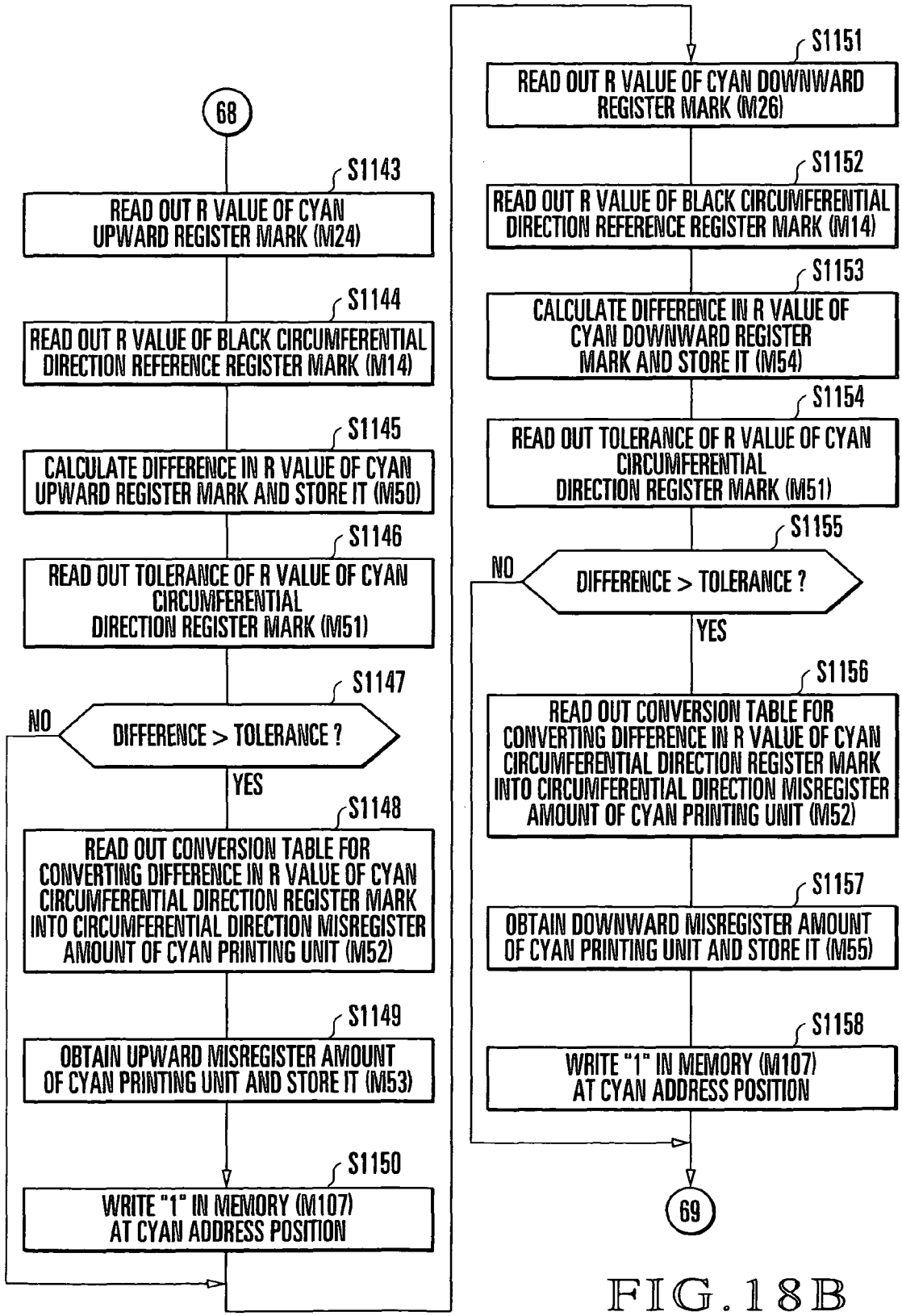
Figure 18C:
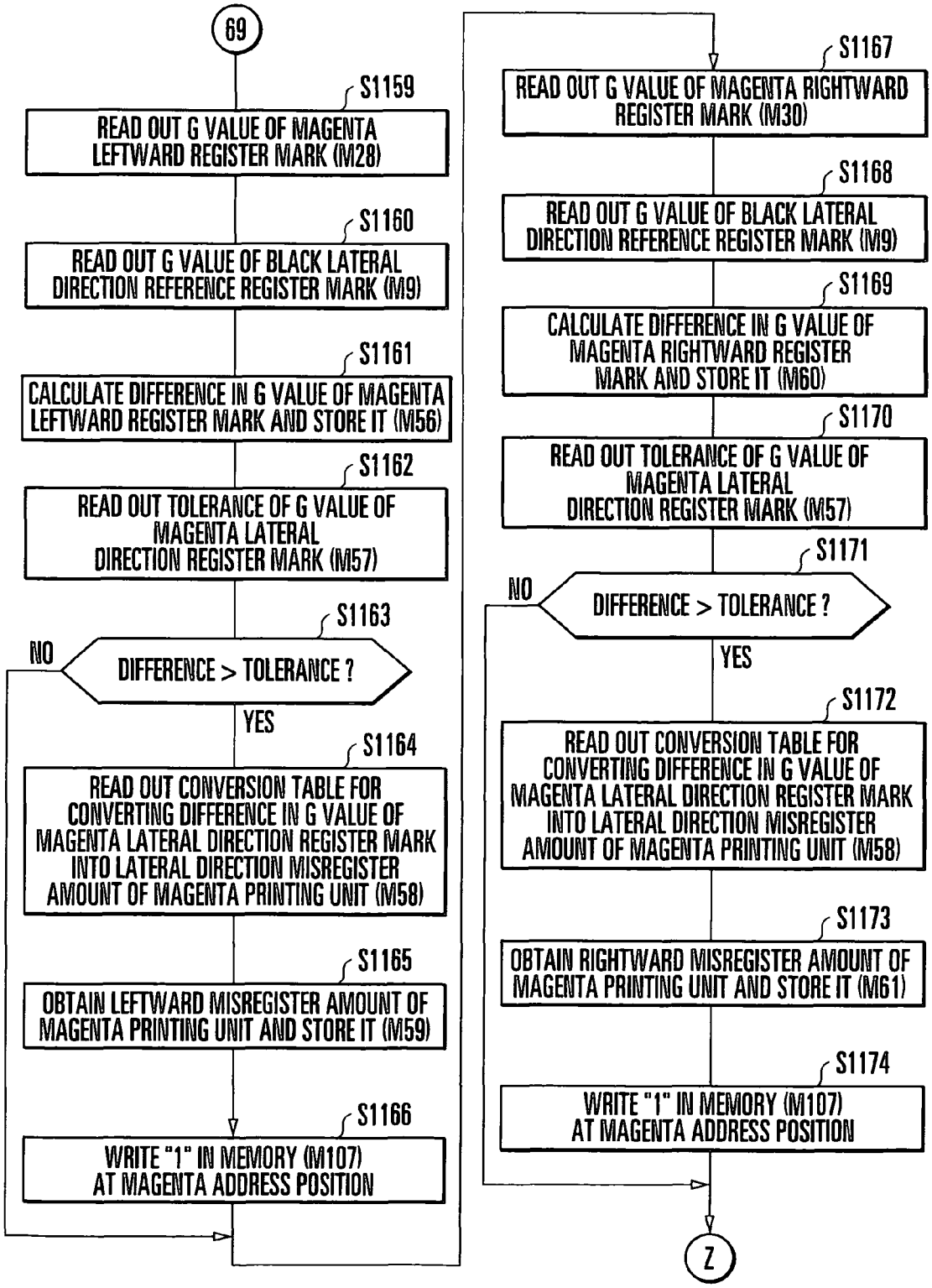
Figure 18D:
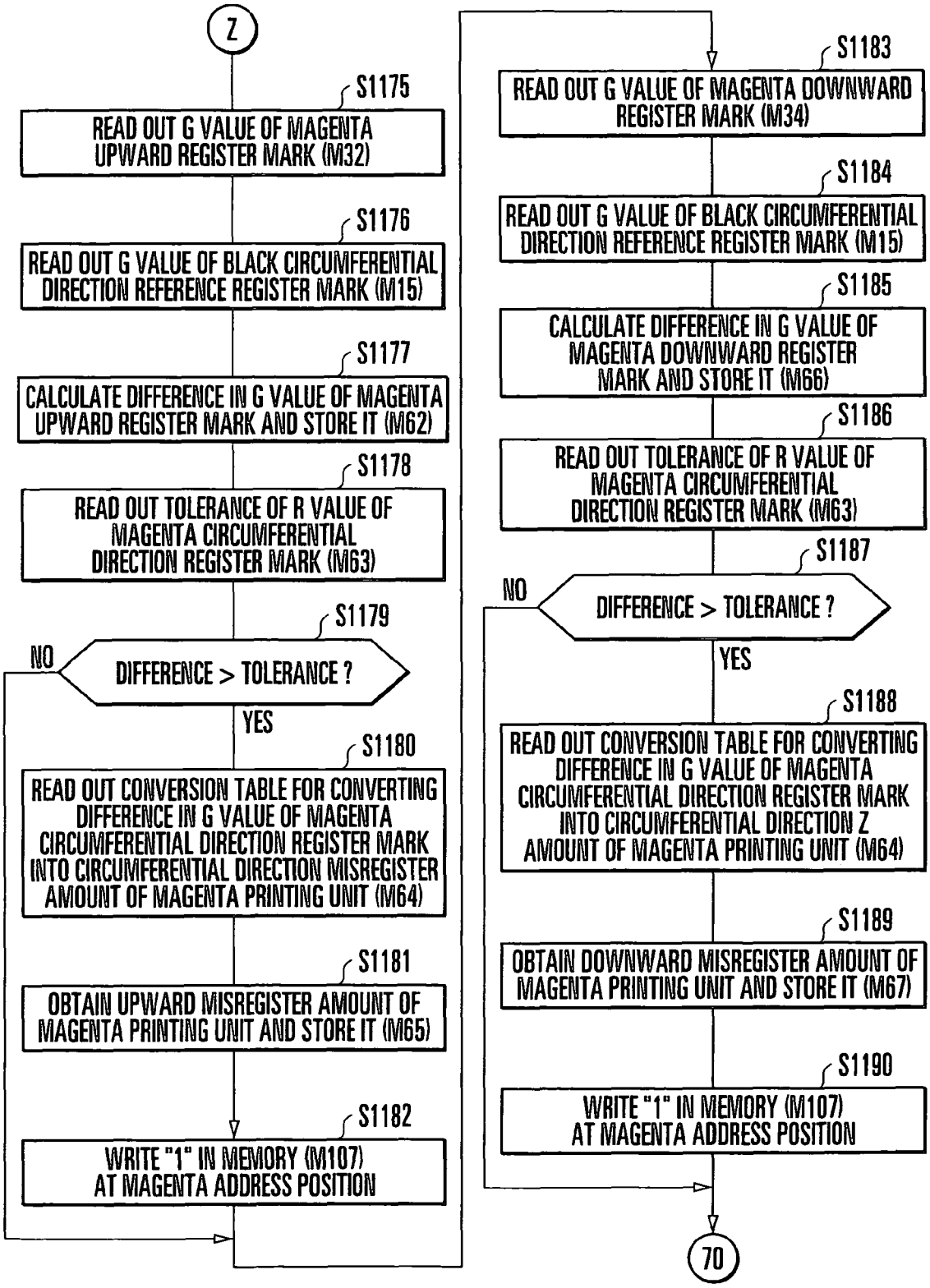
Figure 18E:
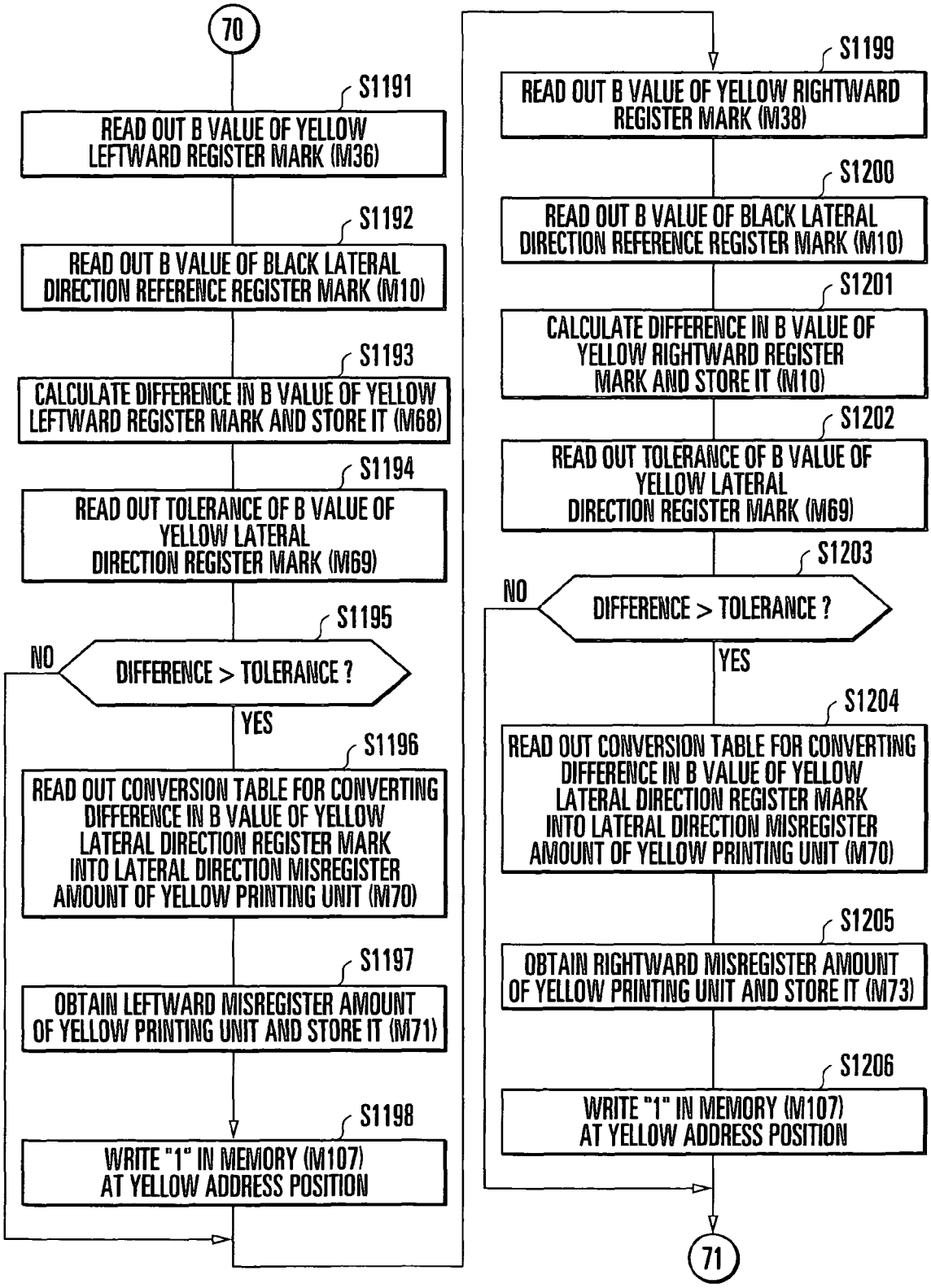
Figure 18F:
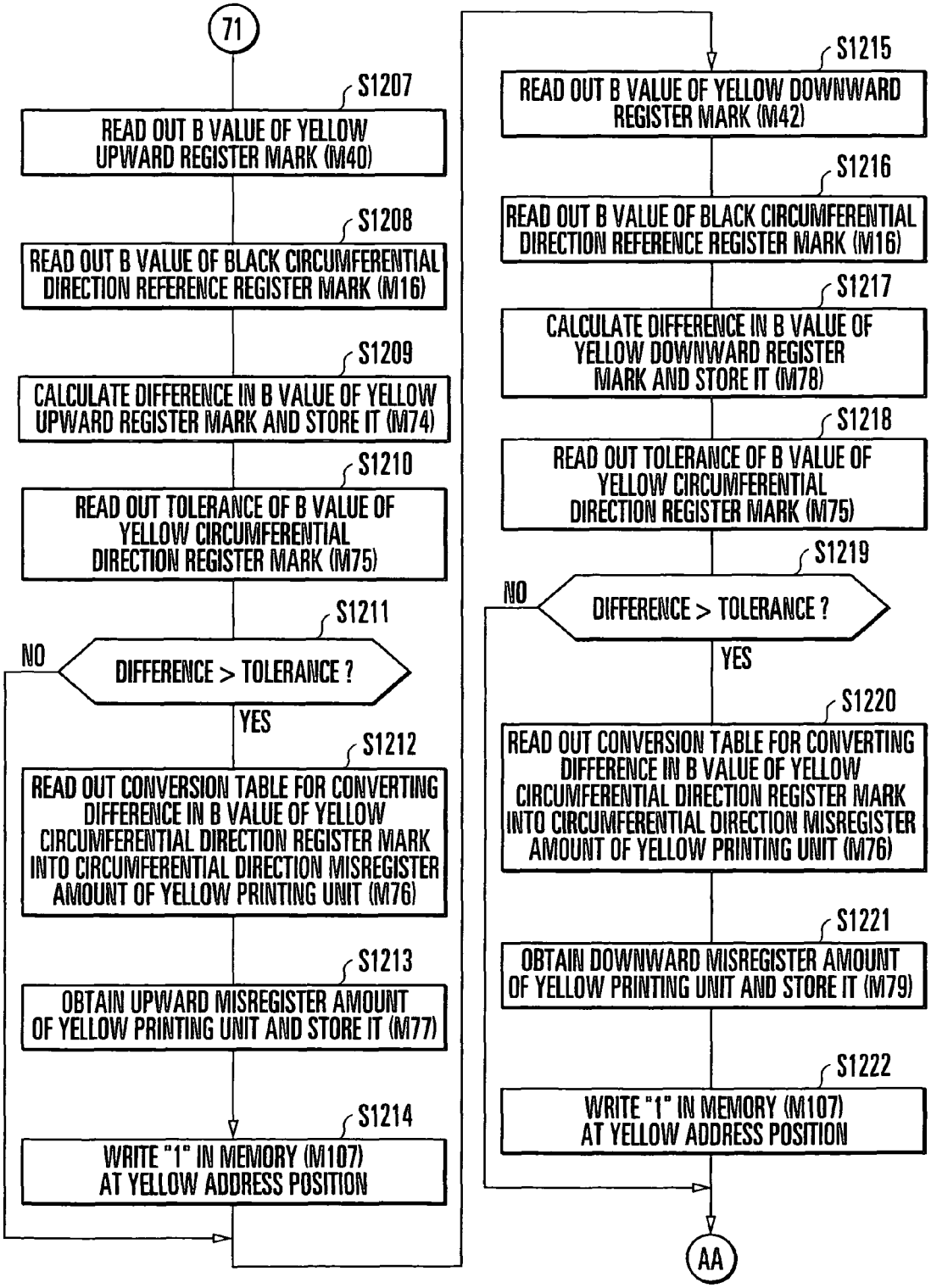

The CPU 1 then performs a process similar to those of steps S135 to S328 shown in FIGS. 12A to 12N to acquire the density information on the target range (step S1126 in FIG. 18A). Subsequently, the CPU 1 performs processes of steps S1127 to S1222 (FIGS. 18A to 18F) corresponding to steps S329 to S412 shown in FIGS. 13A to 13F to obtain the cyan lateral and circumferential direction misregister amounts, the magenta lateral and circumferential direction misregister amounts, and the yellow lateral and circumferential direction misregister amounts.

In this process, when writing the cyan leftward misregister amount, cyan rightward misregister amount, cyan upward misregister amount, and cyan downward misregister amount in the memories M47, M49, M53, and M54, respectively, the CPU 1 writes "1" in the registration abnormality storing memory M107 at the cyan address position (steps S1134, S1142, S1150, and S1158).

When writing the magenta leftward misregister amount, magenta rightward misregister amount, magenta upward misregister amount, and magenta downward misregister amount in the memories M59, M61, M65, and M67, respectively, the CPU 1 writes "1" in the registration abnormality storing memory M107 at the magenta address position (steps S1166, S1174, S1182, and S1190).

When writing the yellow leftward misregister amount, yellow rightward misregister amount, yellow upward misregister amount, and yellow downward misregister amount in the memories M71, M73, M77, and M79, respectively, the CPU 1 writes "1" in the registration abnormality storing memory M107 at the yellow address position (steps S1198, S1206, S1214, and S1222).

[Adjustment of Registration Position]

Figure 19A:
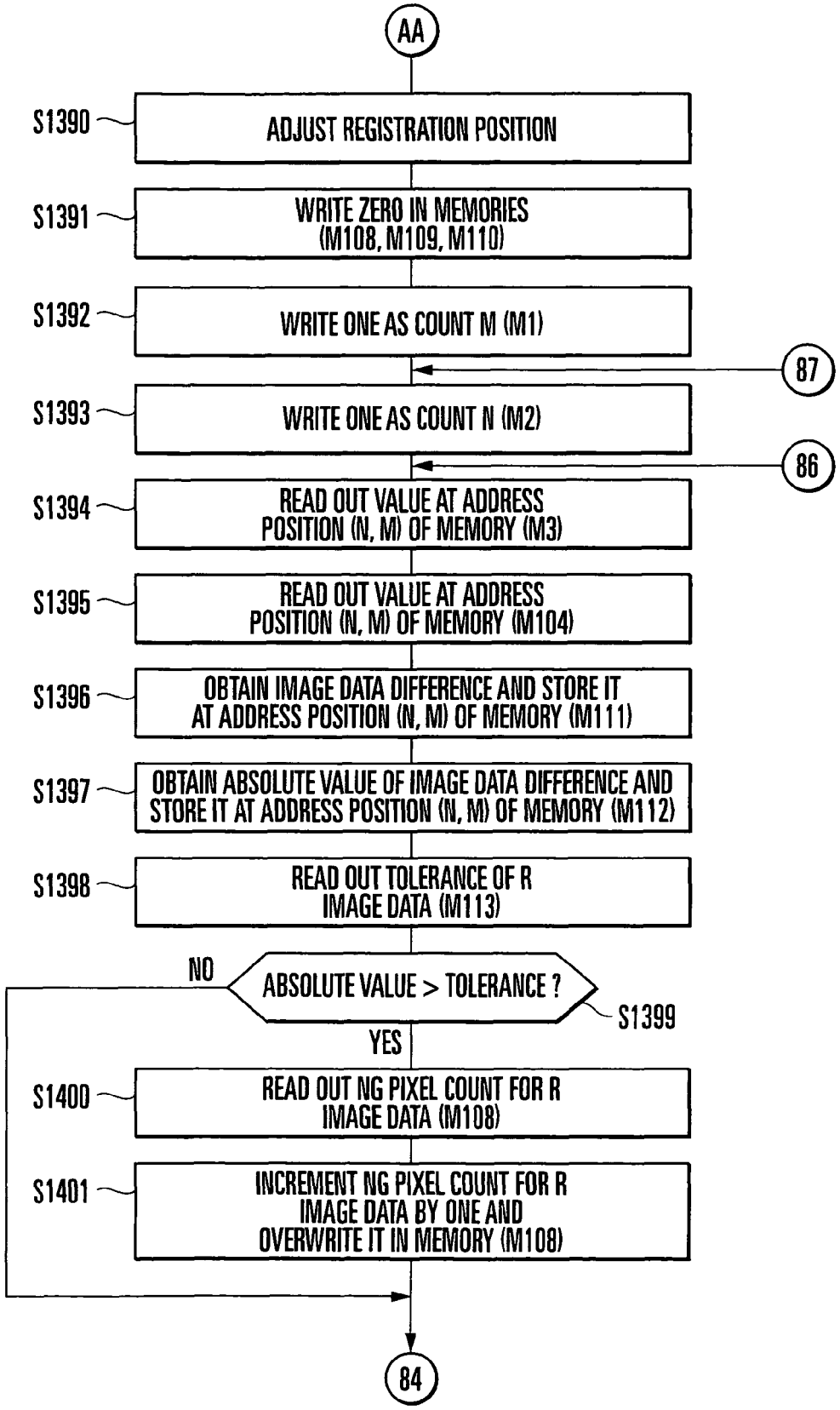
FIGS. 19A to 19F are flowcharts showing the processes, subsequent to the processes shown in FIGS. 18A to 18F, of adjusting the registration position and evaluating the printing quality.

The CPU 1 then performs a process similar to those of steps S413 to S580 shown in FIGS. 14A to 14L to adjust the plate registration positions in the lateral and circumferential directions in each of the cyan printing unit, magenta printing unit, and yellow printing unit (step S1390 in FIG. 19A).

[Evaluation of Printing Quality]

The CPU 1 evaluates the printing quality of the inspection target printed product. The printing quality of the inspection target printed product is evaluated in the following manner.

First, the CPU 1 resets the counts of the memories M108, M109, and M 110, which respectively store the NG pixel counts of the R, G, and B image data, to zero (step S1391 in FIG. 19A), and sets the count M to one (step S1392) and the count N to one (step S1393).

The CPU 1 reads out the value at the address position (N, M) of the memory M3 which stores the image data on the R inspection target image (step S1394) and the value at the address position (N, M) of the memory M104 which stores the image data on the R reference image (step S1395), subtracts the value read out from the memory M104 at the address position (N, M) from the value read out from the memory M3 at the address position (N, M) to obtain an R image data difference, and stores the R image data difference in the memory Mill at the address position (N, M) (step S1396).

The CPU 1 obtains the absolute value of the R image data difference obtained in step S1396, stores the absolute value in the memory M112 at the address position (N, M) (step S1397), reads out the tolerance of the R image data from the memory M113 (step S1398), and compares the readout tolerance with the absolute value of the R image data difference (step S1399).

Figure 19B:
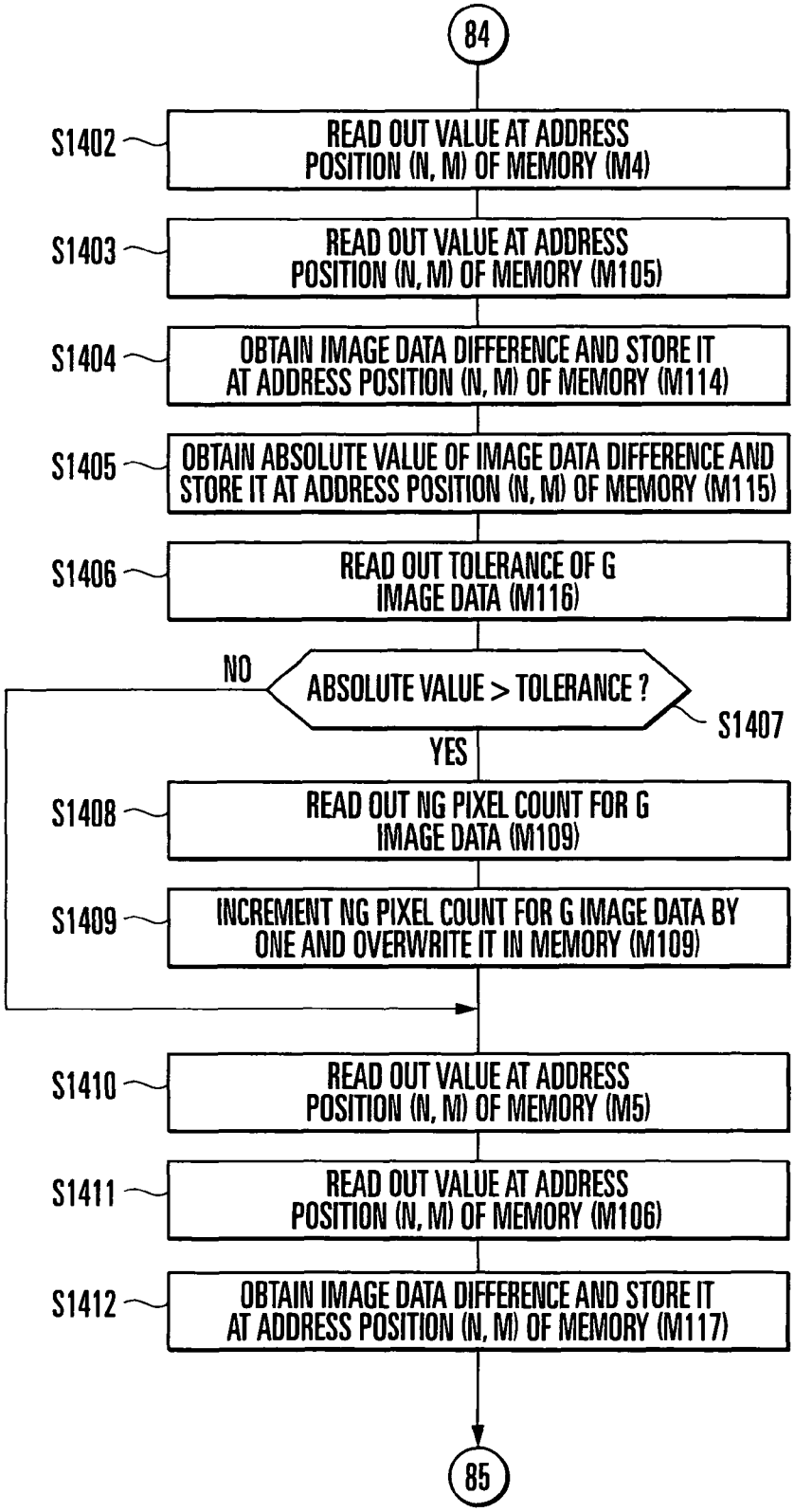

If the absolute value of the R image data difference exceeds the tolerance (YES in step S1399), the CPU 1 determines the given pixel as an NG pixel and increments the count (the NG pixel count for the R image data) of the memory M108 by one (steps S1400 and S1401). If the absolute value of the R image data difference is equal to or less than the tolerance (NO in step S1399), the CPU 1 does not increment the count of the memory M108, and the process advances to step S1402 (FIG. 19B) immediately.

In step S1402, the CPU 1 reads out the value at the address position (N, M) of the memory M4 which stores the image data on the G inspection target image. The CPU 1 reads out the value at the address position (N, M) of the memory M105 which stores the image data on the G reference image (step S1403). The CPU 1 then subtracts the value read out from the memory M105 at the address position (N, M) from the value read out from the memory M4 at the address position (N, M) to obtain the G image data difference, and stores the G image data difference in the memory M114 at the address position (N, M) (step S1404).

The CPU 1 then obtains the absolute value of the G image data difference obtained in step S1404 and stores it in the memory M115 at the address position (N, M) (step S1405). The CPU 1 also reads out the tolerance of the G image data from the memory M116 (step S1406) and compares the readout tolerance with the absolute value of the G image data difference (step S1407).

If the absolute value of the G image data difference exceeds the tolerance (YES in step S1407), the CPU 1 determines the given pixel as an NG pixel and increments the count (the NG pixel count for the G image data) of the memory M109 by one (steps S1408 and S1409). If the absolute value of the G image data difference is equal to or less than the tolerance (NO in step S1407), the CPU 1 does not increment the count of the memory M109, and the process advances to step S1410 immediately.

In step S1410, the CPU 1 reads out the value at the address position (N, M) of the memory M5 which stores the image data on the B inspection target image and the value at the address position (N, M) of the memory M106 which stores the image data on the B reference image (step S1411), subtracts the value read out from the memory M106 at the address position (N, M) from the value read out from the memory M5 at the address position (N, M) to obtain a B image data difference, and stores the B image data difference in the memory M117 at the address position (N, M) (step S1412).

Figure 19C:
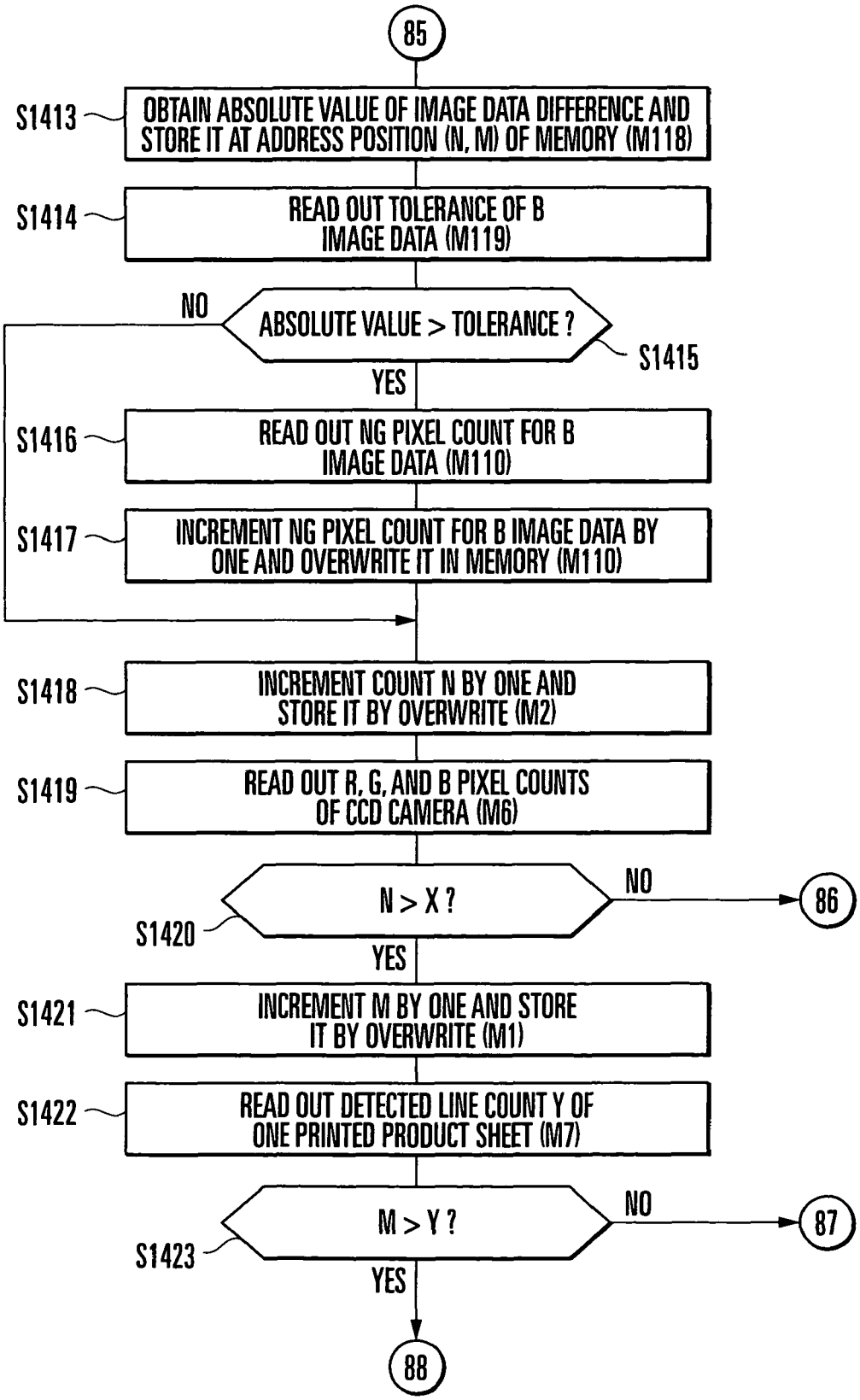

The CPU 1 obtains the absolute value of the B image data difference obtained in step S1412, stores the absolute value in the memory M118 at the address position (N, M) (step S1413 in FIG. 19C), reads out the tolerance of the B image data from the memory M119 (step S1414), and compares the readout tolerance with the absolute value of the B image data difference (step S1415).

If the absolute value of the B image data difference exceeds the tolerance (YES in step S1415), the CPU 1 determines the given pixel as an NG pixel and increments the count (the NG pixel count for the B image data) of the memory M110 by one (steps S1416 and S1417). If the absolute value of the B image data difference is equal to or less than the tolerance (NO in step S1415), the CPU 1 does not increment the count of the memory M110, and the process advances to step S1418 immediately.

The CPU 1 increments the count N by one in step S1418 and reads out the respective pixel counts X of R, G, and B of the CCD camera 11 set in the memory M6 (step S1419). The process then returns to step S1394 (FIG. 19A) in response to NO in step S1420. The CPU 1 repeats the processes of steps S1394 to S1420 until the count N exceeds X in step S1420.

When the count N exceeds X (YES in step S1420), the CPU 1 increments the count M by one (step S1421) and reads out the detected line count Y of one printed product sheet set in the memory M7 (step S1422). The process then returns to step S1393 (FIG. 19A) in response to NO in step S1423. The CPU 1 repeats the processes of steps S1393 to S1423 until the count M exceeds Y in step S1423.

Thus, the pixel count in the R inspection target image in the memory M3 which is determined as NG (NG image pixel count for the R image data) is stored in the memory M108. The pixel count in the G inspection target image in the memory M4 which is determined as NG (NG pixel count for the G image data) is stored in the memory M109. The pixel count in the B inspection target image in the memory M5 which is determined as NG (NG pixel count for the B image data) is stored in the memory M110.

Figure 19D:
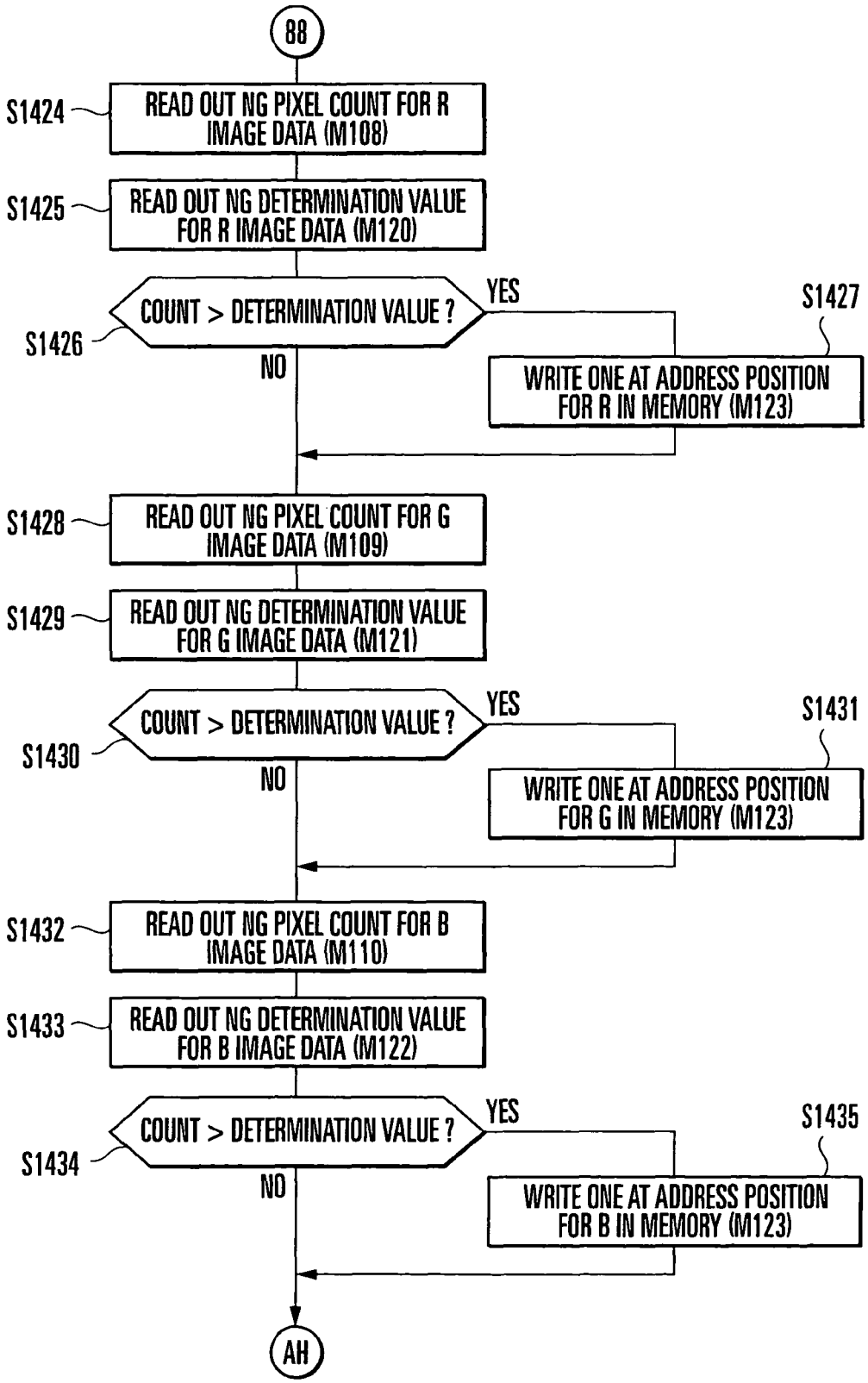

The CPU 1 reads out the NG pixel count for the R image data from the memory M108 (step S1424 in FIG. 19D) and the NG determination value for the R image data from the memory M120 (step S1425). If the NG pixel count for the R image data exceeds the NG determination value for the R image data (YES in step S1426), the CPU 1 writes "1" in the memory M123 at the address position for R (step S1427).

The CPU 1 reads out the NG pixel count for the G image data from the memory M109 (step S1428) and the NG determination value for the G image data from the memory M121 (step S1429). If the NG pixel count for the G image data exceeds the NG determination value for the G image data (YES in step S1430), the CPU 1 writes "1" in the memory M123 at the address position for G (step S1431).

The CPU 1 reads out the NG pixel count for the B image data from the memory M110 (step S1432) and the NG determination value for the B image data from the memory M122 (step S1433). If the NG pixel count for the B image data exceeds the NG determination value for the B image data (YES in step S1434), the CPU 1 writes "1" in the memory M123 at the address position for B (step S1435).

[Display of Evaluation Result]

Figure 19E:
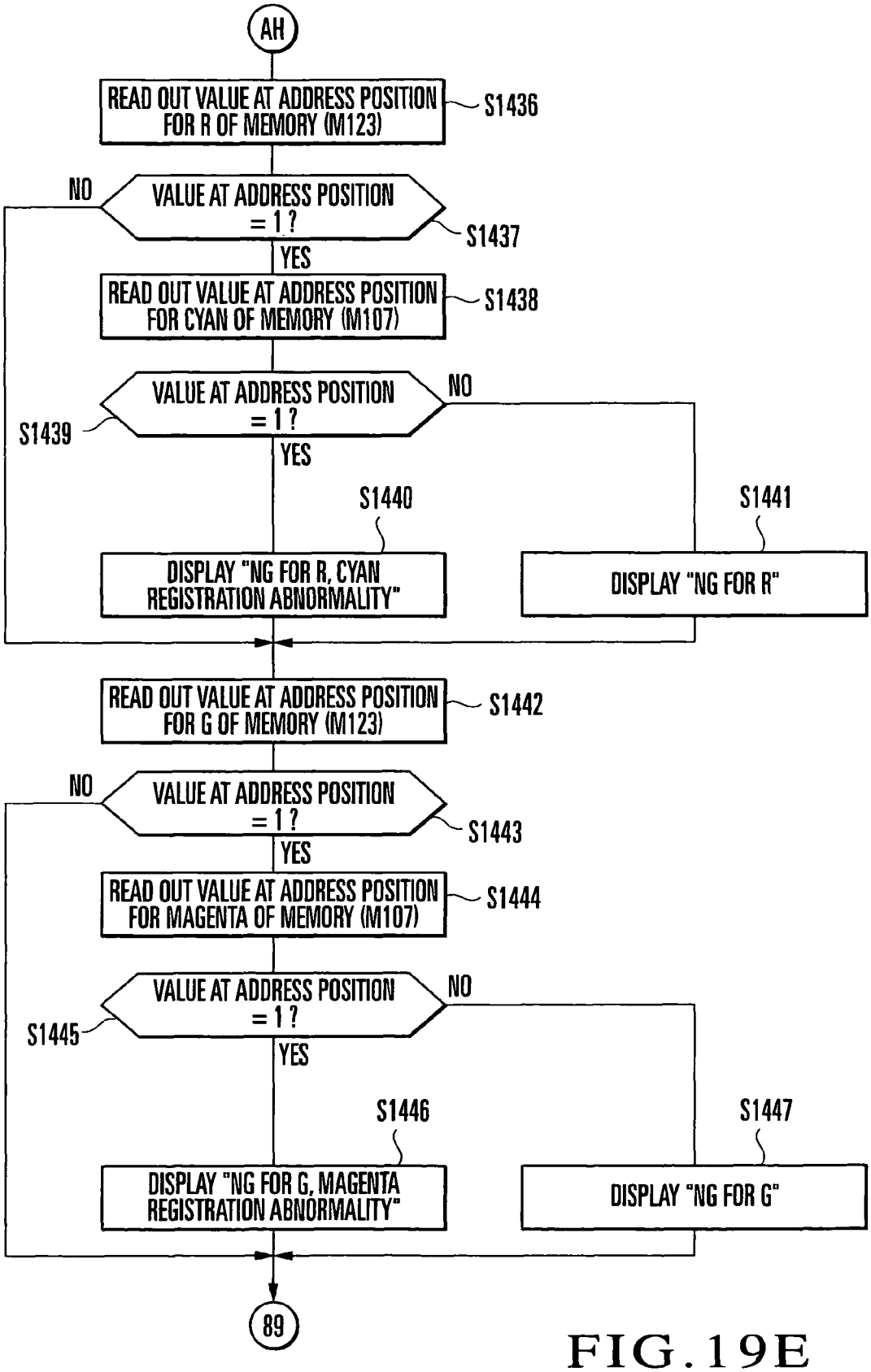

The CPU 1 reads out the value in the memory M123 at the address position for R (step S1436 in FIG. 19E). If the value at the address position for R in the memory M123 is "1" (YES in step S1437), the CPU 1 reads out the value at the address position for cyan of the registration abnormality storing memory M107 (step S1438). If the value at the address position for cyan in the registration abnormality storing memory M107 is "1" (YES in step S1439), "NG for R, Cyan Registration Abnormality" is displayed on the display 9 (step S1440). If the value at the address position for cyan in the registration abnormality storing memory M107 is not "1" (NO in step S1439), "NG for R" is displayed on the display 9 (step S1441).

The CPU 1 reads out the value in the memory M123 at the address position for G (step S1442). If the value at the address position for G in the memory M123 is "1" (YES in step S1443), the CPU 1 reads out the value at the address position for magenta of the registration abnormality storing memory M107 (step S1444). If the value at the address position for magenta in the registration abnormality storing memory M107 is "1" (YES in step S1445), "NG for G, Magenta Registration Abnormality" is displayed on the display 9 (step S1446). If the value at the address position for magenta in the registration abnormality storing memory M107 is not "1" (NO in step S1445), "NG for G" is displayed on the display 9 (step S1446).

The CPU 1 reads out the value in the memory M123 at the address position for B (step S1448). If the value at the address position for B in the memory M123 is "1" (YES in step S1449), the CPU 1 reads out the value at the address position for yellow of the registration abnormality storing memory M107 (step S1450). If the value at the address position for yellow in the registration abnormality storing memory M107 is "1" (YES in step S1451), "NG for B, Yellow Registration Abnormality" is displayed on the display 9 (step S1452). If the value at the address position for yellow in the registration abnormality storing memory M107 is not "1" (NO in step S1451), "NG for B" is displayed on the display 9 (step S1453).

After the evaluation result is displayed, if the reset switch 7 is turned on (YES in step S1454), the CPU 1 clears "NG" displayed on the display 9 (step S1455). The process then returns to step S901 (FIG. 17A).

[Second Embodiment]

Figure 20:
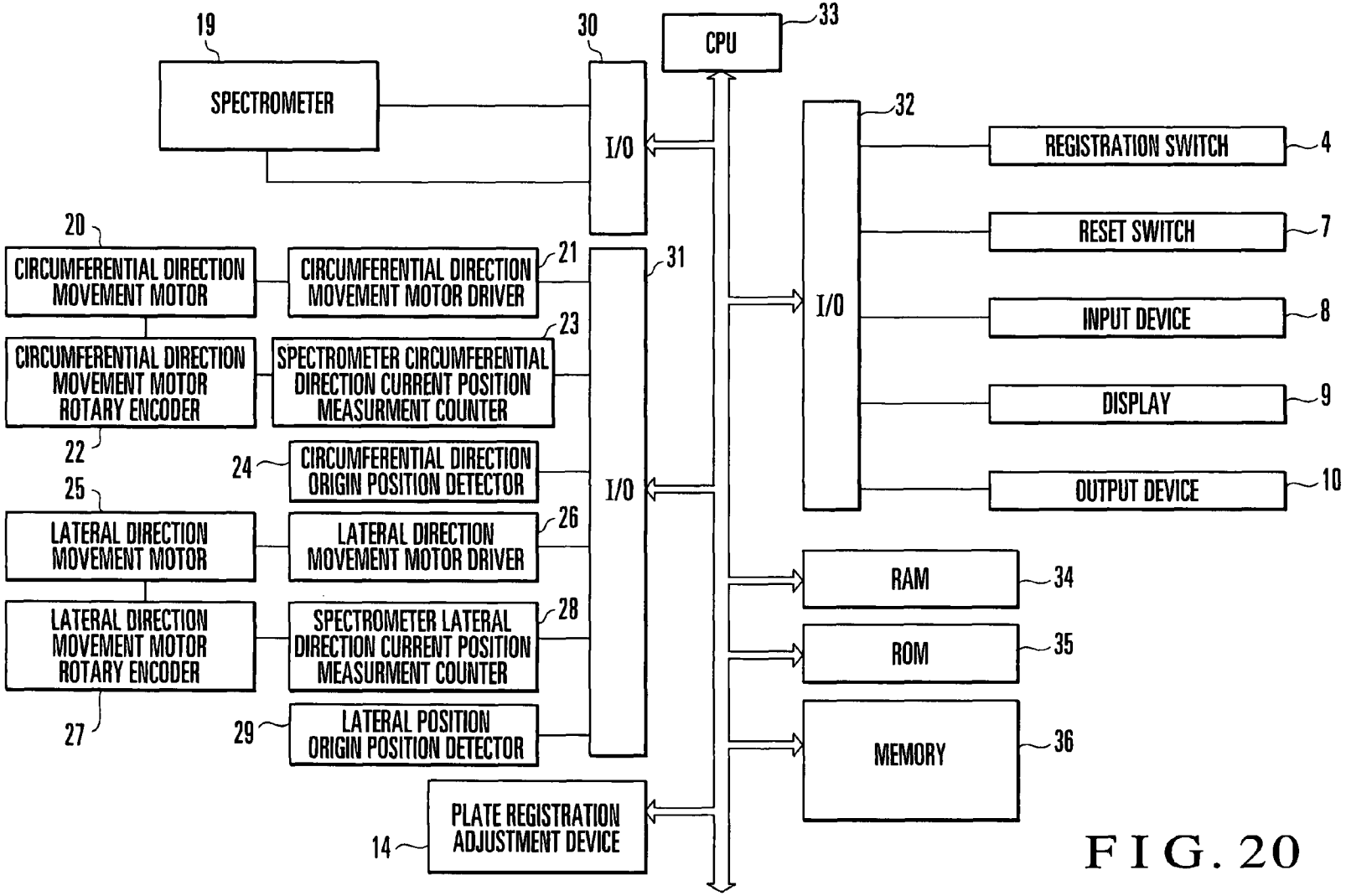
FIG. 20 is a block diagram showing a color misregister amount detection apparatus according to the second embodiment of the present invention.

FIG. 20 is a block diagram of a printed product color misregister amount detection apparatus according to the second embodiment of the present invention which utilizes the detection principle described above. This printed product color misregister amount detection apparatus comprises a CPU 33, RAM 34, ROM 35, registration switch 4, reset switch 7, input device 8, display 9, output device 10, plate registration adjustment device 14, memory 36, and spectrometer 19. Note that the spectrometer 19 includes its controller and A/D converter.

The spectrometer 19 is provided with a circumferential direction movement motor 20, a circumferential direction movement motor driver 21, a circumferential direction movement motor rotary encoder 22, a counter 23 for detecting the current position of the spectrometer in the circumferential direction, a circumferential direction origin position detector 24, a lateral direction movement motor 25, a lateral direction movement motor driver 26, a lateral direction movement motor rotary encoder 27, a counter 28 for measuring the current position of the spectrometer in the lateral direction, and a lateral direction origin position detector 29.

Reference numerals 30 to 32 denote input/output interfaces (I/Os). The plate registration adjustment device 14 has the same structure (see FIG. 9) as that of the first embodiment.

Figure 21:
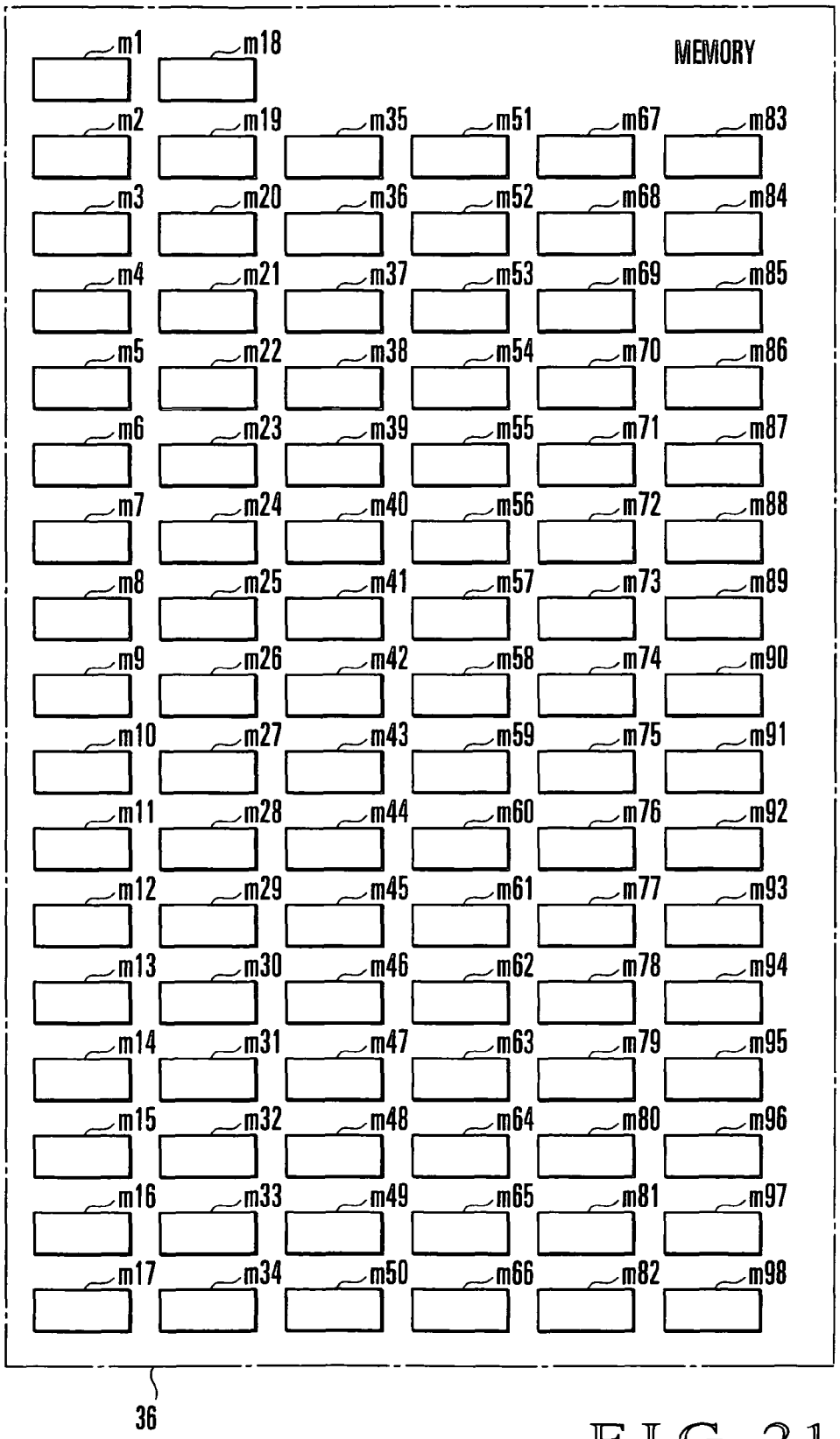
FIG. 21 is a block diagram showing the configuration of a memory in FIG. 20.

FIG. 21 shows the configuration of the memory 36 in blocks. The memory 36 comprises memories m1 to m98. The memory m1 stores the count of the counter for detecting the current position of the spectrometer in the circumferential direction. The memory m2 stores the current position of the spectrometer in the circumferential direction. The memory m3 stores the position (BLX, BLY) of a black lateral direction reference register mark. The memory m4 stores the count of the counter for measuring the current position of the spectrometer in the lateral direction. The memory m5 stores the current position of the spectrometer in the lateral direction. The memory m6 stores an output from the spectrometer. The memory m7 stores the cyan density value of the black lateral direction reference register mark. The memory m8 stores the magenta density value of the black lateral direction reference register mark. The memory m9 stores the yellow density value of the black lateral direction reference register mark. The memory m10 stores the position (BCX, BCY) of a black circumferential direction reference register mark. The memory m11 stores the cyan density value of the black circumferential direction reference register mark. The memory m12 stores the magenta density value of the black circumferential direction reference register mark. The memory m13 stores the yellow density value of the black circumferential direction register mark. The memory m14 stores the position (CLX, CLY) of a cyan leftward register mark. The memory m15 stores the cyan density value of the cyan leftward register mark. The memory m16 stores the position (CRX, CRY) of a cyan rightward register mark. The memory m17 stores the cyan density value of the cyan rightward register mark. The memory m18 stores the position (CFX, CFY) of a cyan upward register mark. The memory m19 stores the cyan density value of the cyan upward register mark. The memory m20 stores the position (CBX, CBY) of a cyan downward register mark. The memory m21 stores the cyan density value of the cyan downward register mark. The memory m22 stores the position (MLX, MLY) of a magenta leftward register mark. The memory m23 stores the magenta density value of the magenta leftward register mark. The memory m24 stores the position (MRX, MRY) of a magenta rightward register mark. The memory m25 stores the magenta density value of the magenta rightward register mark. The memory m26 stores the position (MFX, MFY) of a magenta upward register mark. The memory m27 stores the magenta density value of the magenta upward register mark. The memory m28 stores the position (MBX, MBY) of a magenta downward register mark. The memory m29 stores the magenta density value of the magenta downward register mark. The memory m31 stores the position (YLX, YLY) of a yellow leftward register mark. The memory m32 stores the yellow density value of the yellow leftward register mark. The memory m33 stores the position (YRX, YRY) of a yellow rightward register mark. The memory m34 stores the yellow density value of the yellow rightward register mark. The memory m35 stores the position (YFX, YFY) of a yellow upward register mark. The memory m36 stores the yellow density value of the yellow upward register mark. The memory m37 stores the position (YBX, YBY) of a yellow downward register mark. The memory m38 stores the yellow density value of the yellow downward register mark. The memory m39 stores a difference in the cyan density value of the cyan leftward register mark. The memory m40 stores the tolerance of the cyan density value of a cyan lateral direction register mark. The memory m41 stores a conversion table for converting the difference in the cyan density value of the cyan lateral direction register mark into the lateral direction misregister amount of the cyan printing unit. The memory m42 stores the leftward misregister amount of the cyan printing unit. The memory m43 stores a difference in the cyan density value of the cyan rightward register mark. The memory m44 stores the rightward misregister amount of the cyan printing unit. The memory m45 stores a difference in the cyan density value of the cyan upward register mark. The memory m46 stores the tolerance of the cyan density value of a cyan circumferential direction register mark. The memory m47 stores a conversion table for converting the difference in the cyan density value of the cyan circumferential direction register mark into the circumferential direction misregister amount of the cyan printing unit. The memory m48 stores the upward misregister amount of the cyan printing unit. The memory m49 stores a difference in the cyan density value of the cyan downward register mark. The memory m50 stores the downward misregister amount of the cyan printing unit. The memory m51 stores a difference in the magenta density value of the magenta leftward register mark. The memory m52 stores the tolerance of the magenta density value of a magenta lateral direction register mark. The memory m53 stores a conversion table for converting the difference in the magenta density value of the magenta lateral direction register mark into the lateral direction misregister amount of the magenta printing unit. The memory m54 stores the leftward misregister amount of the magenta printing unit. The memory m55 stores a difference in the magenta density value of the magenta rightward register mark. The memory m56 stores the rightward misregister amount of the magenta printing unit. The memory m57 stores a difference in the magenta density value of the magenta upward register mark. The memory m58 stores the tolerance of the magenta density value of a magenta circumferential direction register mark. The memory m59 stores a conversion table for converting the difference in the magenta density value of the magenta circumferential direction register mark into the circumferential direction misregister amount of the magenta printing unit. The memory m60 stores the upward misregister amount of the magenta printing unit. The memory m61 stores a difference in the magenta density value of the magenta downward register mark. The memory m62 stores the downward misregister amount of the magenta printing unit. The memory m63 stores a difference in the yellow density value of the yellow leftward register mark. The memory m64 stores the tolerance of the yellow density value of a yellow lateral direction register mark. The memory m65 stores a conversion table for converting the difference in the yellow density value of the yellow lateral direction register mark into the lateral direction misregister amount of the yellow printing unit. The memory m66 stores the leftward misregister amount of the yellow printing unit. The memory m67 stores a difference in the yellow density value of the yellow rightward register mark. The memory m68 stores the rightward misregister amount of the yellow printing unit. The memory m69 stores a difference in the yellow density value of the yellow upward register mark. The memory m70 stores the tolerance of the yellow density value of a yellow circumferential direction register mark. The memory m71 stores a conversion table for converting the difference in the yellow density value of the yellow circumferential direction register mark into the circumferential direction misregister amount of the yellow printing unit. The memory m72 stores the upward misregister amount of the yellow printing unit. The memory m73 stores a difference in the yellow density value of the yellow downward register mark. The memory m74 stores the downward misregister amount of the yellow printing unit. The memory m75 stores an output from an A/D converter connected to the potentiometer of the lateral direction registration adjustment motor of the cyan printing unit. The memory m76 stores the current position of the lateral direction registration adjustment motor of the cyan printing unit. The memory m77 stores the target position of the lateral direction registration adjustment motor of the cyan printing unit. The memory m78 stores the target output from the A/D converter connected to the potentiometer of the lateral direction registration adjustment motor of the cyan printing unit. The memory m79 stores an output from an A/D converter connected to the potentiometer of the circumferential direction registration adjustment motor of the cyan printing unit. The memory m80 stores the current position of the circumferential direction registration adjustment motor of the cyan printing unit. The memory m81 stores the target position of the circumferential direction registration adjustment motor of the cyan printing unit. The memory m82 stores the target output from the A/D converter connected to the potentiometer of the circumferential direction registration adjustment motor of the cyan printing unit. The memory m83 stores an output from an A/D converter connected to the potentiometer of the lateral direction registration adjustment motor of the magenta printing unit. The memory m84 stores the current position of the lateral direction registration adjustment motor of the magenta printing unit. The memory m85 stores the target position of the lateral direction registration adjustment motor of the magenta printing unit. The memory m86 stores the target output from the A/D converter connected to the potentiometer of the lateral direction registration adjustment motor of the magenta printing unit. The memory m87 stores an output from an A/D converter connected to the potentiometer of the circumferential direction registration adjustment motor of the magenta printing unit. The memory m88 stores the current position of the circumferential direction registration adjustment motor of the magenta printing unit. The memory m89 stores the target position of the circumferential direction registration adjustment motor of the magenta printing unit. The memory m90 stores the target output from the A/D converter connected to the potentiometer of the circumferential direction registration adjustment motor of the magenta printing unit. The memory m91 stores an output from an A/D converter connected to the potentiometer of the lateral direction registration adjustment motor of the yellow printing unit. The memory m92 stores the current position of the lateral direction registration adjustment motor of the yellow printing unit. The memory m93 stores the target position of the lateral direction registration adjustment motor of the yellow printing unit. The memory m94 stores the target output from the A/D converter connected to the potentiometer of the lateral direction registration adjustment motor of the yellow printing unit. The memory m95 stores an output from an A/D converter connected to the potentiometer of the circumferential direction registration adjustment motor of the yellow printing unit. The memory m96 stores the current position of the circumferential direction registration adjustment motor of the yellow printing unit. The memory m97 stores the target position of the circumferential direction registration adjustment motor of the yellow printing unit. The memory m98 stores the target output from the A/D converter connected to the potentiometer of the circumferential direction registration adjustment motor of the yellow printing unit.

This printed product color misregister amount detection apparatus obtains the color misregister amount between black and each one of cyan (C), magenta (M), and yellow (Y) from the density value of the corresponding one of C, M, and Y within the target range S described above regarding the above detection principle by using the spectrometer 19.

The CPU 33 obtains various types of input information supplied through the I/O interfaces 30 to 32 and operates in accordance with the program stored in the ROM 35, while accessing the RAM 34 and memory 36, to obtain the circumferential and lateral direction color misregister amounts between the reference color and each color other than the reference color, and adjusts the registration position of the plate in the printing unit of each color through the plate registration adjustment device 14.

[Registration]

[Acquisition of Density Information on Each Color of Black Lateral Direction Reference Register Mark within Target Range]

Figure 22A:
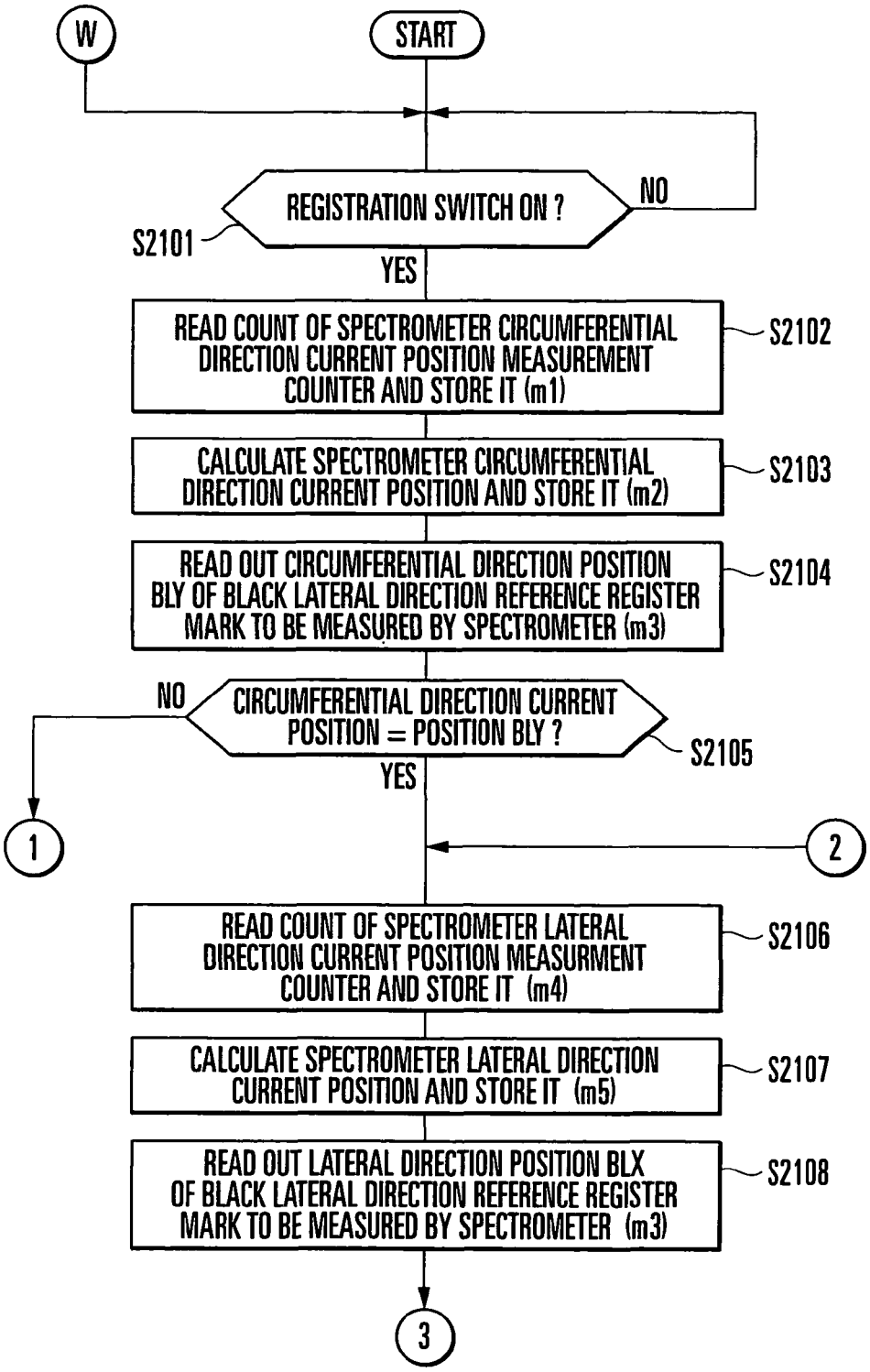
FIGS. 22A to 22G, 23A to 23M, 24A to 24M, and 25A to 25M are flowcharts showing the processes of acquiring density information on each color within a target range in the second embodiment.

In this color misregister amount detection apparatus, the printed product printed by a multi-color printing press is set with respect to the spectrometer 19, and the registration switch 4 is turned on (YES in step S2101, FIG. 22A). The CPU 33 reads the count of the spectrometer circumferential direction current position measurement counter 23 (step S2102) and obtains the circumferential direction current position of the spectrometer 19 from the read value (step S2103). The CPU 33 reads out the circumferential direction mark position BLY of a black lateral direction reference register mark MB34 from the memory m3 (step S2104).

Figure 22B:
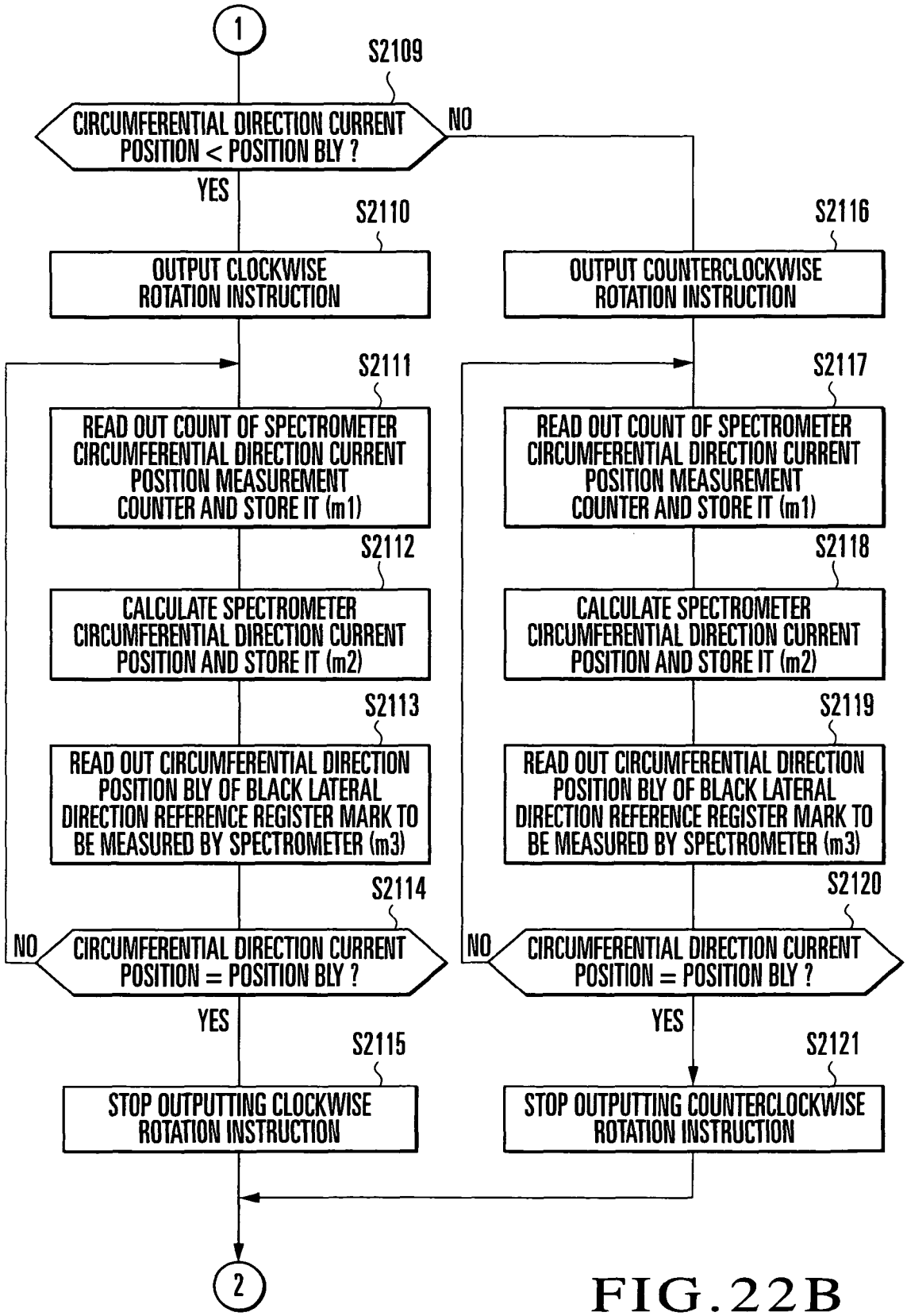

The CPU 33 checks whether the circumferential direction current position of the spectrometer 19 is the circumferential direction mark position BLY of the black lateral direction reference register mark MB34 (step S2105). If the circumferential direction current position of the spectrometer 19 is BLY (YES in step S2105), the process advances to step S2106. If the circumferential direction current position of the spectrometer 19 is not BLY (NO in step S2105), the process advances to step S2109 (FIG. 22B).

Assume that the circumferential direction current position of the spectrometer 19 is not BLY. In this case, the CPU 33 checks whether the circumferential direction current position of the spectrometer 19 is larger or smaller than BLY (step S2109). If the circumferential direction current position of the spectrometer 19 is smaller than BLY (YES in step S2109), the CPU 33 sends a clockwise rotation instruction to the circumferential direction movement motor driver 21 (step S2110) and obtains the circumferential direction current position of the spectrometer 19 from the count of the spectrometer circumferential direction current position measurement counter 23 (steps S2111 and S2112). When the circumferential direction current position of the spectrometer 19 coincides with BLY (YES in step S2114), the CPU 33 stops outputting the clockwise rotation instruction to the circumferential direction movement motor driver 21 (step S2115).

If the circumferential direction current position of the spectrometer 19 is larger than BLY (NO in step S2109), the CPU 33 outputs a counterclockwise rotation instruction to the circumferential direction movement motor driver 21 (step S2116), and obtains the circumferential direction current position of the spectrometer 19 from the count of the spectrometer circumferential direction current position measurement counter 23 (steps S2117 and S2118). When the circumferential direction current position of the spectrometer 19 coincides with BLY (YES in step S2120), the CPU 33 stops outputting the counterclockwise rotation instruction to the circumferential direction movement motor driver 21 (step S2121).

The CPU 33 reads the count of the spectrometer lateral direction current position measurement counter 28 (step S2106 in FIG. 22A), obtains the lateral direction current position of the spectrometer 19 from the read count (step S2107), and reads out the lateral direction mark position BLX of the black lateral direction reference register mark MB34 from the memory m3 (step S2108). In step S2105, if the circumferential direction current position of the spectrometer 19 is the circumferential direction mark position BLY of the black lateral direction reference register mark MB34, the process advances to step S2106 immediately.

Figure 22C:
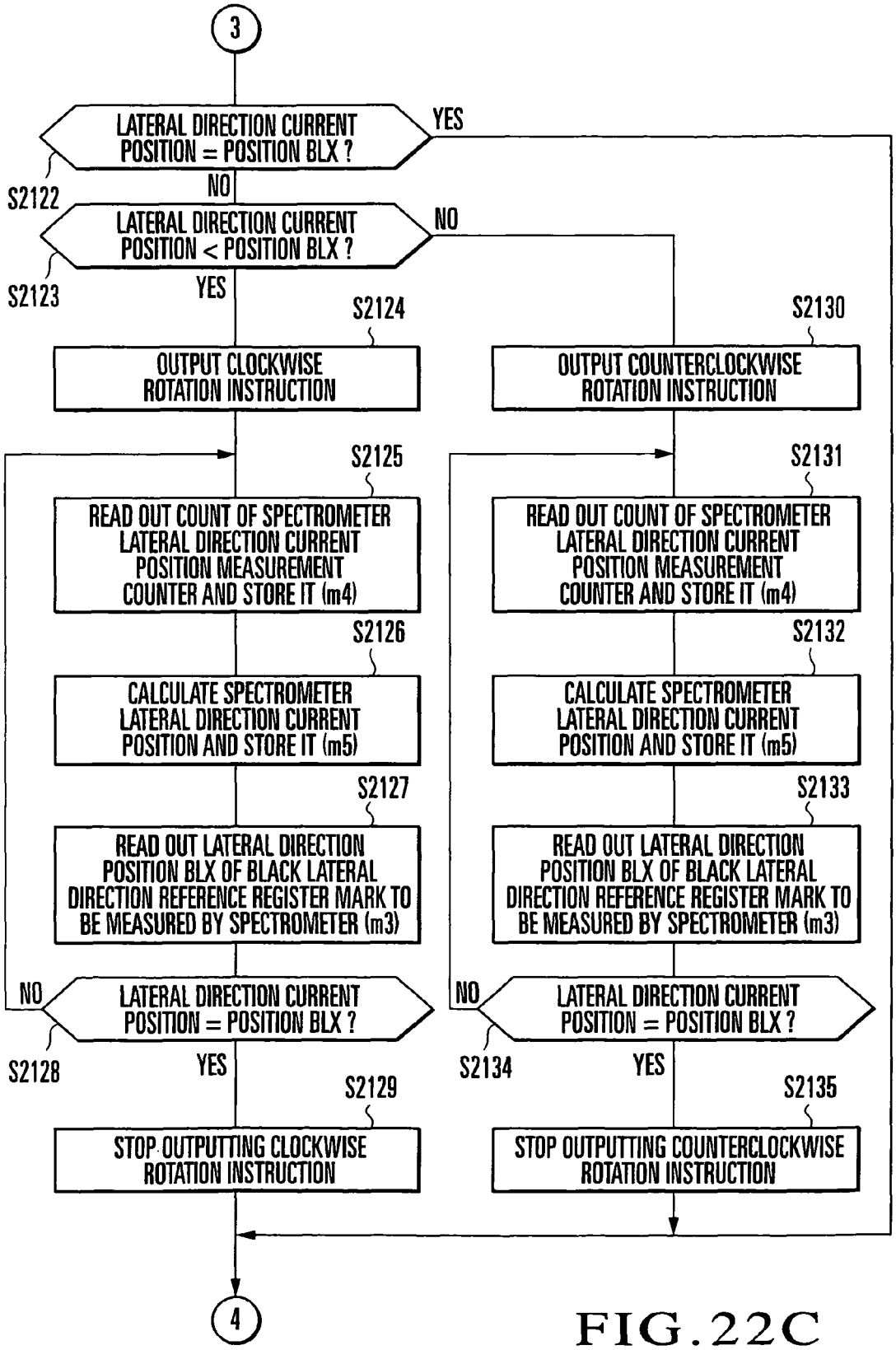

The CPU 33 checks whether the lateral direction current position of the spectrometer 19 is the lateral direction mark position BLX of the black lateral direction reference register mark MB34 (step S2122 in FIG. 22C). If the lateral direction current position of the spectrometer 19 is not BLX (NO in step S2122), the CPU 33 checks whether the lateral direction current position of the spectrometer 19 is larger or smaller than BLX (step S2123).

If the lateral direction current position of the spectrometer 19 is smaller than BLX (YES in step S2123), the CPU 33 sends a clockwise rotation instruction to the lateral direction movement motor driver 26 (step S2124) and obtains the lateral direction current position of the spectrometer 19 from the count of the spectrometer lateral direction current position measurement counter 28 (steps S2125 and S2126). When the lateral direction current position of the spectrometer 19 coincides with BLX (YES in step S2128), the CPU 33 stops outputting the clockwise rotation instruction to the lateral direction movement motor driver 26 (step S2129).

If the lateral direction current position of the spectrometer 19 is larger than BLX (NO in step S2123), the CPU 33 sends a counterclockwise rotation instruction to the lateral direction movement motor driver 26 (step S2130) and obtains the lateral direction current position of the spectrometer 19 from the count of the spectrometer lateral direction current position measurement counter 28 (steps S2131 and S2132). When the lateral direction current position of the spectrometer 19 coincides with BLX (YES in step S2134), the CPU 33 stops outputting the counterclockwise rotation instruction to the lateral direction movement motor driver 26 (step S2135).

Figure 22D:
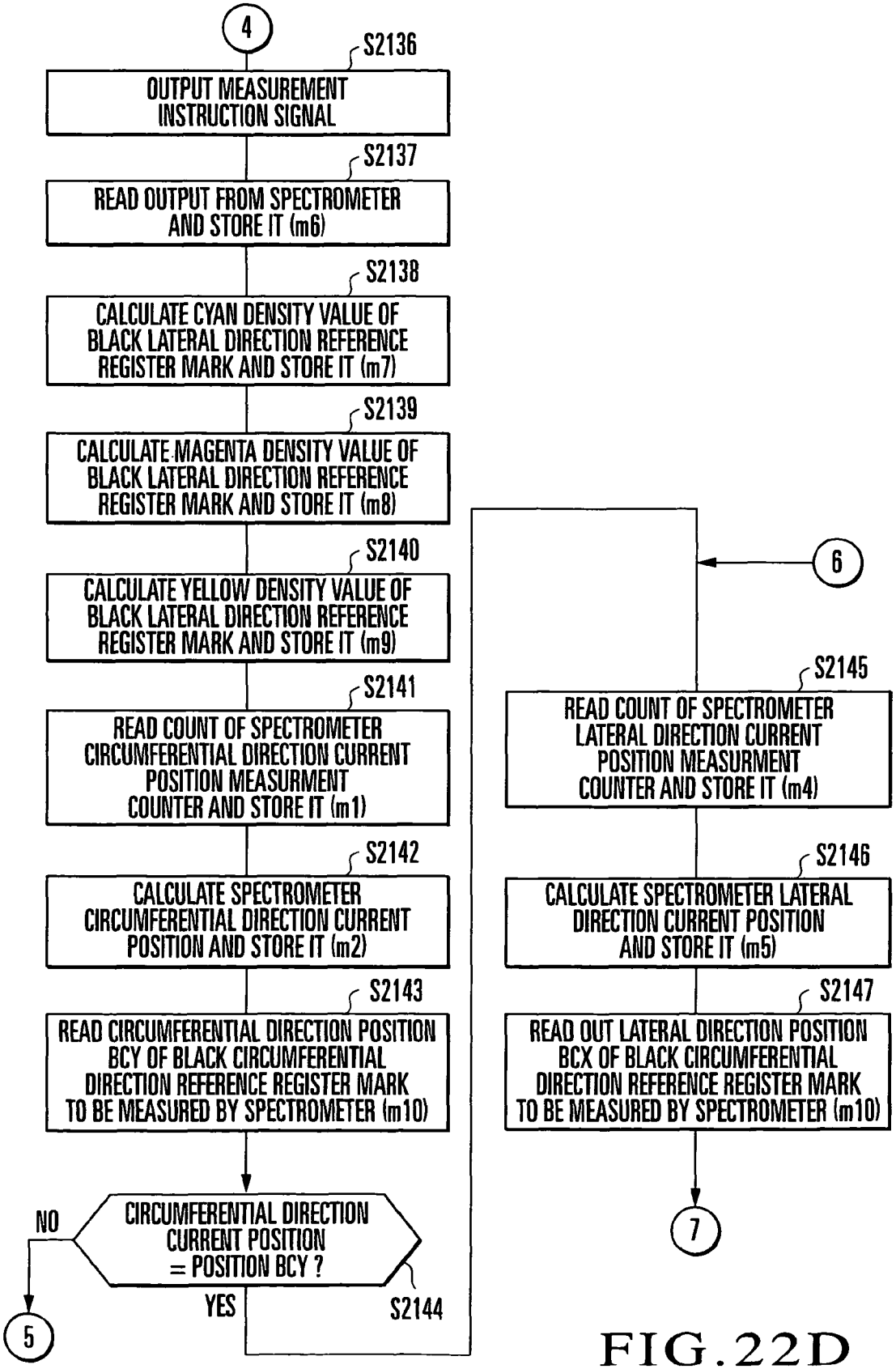

After setting the spectrometer 19 for the lateral direction mark position (BLX, BLY) of the black lateral direction reference register mark MB34, the CPU 33 outputs a measurement instruction signal to the spectrometer 19 (step S2136 in FIG. 22D) and reads an output from the spectrometer 19 (step S2137). The CPU 33 calculates the cyan density value, magenta density value, and yellow density value of the black lateral direction reference register mark MB34 within a target range S from the read output of the spectrometer 19, and stores the calculated density values in the memories m7, m8, and m9 as cyan, magenta, and yellow density information in the target range S (steps S2138, S2139, and S2140).

[Acquisition of Density Information on Each Color of Black Circumferential Direction Reference Register Mark within Target Range]

The CPU 33 reads the count of the spectrometer circumferential direction current position measurement counter 23 (step S2141) and obtains the circumferential direction current position of the spectrometer 19 from the read value (step S2142). The CPU 33 reads out the circumferential direction mark position BCY of a black circumferential direction reference register mark MB12 from the memory m10 (step S2143).

Figure 22E:
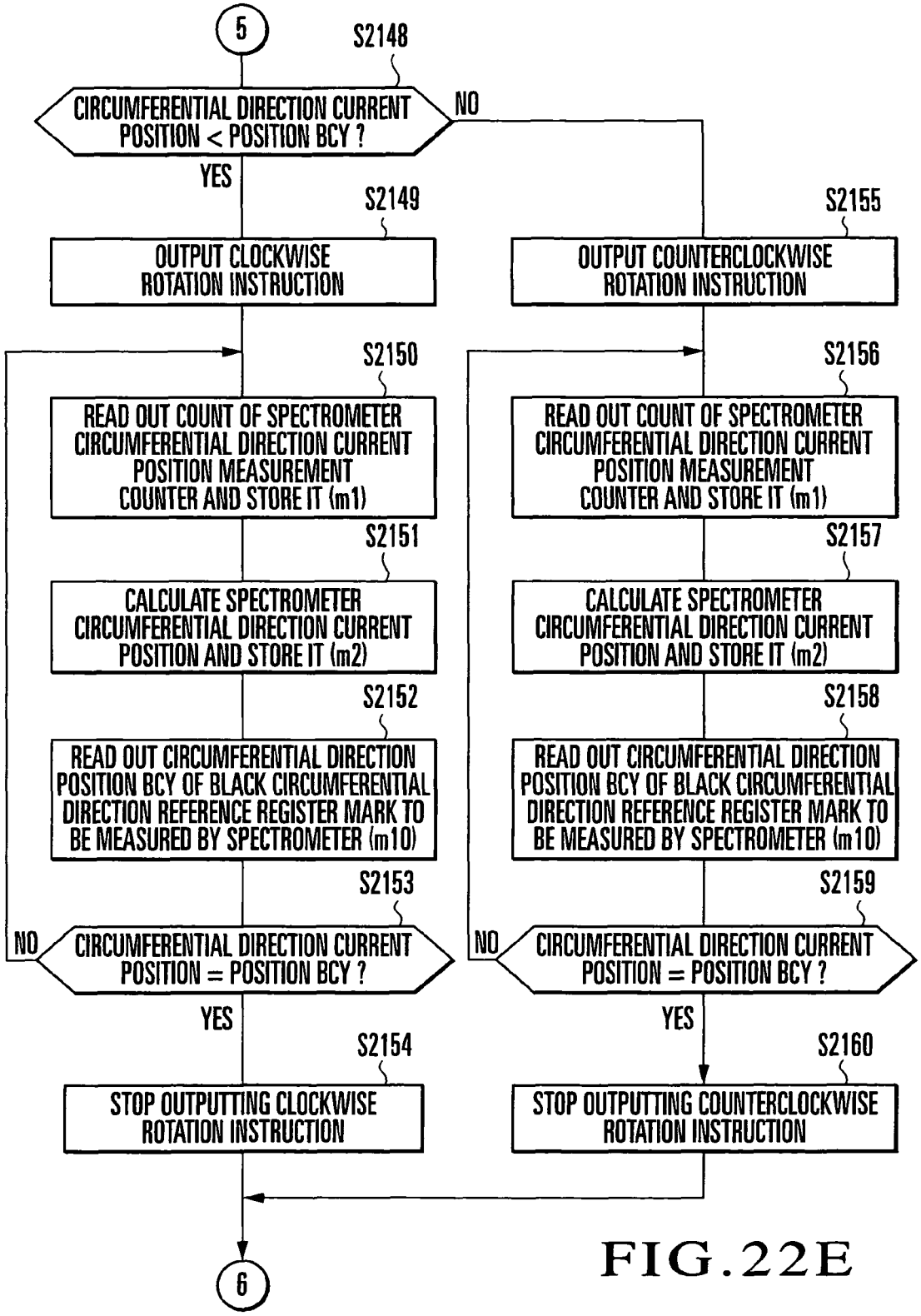

The CPU 33 checks whether the circumferential direction current position of the spectrometer 19 is the circumferential direction mark position BCY of the black circumferential direction reference register mark MB12 (step S2144). If the circumferential direction current position of the spectrometer 19 is BCY (YES in step S2144), the process advances to step S2145. If the circumferential direction current position of the spectrometer 19 is not BCY (NO in step S2144), the process advances to step S2148 (FIG. 22E).

Assume that the circumferential direction current position of the spectrometer 19 is not BCY. In this case, the CPU 33 checks whether the circumferential direction current position of the spectrometer 19 is larger or smaller than BCY (step S2148). If the circumferential direction current position of the spectrometer 19 is smaller than BCY (YES in step S2148), the CPU 33 sends a clockwise rotation instruction to the circumferential direction movement motor driver 21 (step S2149) and obtains the circumferential direction current position of the spectrometer 19 from the count of the spectrometer circumferential direction current position measurement counter 23 (steps S2150 and S2151). When the circumferential direction current position of the spectrometer 19 coincides with BCY (YES in step S2153), the CPU 33 stops outputting the clockwise rotation instruction to the circumferential direction movement motor driver 21 (step S2154).

If the circumferential direction current position of the spectrometer 19 is larger than BCY (NO in step S2148), the CPU 33 outputs a counterclockwise rotation instruction to the circumferential direction movement motor driver 21 (step S2155), and obtains the circumferential direction current position of the spectrometer 19 from the count of the spectrometer circumferential direction current position measurement counter 23 (steps S2156 and S2157). When the circumferential direction current position of the spectrometer 19 coincides with BCY (YES in step S2159), the CPU 33 stops outputting the counterclockwise rotation instruction to the circumferential direction movement motor driver 21 (step S2160).

The CPU 33 reads the count of the spectrometer lateral direction current position measurement counter 28 (step S2145 in FIG. 22D), obtains the lateral direction current position of the spectrometer 19 from the read count (step S2146), and reads out the lateral direction mark position BCX of the black circumferential direction reference register mark MB12 from the memory m10 (step S2147). In step S2144, if the circumferential direction current position of the spectrometer 19 is the circumferential direction mark position BCY of the black circumferential direction reference register mark MB12, the process advances to step S2145 immediately.

Figure 22F:
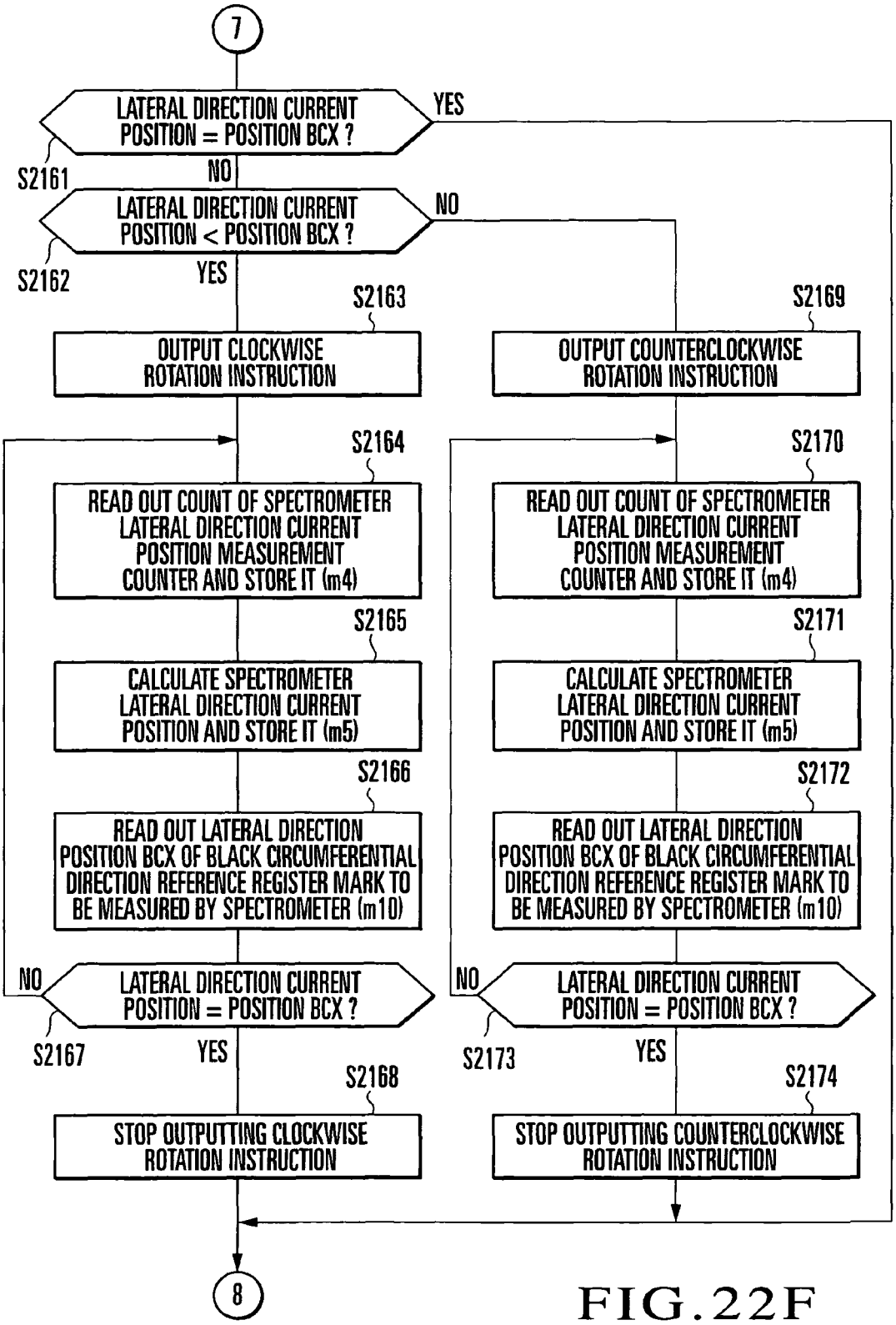

The CPU 33 checks whether the lateral direction current position of the spectrometer 19 is the lateral direction mark position BCX of the black circumferential direction reference register mark MB12 (step S2161 in FIG. 22F). If the lateral direction current position of the spectrometer 19 is not BCX (NO in step S2161), the CPU 33 checks whether the lateral direction current position of the spectrometer 19 is larger or smaller than BCX (step S2162).

If the lateral direction current position of the spectrometer 19 is smaller than BCX (YES in step S2162), the CPU 33 sends a clockwise rotation instruction to the lateral direction movement motor driver 26 (step S2163) and obtains the lateral direction current position of the spectrometer 19 from the count of the spectrometer lateral direction current position measurement counter 28 (steps S2164 and S2165). When the lateral direction current position of the spectrometer 19 coincides with BCX (YES in step S2167), the CPU 33 stops outputting the clockwise rotation instruction to the lateral direction movement motor driver 26 (step S2168).

If the lateral direction current position of the spectrometer 19 is larger than BCX (NO in step S2162), the CPU 33 sends a counterclockwise rotation instruction to the lateral direction movement motor driver 26 (step S2169) and obtains the lateral direction current position of the spectrometer 19 from the count of the spectrometer lateral direction current position measurement counter 28 (steps S2170 and S2171). When the lateral direction current position of the spectrometer 19 coincides with BCX (YES in step S2173), the CPU 33 stops outputting the counterclockwise rotation instruction to the lateral direction movement motor driver 26 (step S2174).

Figure 22G:
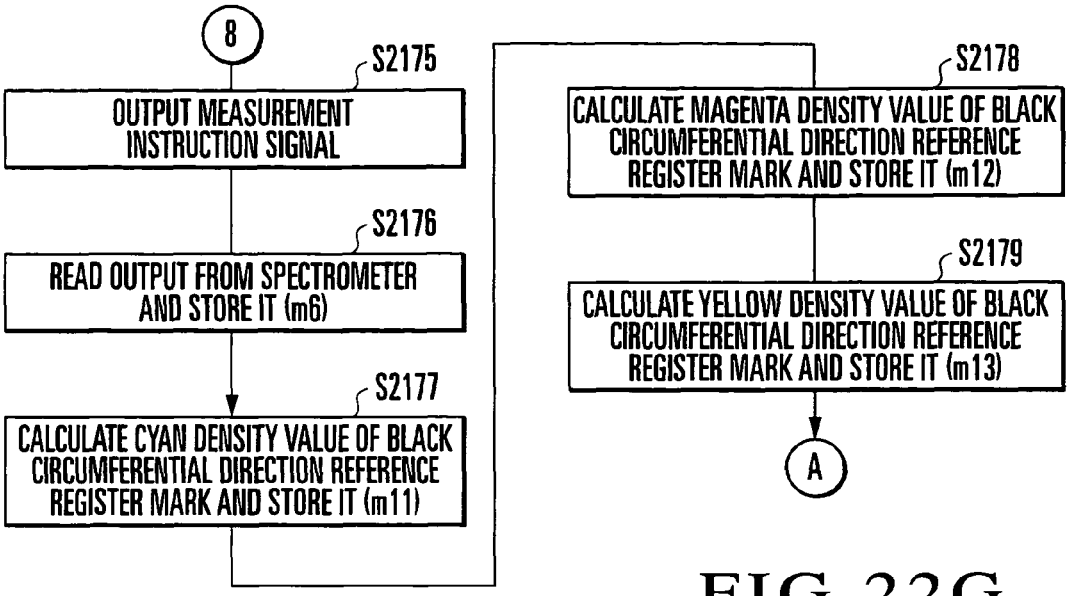

After setting the spectrometer 19 for the lateral direction mark position (BCX, BCY) of the black circumferential direction reference register mark MB12, the CPU 33 outputs a measurement instruction signal to the spectrometer 19 (step S2175 in FIG. 22G) and reads the output from the spectrometer 19 (step S2176). The CPU 33 calculates the cyan density value, magenta density value, and yellow density value of the black circumferential direction reference register mark MB12 within a target range S from the read output of the spectrometer 19, and stores the calculated density values in the memories m11, m12, and m13 as cyan, magenta, and yellow density information in the target range S (steps S2177, S2178, and S2179).

[Acquisition of Density Information on Cyan Component of Leftward Reference Register Mark+Cyan Leftward Register Mark within Target Range]

Figure 23A:
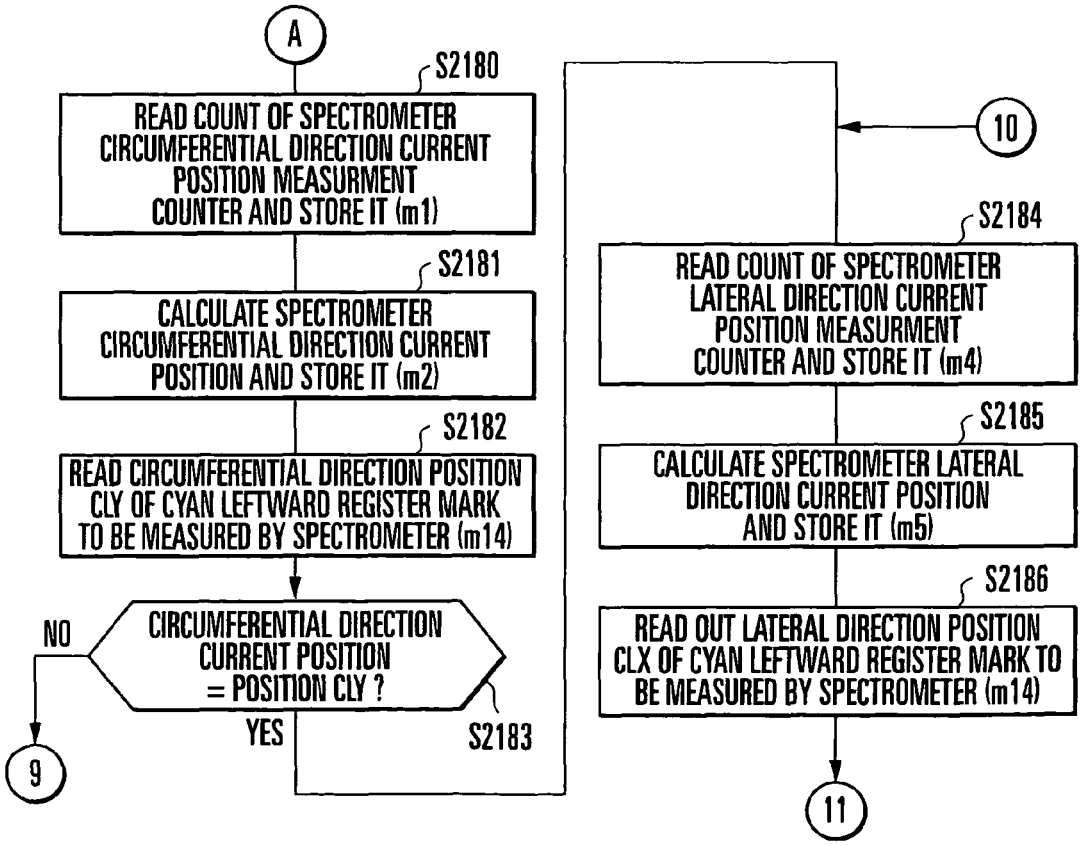
Figure 23B:
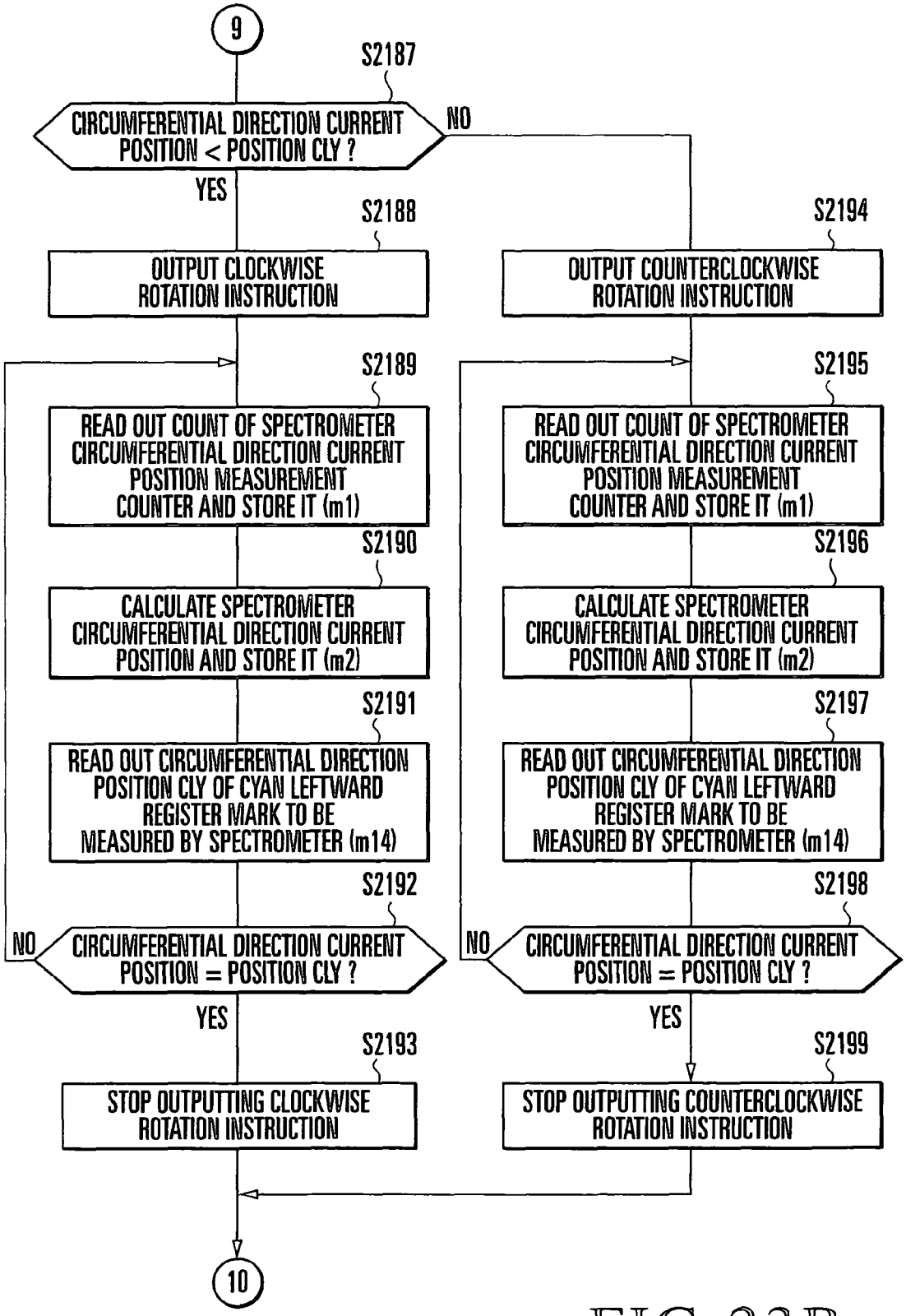
Figure 23C:
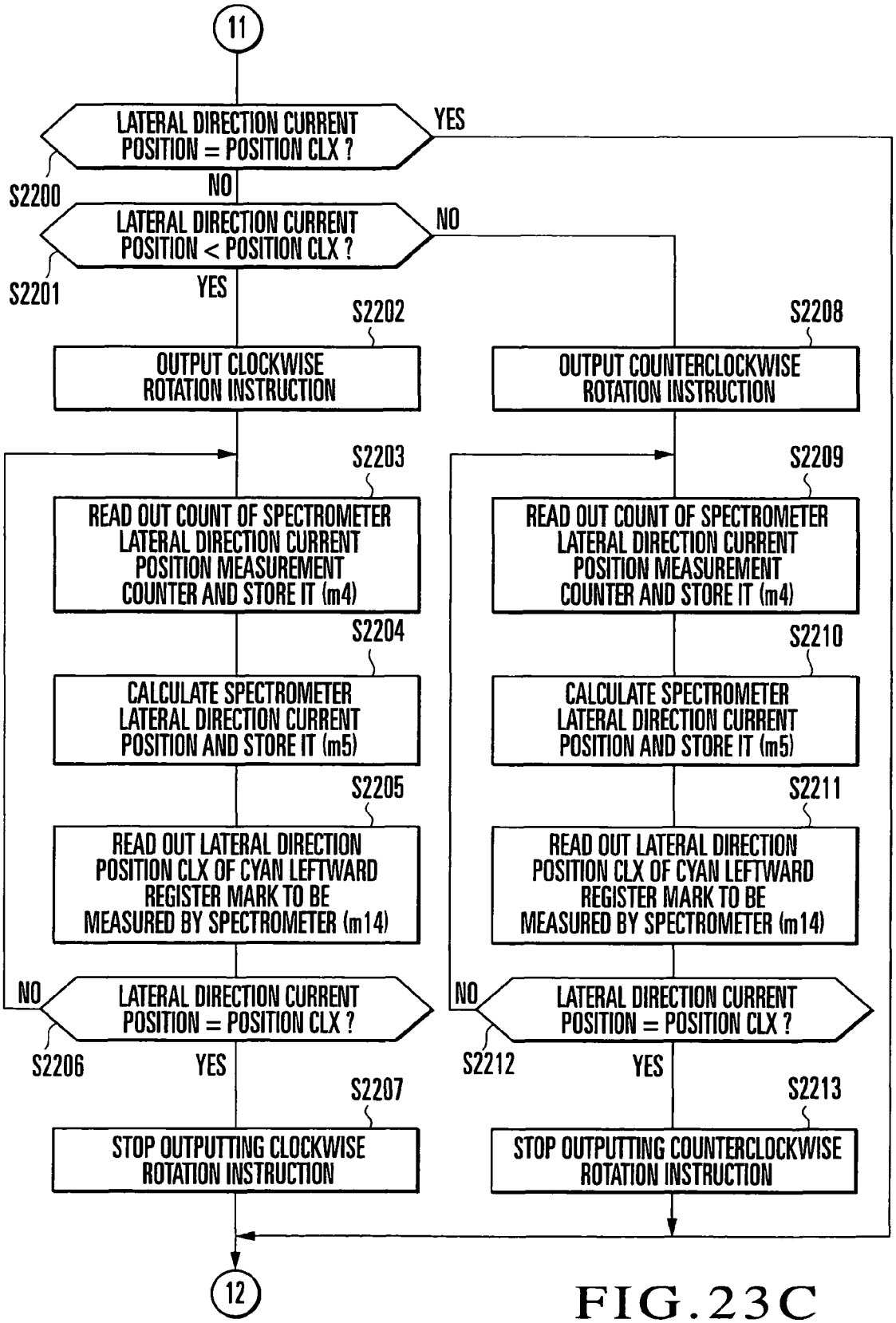
Figure 23D:
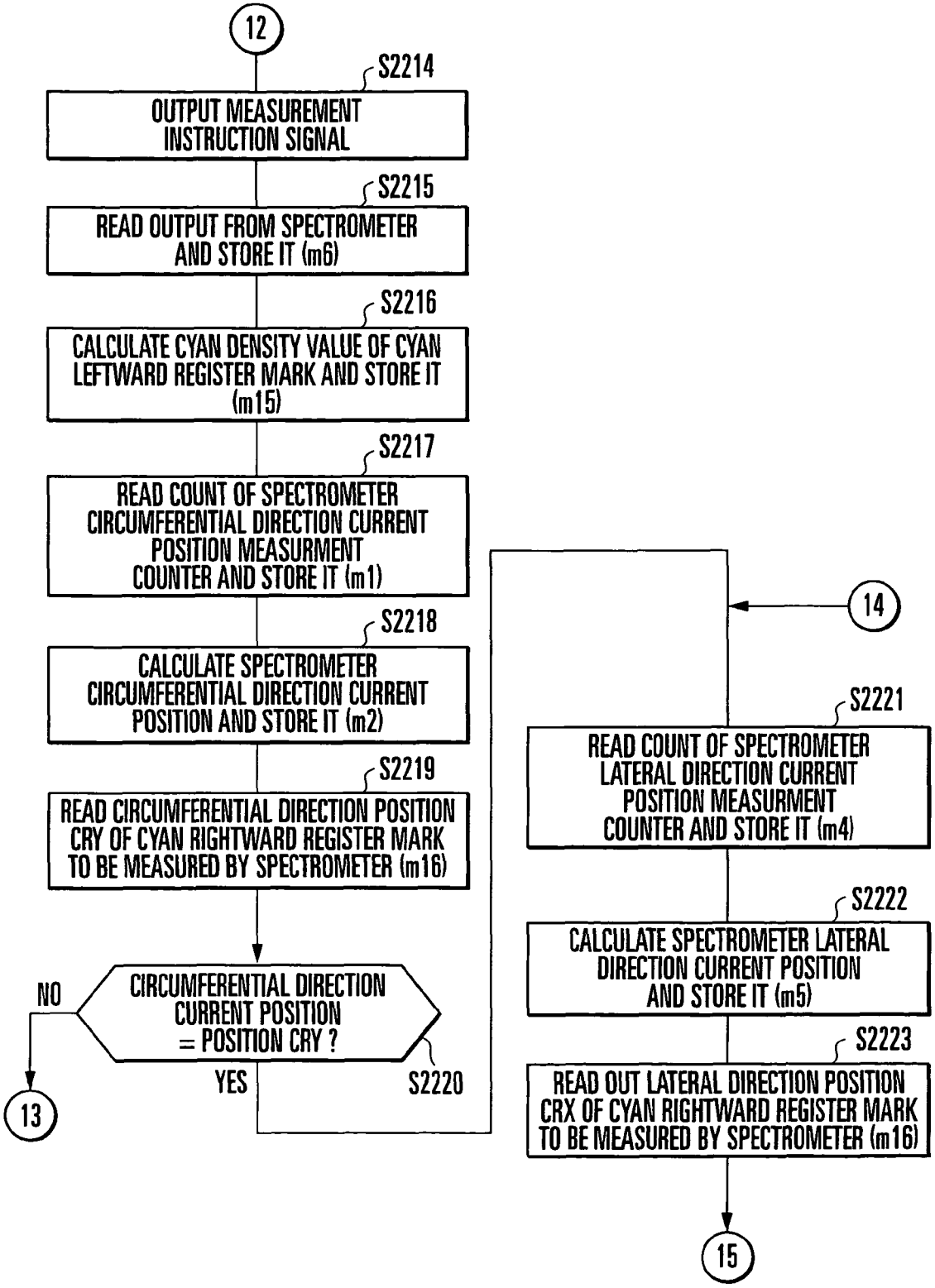
Figure 23E:
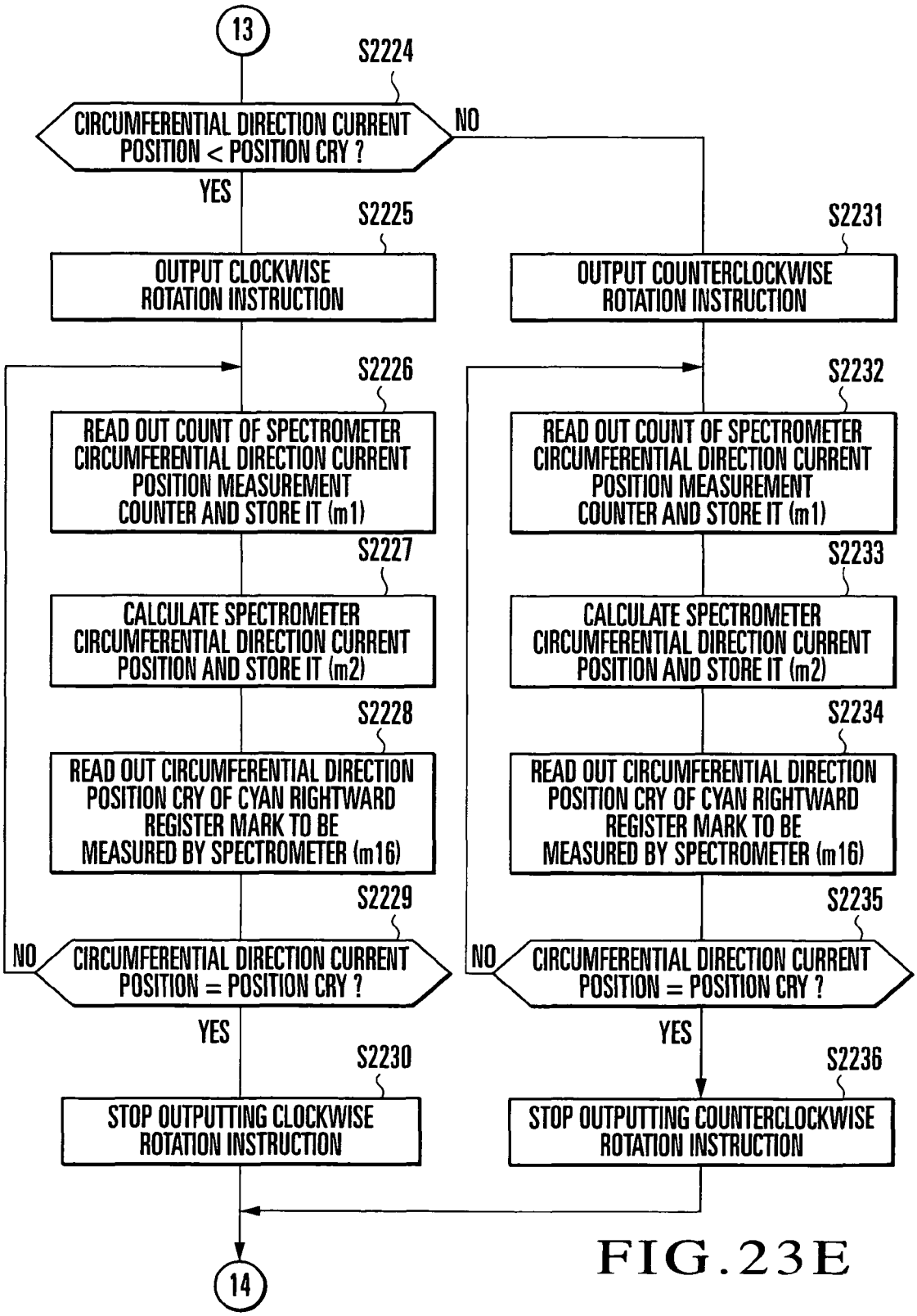
Figure 23F:
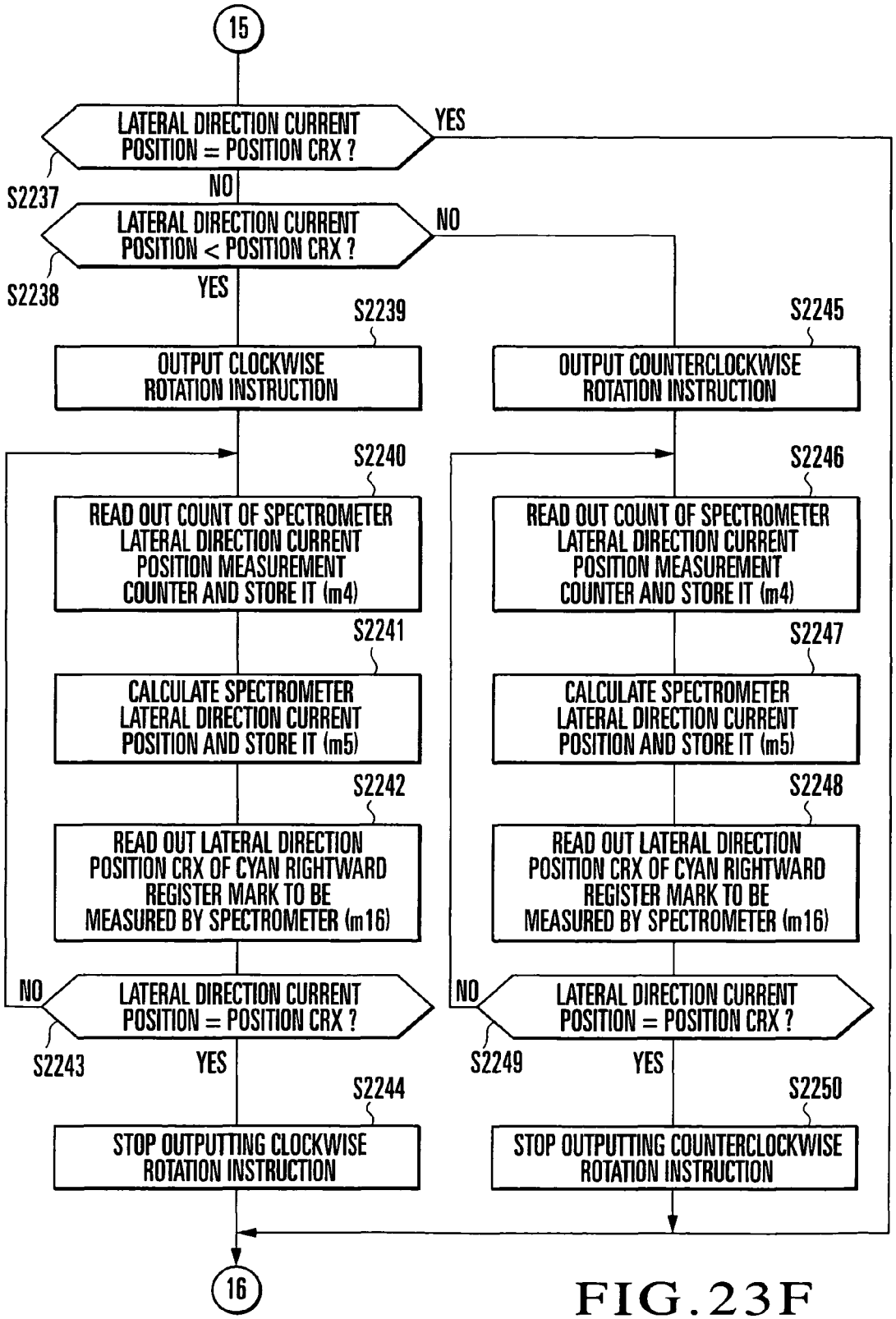
Figure 23G:
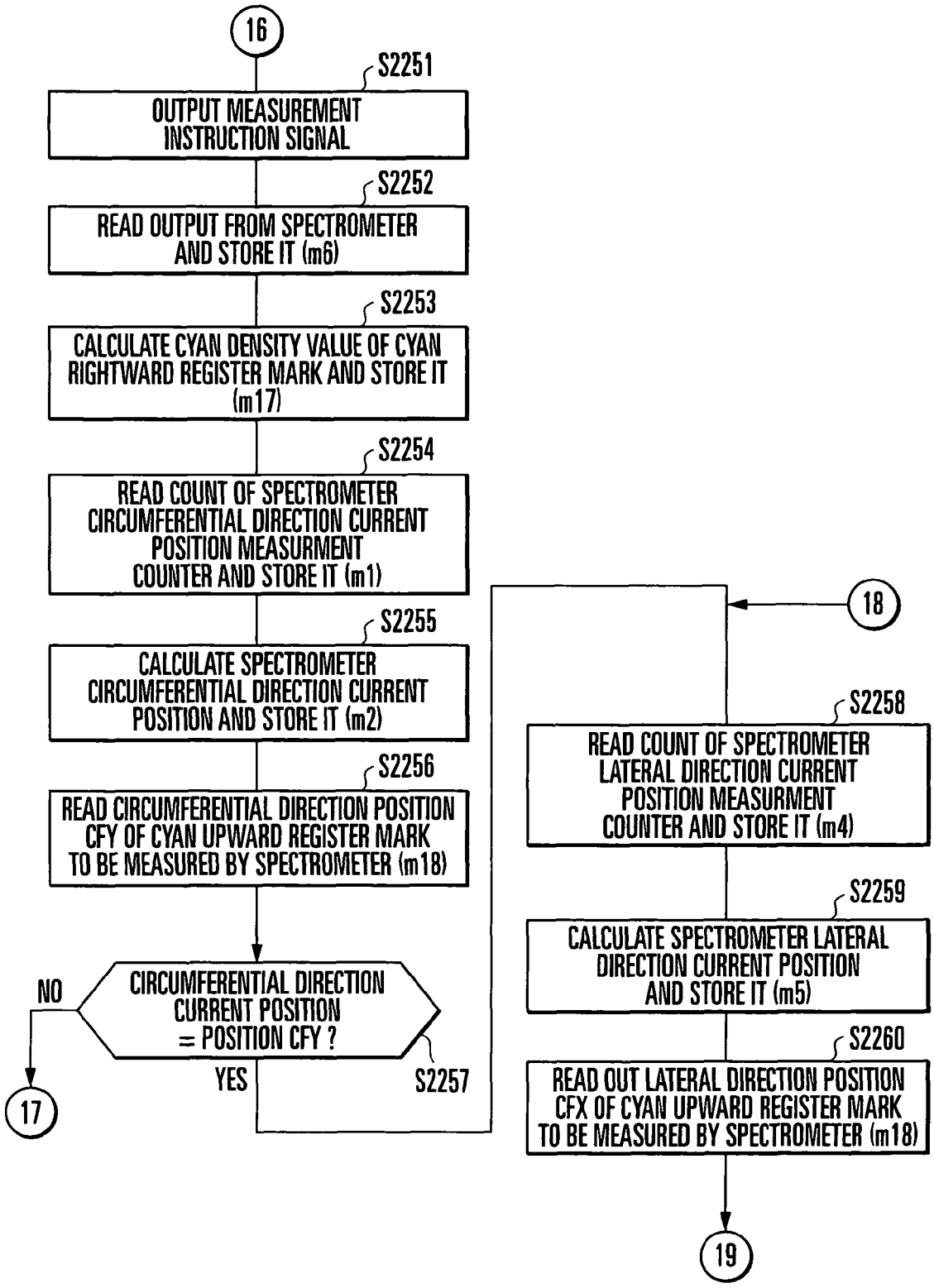
Figure 23H:
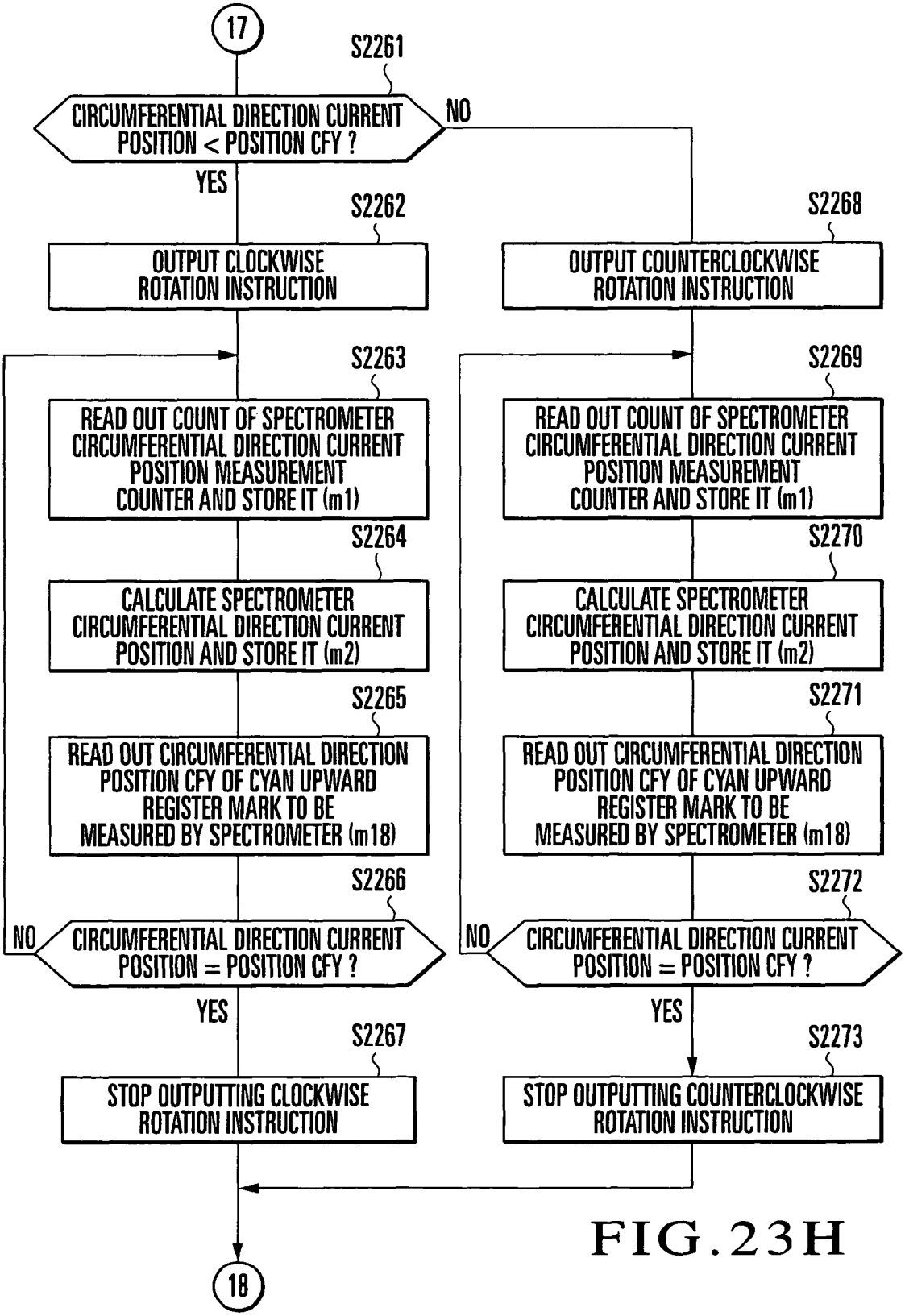
Figure 23I:
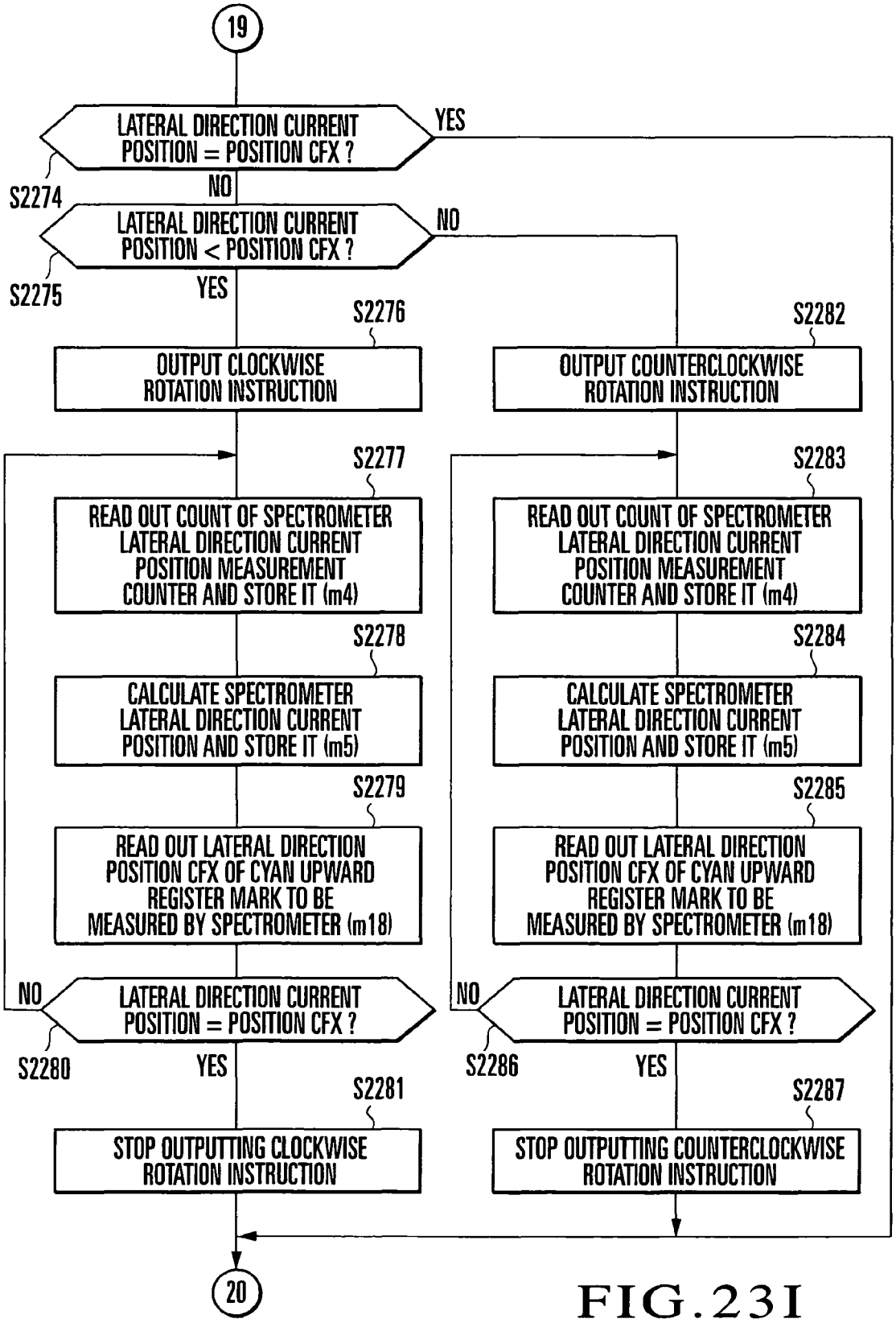
Figure 23J:
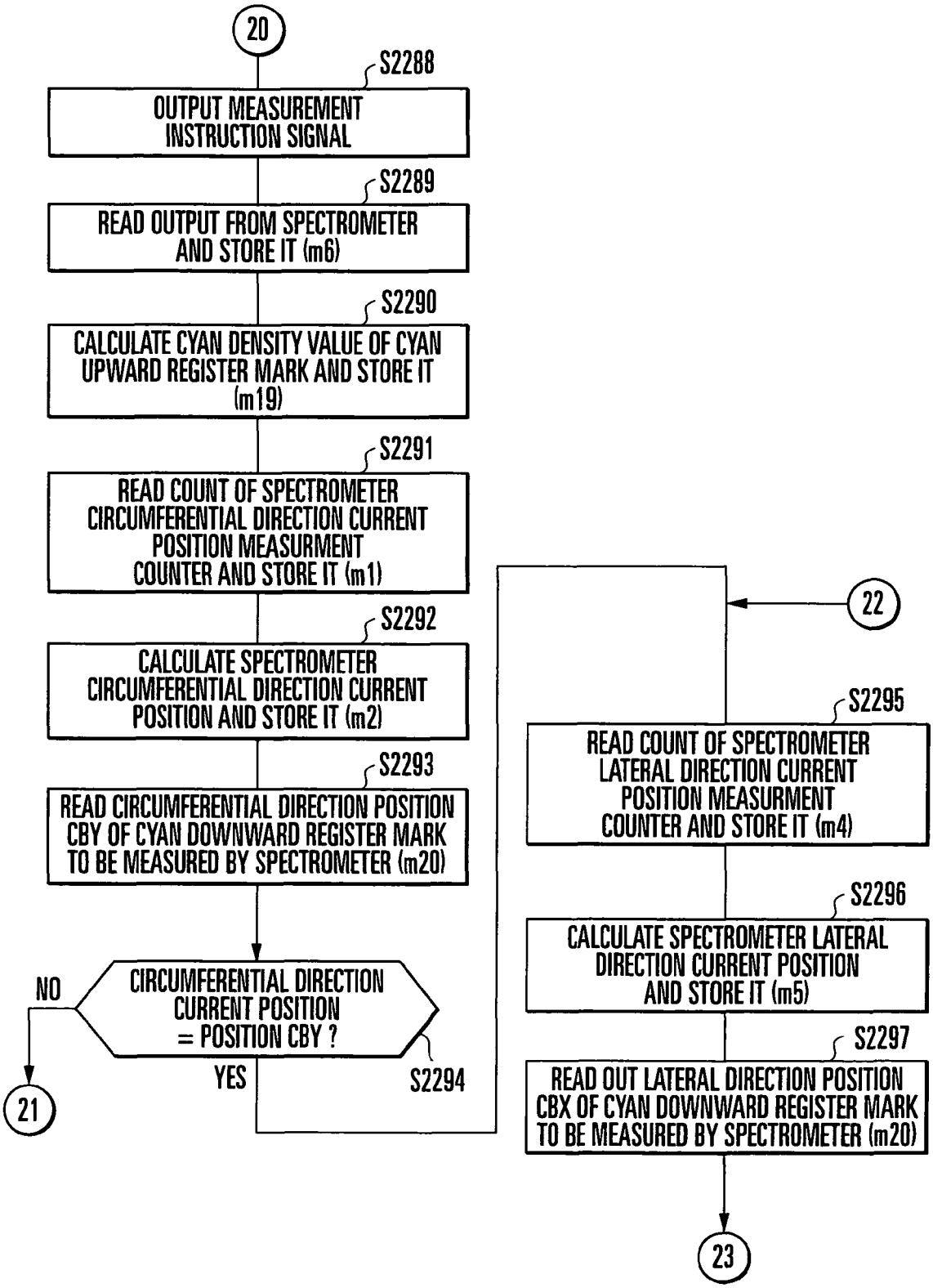
Figure 23K:
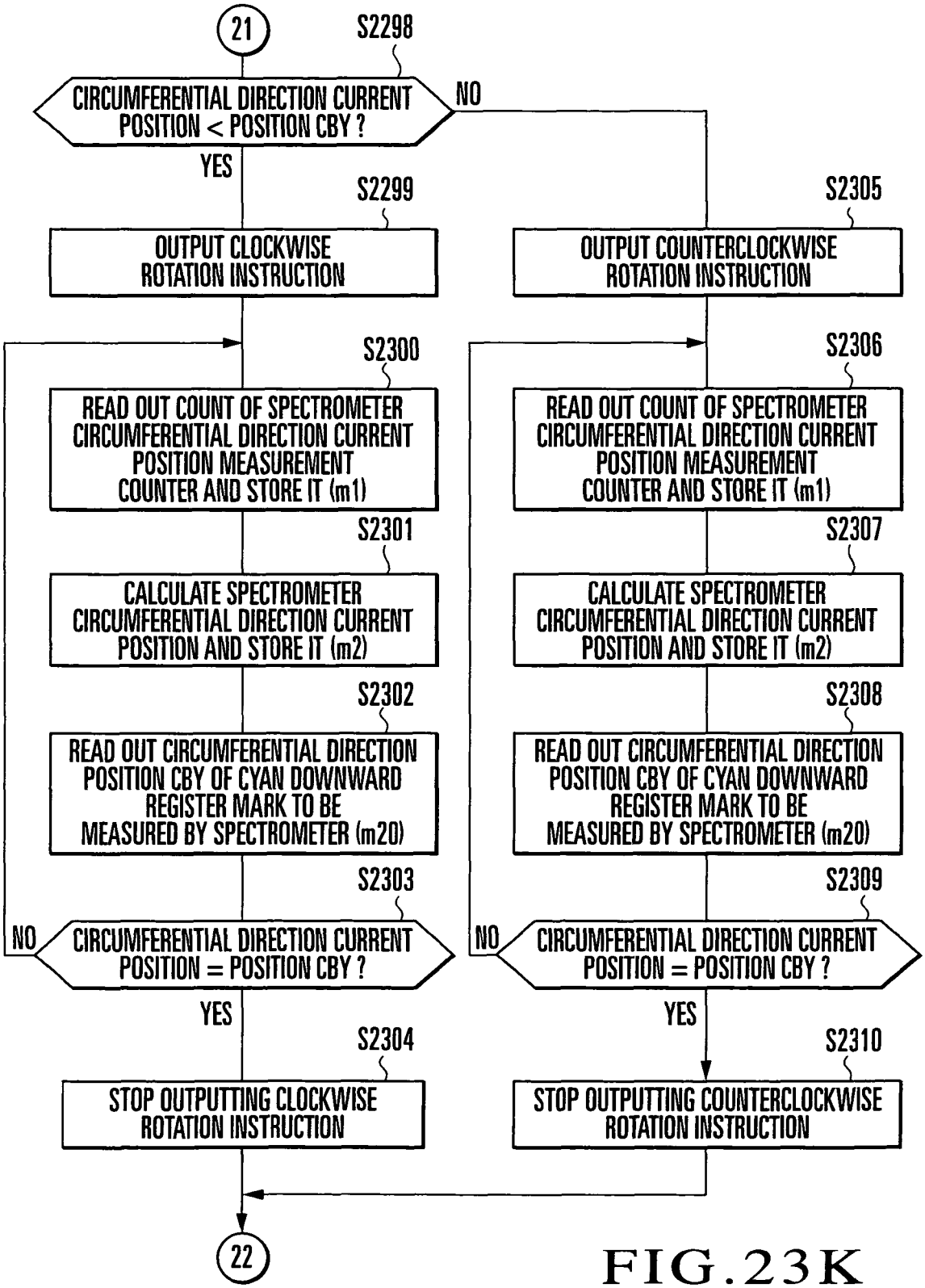
Figure 23L:
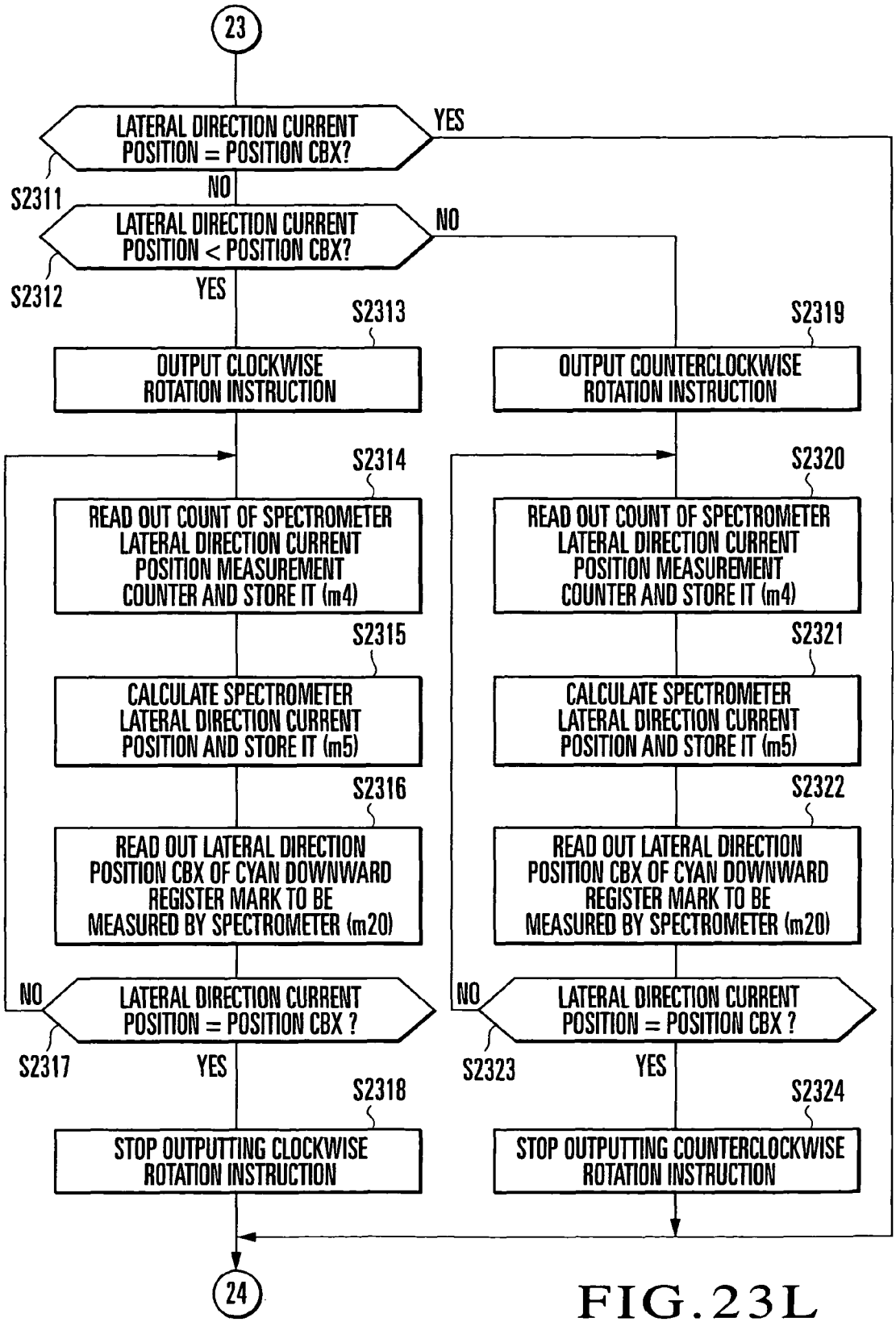
Figure 23M:
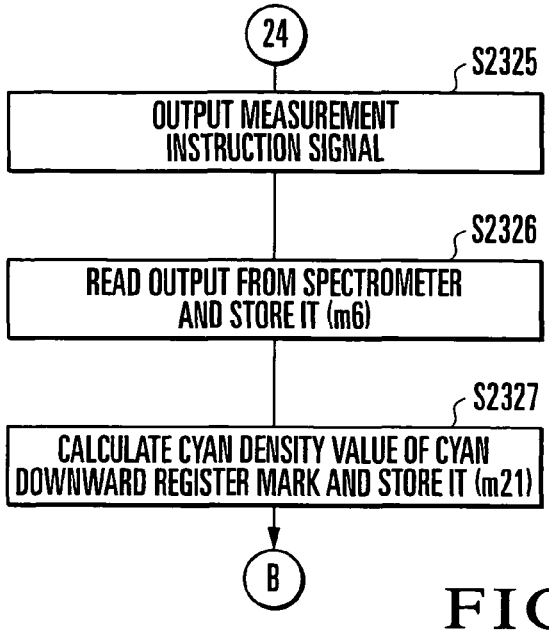

The CPU 33 then reads the count of the spectrometer circumferential direction current position measurement counter 23 (step S2180 in FIG. 23A) to obtain the circumferential direction current position of the spectrometer 19 from the read count (step S2181). The CPU 33 reads out the circumferential direction mark position CLY of a cyan leftward register mark MC3 from the memory m14 (step S2182), performs the processes of steps S2183 to S2216 (FIGS. 23A to 23D) corresponding to steps S2105 to S2140 shown in FIGS. 22A to 22D to calculate the cyan density value of a leftward reference register mark MB3, on which the cyan leftward register mark MC3 is printed to overlap, within a target range S, and stores the density value in the memory m15 as the density information on the cyan component within the target range S.

[Acquisition of Density Information on Cyan Component of Rightward Reference Register Mark+Cyan Rightward Register Mark within Target Range]

The CPU 33 then reads the count of the spectrometer circumferential direction current position measurement counter 23 (step S2217) to obtain the circumferential direction current position of the spectrometer 19 from the read count (step S2218). The CPU 33 reads out the circumferential direction mark position CRY of a cyan rightward register mark MC4 from the memory m16 (step S2219), performs the processes of steps S2220 to S2253 (FIGS. 23D to 23G) corresponding to steps S2105 to S2140 shown in FIGS. 22A to 22D to calculate the cyan density value of a rightward reference register mark MB4, on which the cyan rightward register mark MC4 is printed to overlap, within a target range S, and stores the density value in the memory m17 as the density information on the cyan component within the target range S.

[Acquisition of Density Information on Cyan Component of Upward Reference Register Mark+Cyan Upward Register Mark within Target Range]

The CPU 33 then reads the count of the spectrometer circumferential direction current position measurement counter 23 (step S2254) to obtain the circumferential direction current position of the spectrometer 19 from the read count (step S2255). The CPU 33 reads out the circumferential direction mark position CFY of a cyan upward register mark MC1 from the memory m18 (step S2256), performs the processes of steps S2257 to S2290 (FIGS. 23G to 23J) corresponding to steps S2105 to S2140 shown in FIGS. 22A to 22D to calculate the cyan density value of an upward reference register mark MB1, on which the cyan upward register mark MC1 is printed to overlap, within a target range S, and stores the density value in the memory m19 as the density information on the cyan component within the target range S.

[Acquisition of Density Information on Cyan Component of Downward Reference Register Mark+Cyan Downward Register Mark within Target Range]

The CPU 33 then reads the count of the spectrometer circumferential direction current position measurement counter 23 (step S2291) to obtain the circumferential direction current position of the spectrometer 19 from the read count (step S2292). The CPU 33 reads out the circumferential direction mark position CBY of a cyan downward register mark MC2 from the memory m20 (step S2293), performs the processes of steps S2294 to S2327 (FIGS. 23J to 23M) corresponding to steps S2105 to S2140 shown in FIGS. 22A to 22D to calculate the cyan density value of a downward reference register mark MB2, on which the cyan downward register mark MC2 is printed to overlap, within a target range S, and stores the density value in the memory m21 as the density information on the cyan component within the target range S.

[Acquisition of Density Information on Magenta Component of Leftward Reference Register Mark+Magenta Leftward Register Mark within Target Range]

Figure 24A:
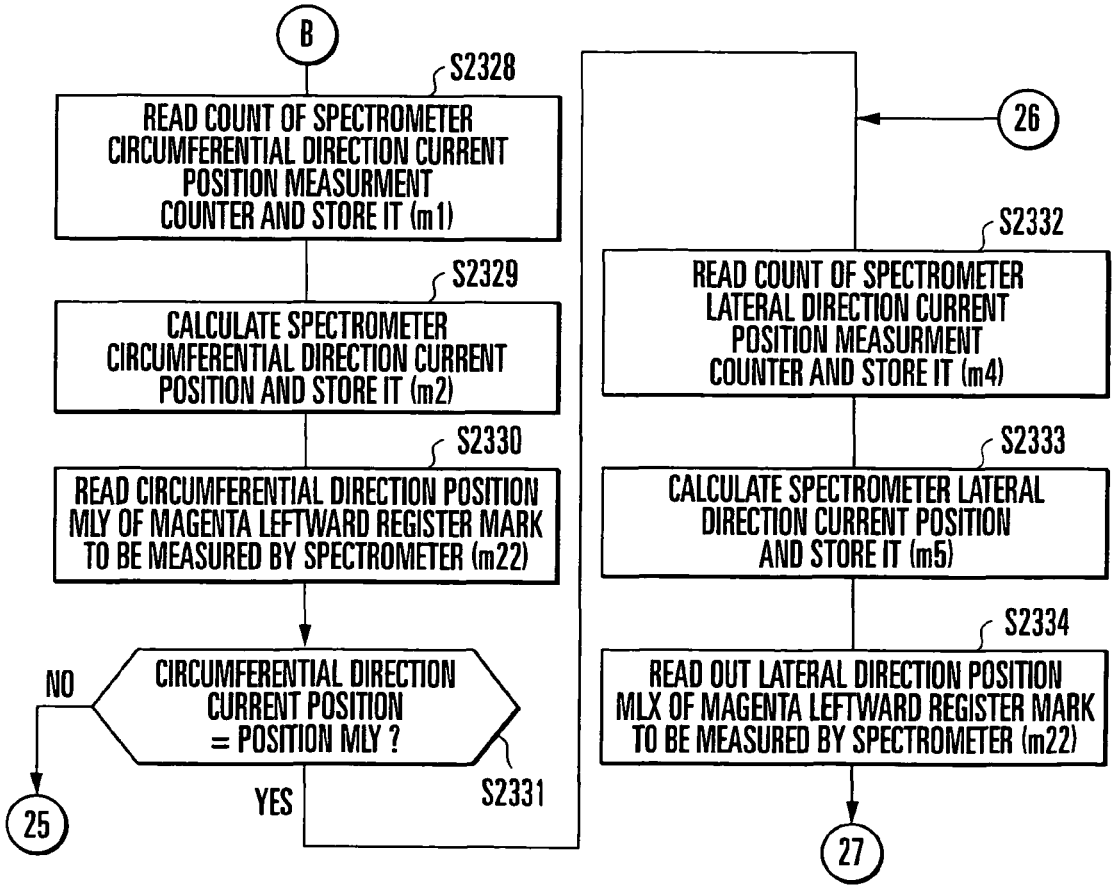
Figure 24B:
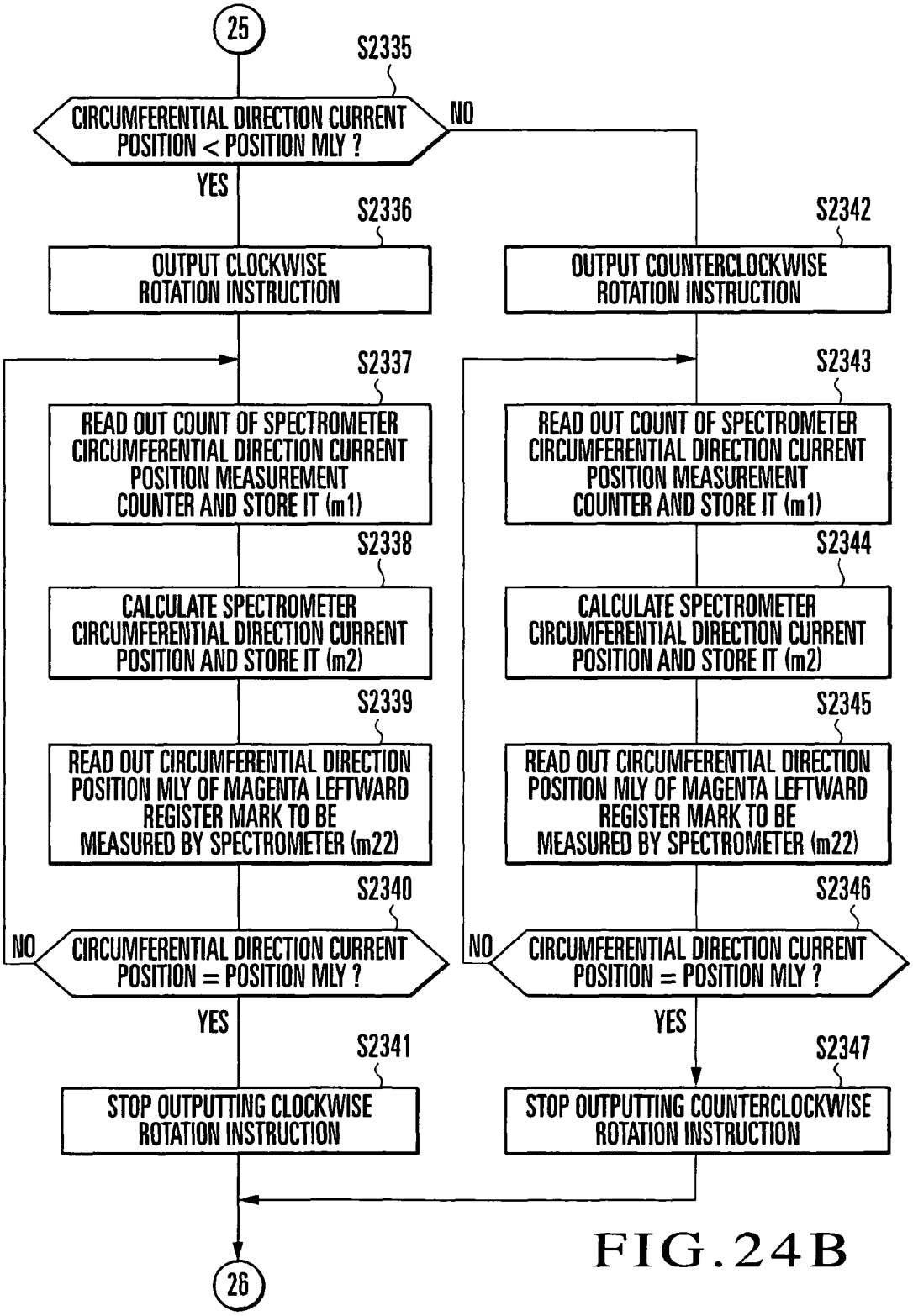
Figure 24C:
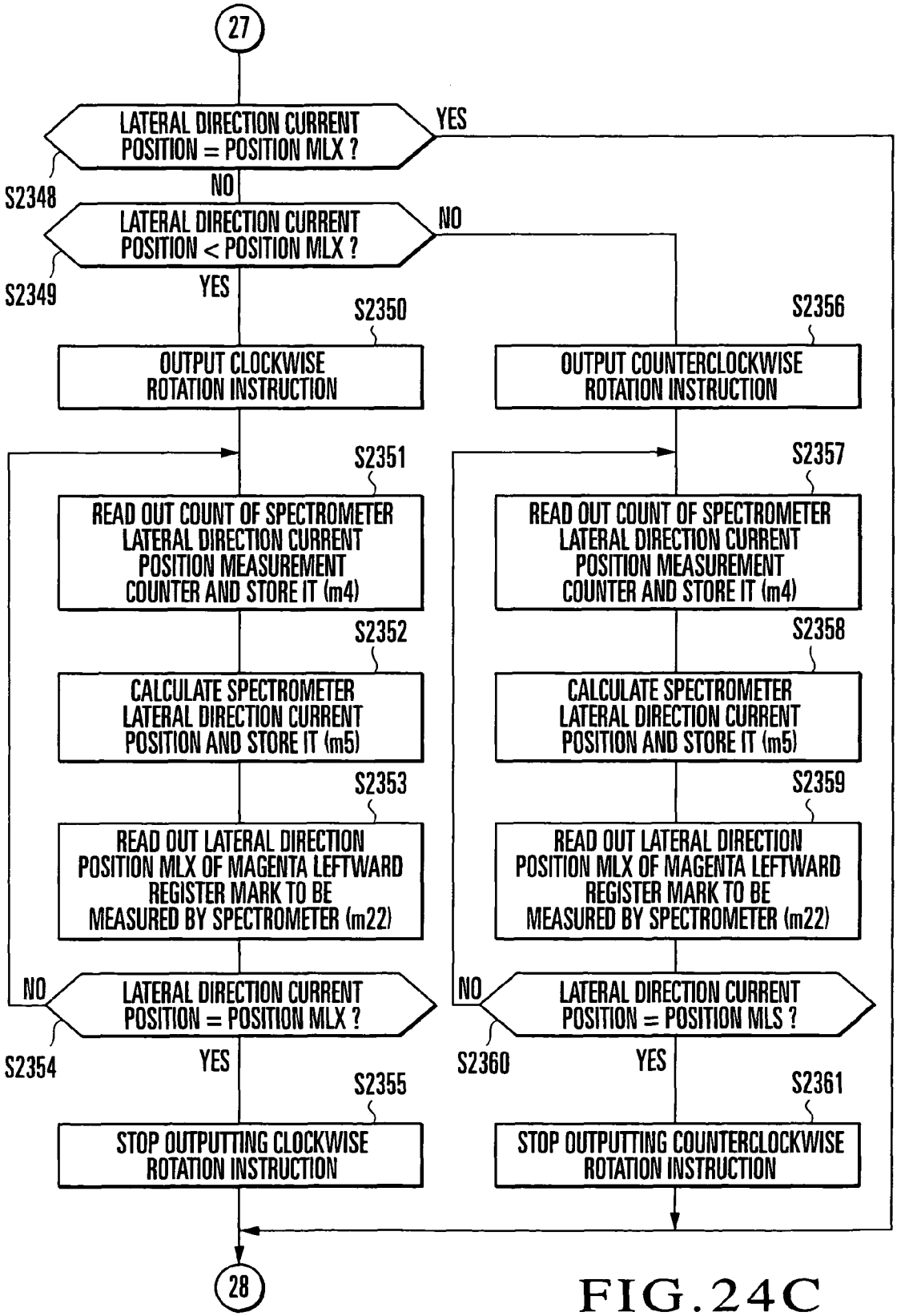
Figure 24D:
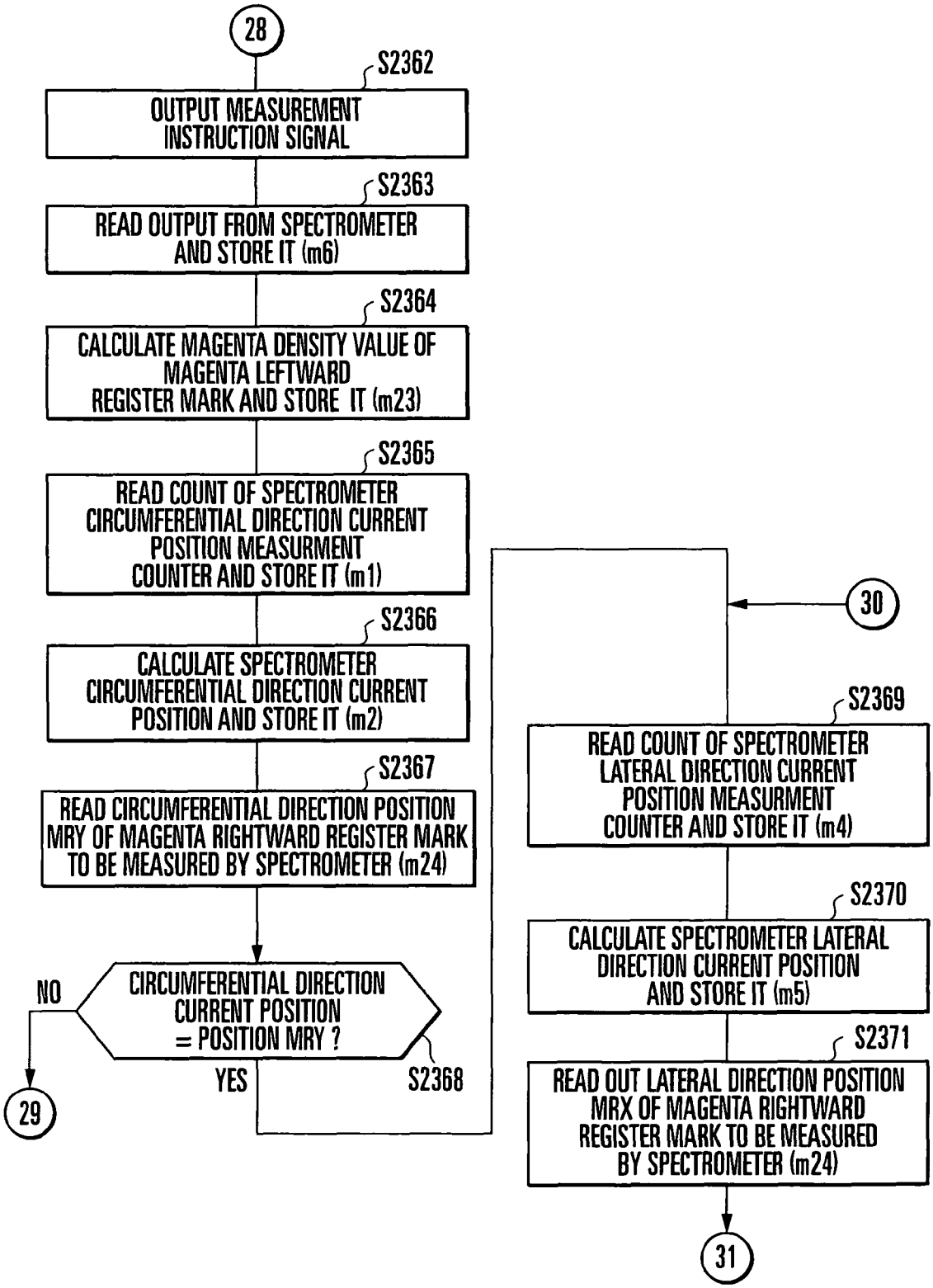
Figure 24E:
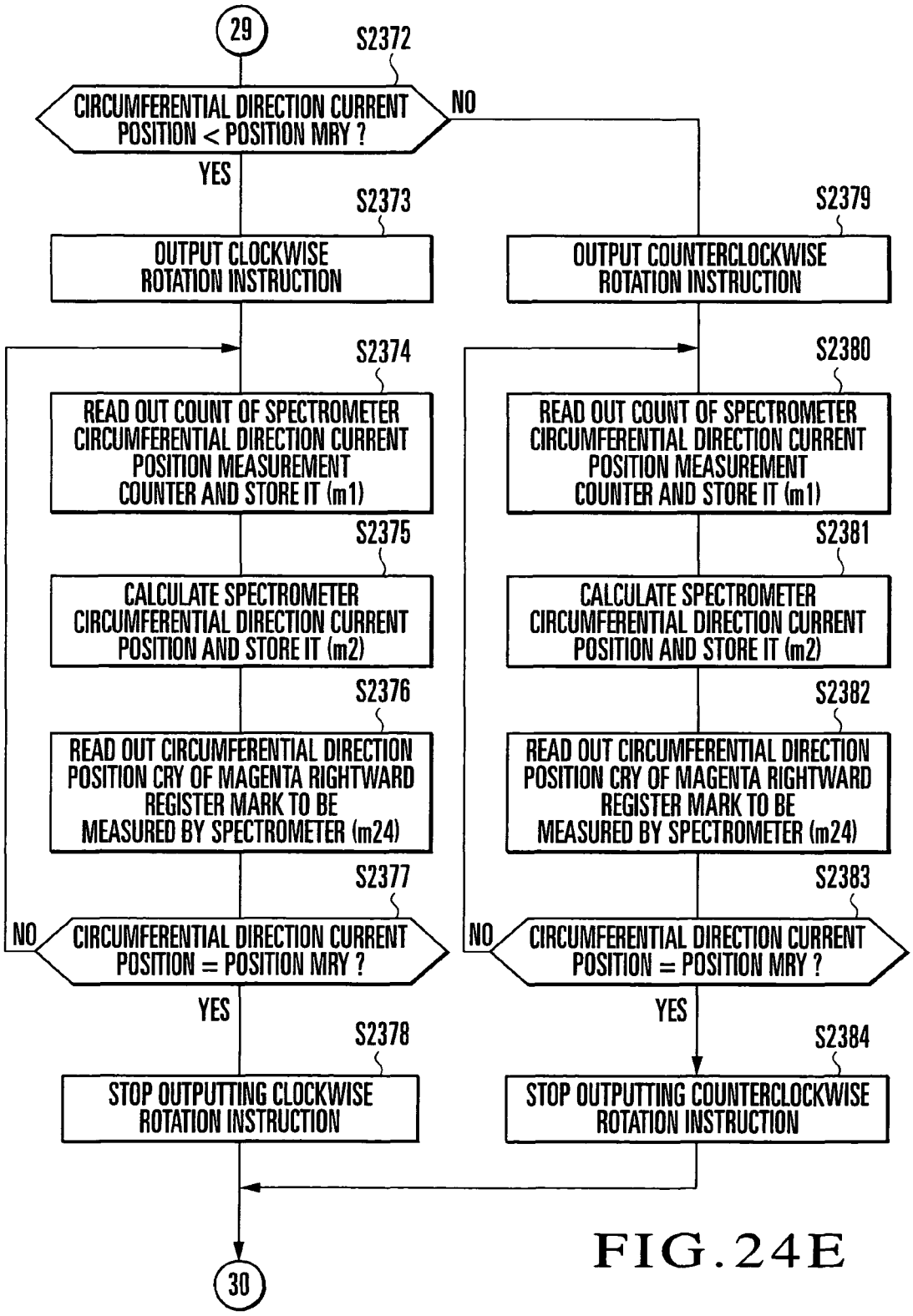
Figure 24F:
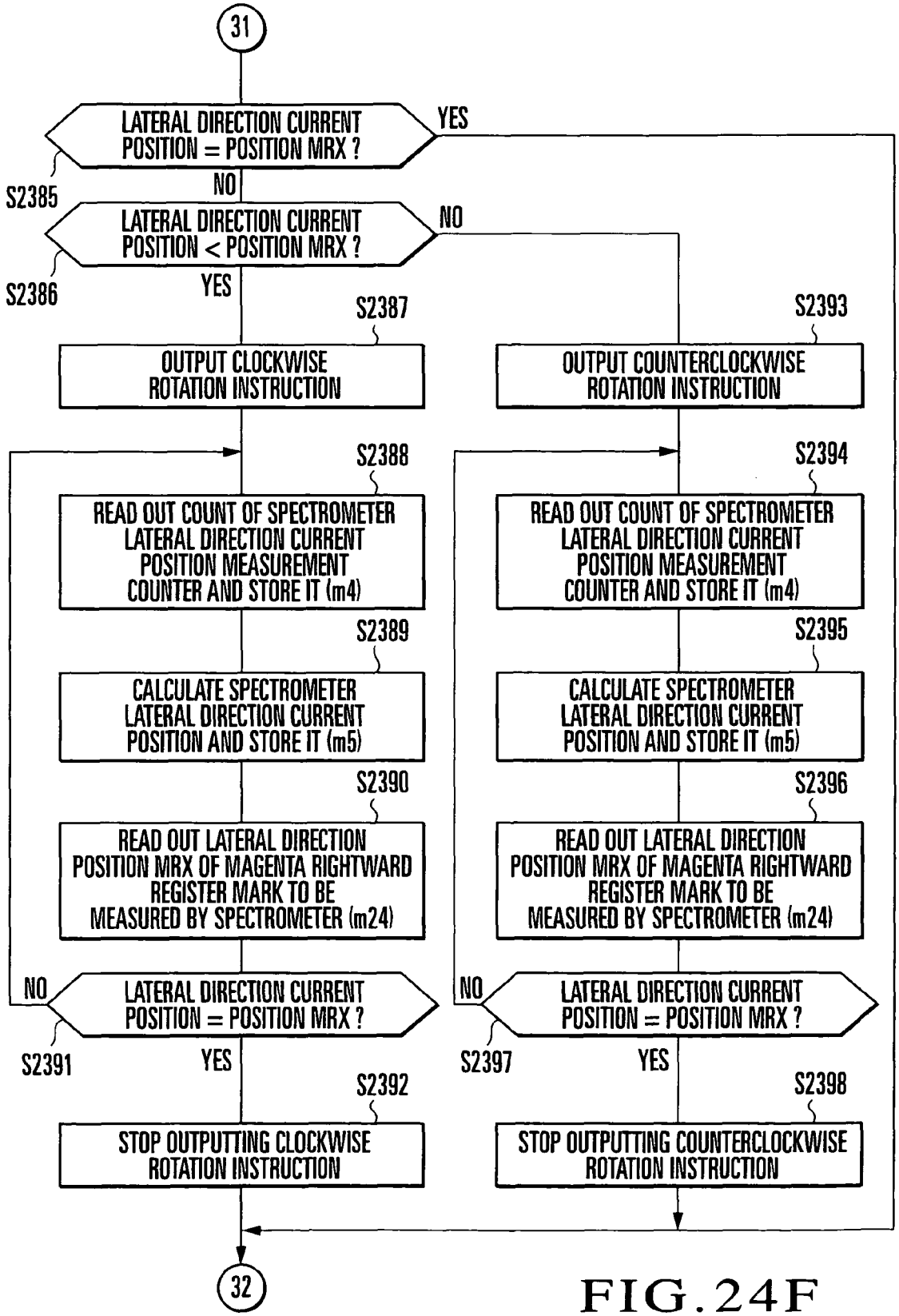
Figure 24G:
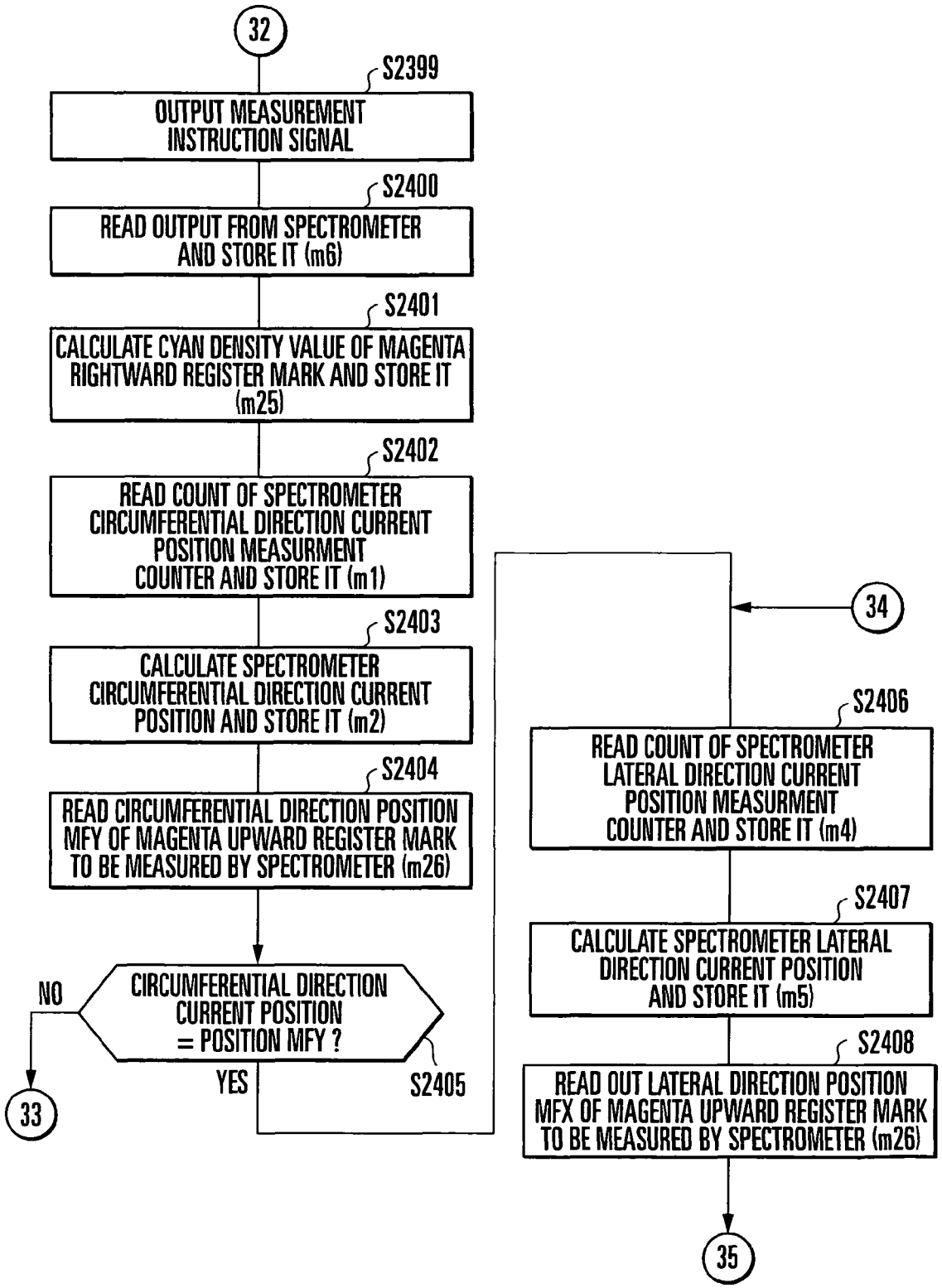
Figure 24H:
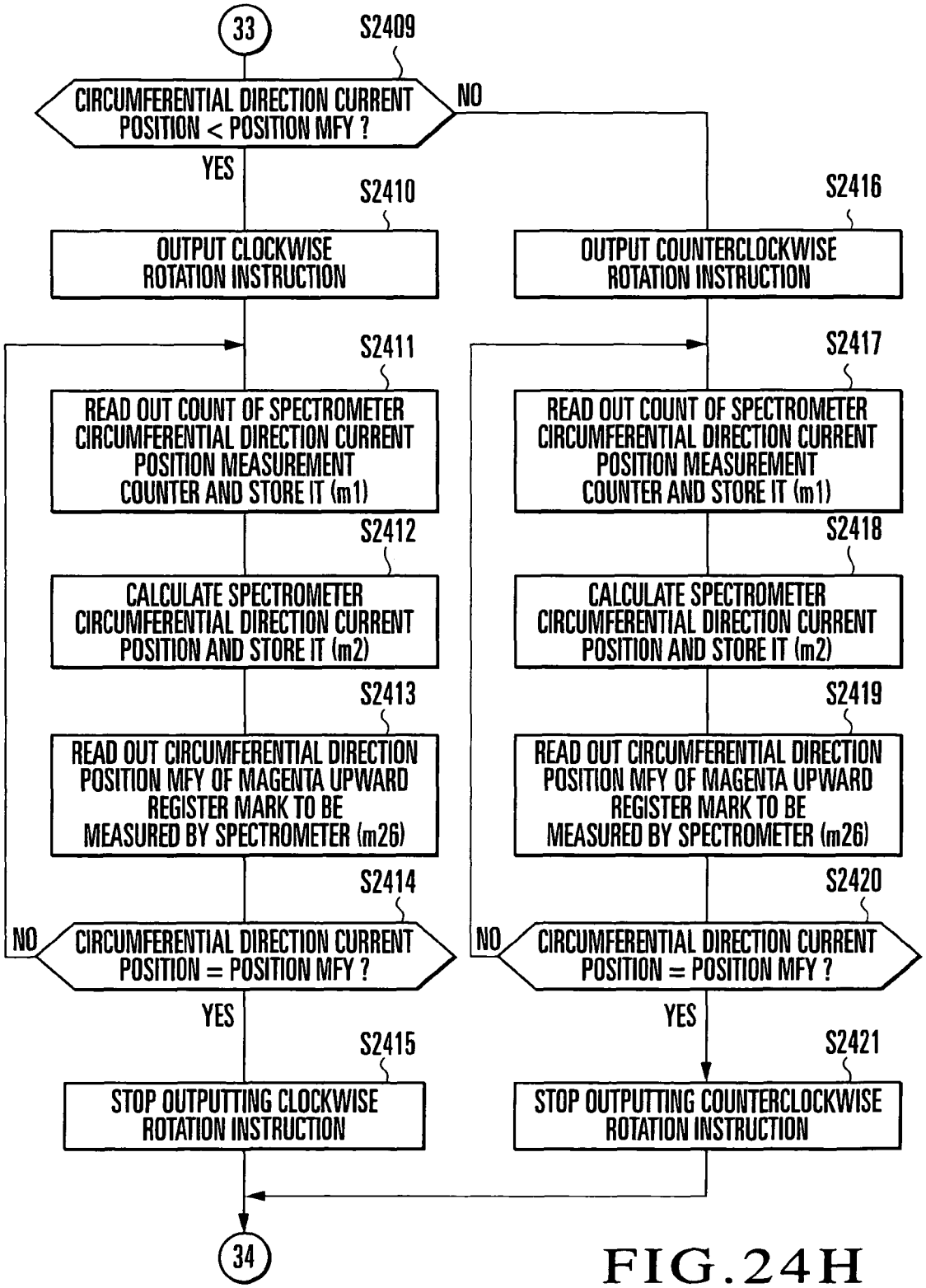
Figure 24I:
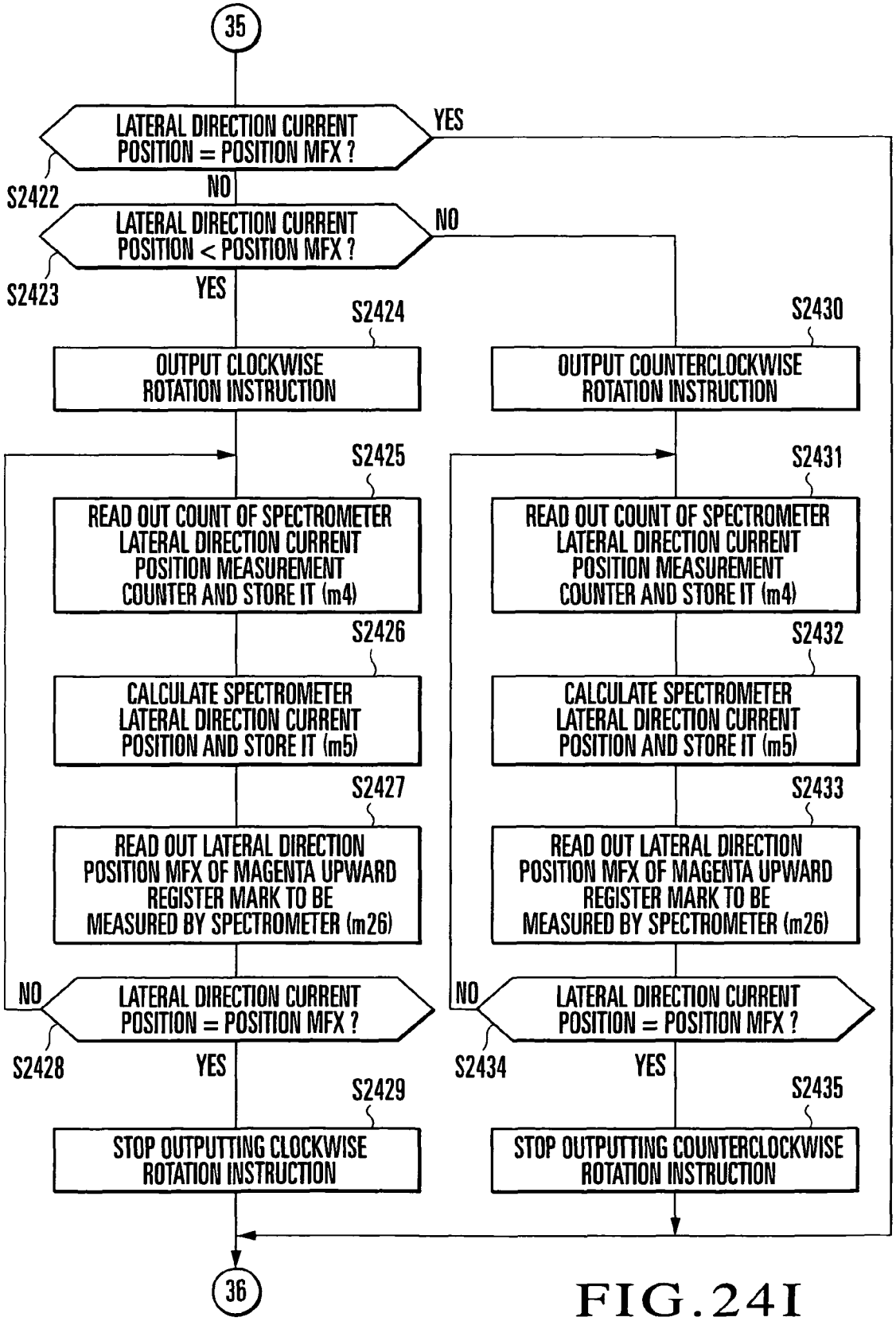
Figure 24J:
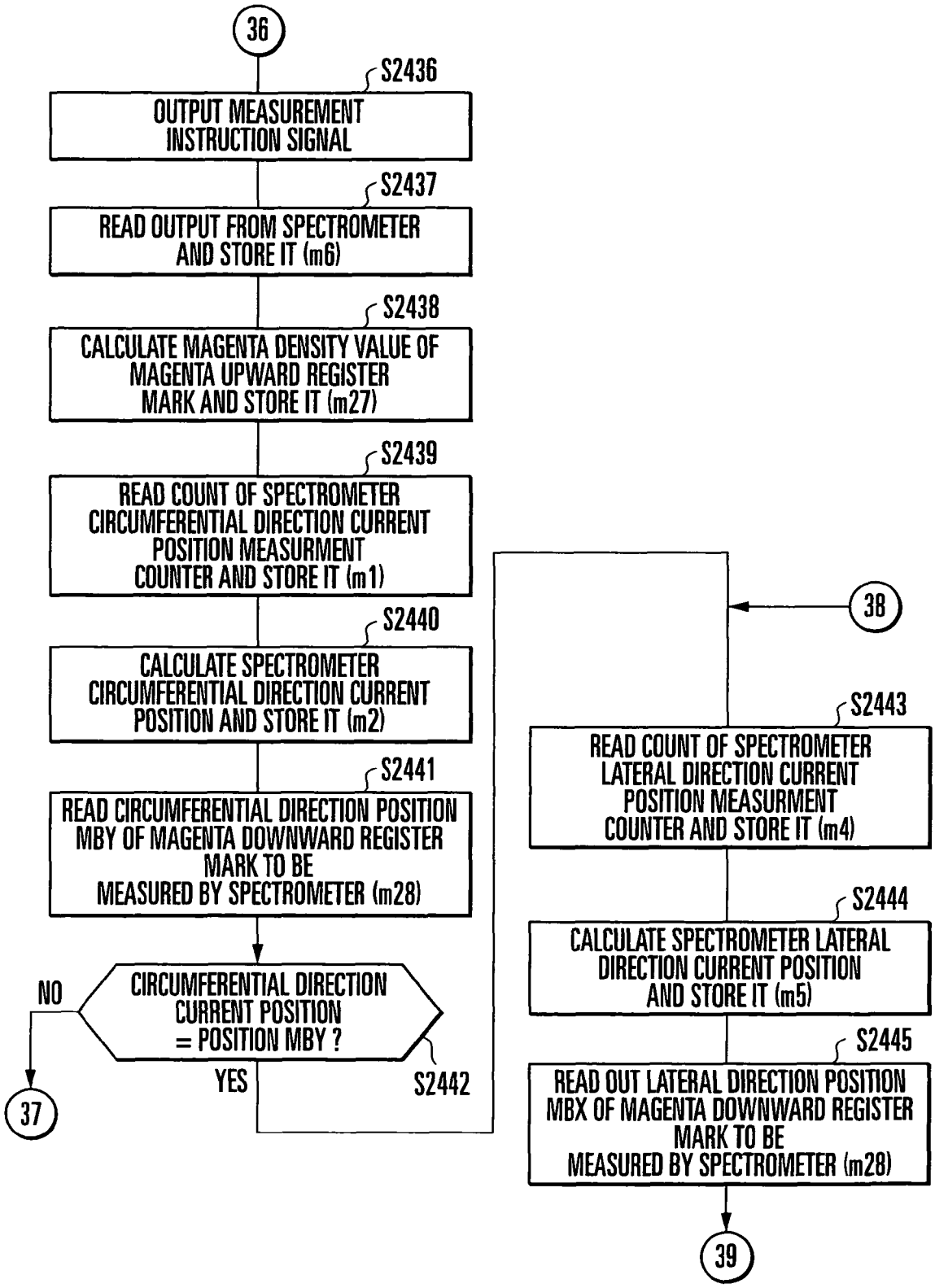
Figure 24K:
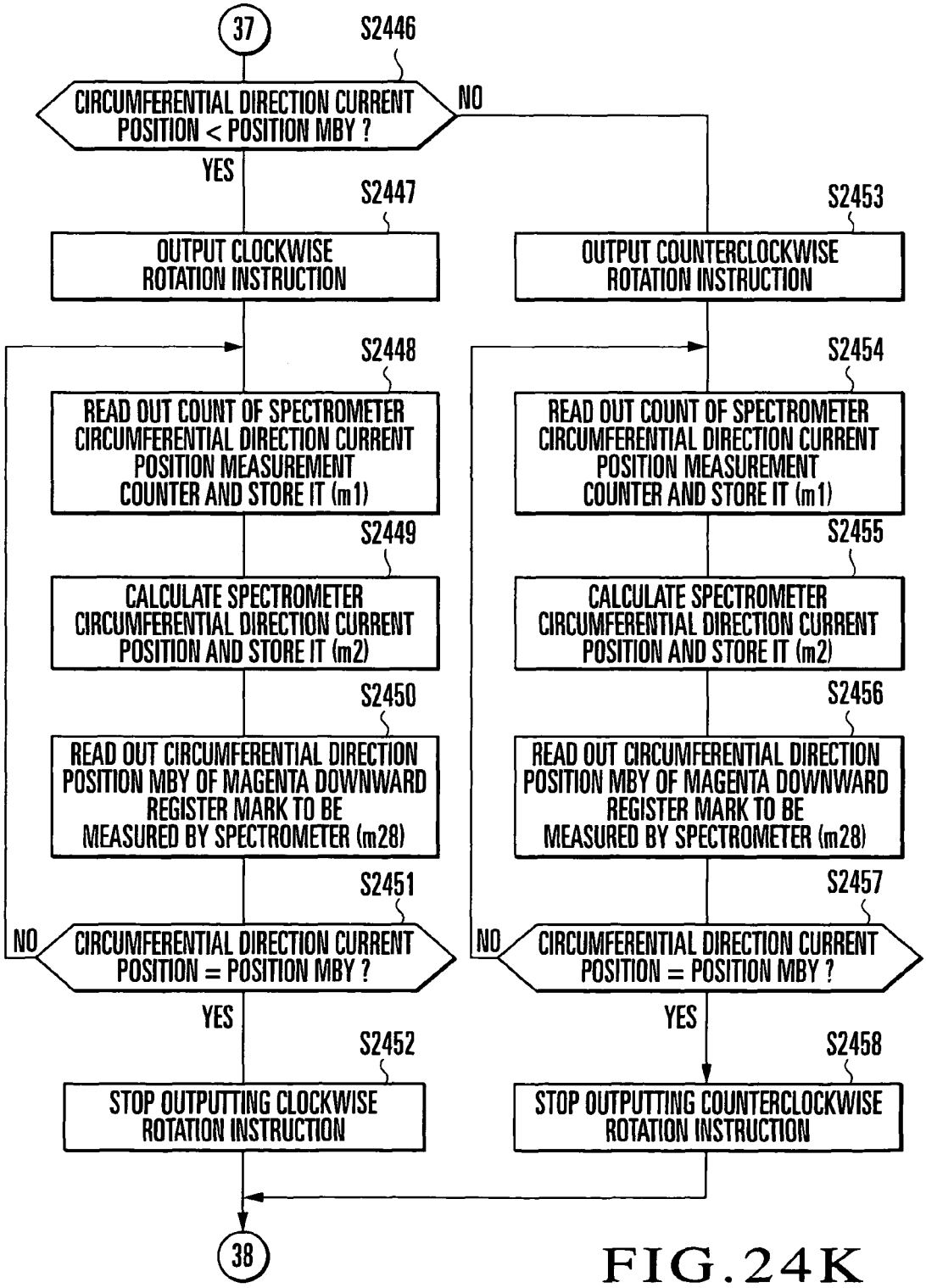
Figure 24L:
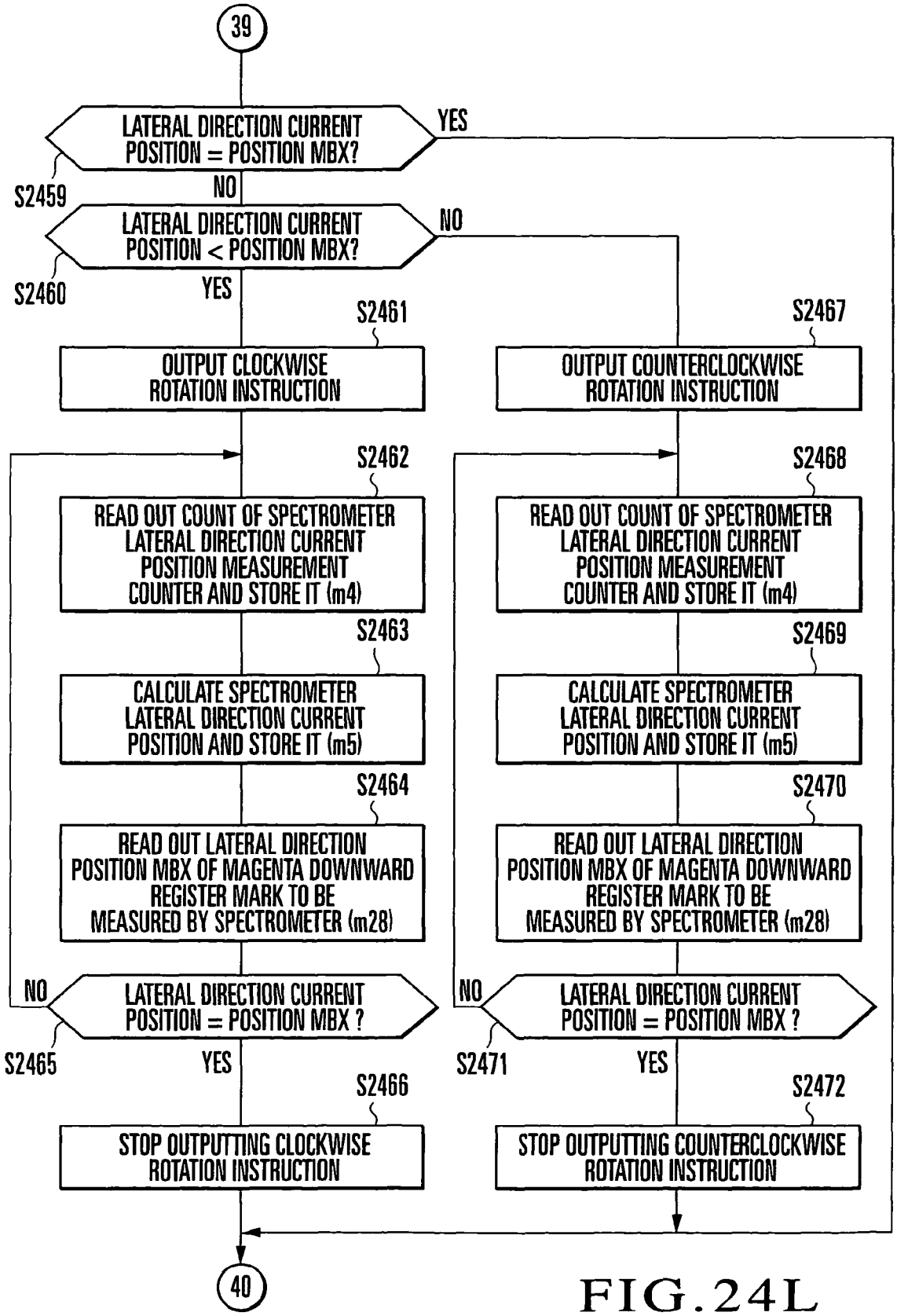
Figure 24M:
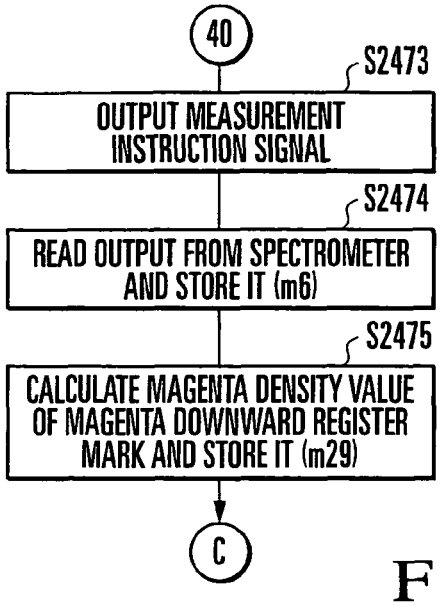

The CPU 33 then reads the count of the spectrometer circumferential direction current position measurement counter 23 (step S2328 in FIG. 24A) to obtain the circumferential direction current position of the spectrometer 19 from the read count (step S2329). The CPU 33 reads out the circumferential direction mark position MLY of a magenta leftward register mark (not shown) from the memory m22 (step S2330), performs the processes of steps S2331 to S2364 (FIGS. 24A to 24D) corresponding to steps S2105 to S2140 shown in FIGS. 22A to 22D to calculate the magenta density value of the leftward reference register mark MB3, on which the magenta leftward register mark is printed to overlap, within the target range S, and stores the density value in the memory m23 as the density information on the magenta component within the target range S.

[Acquisition of Density Information on Magenta Component of Rightward Reference Register Mark+Magenta Rightward Register Mark within Target Range]

The CPU 33 then reads the count of the spectrometer circumferential direction current position measurement counter 23 (step S2365) to obtain the circumferential direction current position of the spectrometer 19 from the read count (step S2366). The CPU 33 reads out the circumferential direction mark position MRY of a magenta rightward register mark from the memory m24 (step S2367), performs the processes of steps S2368 to S2401 (FIGS. 24D to 24G) corresponding to steps S2105 to S2140 shown in FIGS. 22A to 22D to calculate the magenta density value of the rightward reference register mark MB4, on which the magenta rightward register mark is printed to overlap, within the target range S, and stores the density value in the memory m25 as the density information on the magenta component within the target range S.

[Acquisition of Density Information on Magenta Component of Upward Reference Register Mark+Magenta Upward Register Mark within Target Range]

The CPU 33 then reads the count of the spectrometer circumferential direction current position measurement counter 23 (step S2402) to obtain the circumferential direction current position of the spectrometer 19 from the read count (step S2403). The CPU 33 reads out the circumferential direction mark position MFY of a magenta upward register mark (not shown) from the memory m26 (step S2404), performs the processes of steps S2405 to S2438 (FIGS. 24G to 24J) corresponding to steps S2105 to S2140 shown in FIGS. 22A to 22D to calculate the magenta density value of the upward reference register mark MB1, on which the magenta upward register mark is printed to overlap, within the target range S, and stores the density value in the memory m27 as the density information on the magenta component within the target range S.

[Acquisition of Density Information on Magenta Component of Downward Reference Register Mark+Magenta Downward Register Mark within Target Range]

The CPU 33 then reads the count of the spectrometer circumferential direction current position measurement counter 23 (step S2439) to obtain the circumferential direction current position of the spectrometer 19 from the read count (step S2440). The CPU 33 reads out the circumferential direction mark position MBY of a magenta downward register mark from the memory m28 (step S2441), performs the processes of steps S2442 to S2475 (FIGS. 24J to 24M) corresponding to steps S2105 to S2140 shown in FIGS. 22A to 22D to calculate the magenta density value of the downward reference register mark MB2, on which the magenta downward register mark is printed to overlap, within the target range S, and stores the density value in the memory m29 as the density information on the magenta component within the target range S.

[Acquisition of Density Information on Yellow Component of Leftward Reference Register Mark+Yellow Leftward Register Mark within Target Range]

Figure 25A:
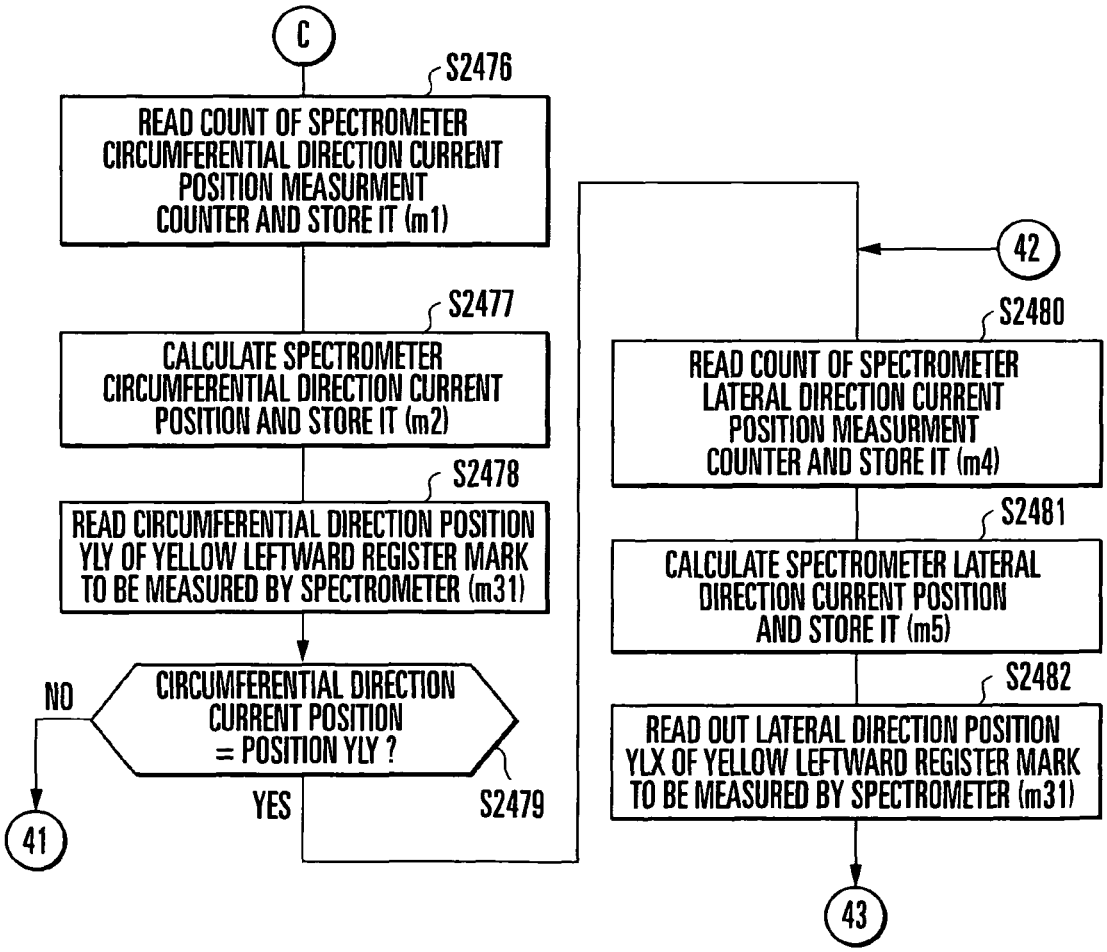
Figure 25B:
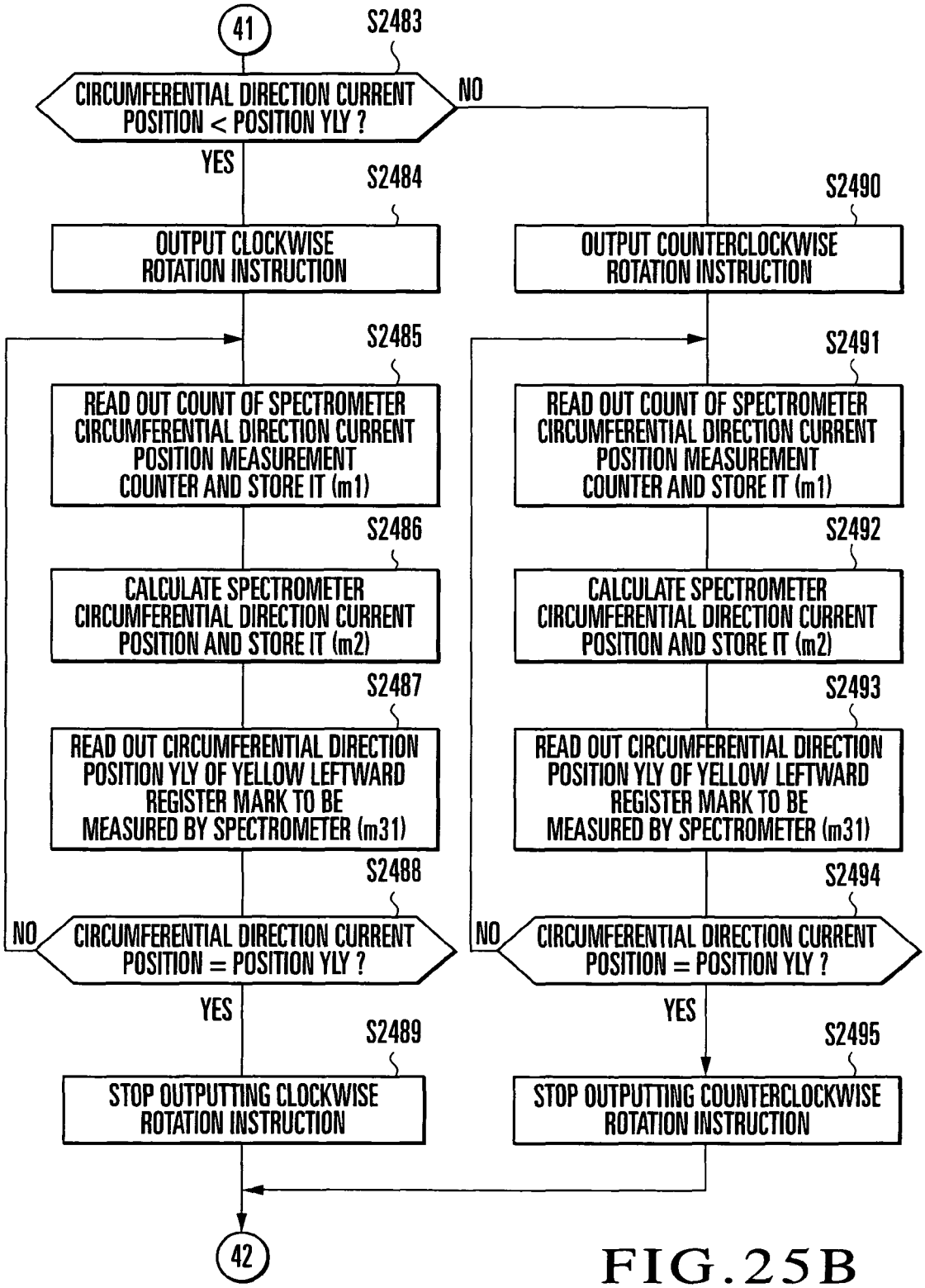
Figure 25C:
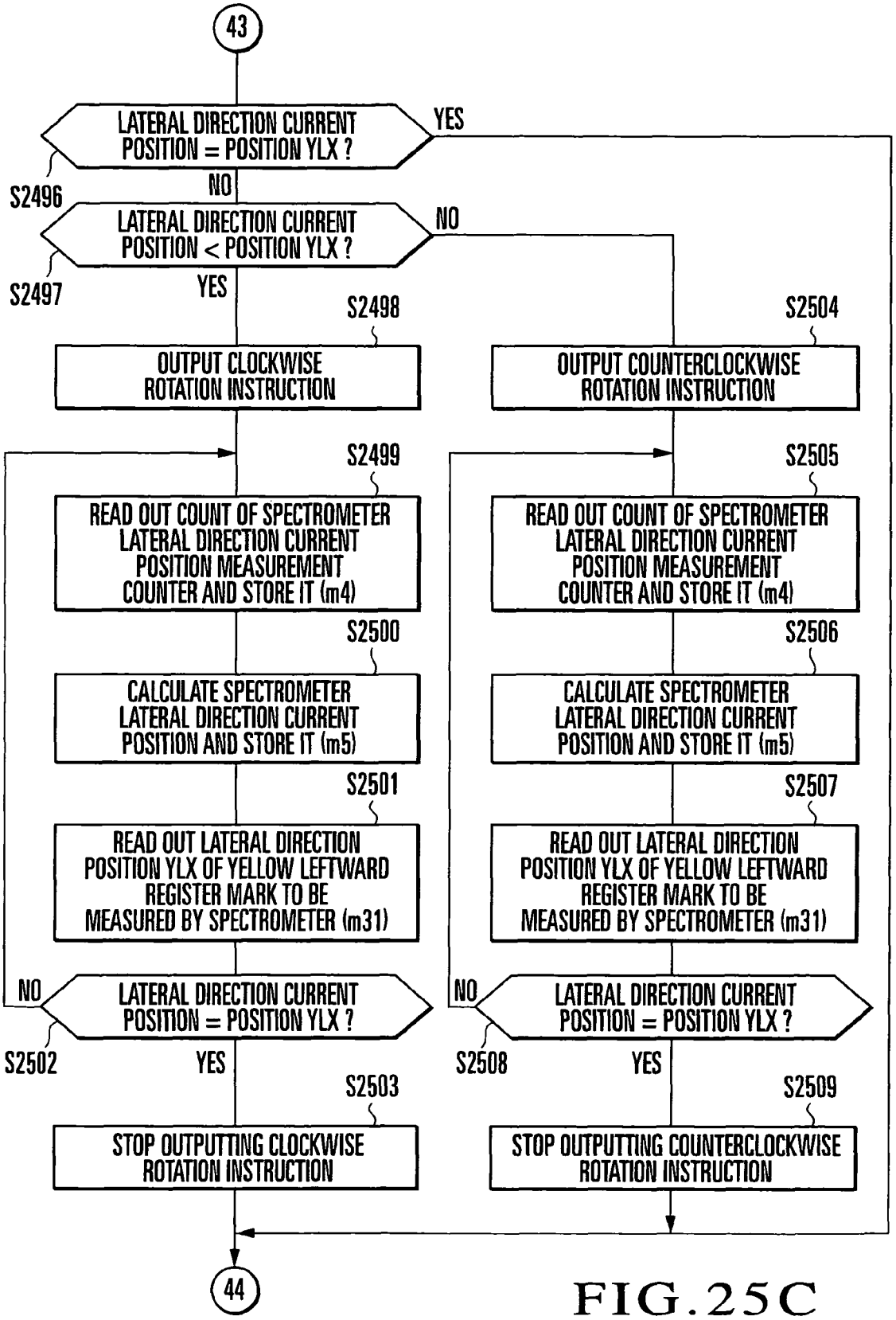
Figure 25D:
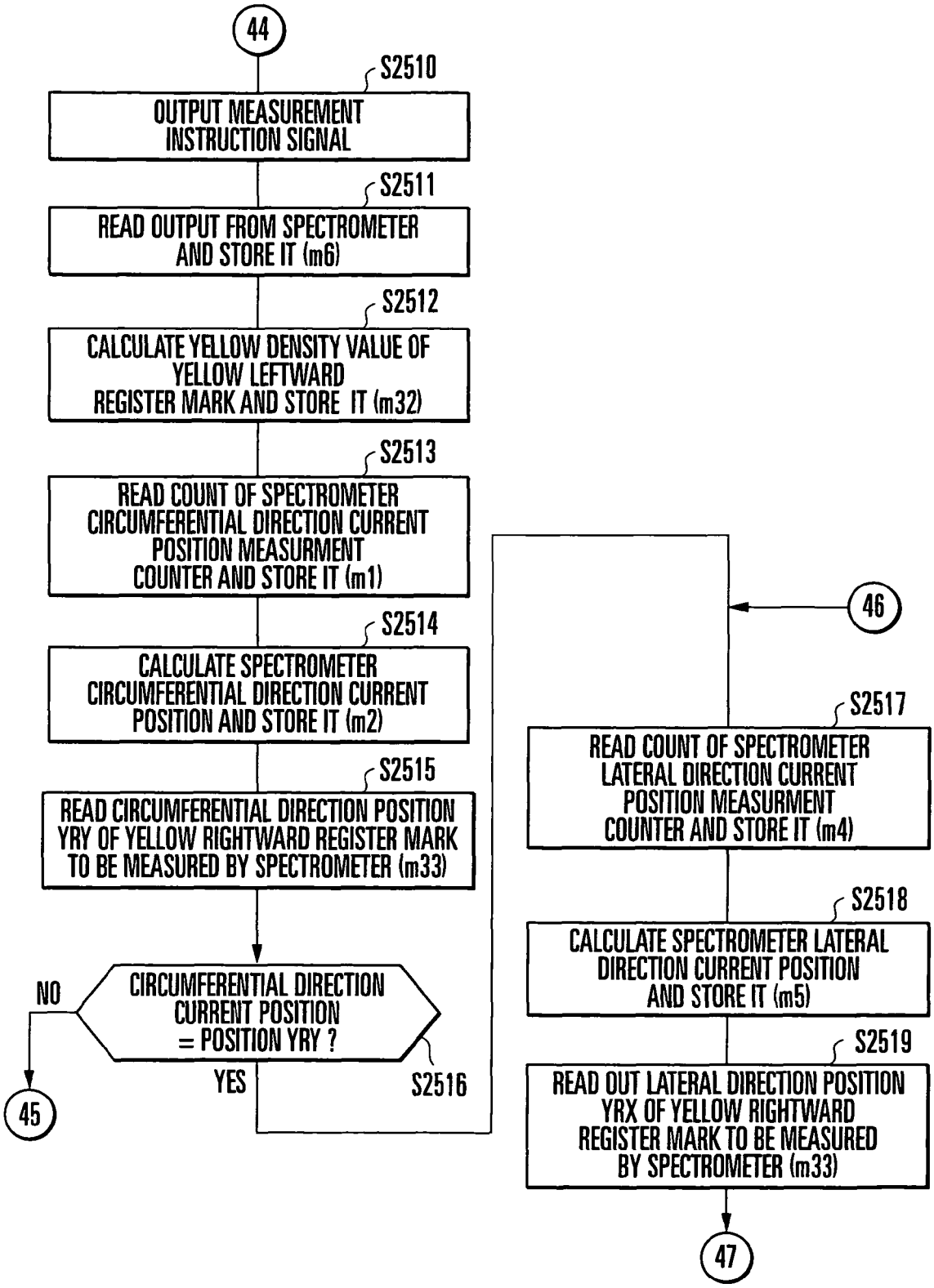
Figure 25E:
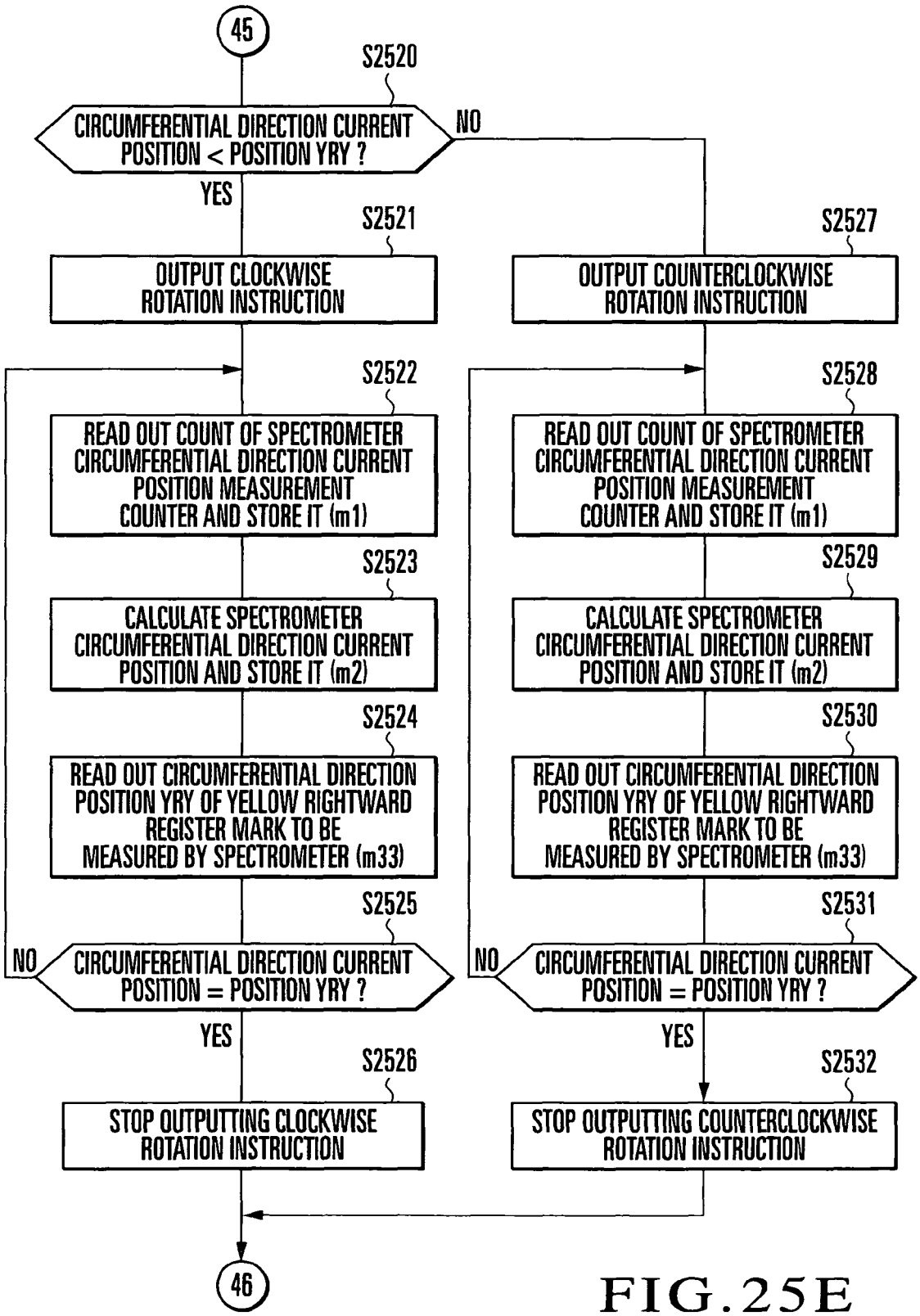
Figure 25F:
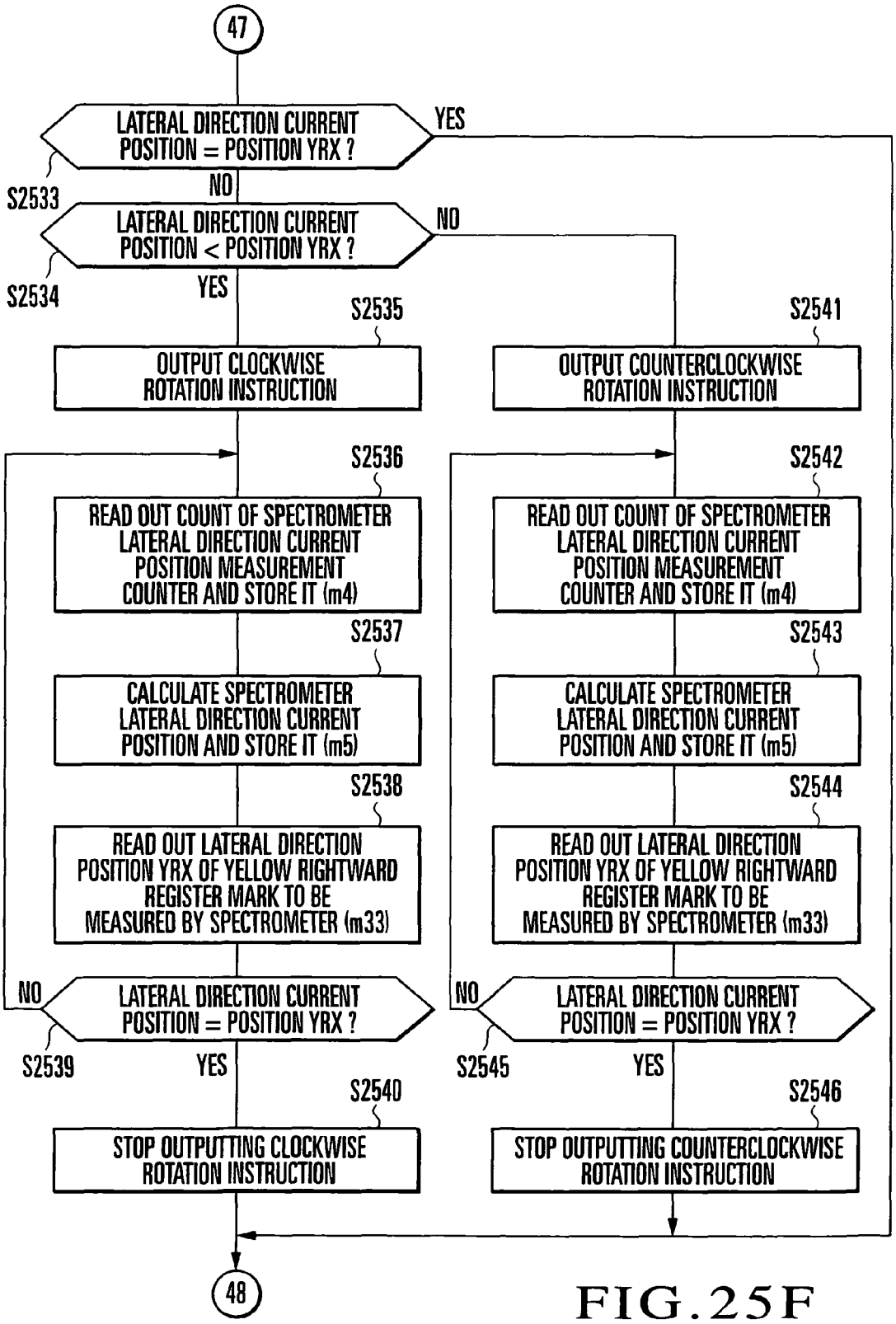
Figure 25G:
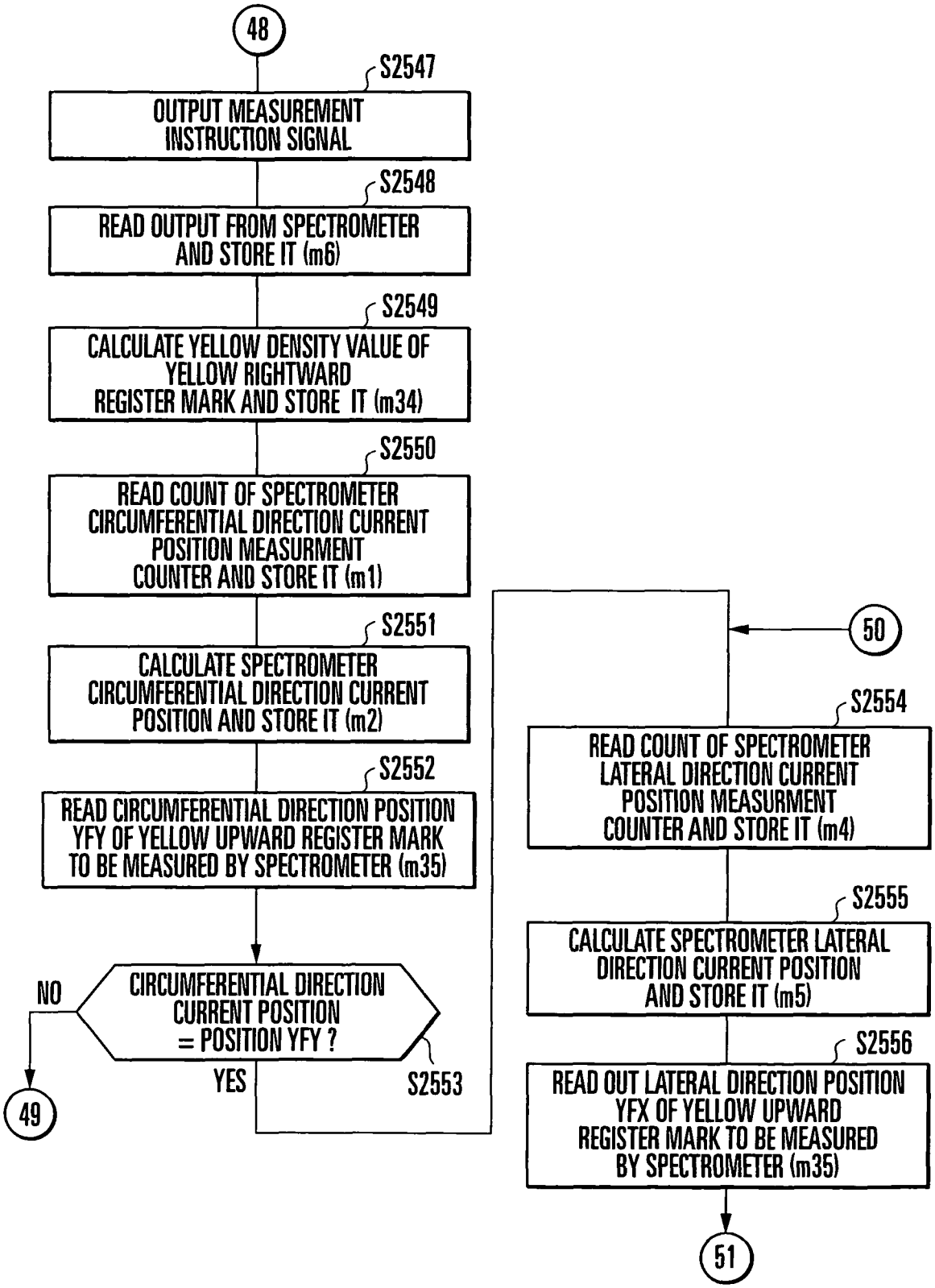
Figure 25H:
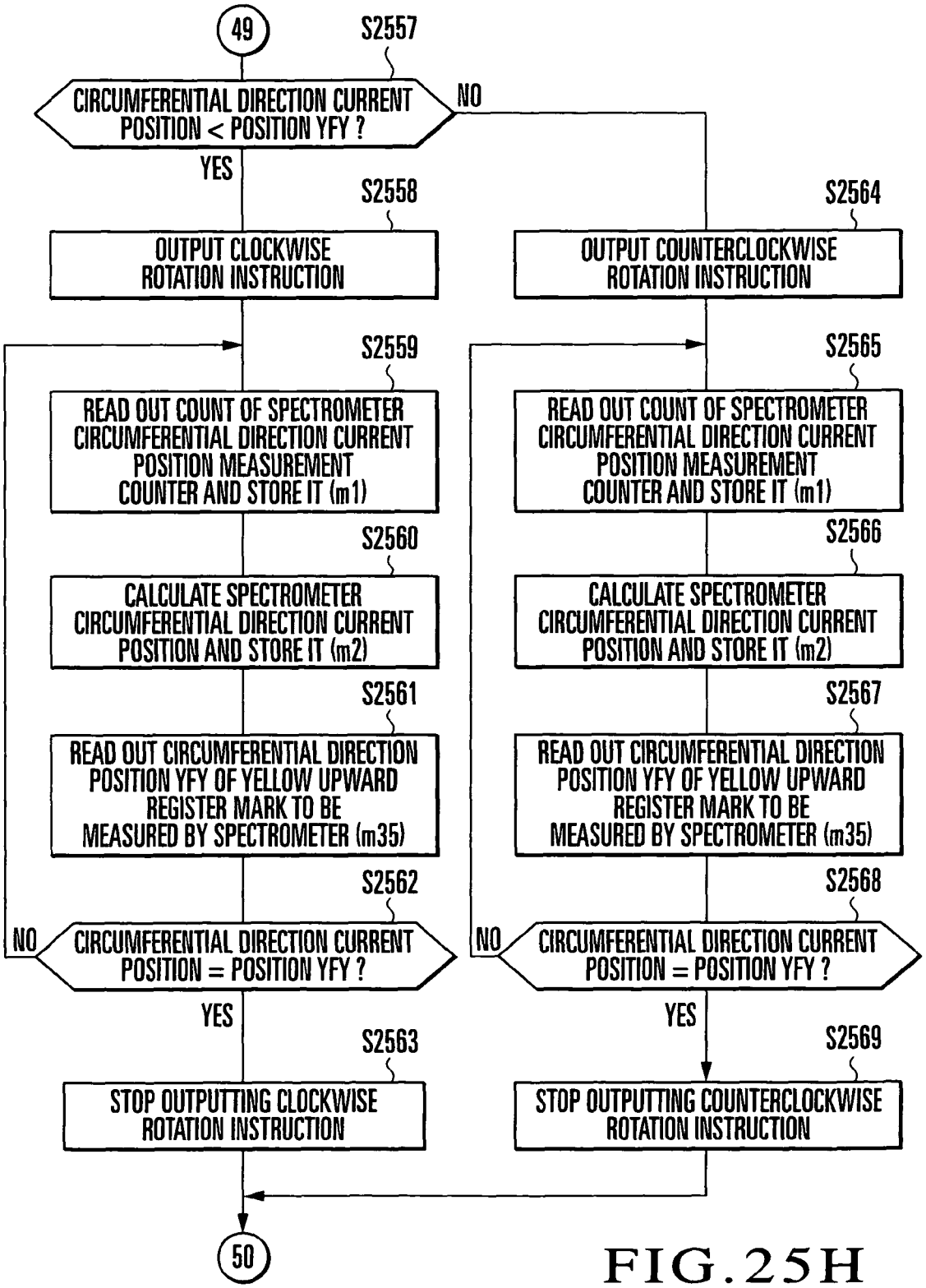
Figure 25I:
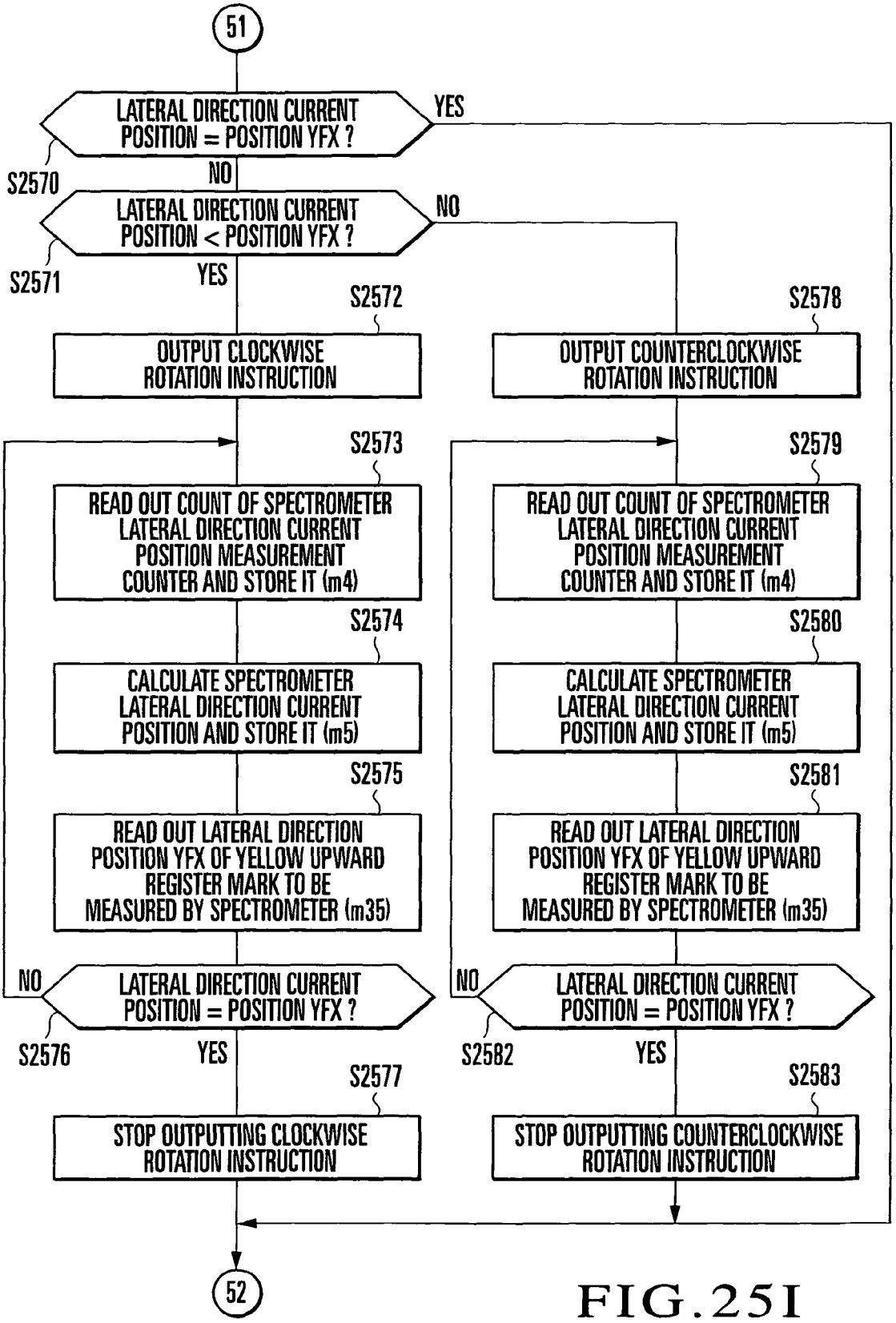
Figure 25J:
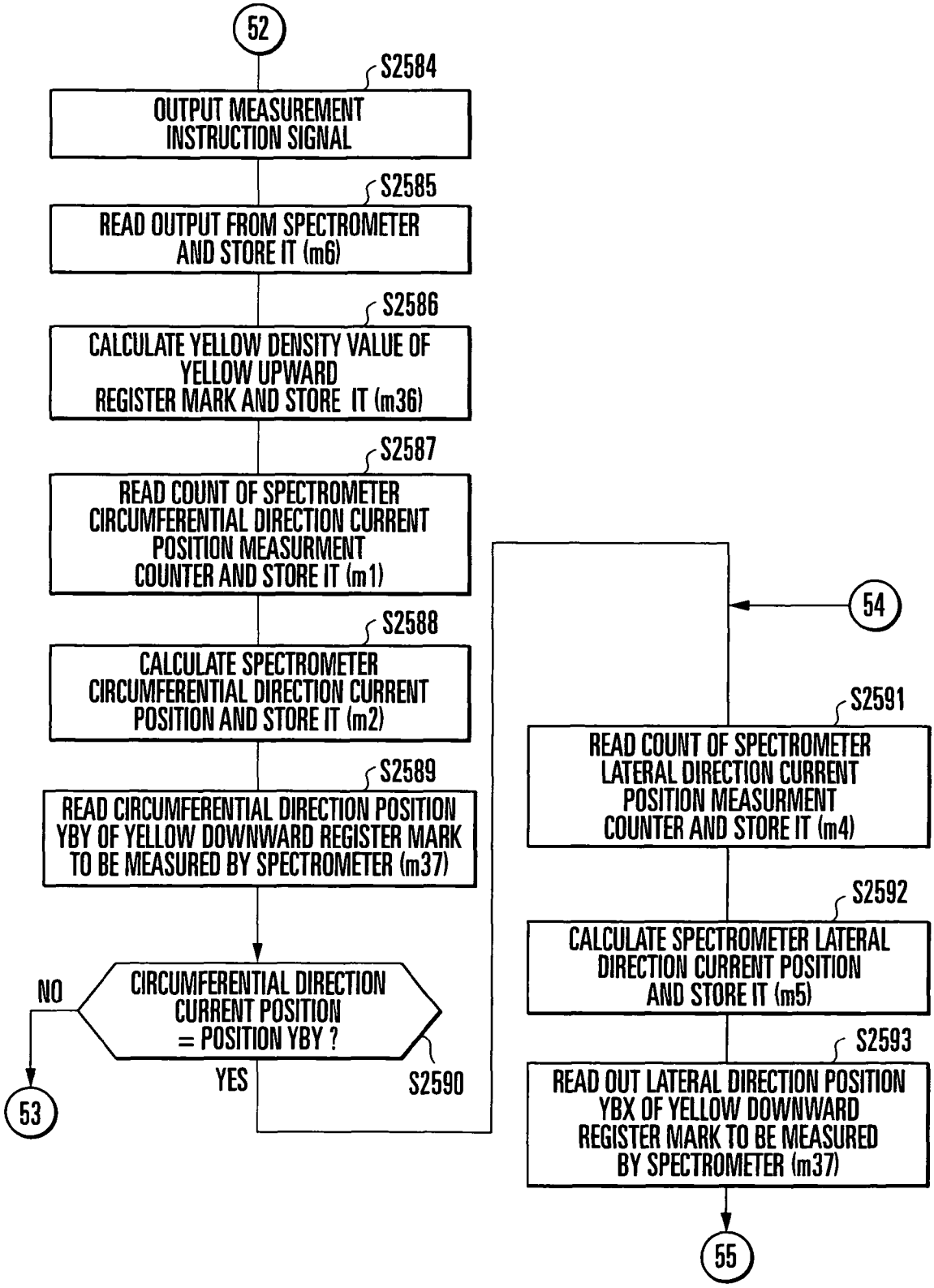
Figure 25K:
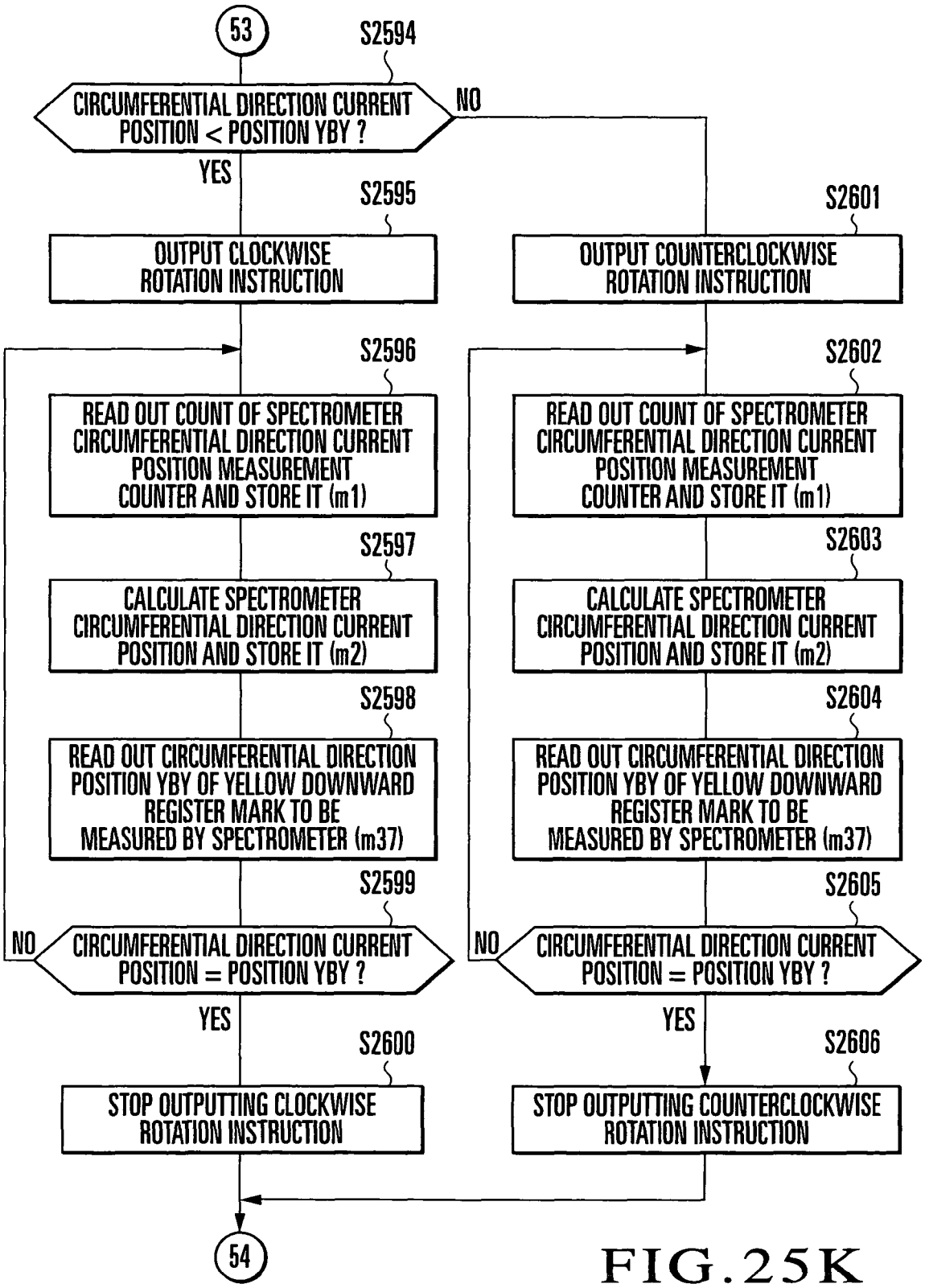
Figure 25L:
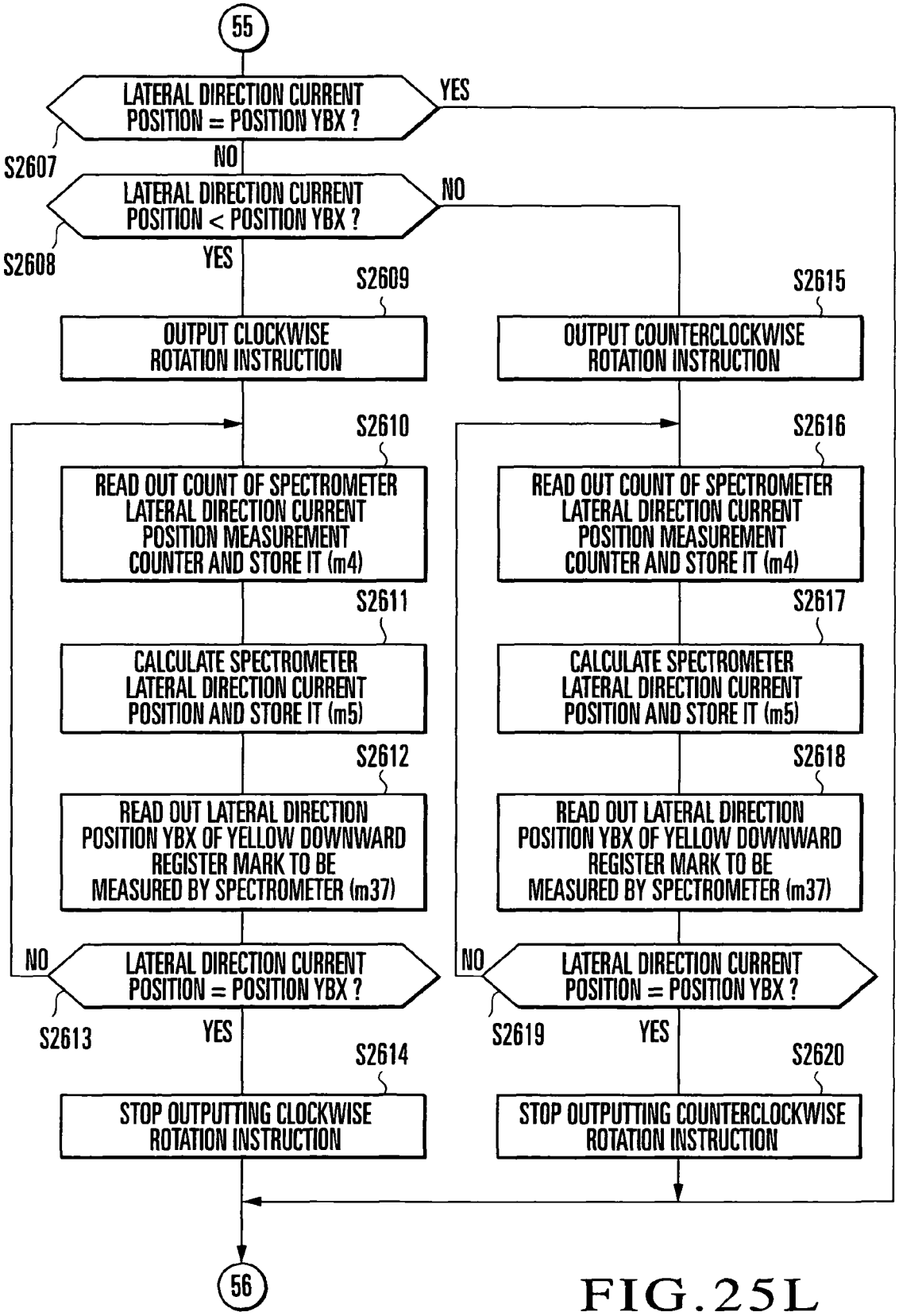
Figure 25M:
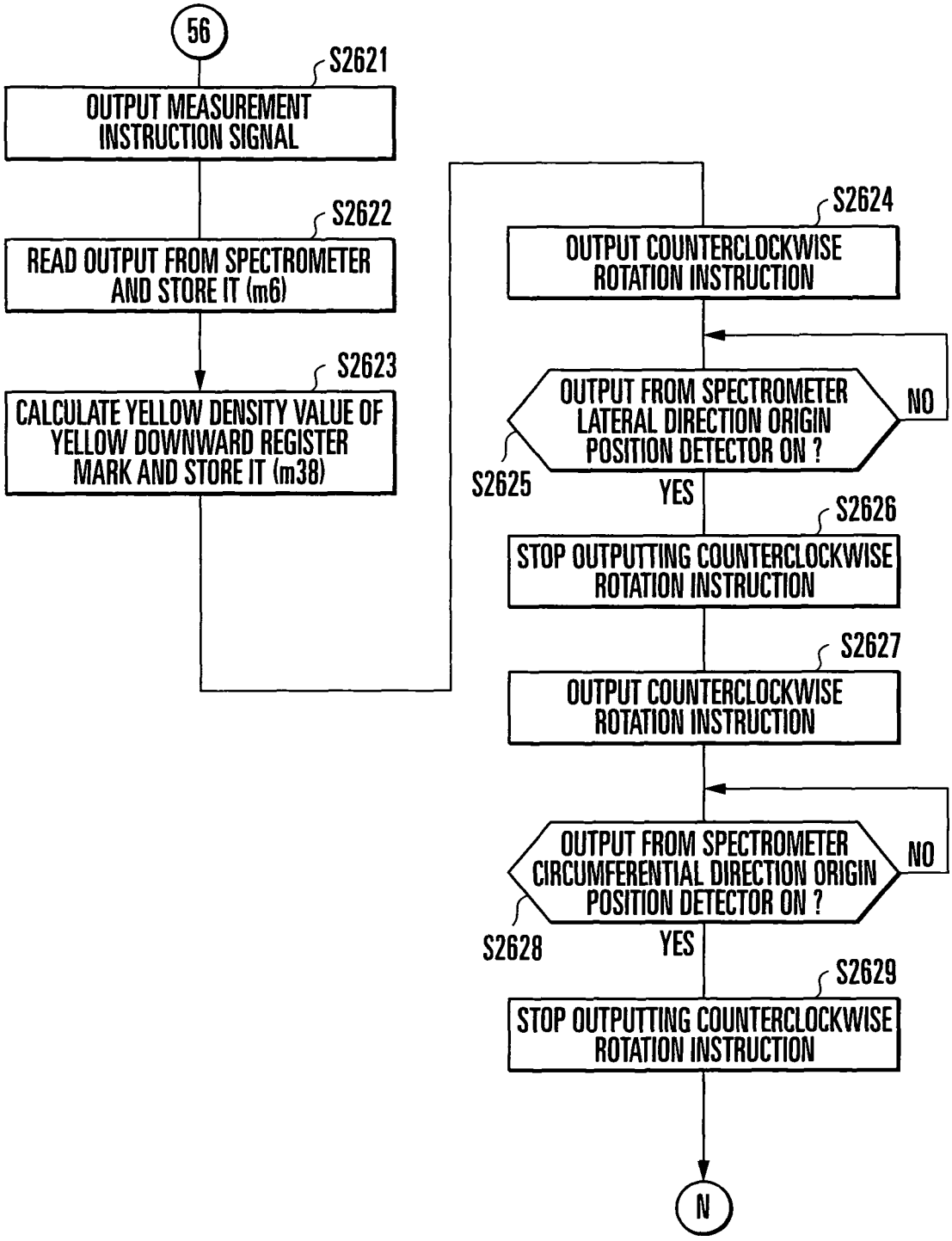

The CPU 33 then reads the count of the spectrometer circumferential direction current position measurement counter 23 (step S2476 in FIG. 25A) to obtain the circumferential direction current position of the spectrometer 19 from the read count (step S2477). The CPU 33 reads out the circumferential direction mark position YLY of a yellow leftward register mark (not shown) from the memory m31 (step S2478), performs the processes of steps S2479 to S2512 (FIGS. 25A to 25D) corresponding to steps S2105 to S2140 shown in FIGS. 22A to 22D to calculate the yellow density value of the leftward reference register mark MB3, on which the yellow leftward register mark is printed to overlap, within the target range S, and stores the density value in the memory m32 as the density information on the yellow component within the target range S.

[Acquisition of Density Information on Yellow Component of Rightward Reference Register Mark+Yellow Rightward Register Mark within Target Range]

The CPU 33 then reads the count of the spectrometer circumferential direction current position measurement counter 23 (step S2513) to obtain the circumferential direction current position of the spectrometer 19 from the read count (step S2514). The CPU 33 reads out the circumferential direction mark position YRY of a yellow rightward register mark from the memory m33 (step S2515), performs the processes of steps S2516 to S2549 (FIGS. 25D to 25G) corresponding to steps S2105 to S2140 shown in FIGS. 22A to 22D to calculate the yellow density value of the rightward reference register mark MB4, on which the yellow rightward register mark is printed to overlap, within the target range S, and stores the density value in the memory m34 as the density information on the yellow component within the target range S.

[Acquisition of Density Information on Yellow Component of Upward Reference Register Mark+Yellow Upward Register Mark within Target Range]

The CPU 33 then reads the count of the spectrometer circumferential direction current position measurement counter 23 (step S2550) to obtain the circumferential direction current position of the spectrometer 19 from the read count (step S2551). The CPU 33 reads out the circumferential direction mark position YFY of a yellow upward register mark (not shown) from the memory m35 (step S2552), performs the processes of steps S2553 to S2586 (FIGS. 25G to 25J) corresponding to steps S2105 to S2140 shown in FIGS. 22A to 22D to calculate the yellow density value of the upward reference register mark MB1, on which the yellow upward register mark is printed to overlap, within the target range S, and stores the density value in the memory m36 as the density information on the yellow component within the target range S.

[Acquisition of Density Information on Yellow Component of Downward Reference Register Mark+Yellow Downward Register Mark within Target Range]

The CPU 33 then reads the count of the spectrometer circumferential direction current position measurement counter 23 (step S2587) to obtain the circumferential direction current position of the spectrometer 19 from the read count (step S2588). The CPU 33 reads out the circumferential direction mark position YBY of a yellow downward register mark from the memory m37 (step S2589), performs the processes of steps S2590 to S2623 (FIGS. 25J to 25M) corresponding to steps S2105 to S2140 shown in FIGS. 22A to 22D to calculate the yellow density value of the downward reference register mark MB2, on which the yellow downward register mark is printed to overlap, within the target range S, and stores the density value in the memory m38 as the density information on the yellow component within the target range S.

The CPU 33 sends a counterclockwise rotation instruction to the lateral direction movement motor driver 26 (step S2624) to stop the spectrometer 19 at its lateral direction origin position (steps S2625 and S2626). The CPU 33 also sends a counterclockwise rotation instruction to the circumferential direction movement motor driver 21 (step S2627) to stop the spectrometer 19 at its circumferential direction origin position (steps S2628 and S2629).

[Calculation of Misregister Amount of Cyan in Lateral Direction]

The CPU 33 reads out the cyan density value of the leftward reference register mark MB3, on which the cyan leftward register mark MC3 is printed to overlap, within the target range S from the memory m15 (step S2630 in FIG. 26A) and the cyan density value of the black lateral direction reference register mark MB34 within the target range S from the memory m7 (step S2631), subtracts the density value read out from the memory m7 from the density value read out from the memory m15 to obtain the difference in density value of the cyan leftward register mark, and stores the difference in density value in the memory m39 (step S2632).

The CPU 33 reads out a tolerance from the memory m40 (step S2633) and compares it with the difference in density value of the cyan leftward register mark obtained in step S2632 (step S2634). If the difference in density value of the cyan leftward register mark exceeds the tolerance (YES in step S2634), the CPU 33 reads out from the memory m41 the conversion table of the difference in density value of the cyan lateral direction register mark into the lateral direction misregister amount of the cyan printing unit (step S2635), obtains a lateral direction misregister amount corresponding to the given difference in density value of the cyan leftward register mark from the readout table, and stores the obtained lateral direction misregister amount in the memory m42 as the leftward misregister amount of the cyan printing unit (step S2636).

The CPU 33 reads out the cyan density value of the rightward reference register mark MB4, on which the cyan rightward register mark MC4 is printed to overlap, within the target range S from the memory m17 (step S2637) and the cyan density value of the black lateral direction reference register mark MB34 within the target range S from the memory m7 (step S2638), subtracts the density value read out from the memory m7 from the density value read out from the memory m17 to obtain the difference in density value of the cyan rightward register mark, and stores the difference in density value in the memory m43 (step S2639).

The CPU 33 reads out the tolerance from the memory m40 (step S2640) and compares it with the difference in density value of the cyan rightward register mark obtained in step S2639 (step S2641). If the difference in density value of the cyan rightward register mark exceeds the tolerance (YES in step S2641), the CPU 33 reads out from the memory m41 the conversion table of the difference in density value of the cyan lateral direction register mark into the lateral direction misregister amount of the cyan printing unit (step S2642), obtains a lateral direction misregister amount corresponding to the given difference in density value of the cyan rightward register mark from the readout table, and stores the obtained lateral direction misregister amount in the memory m44 as the rightward misregister amount of the cyan printing unit (step S2643).

[Calculation of Misregister Amount of Cyan in Circumferential Direction]

The CPU 33 reads out the cyan density value of the upward reference register mark MB1, on which the cyan upward register mark MC1 is printed to overlap, within the target range S from the memory m19 (step S2644 in FIG. 26B) and the cyan density value of the black circumferential direction reference register mark MB12 within the target range S from the memory m11 (step S2645), subtracts the density value read out from the memory m11 from the density value read out from the memory m19 to obtain the difference in density value of the cyan upward register mark, and stores the difference in density value in the memory m45 (step S2646).

The CPU 33 reads out a tolerance from the memory m46 (step S2647) and compares it with the difference in density value of the cyan upward register mark obtained in step S2646 (step S2648). If the difference in density value of the cyan upward register mark exceeds the tolerance (YES in step S2648), the CPU 33 reads out from the memory m47 the conversion table of the difference in density value of the cyan circumferential direction register mark into the circumferential direction misregister amount of the cyan printing unit (step S2649), obtains a circumferential direction misregister amount corresponding to the given difference in density value of the cyan upward register mark from the readout table, and stores the obtained circumferential direction misregister amount in the memory m48 as the upward misregister amount of the cyan printing unit (step S2650).

The CPU 33 reads out the cyan density value of the downward reference register mark MB2, on which the cyan downward register mark MC2 is printed to overlap, within the target range S from the memory m21 (step 2651) and the cyan density value of the black circumferential direction reference register mark MB12 within the target range S from the memory m11 (step S2652), subtracts the density value read out from the memory m11 from the density value read out from the memory m21 to obtain the difference in density value of the cyan downward register mark, and stores the difference in density value in the memory m49 (step S2653).

The CPU 33 reads out the tolerance from the memory m46 (step S2654) and compares it with the difference in density value of the cyan downward register mark obtained in step S2653 (step S2655). If the difference in density value of the cyan downward register mark exceeds the tolerance (YES in step S2655), the CPU 33 reads out from the memory m47 the conversion table of the difference in density value of the cyan circumferential direction register mark into the circumferential direction misregister amount of the cyan printing unit (step S2656), obtains a circumferential direction misregister amount corresponding to the given difference in density value of the cyan downward register mark from the readout table, and stores the obtained circumferential direction misregister amount in the memory m50 as the downward misregister amount of the cyan printing unit (step S2657).

[Calculation of Magenta Lateral Direction Misregister Amount]

Figure 26A:
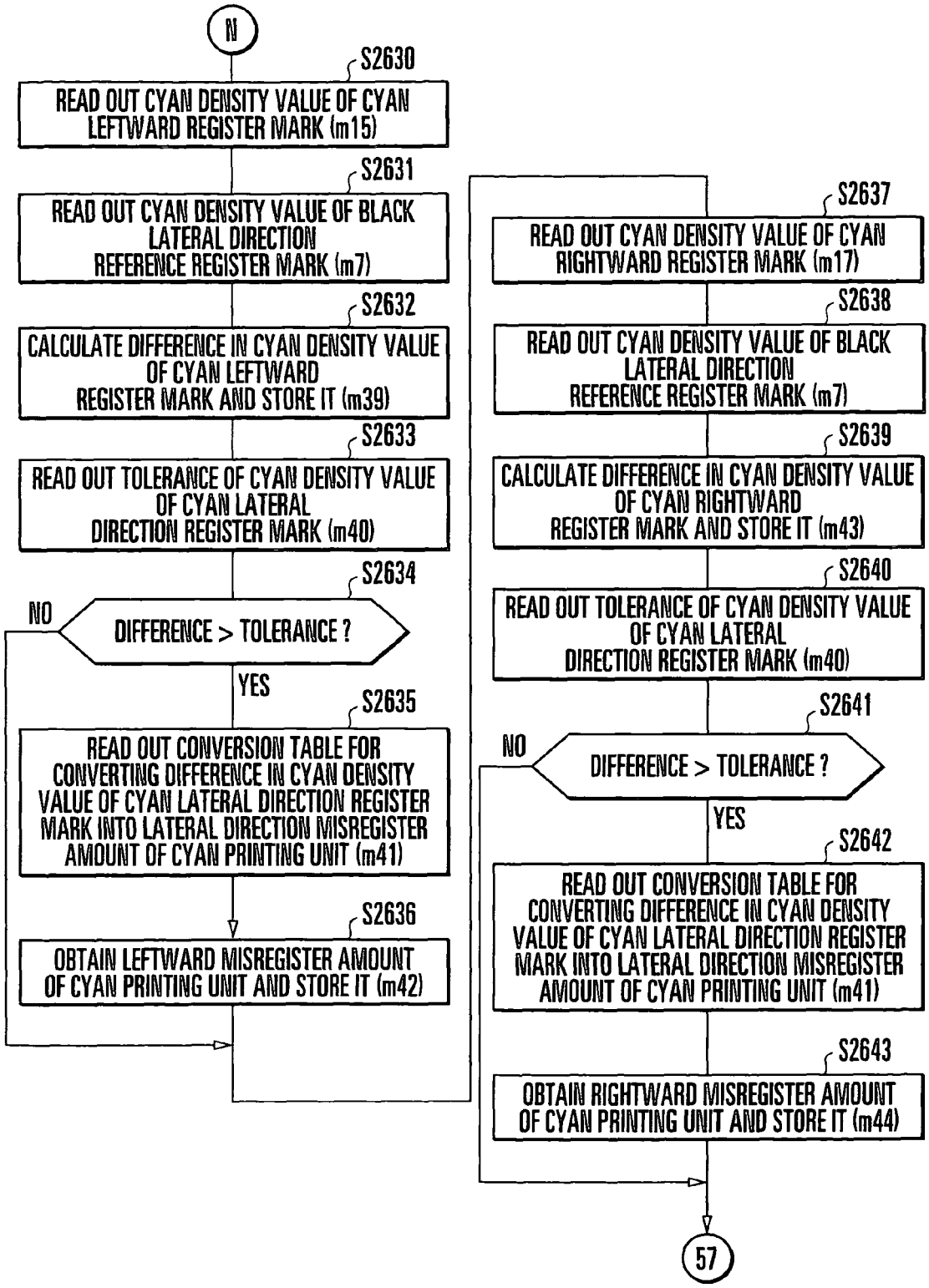
FIGS. 26A to 26F are flowcharts showing the processes, subsequent to the processes shown in FIGS. 22A to 25M, of calculating a misregister amount.

The CPU 33 performs the processes of steps S2658 to S2671 (FIG. 26C) corresponding to steps S2630 to S2643 shown in FIG. 26A. The CPU 33 thus obtains a leftward misregister amount corresponding to the difference in magenta density value of the magenta leftward register mark and stores it in the memory m54, and obtains a rightward misregister amount corresponding to the difference in magenta density value of the magenta rightward register mark and stores it in the memory m56.

[Calculation of Magenta Circumferential Direction Misregister Amount]

Figure 26B:
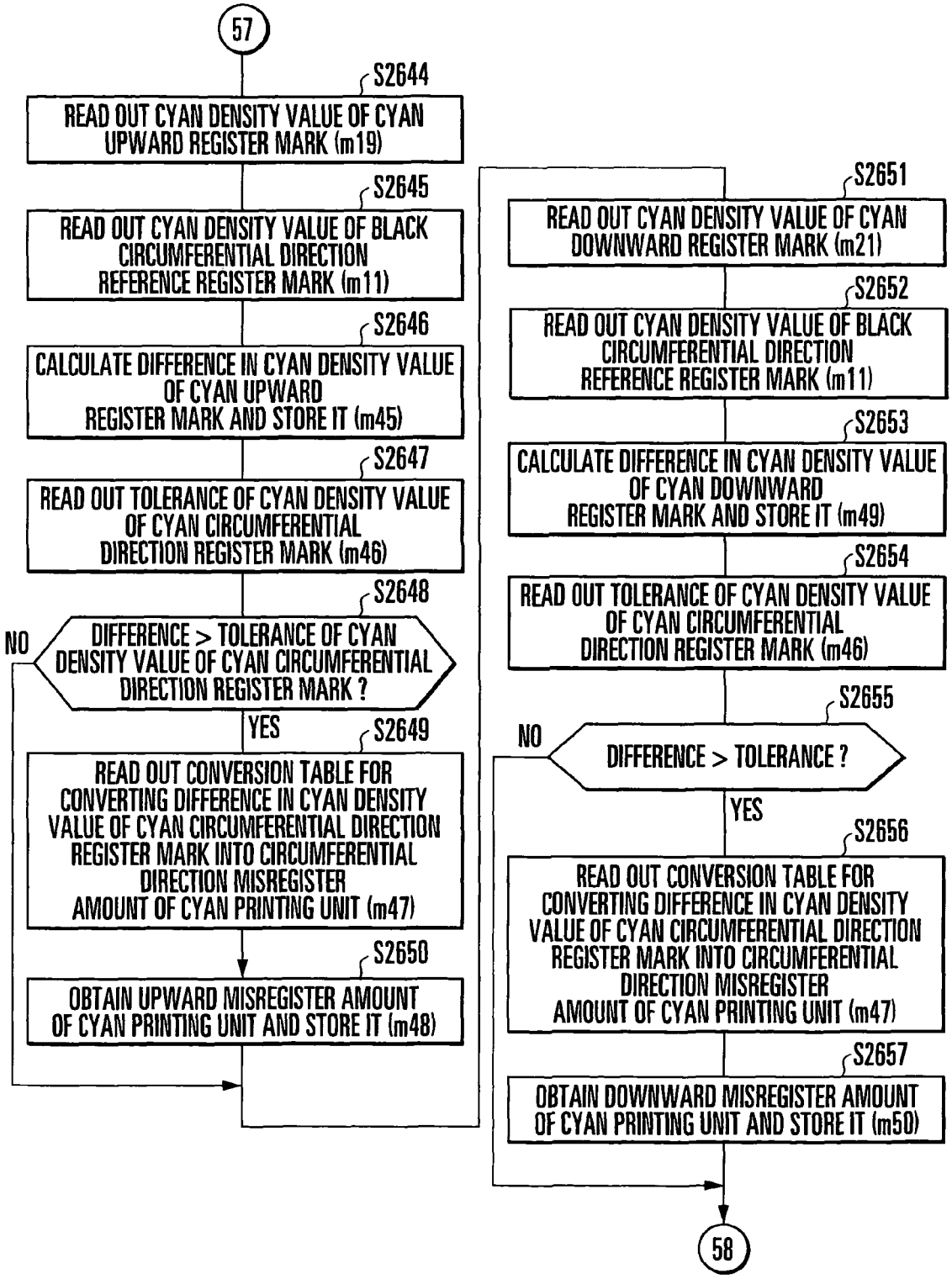
Figure 26C:
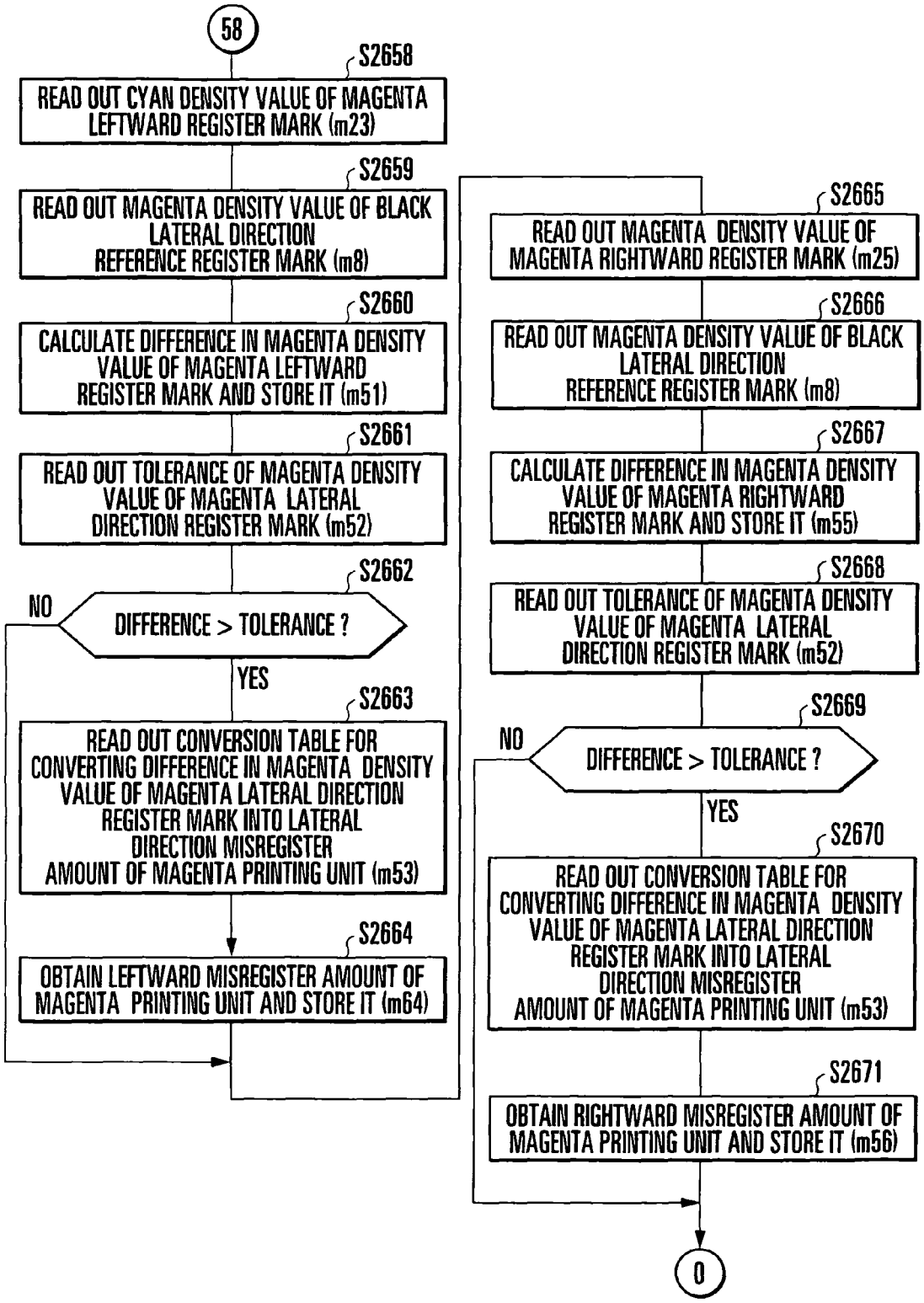
Figure 26D:
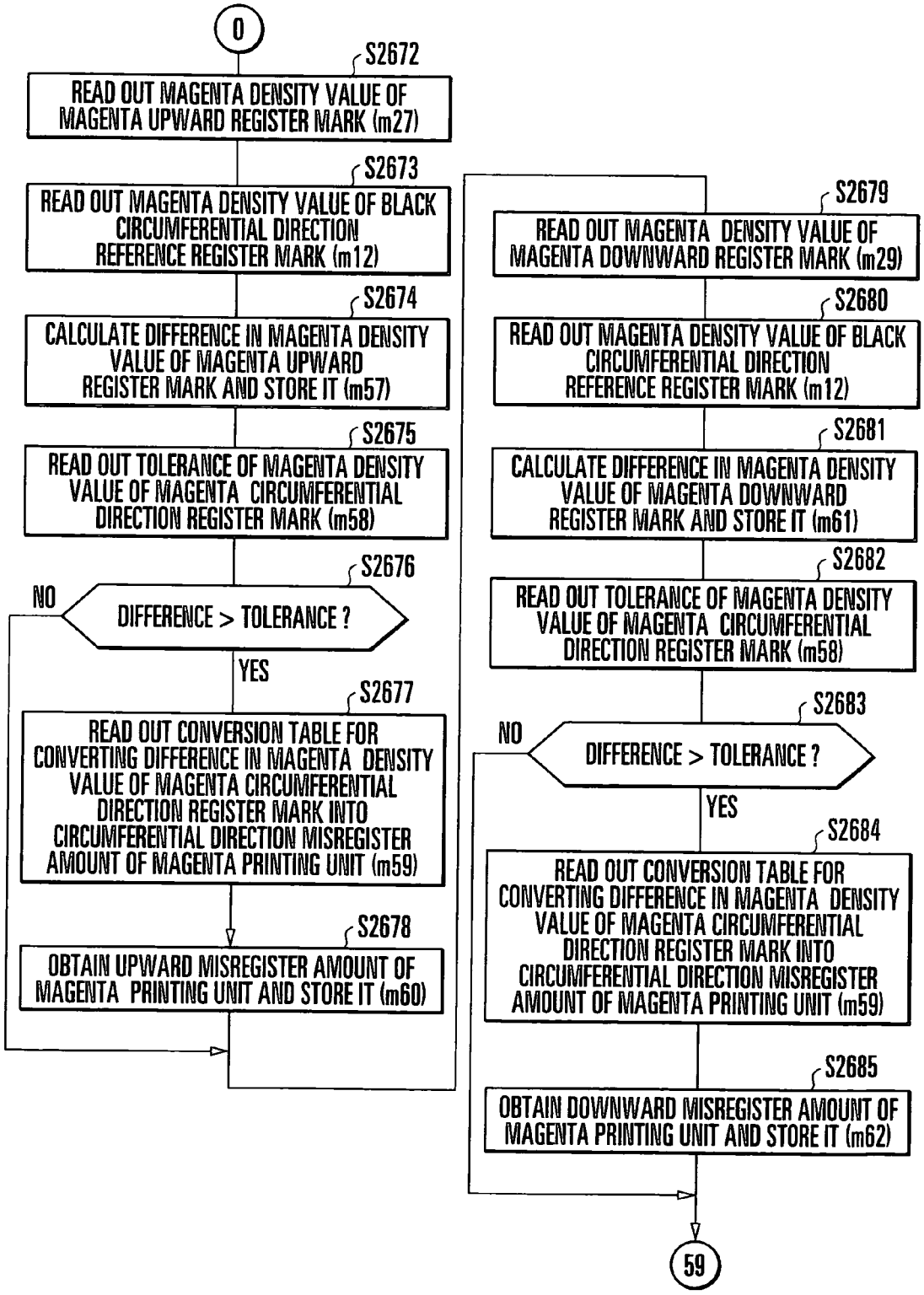

The CPU 33 performs the processes of steps S2672 to S2685 (FIG. 26D) corresponding to steps S2644 to S2657 shown in FIG. 26B. The CPU 33 thus obtains an upward misregister amount corresponding to the difference in magenta density value of the magenta upward register mark and stores it in the memory m60, and obtains a downward misregister amount corresponding to the difference in magenta density value of the magenta downward register mark and stores it in the memory m62.

[Calculation of Yellow Lateral Direction Misregister Amount]

Figure 26E:
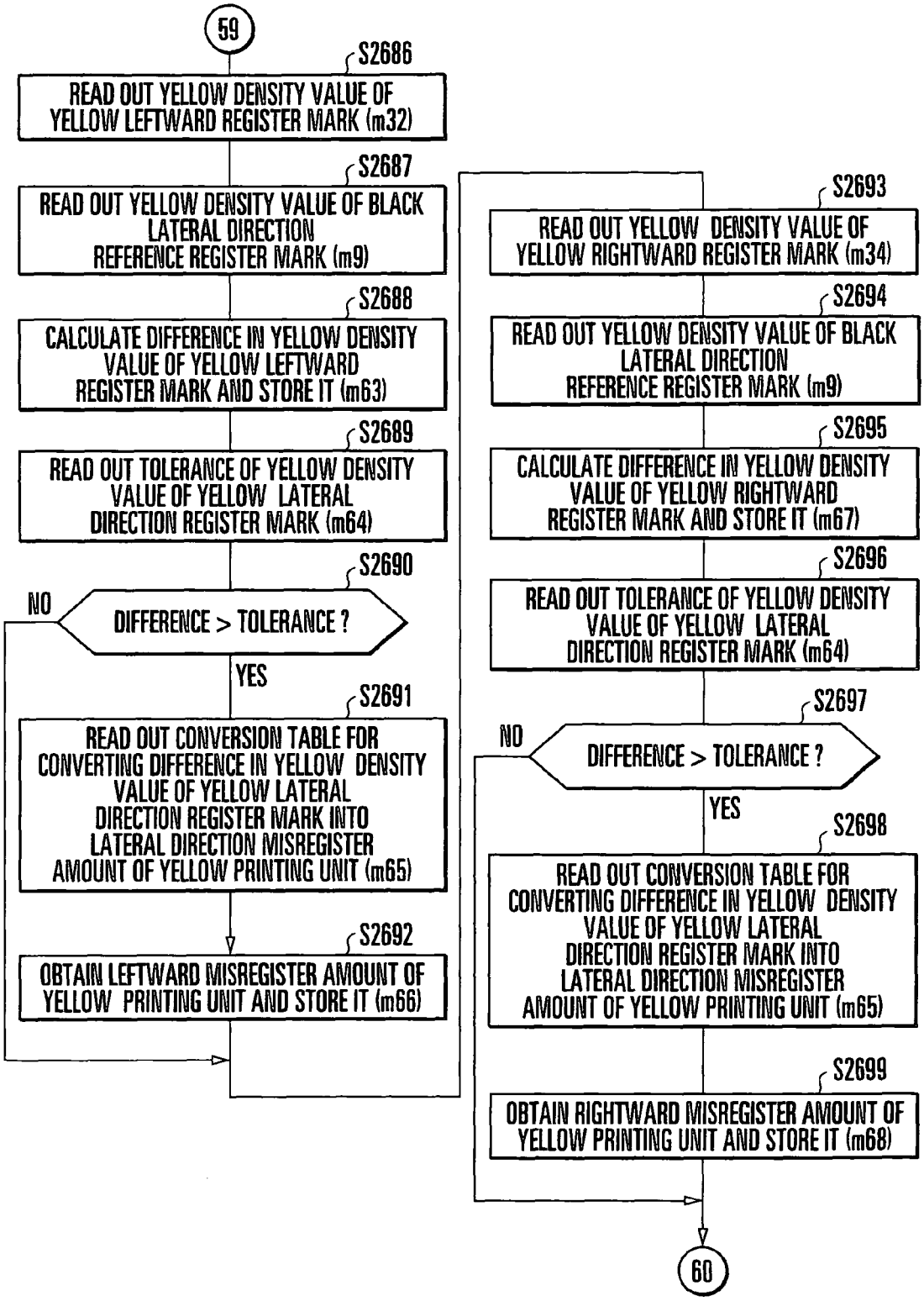

The CPU 33 performs the processes of steps S2686 to S2699 (FIG. 26E) corresponding to steps S2630 to S2643 shown in FIG. 26A. The CPU 33 thus obtains a leftward misregister amount corresponding to the difference in yellow density value of the yellow leftward register mark and stores it in the memory m66, and obtains a rightward misregister amount corresponding to the difference in yellow density value of the yellow rightward register mark and stores it in the memory m68.

[Calculation of Yellow Circumferential Direction Misregister Amount]

Figure 26F:
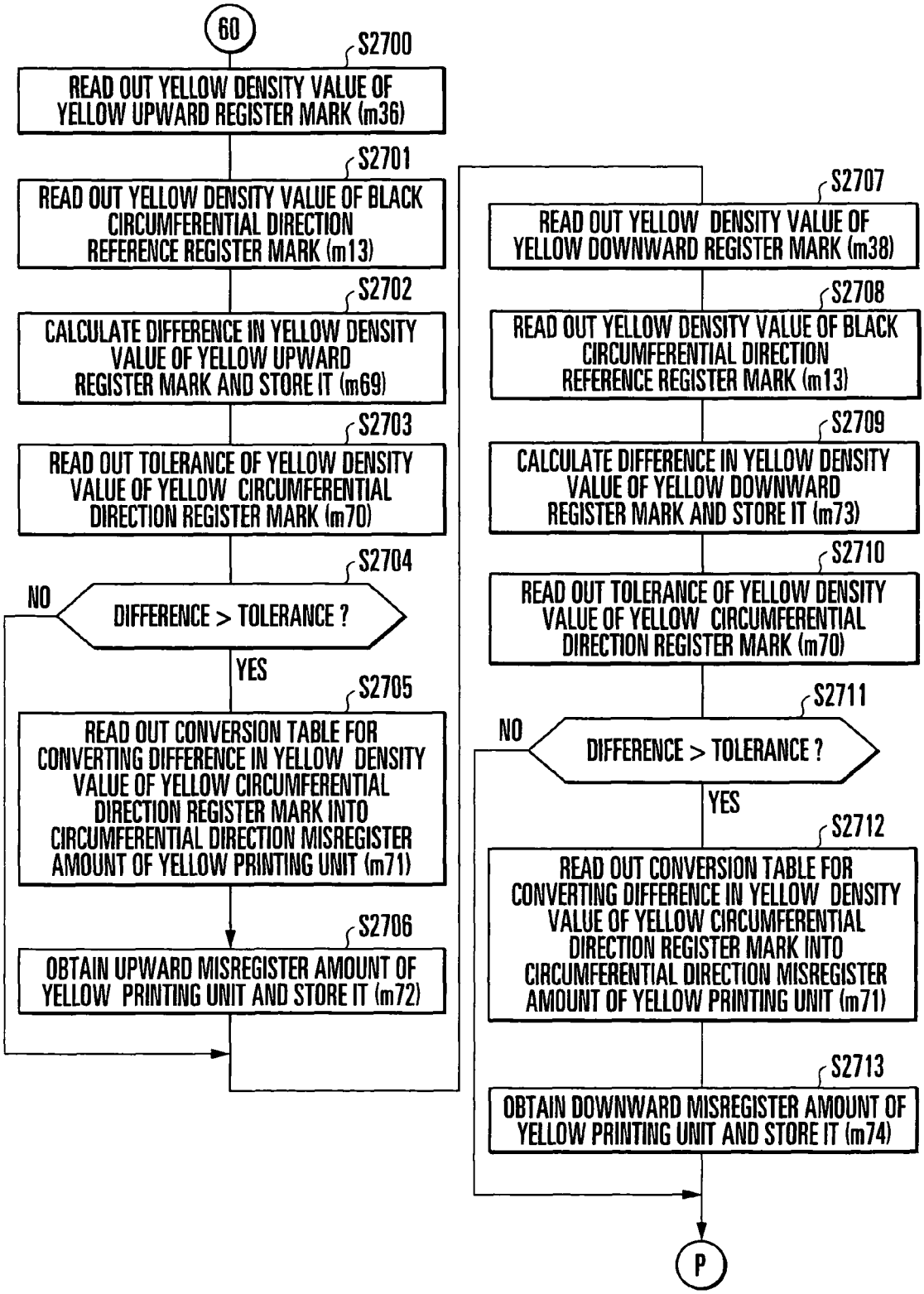

The CPU 33 performs the processes of steps S2700 to S2713 (FIG. 26F) corresponding to steps S2644 to S2657 shown in FIG. 26B. The CPU 33 thus obtains an upward misregister amount corresponding to the difference in yellow density value of the yellow upward register mark and stores it in the memory m72, and obtains a downward misregister amount corresponding to the difference in yellow density value of the yellow downward register mark and stores it in the memory m74.

[Adjustment of Registration Position]

On the basis of the misregister amount obtained in the above manner, the CPU 33 adjusts the registration position of the plate in the lateral direction and circumferential direction in each of the cyan, magenta, and yellow printing units. The adjustment of the registration position is performed in the following manner.

Figure 27A:
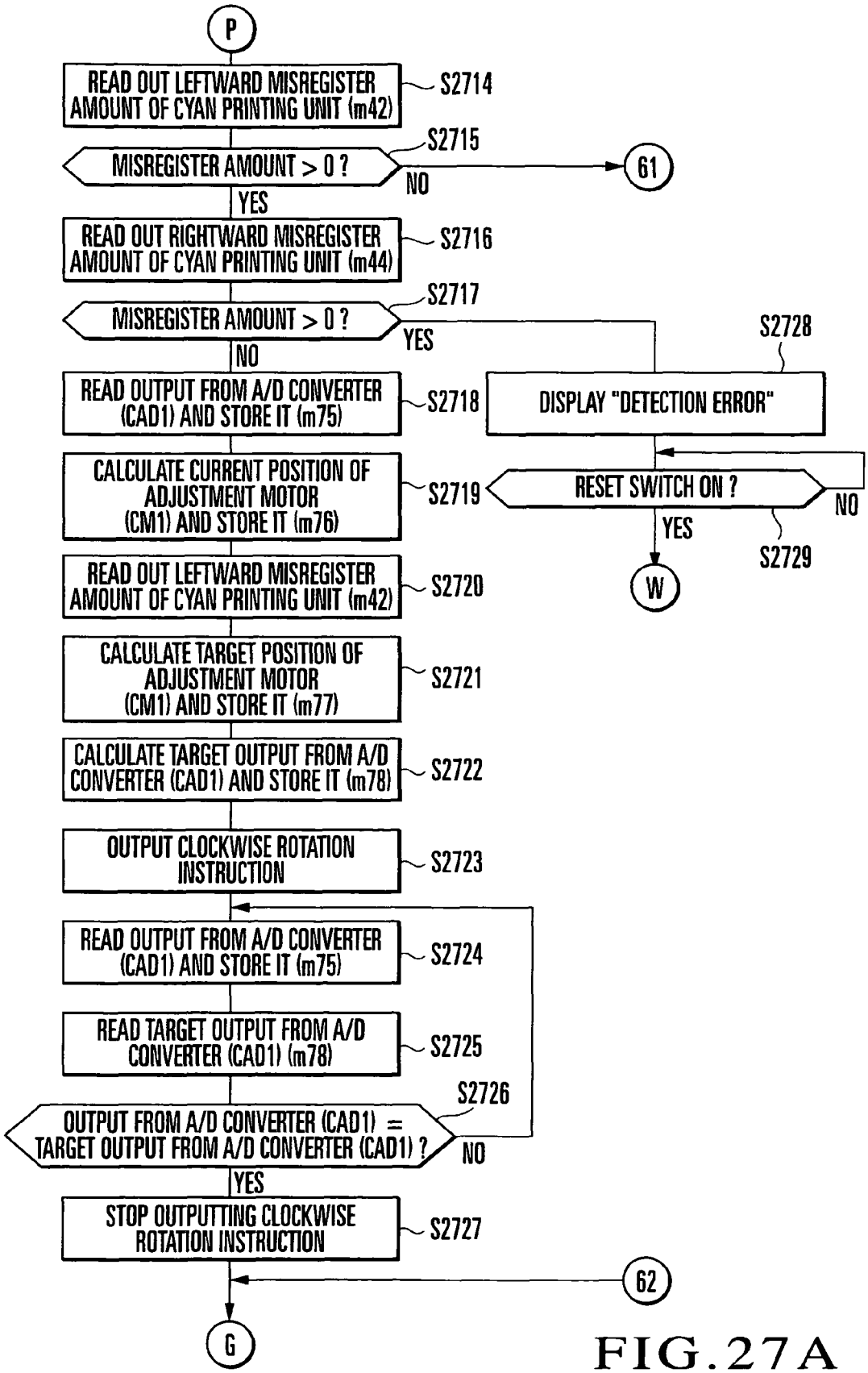
FIGS. 27A to 27L are flowcharts showing the processes, subsequent to the processes shown in FIGS. 26A to 26F, of adjusting a registration position.

First, the CPU 33 reads out the leftward misregister amount of the cyan printing unit from the memory m42 (step S2714 in FIG. 27A). If the leftward misregister amount of the cyan printing unit is larger than zero (YES in step S2715), the CPU 33 reads out the rightward misregister amount of the cyan printing unit from the memory m44 (step S2716).

If the rightward misregister amount of the cyan printing unit is larger than zero (YES in step S2717), "Detection Error" is displayed on the display 9 (step S2728), and the process is interrupted. In this case, when the reset switch 7 is turned on (YES in step S2729), the process returns to step S2101 (FIG. 22A).

[Adjustment of Leftward Registration Position of Cyan Printing Unit]

If the rightward misregister amount of the cyan printing unit is not larger than zero (NO in step S2717), that is, of the lateral direction misregister amounts of the cyan printing unit, if only the leftward misregister amount is larger than zero, the CPU 33 reads an output from an A/D converter CAD1 in a plate registration adjustment unit 14C of the cyan printing unit (step S2718), and obtains the current position of a lateral direction registration adjustment motor CM1 for the cyan printing unit from the read output (step S2719). The CPU 33 then reads out the leftward misregister amount of the cyan printing unit from the memory m42 (step S2720), and adds the leftward misregister amount of the cyan printing unit to the current position of the lateral direction registration adjustment motor CM1 for the cyan printing unit to obtain the target position of the lateral direction registration adjustment motor CM1 for the cyan printing unit (step S2721).

The CPU 33 calculates the target output of the A/D converter CAD1 from the target position of the lateral direction registration adjustment motor CM1 for the cyan printing unit (step S2722), sends a clockwise rotation instruction to a lateral direction registration adjustment motor driver CMD1 for the cyan printing unit (step S2723), and reads the output value of the A/D converter CAD1 connected to a lateral direction registration adjustment motor potentiometer CPT1 for the cyan printing unit (step S2724). The CPU 33 also reads the target output from the A/D converter CAD1 (step S2725). When the output value of the A/D converter CAD1 connected to the lateral direction registration adjustment motor potentiometer CPT1 for the cyan printing unit becomes equal to the target output from the A/D converter CAD1 (YES in step S2726), the CPU 33 stops outputting the clockwise rotation instruction to the lateral direction registration adjustment motor driver CMD1 for the cyan printing unit (step S2727). Thus, the leftward registration position of the cyan printing unit is adjusted, and its misregister amount falls within the tolerance range.

[Adjustment of Rightward Registration Position of Cyan Printing Unit]

Figure 27B:
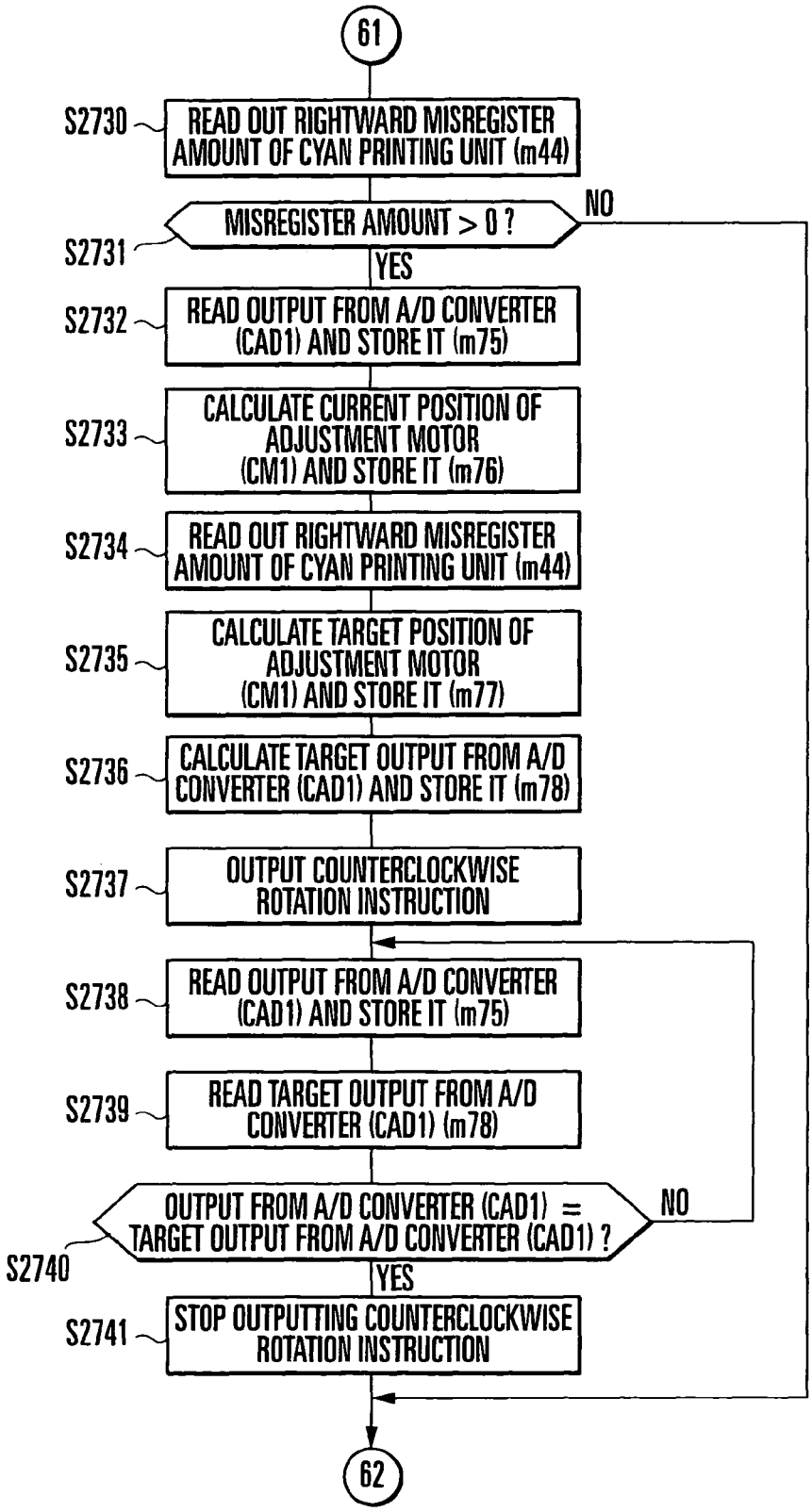

If the leftward misregister amount of the cyan printing unit is not larger than zero (NO in step S2715), the CPU 33 reads out the rightward misregister amount of the cyan printing unit from the memory m44 (step S2730 in FIG. 27B). If the rightward misregister amount of the cyan printing unit is larger than zero (YES in step S2731), that is, of the lateral direction misregister amounts of the cyan printing unit, if only the rightward misregister amount is larger than zero, the CPU 33 reads the output from the A/D converter CAD1 in the plate registration adjustment unit 14C of the cyan printing unit (step S2732), and obtains the current position of the lateral direction registration adjustment motor CM1 for the cyan printing unit from the read output (step S2733). The CPU 33 then reads out the rightward misregister amount of the cyan printing unit from the memory m44 (step S2734), and subtracts the rightward misregister amount of the cyan printing unit from the current position of the lateral direction registration adjustment motor CM1 for the cyan printing unit to obtain the target position of the lateral direction registration adjustment motor CM1 for the cyan printing unit (step S2735).

The CPU 33 calculates the target output of the A/D converter CAD1 from the target position of the lateral direction registration adjustment motor CM1 for the cyan printing unit (step S2736), sends a counterclockwise rotation instruction to the lateral direction registration adjustment motor driver CMD1 for the cyan printing unit (step S2737), and reads the output value of the A/D converter CAD1 connected to the lateral direction registration adjustment motor potentiometer CPT1 for the cyan printing unit (step S2738). The CPU 33 also reads the target output from the A/D converter CAD1 (step S2739). When the output value of the A/D converter CAD1 connected to the lateral direction registration adjustment motor potentiometer CPT1 for the cyan printing unit becomes equal to the target output from the A/D converter CAD1 (YES in step S2740), the CPU 33 stops outputting the counterclockwise rotation instruction to the lateral direction registration adjustment motor driver CMD1 for the cyan printing unit (step S2741). Thus, the rightward registration position of the cyan printing unit is adjusted, and its misregister amount falls within the tolerance range.

Figure 27C:
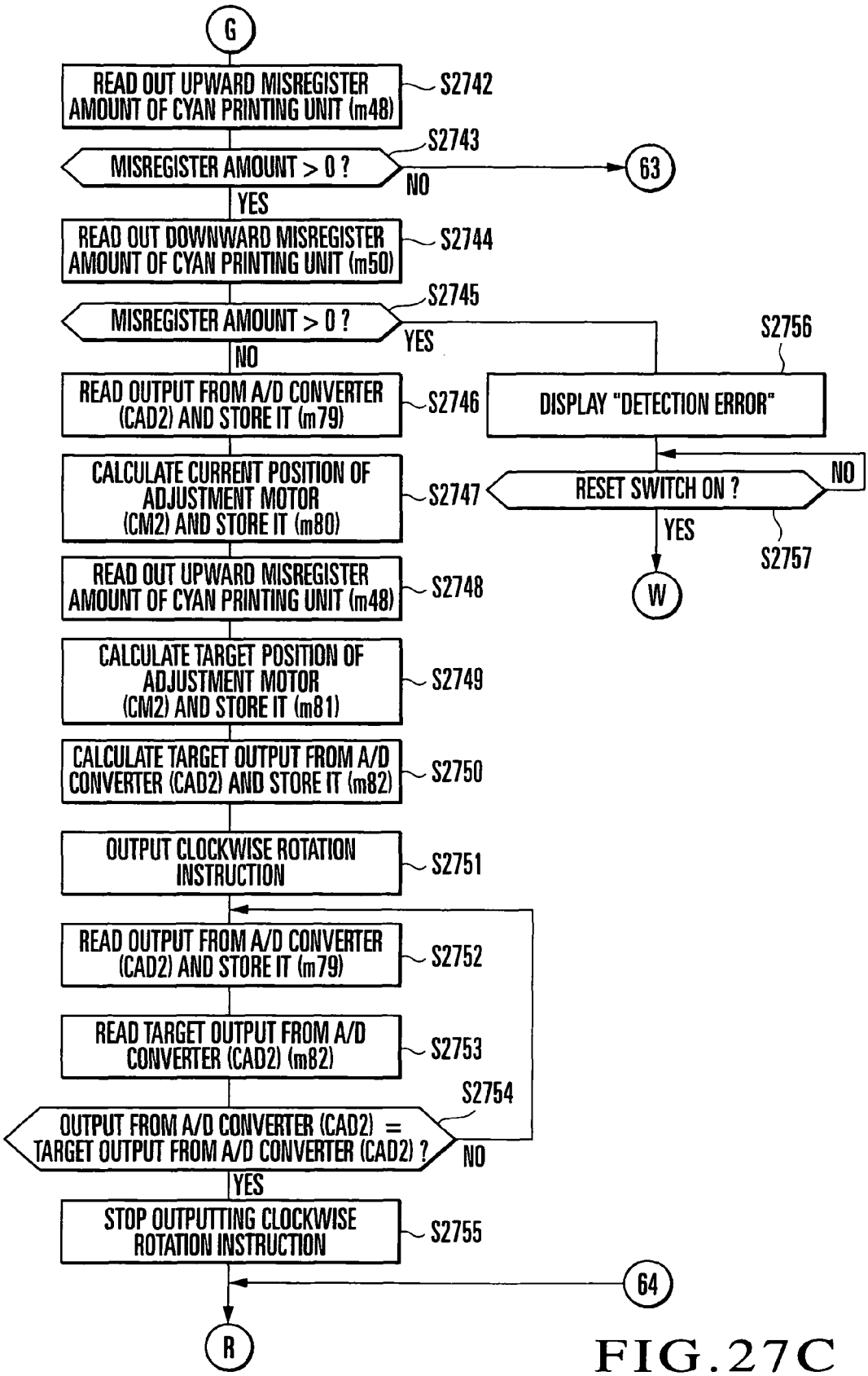

Next, the CPU 33 reads out the upward misregister amount of the cyan printing unit from the memory m48 (step S2742 in FIG. 27C). If the upward misregister amount of the cyan printing unit is larger than zero (YES in step S2743), the CPU 33 reads out the downward misregister amount of the cyan printing unit from the memory m50 (step S2744).

If the downward misregister amount of the cyan printing unit is larger than zero (YES in step S2745), "Detection Error" is displayed on the display 9 (step S2756), and the process is interrupted. In this case, when the reset switch 7 is turned on (YES in step S2757), the process returns to step S2101 (FIG. 22A).

[Adjustment of Upward Registration Position of Cyan Printing Unit]

If the downward misregister amount of the cyan printing unit is not larger than zero (NO in step S2745), that is, of the circumferential direction misregister amounts of the cyan printing unit, if only the upward misregister amount is larger than zero, the CPU 33 reads out an output from an A/D converter CAD2 in the plate registration adjustment unit 14C of the cyan printing unit (step S2746), and obtains the current position of a circumferential direction registration adjustment motor CM2 for the cyan printing unit from the readout output (step S2747). The CPU 33 then reads out the upward misregister amount of the cyan printing unit from the memory m48 (step S2748), and adds the upward misregister amount of the cyan printing unit to the current position of the circumferential direction registration adjustment motor CM2 for the cyan printing unit to obtain the target position of the circumferential direction registration adjustment motor CM2 for the cyan printing unit (step S2749).

The CPU 33 calculates the target output of the A/D converter CAD2 from the target position of the circumferential direction registration adjustment motor CM2 for the cyan printing unit (step S2750), sends a clockwise rotation instruction to a circumferential direction registration adjustment motor driver CMD2 for the cyan printing unit (step S2751), and reads the output value of the A/D converter CAD2 connected to a circumferential direction registration adjustment motor potentiometer CPT2 for the cyan printing unit (step S2752). The CPU 33 also reads the target output from the A/D converter CAD2 (step S2753). When the output value of the A/D converter CAD2 connected to the circumferential direction registration adjustment motor potentiometer CPT2 for the cyan printing unit becomes equal to the target output from the A/D converter CAD2 (YES in step S2754), the CPU 33 stops outputting the clockwise rotation instruction to the circumferential direction registration adjustment motor driver CMD2 for the cyan printing unit (step S2755). Thus, the upward registration position of the cyan printing unit is adjusted, and its misregister amount falls within the tolerance range.

[Adjustment of Downward Registration Position of Cyan Printing Unit]

Figure 27D:
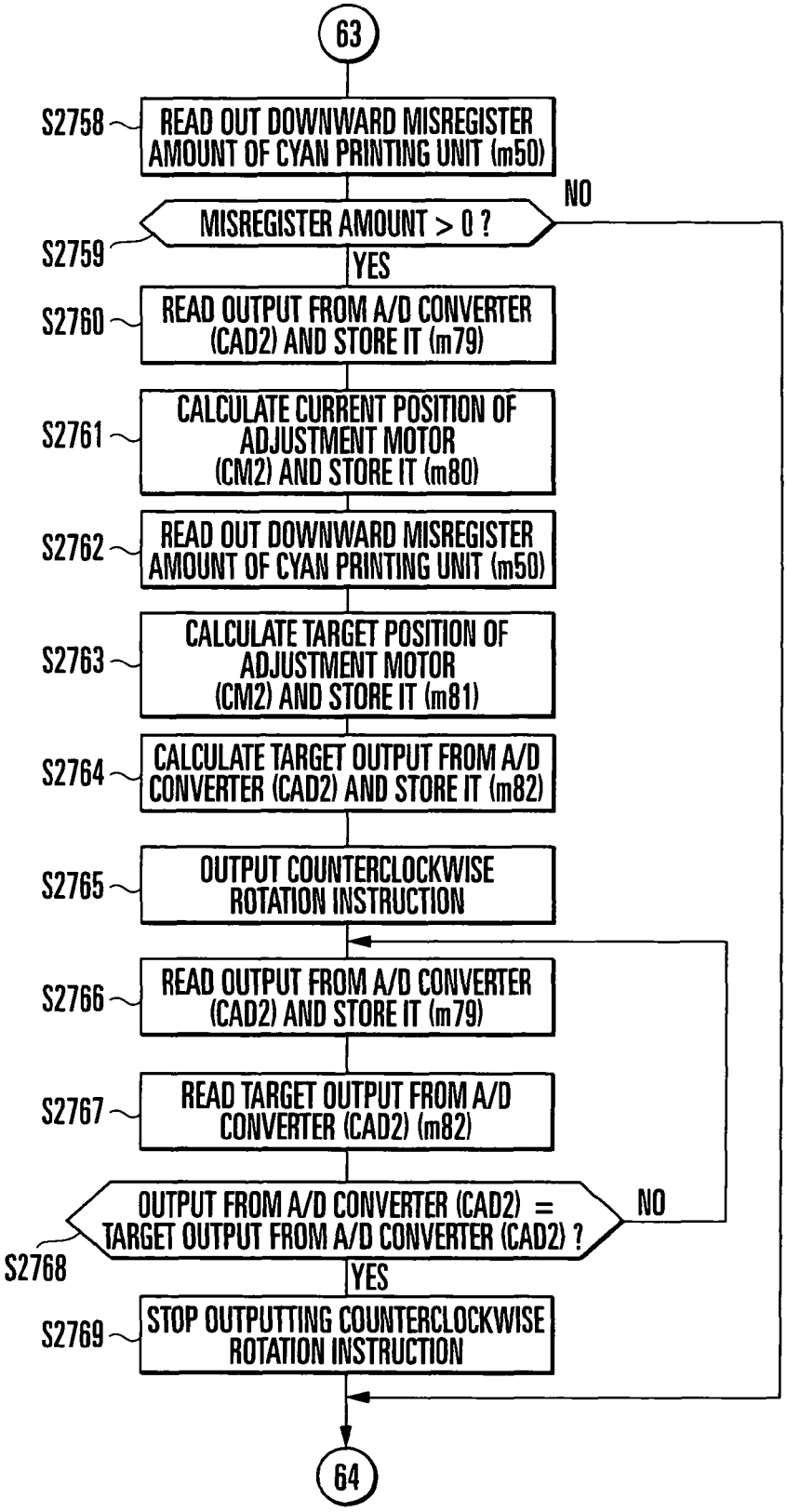

If the upward misregister amount of the cyan printing unit is not larger than zero (NO in step S2743), the CPU 33 reads out the downward misregister amount of the cyan printing unit from the memory m50 (step 2758 in FIG. 27D). If the downward misregister amount of the cyan printing unit is larger than zero (YES in step S2759), that is, of the circumferential direction misregister amounts of the cyan printing unit, if only the downward misregister amount is larger than zero, the CPU 33 reads the output from the A/D converter CAD2 in the plate registration adjustment unit 14C of the cyan printing unit (step S2760), and obtains the current position of the circumferential direction registration adjustment motor CM2 for the cyan printing unit from the readout output (step S2761). The CPU 33 then reads out the downward misregister amount of the cyan printing unit from the memory m50 (step S2762), and subtracts the downward misregister amount of the cyan printing unit from the current position of the circumferential direction registration adjustment motor CM2 for the cyan printing unit to obtain the target position of the circumferential direction registration adjustment motor CM2 for the cyan printing unit (step S2763).

The CPU 33 calculates the target output of the A/D converter CAD2 from the target position of the circumferential direction registration adjustment motor CM2 for the cyan printing unit (step S2764), sends a counterclockwise rotation instruction to the circumferential direction registration adjustment motor driver CMD2 for the cyan printing unit (step S2765), and reads the output value of the A/D converter CAD2 connected to the circumferential direction registration adjustment motor potentiometer CPT2 for the cyan printing unit (step S2766). The CPU 33 also reads the target output from the A/D converter CAD2 (step S2767). When the output value of the A/D converter CAD2 connected to the circumferential direction registration adjustment motor potentiometer CPT2 for the cyan printing unit becomes equal to the target output from the A/D converter CAD2 (YES in step S2768), the CPU 33 stops outputting the counterclockwise rotation instruction to the circumferential direction registration adjustment motor driver CMD2 for the cyan printing unit (step S2769). Thus, the downward registration position of the cyan printing unit is adjusted, and its misregister amount falls within the tolerance range.

[Adjustment of Registration Position of Magenta Printing Unit]

Figure 27E:
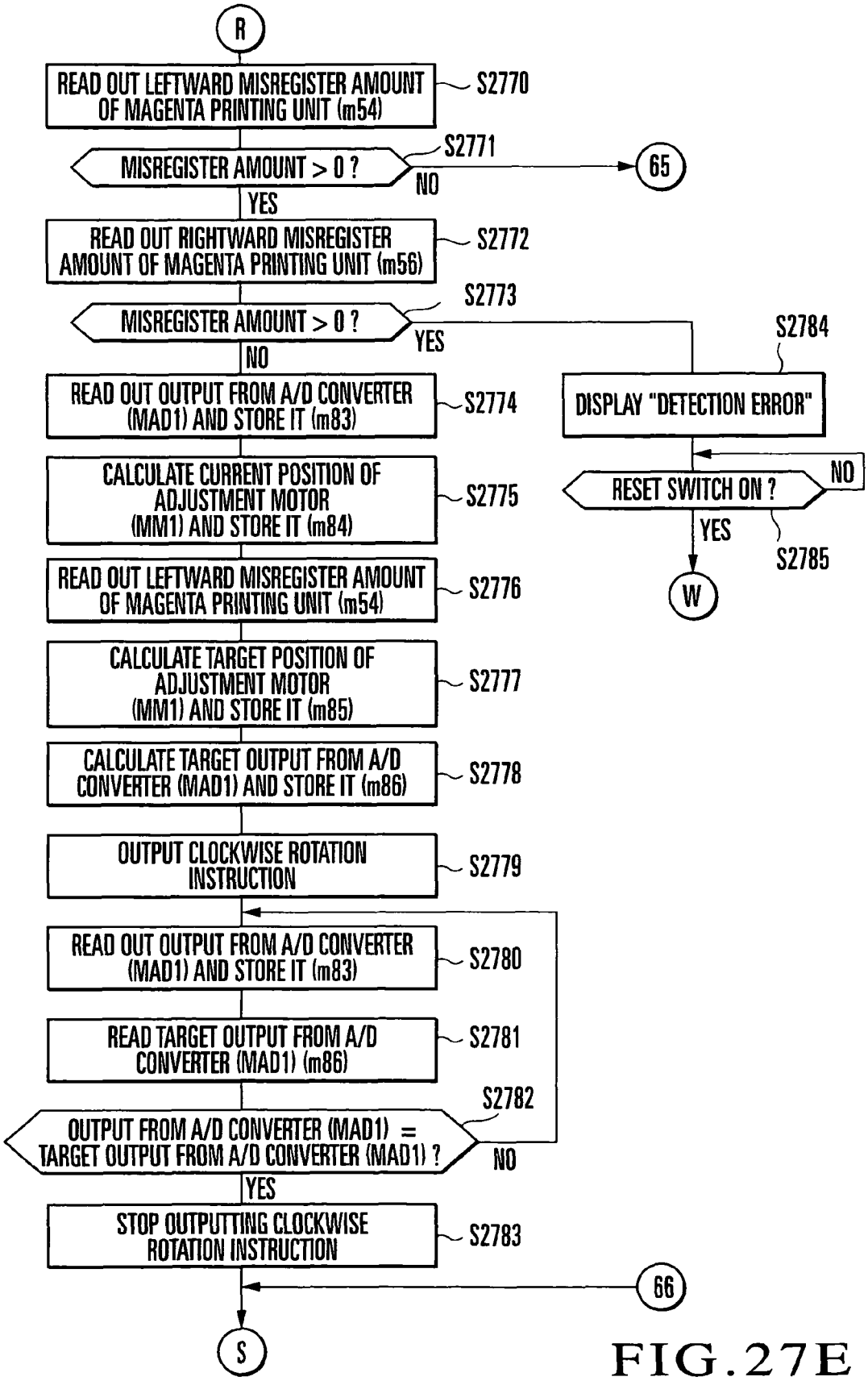
Figure 27F:
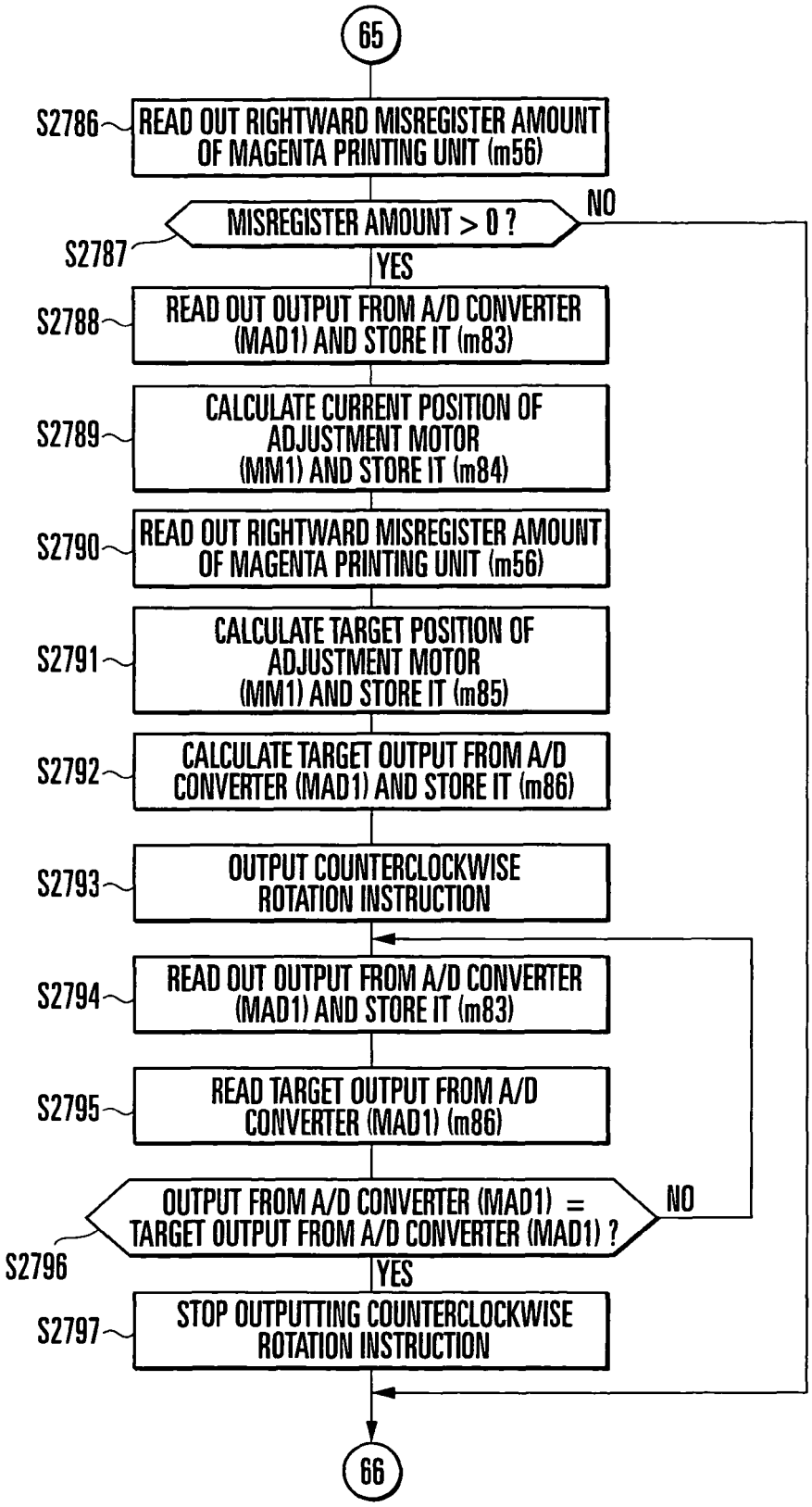
Figure 27G:
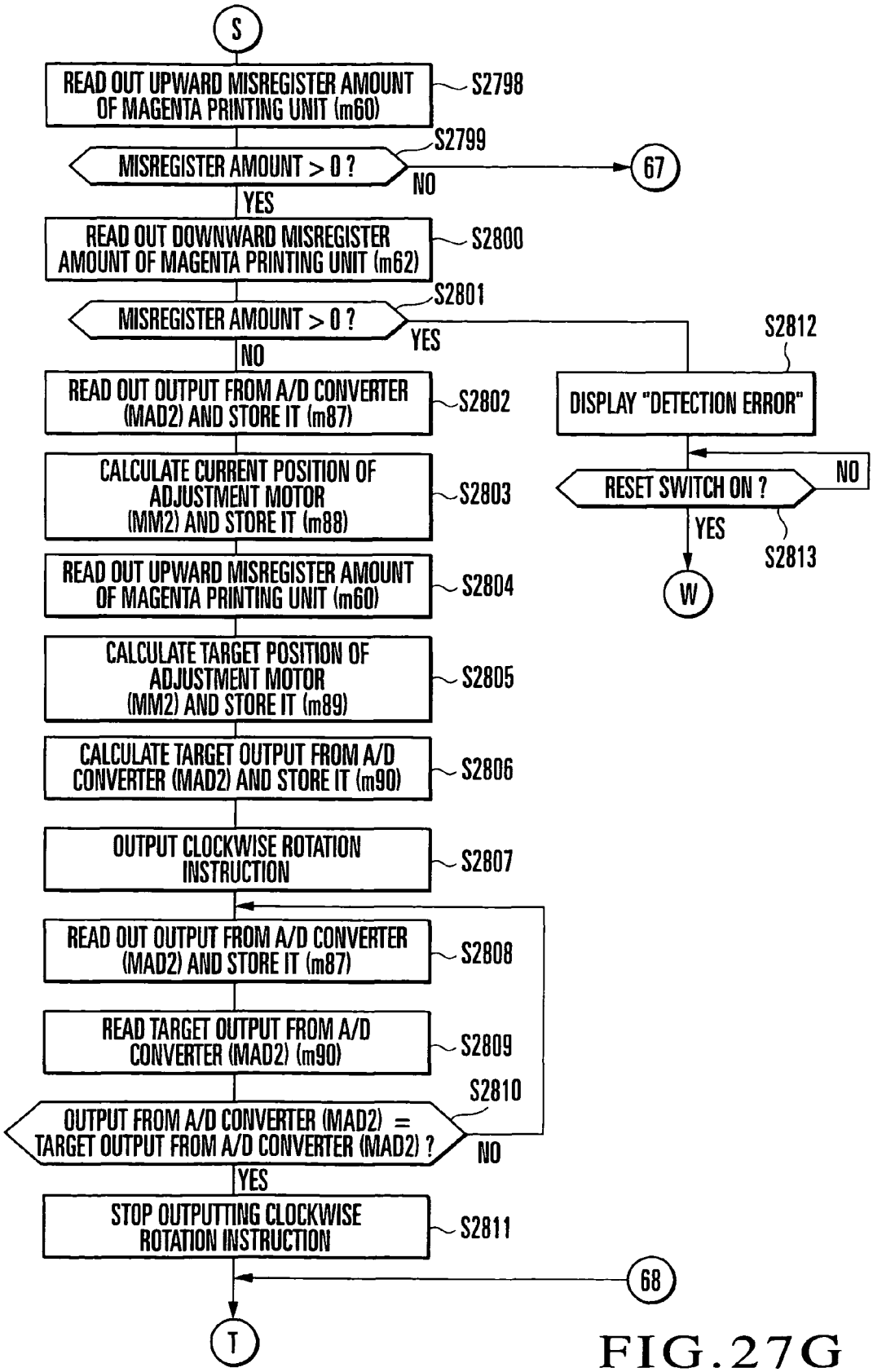
Figure 27H:
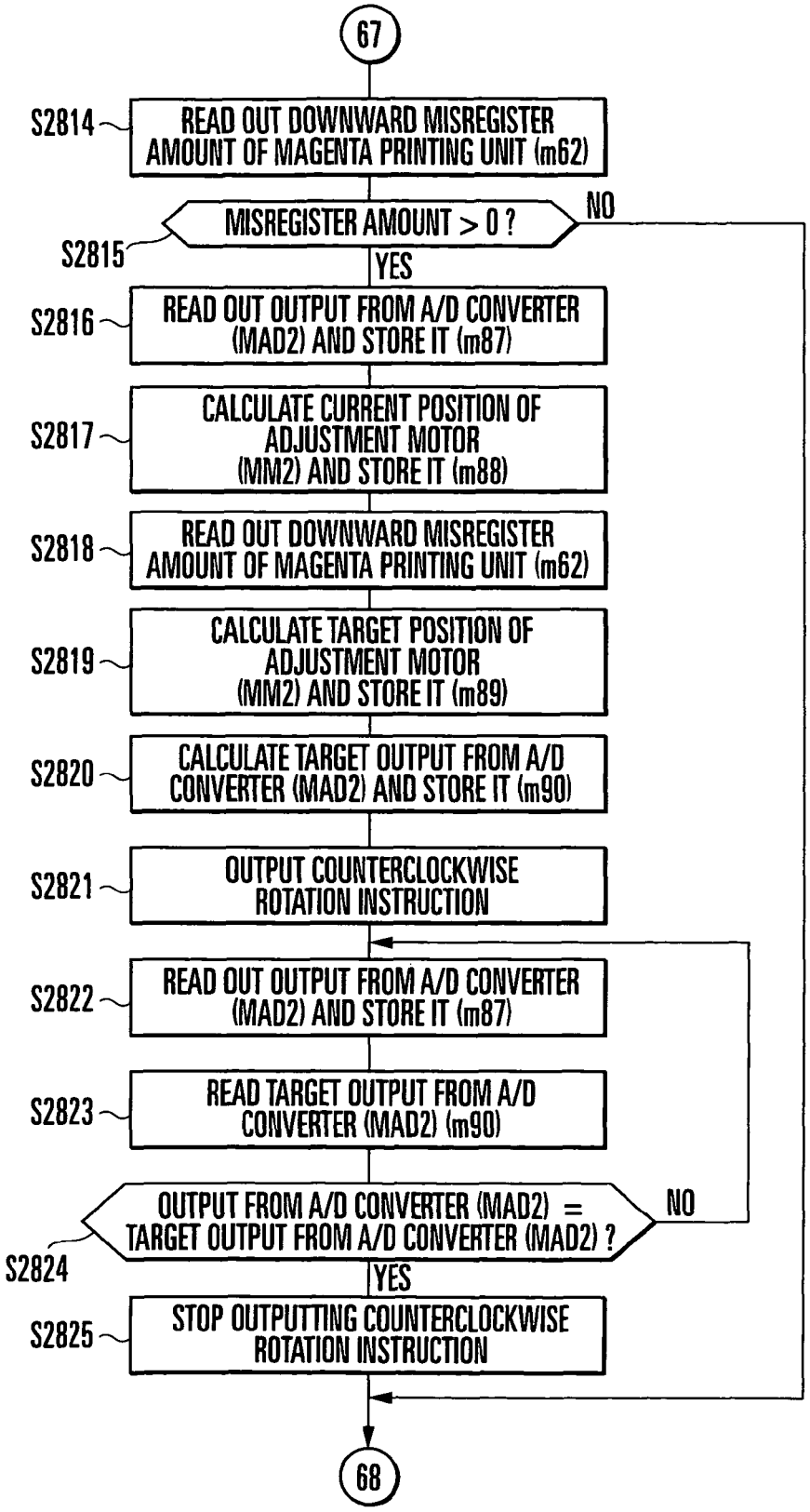

The CPU 33 performs the processes of steps S2770 to S2783 (FIG. 27E) corresponding to steps S2714 to S2727 shown in FIG. 27A to adjust the leftward misregister amount of the magenta printing unit, and the processes of steps S2786 to S2797 (FIG. 27F) corresponding to steps S2730 to S2741 shown in FIG. 27B to adjust the rightward misregister amount of the magenta printing unit. The CPU 33 also performs the processes of steps S2798 to S2811 (FIG. 27G) corresponding to steps S2742 to S2755 shown in FIG. 27C to adjust the upward misregister amount of the magenta printing unit, and the processes of steps S2814 to S2825 (FIG. 27H) corresponding to steps S2758 to S2769 shown in FIG. 27D to adjust the downward misregister amount of the magenta printing unit.

[Adjustment of Registration Position of Yellow Printing Unit]

Figure 27I:
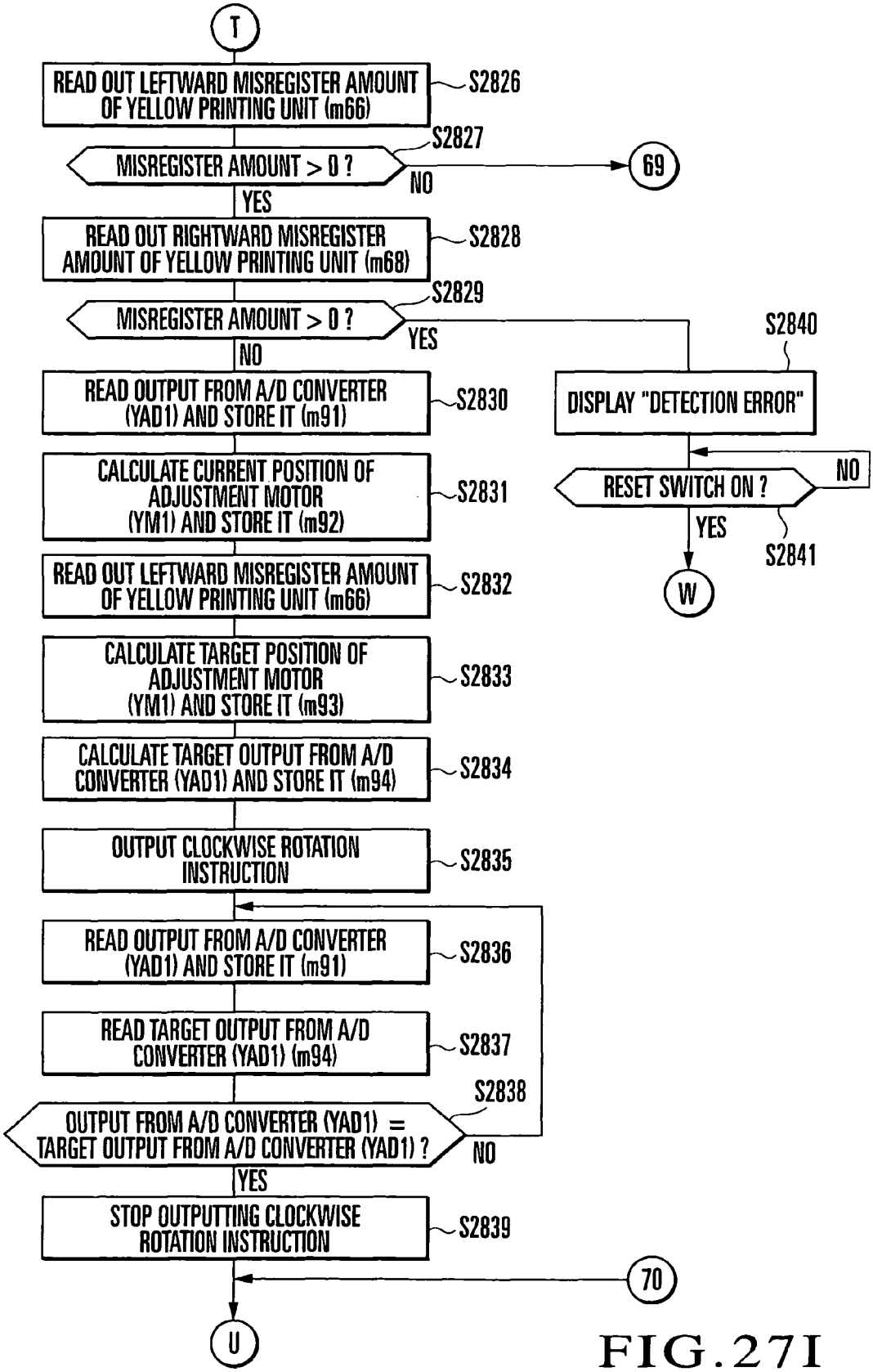
Figure 27J:
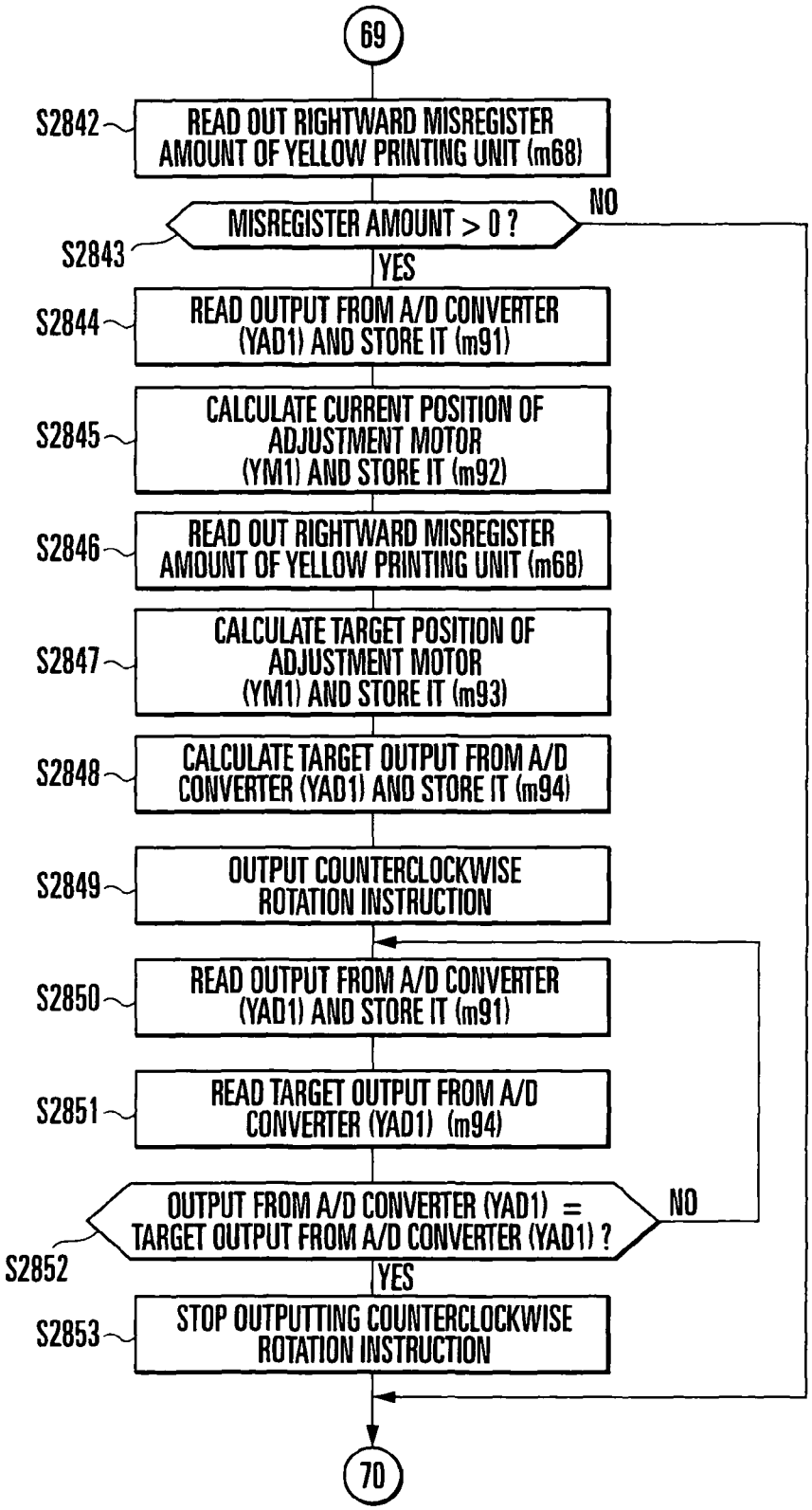
Figure 27K:
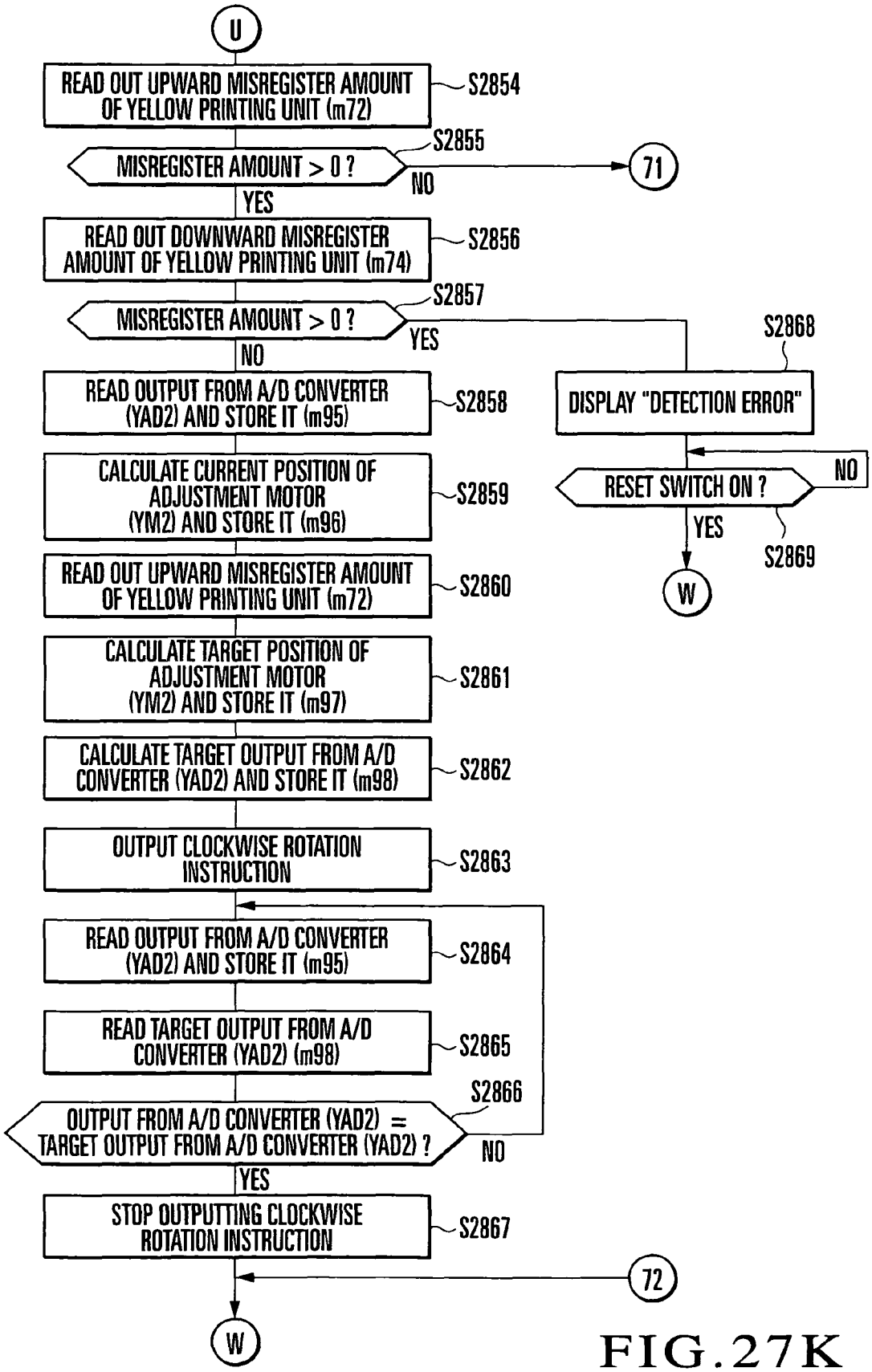
Figure 27L:
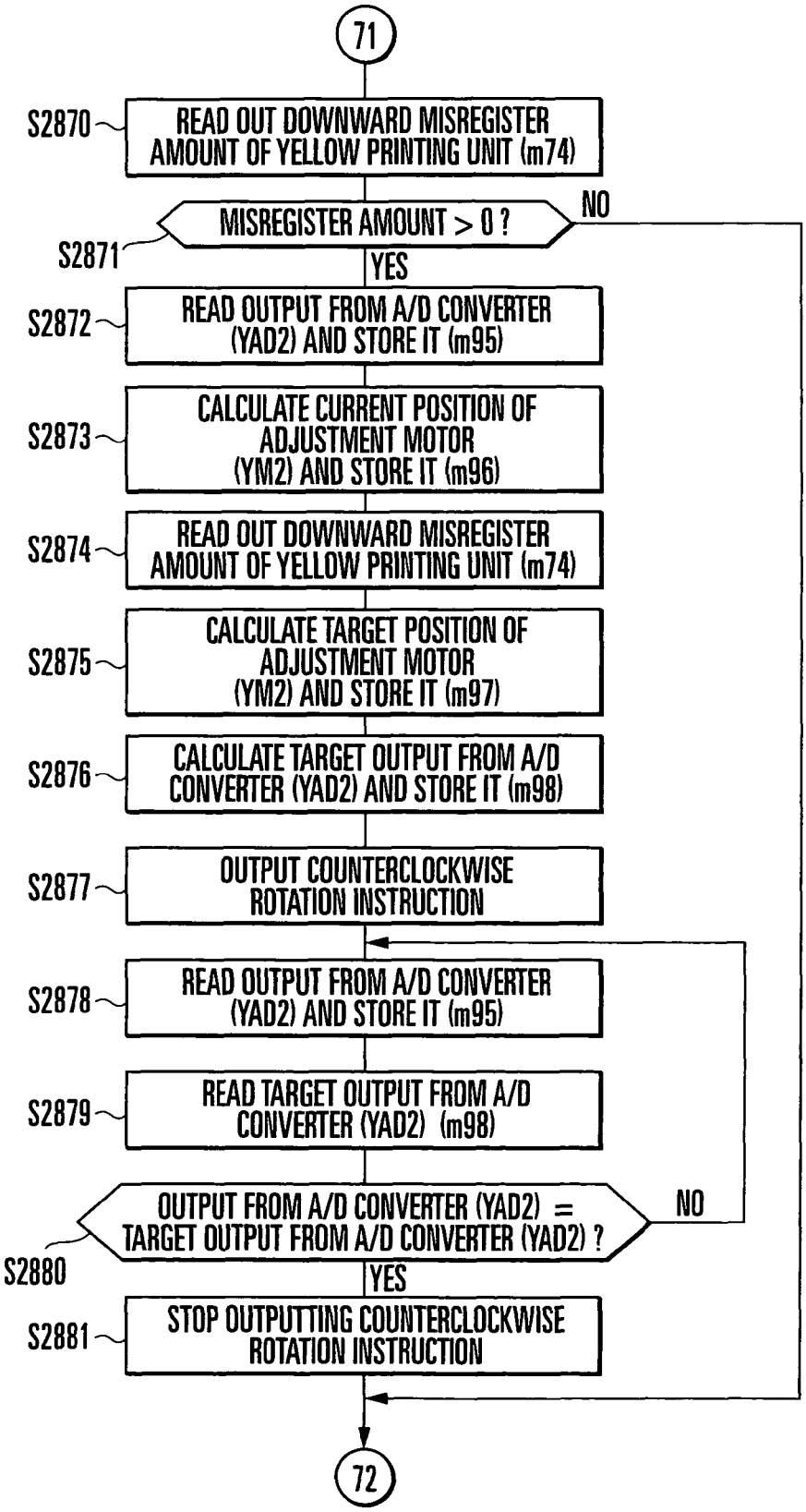

The CPU 33 performs the processes of steps S2826 to S2839 (FIG. 27I) corresponding to steps S2714 to S2727 shown in FIG. 27A to adjust the leftward misregister amount of the yellow printing unit, and the processes of steps S2842 to S2853 (FIG. 27J) corresponding to steps S2730 to S2741 shown in FIG. 27B to adjust the rightward misregister amount of the yellow printing unit. The CPU 33 also performs the processes of steps S2854 to S2867 (FIG. 27K) corresponding to steps S2742 to S2755 shown in FIG. 27C to adjust the upward misregister amount of the yellow printing unit, and the processes of steps S2870 to S2881 (FIG. 27L) corresponding to steps S2758 to S2769 shown in FIG. 27D to adjust the downward misregister amount of the yellow printing unit. The process returns to step S2101 (FIG. 22A).

Figure 29:
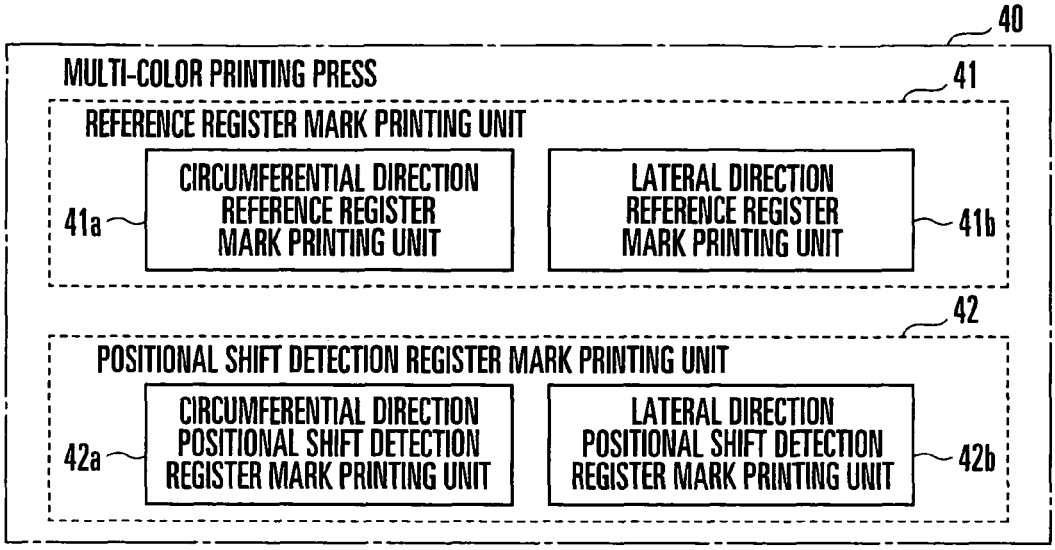
FIG. 29 is a functional block diagram of a multi-color printing press used by the color misregister amount detection apparatus according to an embodiment of the present invention.
Figure 30:
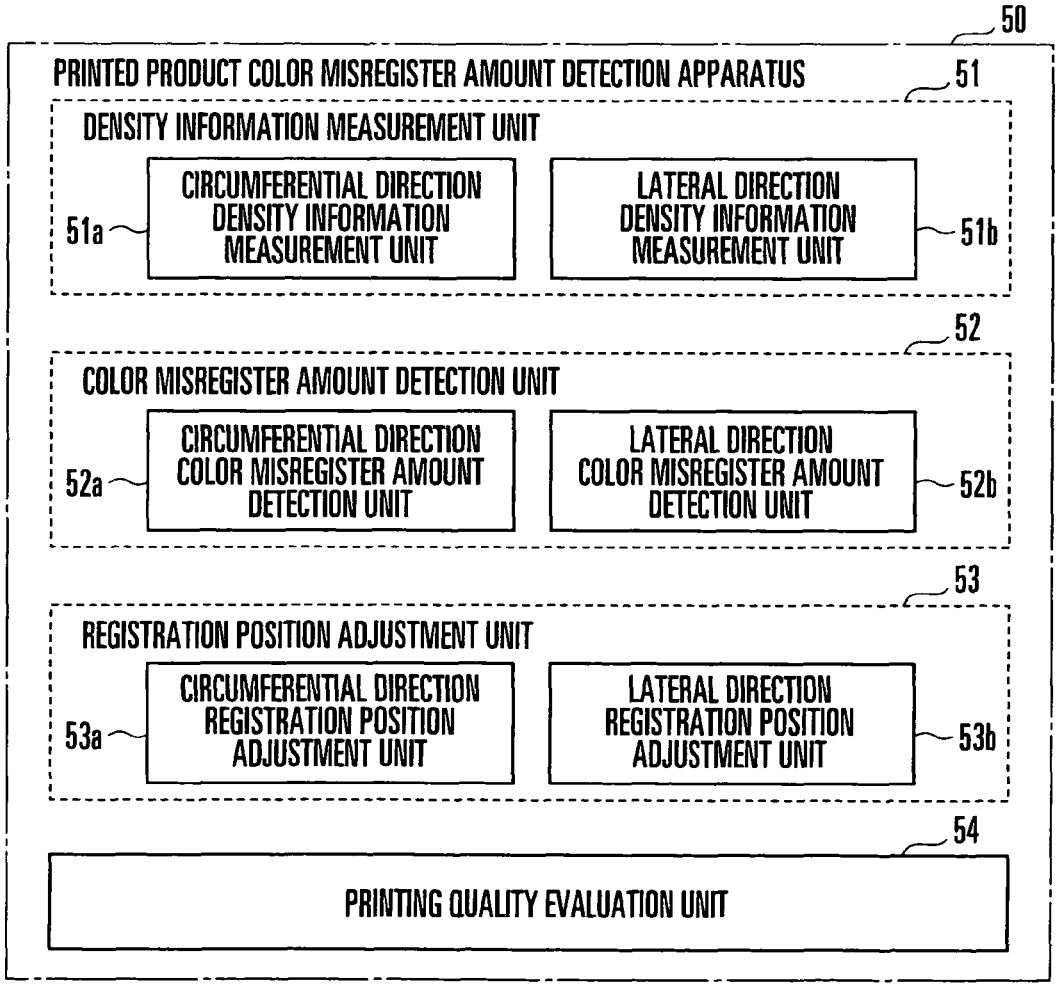
FIG. 30 is a functional block diagram of the color misregister amount detection apparatus according to an embodiment of the present invention.

In each of the first and second embodiments described above, the multi-color printing press which prints a printed product and the printed product color misregister amount detection apparatus can be represented as shown in FIGS. 29 and 30.

A multi-color printing press 40 shown in FIG. 29 comprises a reference register mark printing unit 41 and positional shift detection register mark printing unit 42. A color misregister amount detection apparatus 50 shown in FIG. 30 comprises a density information measurement unit 51, color misregister amount detection unit 52, registration position adjustment unit 53, and printing quality evaluation unit 54.

The reference register mark printing unit 41 prints the reference register marks MB1 to MB4 in a reference color on a printed product 100 to be printed by the multi-color printing press 40. The reference register mark printing unit 41 comprises a reference color plate and reference color printing unit, which are used for printing the reference register marks MB1 to MB4.

The positional shift detection register mark printing unit 42 prints the positional shift detection register marks MC1 to MC4 in a color other than the reference color. At this time, each of the positional shift detection register marks MC1 to MC4 is printed to have as a target position a position where the width of its line L3 falls within the width of a line L1 of the corresponding one of the reference register marks MB1 to MB4. The positional shift detection register mark printing unit 42 comprises a plate for a color other than the reference color and a printing unit for the color other than the reference color, which are used for printing the positional shift detection register marks MC1 to MC4.

The density information measurement unit 51 measures the density information of those color components, within the target range S including the lines L1 and blanks L2 in contact with them of the reference register marks MB1 to MB4 where the positional shift detection register marks MC1 to MC4 have been printed, which are of the same color as those of the positional shift detection register marks MC1 to MC4. For example, the density information measurement unit 51 performs the processes of step S135 in FIG. 12A to step S328 in FIG. 12N, step S632 in FIG. 16A to step S1126 in FIG. 18A, and step S2136 in FIG. 22D to step S2629 in FIG. 25M.

The color misregister amount detection unit 52 obtains a positional shift amount between the reference color and a color other than the reference color as a color misregister amount on the basis of the measured density information. For example, the color misregister amount detection unit 52 performs the processes of step S329 in FIG. 13A to step S412 in FIG. 13F, step S1127 in FIG. 18A to step S1222 in FIG. 18F, and step S2630 in FIG. 26A to step S2713 in FIG. 26F.

The registration position adjustment unit 53 adjusts the registration position of the plate (plate cylinder) of the printing unit so that the color misregister amount falls within the tolerance range. For example, the registration position adjustment unit 53 performs the processes of step S413 in FIG. 14A to step S580 in FIG. 14L, step S1390 in FIG. 19A, and step S2714 in FIG. 27A to step S2881 in FIG. 27L.

Figure 19F:
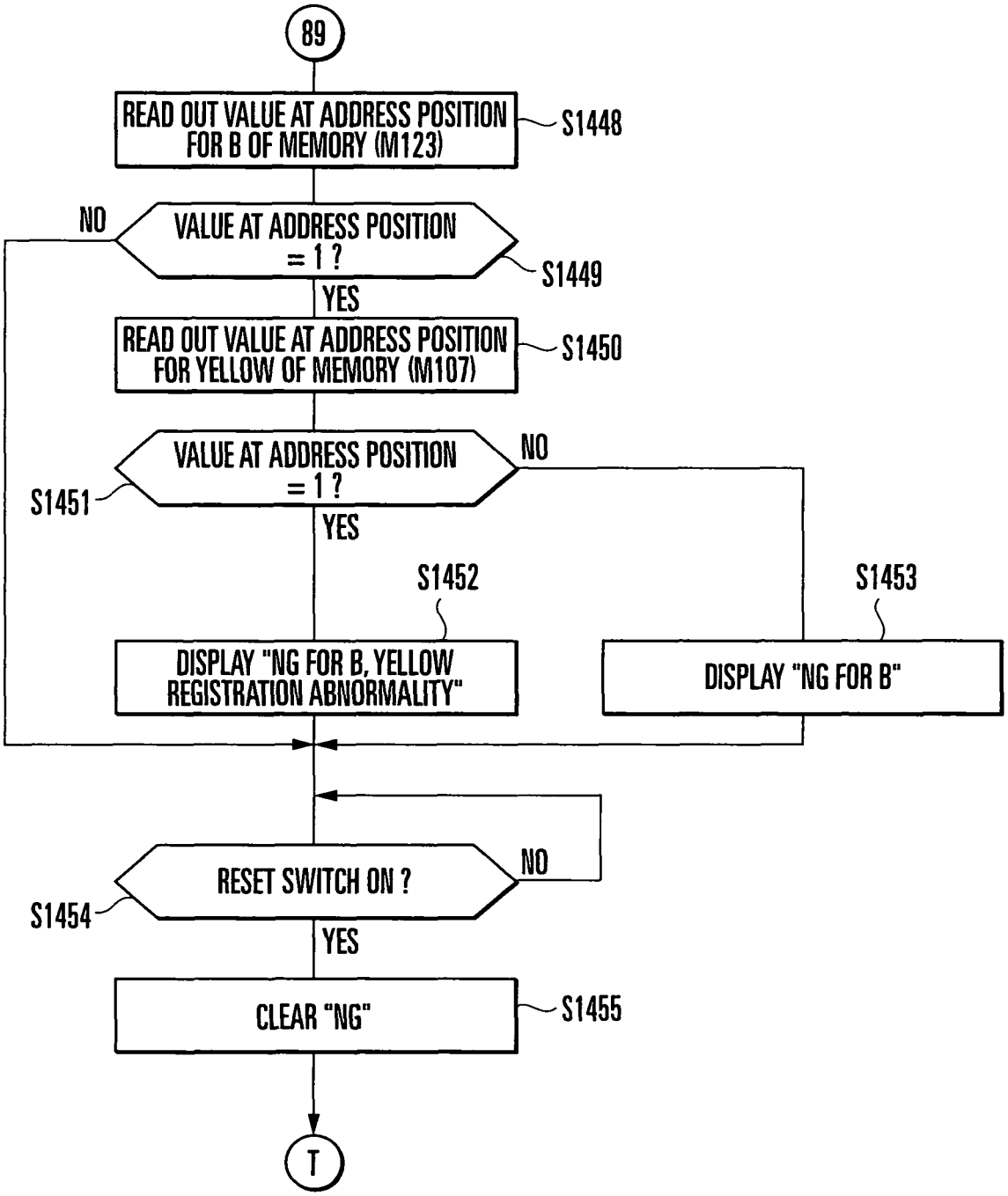

The printing quality evaluation unit 54 evaluates the printing quality of the printed product 100. For example, the printing quality evaluation unit 54 performs the processes of step S1391 in FIG. 19A to step S1455 in FIG. 19F.

The reference register marks MB1 to MB4 are printed on the printed product 100 in the reference color (e.g., black), and the positional shift detection register marks MC1 to MC4 are printed to overlap the reference register marks MB1 to MB4 in a color other than the reference color (e.g., cyan). If no positional shift occurs between the reference color and the color other than the reference color, the widths of the lines L3 of the positional shift detection register marks MC1 to MC4 fall within the widths of the lines L1 of the positional shift detection reference register marks MB1 to MB4, respectively. Hence, if the widths of the lines L3 of the positional shift detection register marks MC1 to MC4 extend from the widths of the lines L1 of the reference register marks MB1 to MB4, respectively, it indicates that a positional shift occurs between the reference color and the color other than the reference color.

Assuming that the reference register marks MB1 to MB4 are in black and that the positional shift detection register marks MC1 to MC4 are in cyan, the density information measurement unit 51 measures density information representing the density of cyan within the target range S. For example, the density information measurement unit 51 deals with images (R image signals) in red, which is the complementary color of cyan, as the target, and measures the sum of the pixel values of the red images within the target range S as the density information by using, e.g., a CCD color camera. Alternatively, the density information measurement unit 51 measures the density value of cyan within the target range S as density information by using a spectrometer or densitometer. As the widths of the lines L3 of the positional shift detection register marks MC1 to MC4 extend more from the widths of the lines L1 of the reference register marks MB1 to MB4, respectively, the area ratio of cyan increases gradually, and accordingly the density of cyan in the target range S increases gradually. This color misregister amount detection apparatus measures the density information representing the density of cyan within the target range S and obtains a color misregister amount between black and cyan on the basis of the measured density information. The color misregister amount between black and any other color (e.g., magenta or yellow) can be obtained in the same manner.

Hence, the color misregister amount detection apparatus 50 can accurately obtain the color misregister amount of the printed product 100 without using a high-accuracy, high-resolution camera, but by only measuring the sum of the pixel values of images in colors that are complementary to the colors of the positional shift detection register marks MC1 to MC4 within the target range S captured by the CCD color camera, or by measuring the density values of colors that are the same as those of the positional shift detection register marks MC1 to MC4 within the target range S by using the spectrometer or densitometer. When obtaining a misregister amount during conveyance of the printed product 100, high-accurate conveyance is not needed.

To measure the color misregister amount and adjust the registration position of the printed product 100 in the circumferential direction and lateral direction, the reference register mark printing unit 41 comprises a circumferential direction reference register mark printing unit 41*a* and lateral direction reference register mark printing unit 41*b*. The positional shift detection register mark printing unit 42 comprises a circumferential direction positional shift detection register mark printing unit 42*a* and lateral direction positional shift detection register mark printing unit 42*b*. The density information measurement unit 51 comprises a circumferential direction density information measurement unit 51*a* and lateral direction density information measurement unit 51*b*. The color misregister amount detection unit 52 comprises a circumferential direction color misregister amount detection unit 52*a* and lateral direction color misregister amount detection unit 52*b*. The registration position adjustment unit 53 comprises a circumferential direction registration position adjustment unit 53*a* and lateral direction registration position adjustment unit 53*b*.

The circumferential direction reference register mark printing unit 41*a* prints the first and second circumferential direction reference register marks MB1 and MB2 each of which includes the line L1 the widthwise direction of which corresponds to the circumferential direction. The circumferential direction reference register mark printing unit 41*a* comprises portions for the circumferential direction reference register marks MB1 and MB2 of the reference color plate, and the reference color printing unit.

The circumferential direction positional shift detection register mark printing unit 42*a* prints the circumferential direction positional shift detection register mark MC1 to have as a target position a position where the edge of the line L3 of the first circumferential direction positional shift detection register mark MC1 overlaps the upward edge of the line L1 of the circumferential direction reference register mark MB1 at least partially. The circumferential direction positional shift detection register mark printing unit 42*a* also prints the circumferential direction positional shift detection register mark MC2 to have as a target position a position where the edge of the line L3 of the second circumferential direction positional shift detection register mark MC2 overlaps the downward edge of the line L1 of the circumferential direction reference register mark MB2 at least partially. The circumferential direction positional shift detection register mark printing unit 42*a* comprises portions for the circumferential direction positional shift detection register marks MC1 and MC2 of the plate for a color other than the reference color, and a printing unit for the color other than the reference color.

The circumferential direction density information measurement unit 51*a* measures as the first density information the density information representing the density of a color component, within the target range S including the line L1 and the blank L2 in contact with it of the reference register mark MB1 where the positional shift detection register mark MC1 has been printed, which is of the same color as that of the positional shift detection register mark MC1. The circumferential direction density information measurement unit 51*a* also measures as the second density information the density information representing the density of a color component, within the target range S including the line L1 and the blank L2 in contact with it of the reference register mark MB2 where the positional shift detection register mark MC2 has been printed, which is of the same color as that of the positional-shift detection register mark MC2.

The circumferential direction color misregister amount detection unit 52*a* obtains an upward color misregister amount on the basis of the first density information and a downward color misregister amount on the basis of the second density information.

This enables accurate measurement of an upward positional shift, between the reference color and the color other than the reference color, which starts from the upward edge of the line L1 of the reference register mark MB1. This also enables accurate measurement of a downward positional shift, between the reference color and the color other than the reference color, which starts from the downward edge of the line L1 of the reference register mark MB2.

The lateral direction reference register mark printing unit 41*b* prints the first and second lateral direction reference register marks MB3 and MB4 each of which includes the line L1 the widthwise direction of which corresponds to the lateral direction. The lateral direction reference register mark printing unit 41*b* comprises portions for the lateral direction reference register marks MB3 and MB4 of the reference color plate, and the reference color printing unit.

The lateral direction positional shift detection register mark printing unit 42*b* prints the lateral direction positional shift detection register mark MC3 to have as a target position a position where the edge of the line L3 of the first lateral direction positional shift detection register mark MC3 overlaps the leftward edge of the line L1 of the lateral direction reference register mark MB3 at least partially. The lateral direction register mark printing unit 42*b* also prints the lateral direction positional shift detection register mark MC4 to have as a target position a position where the edge of the line L3 of the second lateral direction positional shift detection register mark MC4 overlaps the rightward edge of the line L1 of the lateral direction reference register mark MB4 at least partially. The lateral direction positional shift detection register mark printing unit 42*b* comprises portions for the lateral direction positional shift detection register marks MC3 and MC4 of the plate for the color other than the reference color, and a printing unit for the color other than the reference color.

The lateral direction density information measurement unit 51*b* measures as the first density information the density information representing the density of a color component, within the target range S including the line L1 and the blank L2 in contact with it of the reference register mark MB3 where the positional shift detection register mark MC3 has been printed, which is of the same color as that of the positional shift detection register mark MC3. The lateral direction density information measurement unit 51*b* also measures as the second density information the density information representing the density of a color component, within the target range S including the line L1 and the blank L2 in contact with it of the reference register mark MB4 where the positional shift detection register mark MC4 has been printed, which is of the same color as that of the positional shift detection register mark MC4.

The lateral direction color misregister amount detection unit 52*b* obtains a leftward color misregister amount on the basis of the first density information and a rightward color misregister amount on the basis of the second density information.

This enables accurate measurement of a leftward positional shift, between the reference color and the color other than the reference color, which starts from the leftward edge of the line L1 of the reference register mark MB3. This also enables accurate measurement of a rightward positional shift, between the reference color and the color other than the reference color, which starts from the rightward edge of the line L1 of the reference register mark MB4.

The width of the line L3 of the positional shift detection register mark MC1 may be equal to or less than half the width of the line L1 of the reference register mark MB1, and the width of the line L1 of the positional shift detection register mark MC2 may be equal to or less than half the width of the line L1 of the reference register mark MB2. Then, even if the entire width of the line L3 of the positional shift detection register mark MC1 extends from the width of the line L1 of the reference register mark MB1 due to an upward positional shift, the width of the line L3 of the positional shift detection register mark MC2 falls within the width of the line L1 of the reference register mark MB2. Even if the entire width of the line L3 of the positional shift detection register mark MC2 extends from the width of the line L1 of the reference register mark MB2 due to a downward positional shift, the width of the line L3 of the positional shift detection register mark MC1 falls within the width of the line L1 of the reference register mark MB1. Similarly, the widths of the lines L3 of the positional shift detection register marks MC3 and MC4 may be equal to or less than half the widths of lines L4 of the reference register marks MB3 and MB4, respectively.

Each of the reference register marks MB1 to MB4 may include only one set consisting of the line L1 and blank L2, or a plurality of such sets. When each of the reference register marks MB1 to MB4 includes a plurality of sets, the density information may be measured not from the entire regions of the plurality of reference register marks but from some region of each reference register mark as the target range.

What is claimed is:

1. A printed product color misregister amount detection method comprising the steps of:

printing, in a reference color on a printed product to be printed by a multi-color printing press, a reference register mark including first color area portion with a predetermined width and a blank portion in contact with the first color area portion;

printing, in a color other than the reference color, a positional shift detection register mark including a second color area portion with a width smaller than that of the first color area portion of the reference register mark to have as a target position a position where the width of the second color area portion falls within the width of the first color area portion of the reference register mark;

measuring density information representing a density of a color component which is of the same color as that of positional shift detection register mark within a target range including the first color area portion and the blank portion in contact with the first color area portion of the reference register mark where the positional shift detection register mark has been printed; and obtaining a positional shift amount between the reference color and the color other than the reference color as a color on misregister amount on the basis of the measured density information, wherein the step of printing the reference register mark comprises the step of determining a convey direction of the printed product in the multi-color printing press as a circumferential direction and the circumferential direction as a widthwise direction of the first color area portion, wherein the step of determining the circumferential direction as the widthwise direction comprises the step of printing as the reference register mark a first reference register mark and a second reference register mark, the step of printing the positional shift detection register mark comprises the steps of printing a first positional shift detection register mark and a second positional shift detection register mark, respectively, as the positional shift detection register mark, the step of printing the first positional shift detection register mark comprising printing the first positional shift detection register mark to have as a target position a position where an edge of a second color area portion of the first positional shift detection register mark overlaps an upward edge of a first color area portion of the first reference register mark at least partially, and the step of printing the second positional shift detection register mark comprising printing the second positional shift detection register mark to have as a target position a position where an edge of a second color area portion of the second positional shift detection register mark overlaps a downward edge of a first color area portion of he second reference register mark at least partially, the step of measuring comprises the step of measuring, as first density information, density information representing a density of a color component which is of the same color as that of the first positional shift detection register mark within a target range including the first color area portion and a blank portion in contact with the first color area portion of the first reference register mark where the first positional shift detection register mark has been printed and, as second density information, density information presenting a density of a color component which is of the same color as that of the second positional shift detection register mark within a target range including the first color area portion and a blank portion in contact with the first color area portion of the second reference register mark where the second positional shift detection register mark has been printed, and the step of obtaining comprises the step of obtaining an upward color misregister amount on the basis of the measured first density information and a downward color misregister amount on the basis of the measured second density information.

2. A method according to claim 1, wherein the step of printing the first positional shift detection register mark comprises the step of printing the first positional shift detection register mark to have as a target position a position where the edge of the second color area portion of the first positional shift detection register mark overlaps the upward edge of the first color area portion of the first reference register mark entirely, and the step of printing the second positional shift detection register mark comprises the step of printing the second positional shift detection register mark to have as a target position a position where the edge of the second color area portion of the second positional shift detection register mark overlaps the downward edge of the first color area portion of the second reference register mark entirely.

3. A method according to claim 1, wherein a width of the second color area portion of each of the first positional shift detection register mark and the second positional shift detection register mark is not more than half a width of the first color area portion of a corresponding one of the first reference register mark and the second reference register mark.

4. A method according to claim 1, wherein the step of printing the reference register mark comprises the step of printing the first color area portion of the reference register mark to form a line extending in a direction perpendicular to the circumferential direction, and the step of printing the positional shift detection register mark comprises the step of printing the second color area portion of the positional shift detection register mark to form a line extending in a direction perpendicular to the circumferential direction.

5. A method according to claim 1, wherein the step of printing the reference register mark comprises the step of printing a reference register mark including a plurality of first color area portions and a plurality of blank portions, and the step of printing the positional shift detection register mark comprises the step of printing a positional shift detection register mark including a plurality of second color area portions.

6. A method according to claim 5, wherein the step of measuring comprises the step of measuring density information of a target range that covers some region of each of a reference register mark and a positional shift detection register mark that correspond to each other.

7. A printed product color misregister amount detection method comprising the steps of:

printing, in a reference color on a printed product to be printed by a multi-color printing press, a reference register mark including a first color area portion with a predetermined width and a blank portion in contact with the first color area portion;

printing, in a color other than the reference color, a positional shift detection register mark including a second color area portion with a width smaller than that of the first color area portion of the reference register mark to have as a target position a position where the width of the second color area portion falls within the width of the first color area portion of the reference register mark;

measuring density information representing a density of a color component which is of the same color as that of the positional shift detection register mark within a target range including the first color area portion and the blank portion in contact with the first color area portion of the reference register mark where the positional shift detection register mark has been printed; and obtaining a positional shift amount between the reference color and the color other than the reference color as a color misregister amount on the basis of the measured density information, wherein the step of printing the reference register mark comprises the step of determining a direction perpendicular to a convey direction of the printed product in the multi-color printing press as a lateral direction, and the lateral direction as a widthwise direction of the first color area portion, wherein the step of determining the lateral direction as the widthwise direction comprises the step of printing as the reference register mark a first reference register mark and a second reference register mark, the step of printing the positional shift detection register mark comprises the steps of printing a first positional shift detection register mark and a second positional shift detection register mark, respectively, as the positional shift detection register mark, the step of printing the first positional shift detection register mark comprising printing the first positional shift detection register mark to have as a target position a position where an edge of a second color area portion of the first positional shift detection register mark overlaps a leftward edge of a first color area portion of the first reference register mark at least partially, and the step of printing the second positional shift detection register mark comprising printing the second positional shift detection register mark to have as a target position a position where an edge of a second color area portion of the second positional shift detection register mark overlaps a rightward edge of a first color area portion of the second reference register mark at least partially, the step of measuring comprises the step of measuring, as first density information, density information representing a density of a color component which is of the same color as that of the first positional shift detection register mark within a target range including the first color area portion and a blank portion in contact with the first color area portion of the first reference register mark where the first positional shift detection register mark has been printed and, as second density information, density information presenting a density of a color component which is of the same color as that of the second positional shift detection register mark within a target range including the first color area portion and a blank portion in contact with the first color area portion of the second reference register mark where the second positional shift detection register mark has been printed, and the step of obtaining comprises the step of obtaining a leftward color misregister amount on the basis of the measured first density information and a rightward color misregister amount on the basis of the measured second density information.

8. A method according to claim 7, wherein the step of printing the first positional shift detection register mark comprises the step of printing the first positional shift detection register mark to have as a target position a position where the edge of the second color area portion of the first positional shift detection register mark overlaps the leftward edge of the first color area portion of the first reference register mark entirely, and the step of printing the second positional shift detection register mark comprises the step of printing the second positional shift detection register mark to have as a target position a position where the edge of the second color area portion of the second positional shift detection register mark overlaps the rightward edge of the first color area portion of the second reference register mark entirely.

9. A method according to claim 7, wherein a width of the second color area portion of each of the first positional shift detection register mark and the second positional shift detection register mark is not more than half a width of the first color area portion of a corresponding one of the first reference register mark and the second reference register mark.

10. A method according to claim 7, wherein the step of printing the reference register mark comprises the step of printing the first color area portion of the reference register mark to form a line extending in a direction perpendicular to the lateral direction, and the step of printing the positional shift detection register mark comprises the step of printing the second color area portion of the positional shift detection register mark to form a line extending in a direction perpendicular to the lateral direction.

11. A method according to claim 7, wherein the step of printing the reference register mark comprises the step of printing a reference register mark including a plurality of first color area portions and a plurality of blank portions, and the step of printing the positional shift detection register mark comprises the step of printing a positional shift detection register mark including a plurality of second color area portions.

12. A method according to claim 11, wherein the step of measuring comprises the step of measuring density information of a target range that covers some region of each of a reference register mark and a positional shift detection register mark that correspond to each other.

13. A printed product color misregister amount detection apparatus comprising:

density information measuring means for measuring density information representing a density of a color component which is of the same color as that of the positional shift detection register mark within a target range of a printed product where a reference register mark and a positional shift detection register mark have been printed by a multi-color printing press, the reference register mark including a first color area portion with a predetermined width and a blank portion in contact with the first color area portion of the reference register mark and being printed in a reference color, the positional shift detection register mark including a second color area portion with a width smaller than that of the first color area portion and being printed in a color other than the reference color to have as a target position a position where the width of the second color area portion falls within the width of the first color area portion, and the target range including the first color area portion and the blank portion in contact with the first color area portion of the reference register mark; and color misregister amount detection means for obtaining a positional shift amount between the reference color and the color other than the reference color as a color misregister amount on the basis of the measured density information, wherein the reference register mark is printed such that a widthwise direction of the first color area portion comprises a circumferential direction of the printed product which corresponds to a convey direction of the printed product in said multi-color printing press, wherein the reference register mark includes a first reference register mark and a second reference register mark, the positional shift detection register mark includes a first positional shift detection register mark and a second positional shift detection register mark, the first positional shift detection register mark being printed to have as a target position a position where an edge of a second color area portion of the first positional shift detection register mark overlaps an upward edge of a first color area portion of the first reference register mark at least partially, and the second positional shift detection register mark being printed to have as a target position a position where an edge of a second color area portion of the second positional shift detection register mark overlaps a downward edge of a first color area portion of the second reference register mark at least partially, said density information measuring means comprises circumferential direction density information measuring means for measuring, as first density information, density information representing a density of a color component which is of the same color as that of the first positional shift detection register mark within a target range including the first color area portion and a blank portion in contact with the first color area portion of the first reference register mark where the first positional shift detection register mark has been printed and, as second density information, density information presenting a density of a color component which is of the same color as that of the second positional shift detection register mark within a target range including the first color area portion and a blank portion in contact with the first color area portion of the second reference register mark where the second positional shift detection register mark has been printed, and said color misregister amount detection means comprises circumferential direction color misregister amount detection means for obtaining an upward color misregister amount on the basis of the measured first density information and a downward color misregister amount on the basis of the measured second density information.

14. An apparatus according to claim 13, wherein the first positional shift detection register mark is printed to have as a target position a position where the edge of the second color area portion of the first positional shift detection register mark overlaps the upward edge of the first color area portion of the first reference register mark entirely, and the second positional shift detection register mark is printed to have as a target position a position where the edge of the second color area portion of the second positional shift detection register mark overlaps the downward edge of the first color area portion of the second reference register mark entirely.

15. An apparatus according to claim 13, wherein a width of the second color area portion of each of the first positional shift detection register mark and the second positional shift detection register mark is not more than half a width of the first color area portion of a corresponding one of the first reference register mark and the second reference register mark.

16. An apparatus according to claim 13, wherein the first color area portion of the reference register mark is printed to form a line extending in a direction perpendicular to the circumferential direction, and the second color area portion of the positional shift detection register mark is printed to form a line extending in a direction perpendicular to the circumferential direction.

17. An apparatus according to claim 13, wherein the reference register mark includes a plurality of first color area portions and a plurality of blank portions, and the positional shift detection register mark includes a plurality of second color area portions.

18. An apparatus according to claim 17, wherein said density information measuring means measures the density information of a target range that covers some region of each of a reference register mark and a positional shift detection register mark that correspond to each other.

19. A printed product color misregister amount detection apparatus comprising:

density information measuring means for measuring density information representing a density of a color component which is of the same color as that of the positional shift detection register mark within a target range of a printed product where a reference register mark and a positional shift detection register mark have been printed by a multi-color printing press, the reference register mark including a first color area portion with a predetermined width and a blank portion in contact with the first color area portion of the reference register mark and being printed in a reference color, the positional shift detection register mark including a second color area portion with a width smaller than that of the first color area portion and being printed in a color other than the reference color to have as a target position a position where the width of the second color area portion falls within the width of the first color area portion, and the target range including the first color area portion and the blank portion in contact with the first color area portion of the reference register mark; and color misregister amount detection means for obtaining a positional shift amount between the reference color and the color other than the reference color as a color misregister amount on the basis of the measured density information, wherein the reference register mark is printed such that a widthwise direction of the first color area portion comprises a lateral direction of the printed product which is perpendicular to a convey direction of the printed product in said multi-color printing press, wherein the reference register mark includes a first reference register mark and a second reference register mark, the positional shift detection register mark includes a first positional shift detection register mark and a second positional shift detection register mark, the first positional shift detection register mark being printed to have as a target position a position where an edge of a second color area portion of the first positional shift detection register mark overlaps an leftward edge of a first color area portion of the first reference register mark at least partially, and the second positional shift detection register mark being printed to have as a target position a position where an edge of a second color area portion of the second positional shift detection register mark overlaps a rightward edge of a first color area portion of the second reference register mark at least partially, said density information measuring means comprises lateral direction density information measuring means for measuring, as first density information, density information representing a density of a color component which is of the same color as that of the first positional shift detection register mark within a target range including the first color area portion and a blank portion in contact with the first color area portion of the first reference register mark where the first positional shift detection register mark has been printed and, as second density information, density information presenting a density of a color component which is of the same color as that of the second positional shift detection register mark within a target range including the first color area portion and a blank portion in contact with the first color area portion of the second reference register mark where the second positional shift detection register mark has been printed, and said color misregister amount detection means comprises lateral color misregister amount detection means for obtaining a leftward color misregister amount on the basis of the measured first density information and a rightward color misregister amount on the basis of the measured second density information.

20. An apparatus according to claim 19, wherein the first positional shift detection register mark is printed to have as a target position a position where the edge of the second color area portion of the first positional shift detection register mark overlaps the leftward edge of the first color area portion of the first reference register mark entirely, and the second positional shift detection register mark is printed to have as a target position a position where the edge of the second color area portion of the second positional shift detection register mark overlaps the rightward edge of the first color area portion of the second reference register mark entirely.

21. An apparatus according to claim 19, wherein a width of the second color area portion of each of the first positional shift detection register mark and the second positional shift detection register mark is not more than half a width of the first color area portion of a corresponding one of the first reference register mark and the second reference register mark.

22. An apparatus according to claim 19, wherein the first color area portion of the reference register mark is printed to form a line extending in a direction perpendicular to the lateral direction, and the second color area portion of the positional shift detection register mark is printed to form a line extending in a direction perpendicular to the lateral direction.

23. An apparatus according to claim 19, wherein the reference register mark includes a plurality of first color area portions and a plurality of blank portions, and the positional shift detection register mark includes a plurality of second color area portions.

24. An apparatus according to claim 23, wherein said density information measuring means measures the density information of a target range that covers some region of each of a reference register mark and a positional shift detection register mark that correspond to each other.

* * * * *